United States Patent [19]

Moldovan, Jr. et al.

[11] 4,010,353

[45] Mar. 1, 1977

[54] ELECTRONIC VOTING MACHINE WITH CATHODE RAY TUBE DISPLAY

[75] Inventors: Michael Terrance Moldovan, Jr., Lakewood; Charles Jerome Lindros, Jamestown; Robert Dean Wescott, Jamestown; Benedict Stewart Snyder,III, Jamestown; Richard John Cusimano, Jamestown; Michael Kristan, Frewsburg, all of N.Y.

[73] Assignee: AVM Corporation, Jamestown, N.Y.

[22] Filed: Sept. 11, 9174

[21] Appl. No.: 505,199

[52] U.S. Cl. ..... 235/54 F

[51] Int. Cl.[2] ..... G07C 13/00

[58] Field of Search ..... 235/51–56; 340/166 EL, 173 RL, 324 R; 178/18–20

[56] References Cited

UNITED STATES PATENTS

| | | | |
|---|---|---|---|
| 3,162,365 | 12/1964 | Tazbuns | 235/54 F |
| 3,237,364 | 1/1966 | Clark | 235/54 F |
| 3,710,105 | 1/1973 | Oxendine et al. | 235/54 F |
| 3,779,453 | 12/1973 | Kirby et al. | 235/54 F |
| 3,793,505 | 2/1974 | McKay et al. | 235/54 F |
| 3,847,345 | 11/1974 | Moldovan, Jr. et al. | 235/54 F |
| 3,887,767 | 6/1975 | Miller | 178/18 |

*Primary Examiner*—L. T. Hix
*Assistant Examiner*—Vit W. Miska
*Attorney, Agent, or Firm*—Bean & Bean

[57] ABSTRACT

A voting machine system employs a processor section and a plurality of peripheral units, all interconnected by a two-way street or bus system. The peripheral units constitute the voting machine proper and the processor or section acts upon the data generated by the peripheral units. One of the peripheral units is a visual display whereas the ballot format upon which a voter may vote is displayed. This ballot format is called up and displayed in response to unique input provided by the voter and different ballot formats are stored for call-up. Vote selections are made by the voter from the display. Provision is made for voter write-in selections which are stored in machine-readable, i.e., digital form. Two other peripheral units are redundant recording devices, one of which remains with the machine for a permanent record and the other of which is removable to permit forwarding thereof to a central data accumulation center. The removable record is used to program the machine and contains all of the permissable ballot formats. During set-up, the program and information on the removable record is read into the machine and is transferred to the permanent record. Vote selections as well as other data are recorded and a verification display for the voter is read from the record.

86 Claims, 90 Drawing Figures

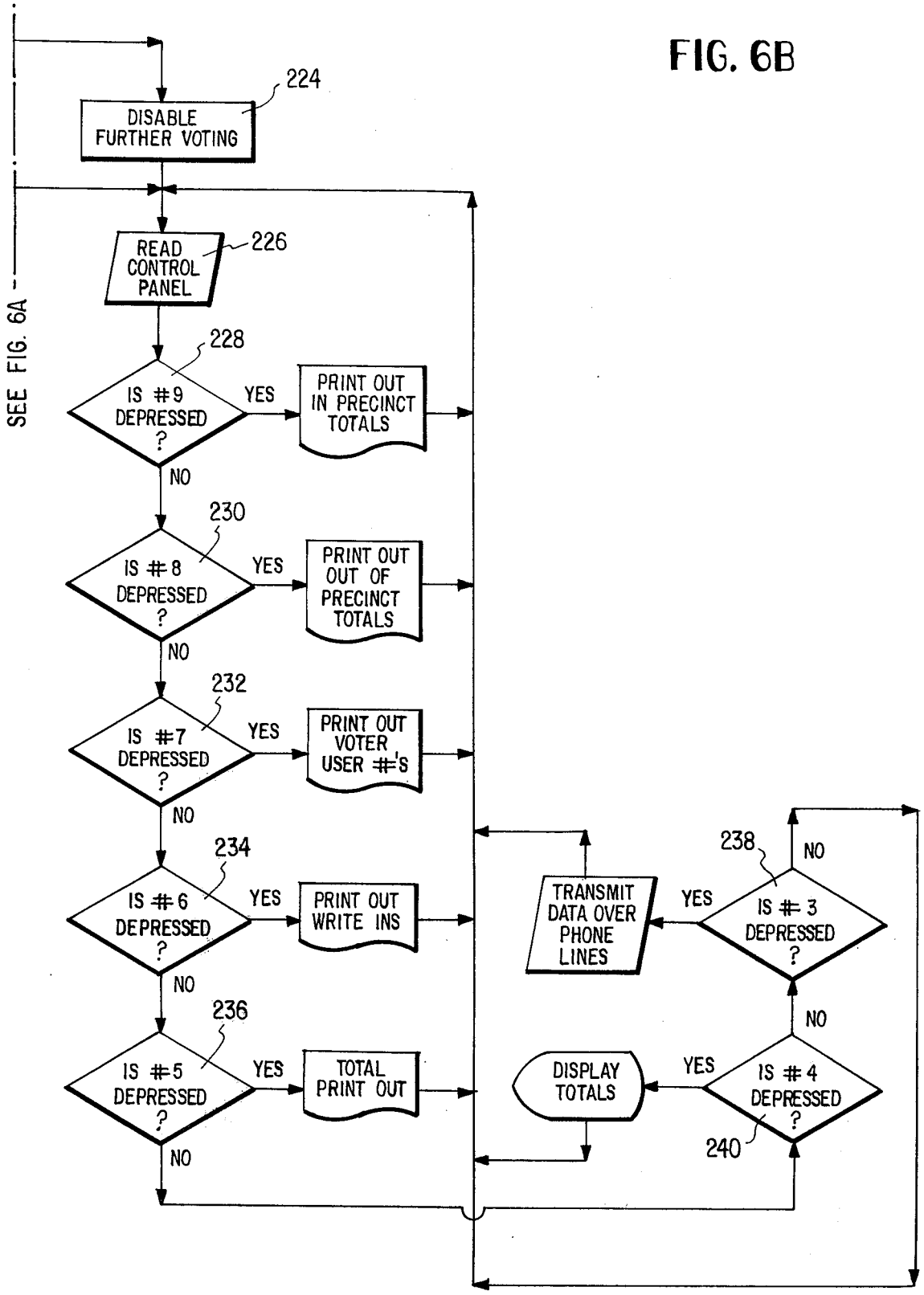
FIG. 6B
SEE FIG. 6A
224
DISABLE FURTHER VOTING
226
READ CONTROL PANEL
228
IS #9 DEPRESSED ?
YES
PRINT OUT IN PRECINCT TOTALS
NO
230
IS #8 DEPRESSED ?
YES
PRINT OUT OUT OF PRECINCT TOTALS
NO
232
IS #7 DEPRESSED ?
YES
PRINT OUT VOTER USER #'S
NO
234
IS #6 DEPRESSED ?
YES
PRINT OUT WRITE INS
NO
236
IS #5 DEPRESSED ?
YES
TOTAL PRINT OUT
NO
TRANSMIT DATA OVER PHONE LINES
238
NO
YES
IS #3 DEPRESSED ?
NO
DISPLAY TOTALS
YES
IS #4 DEPRESSED ?
240

FIG. 18G
FIG. 18
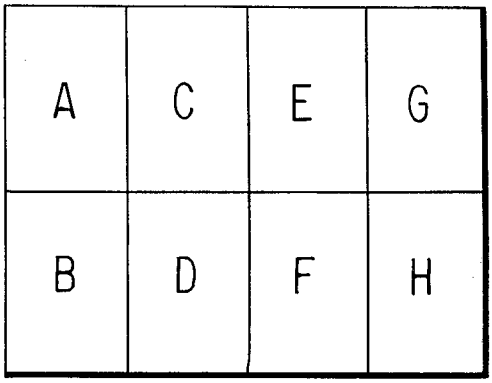
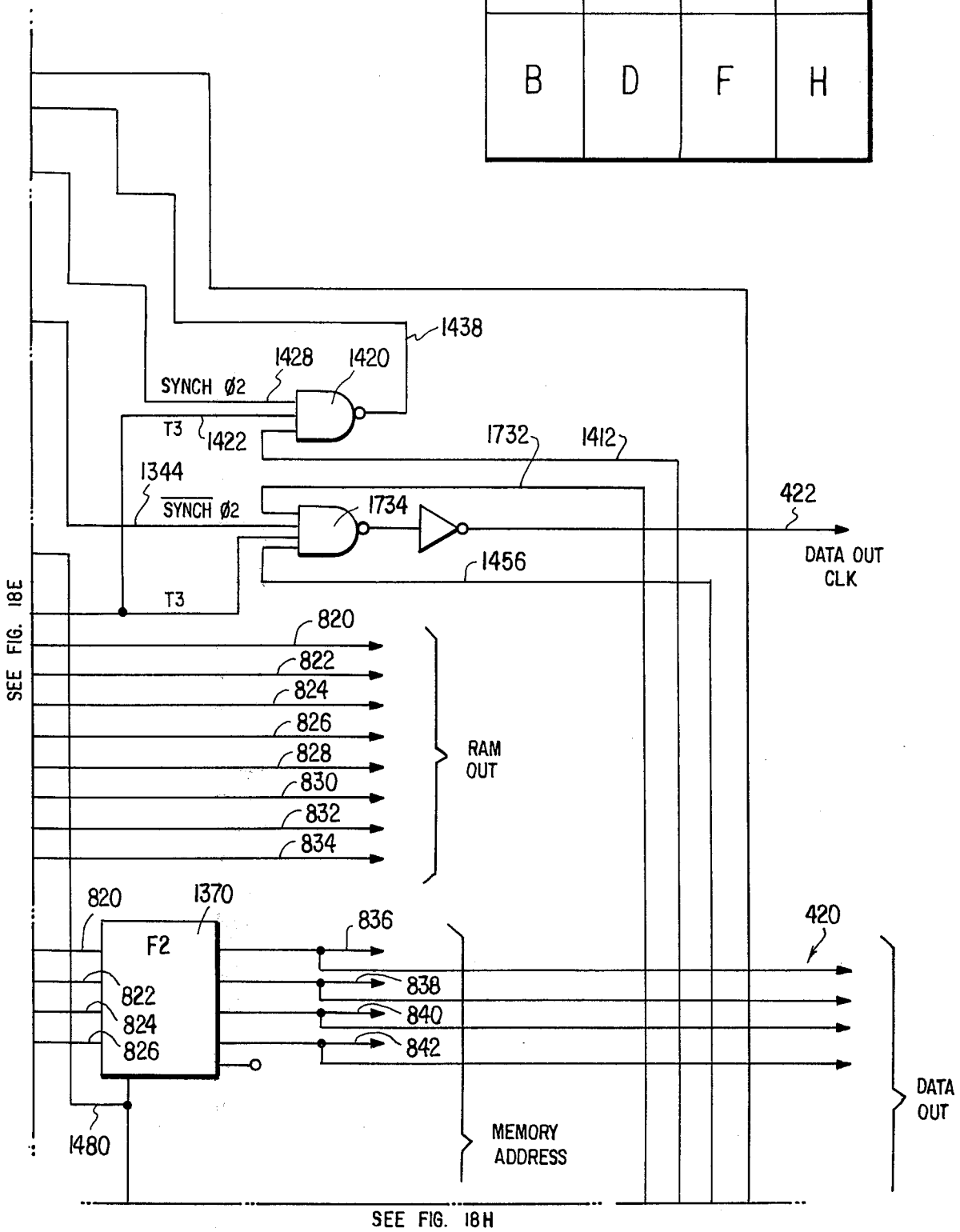

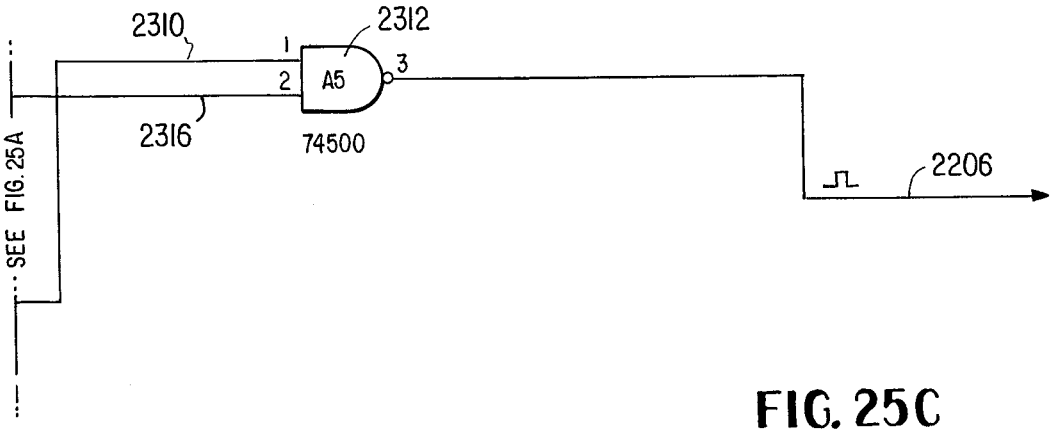
FIG. 25C
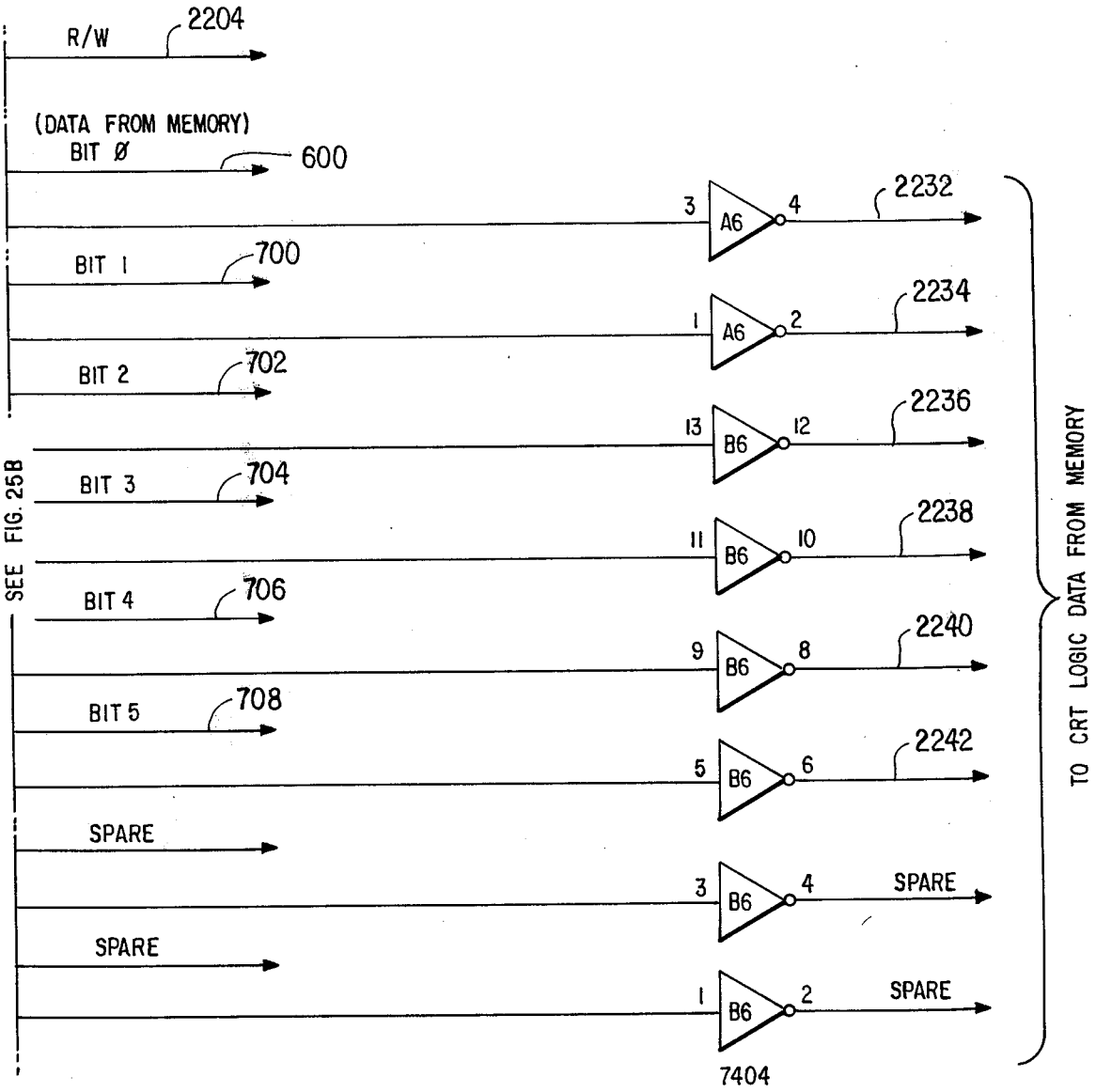

ELECTRONIC VOTING MACHINE WITH CATHODE RAY TUBE DISPLAY

BACKGROUND OF THE INVENTION

Mechanical voting machines are of course well known and in recent years electronic voting machines which more or less parallel the operations of the mechanical voting machines have become known, On the other hand, voting by means of individual paper ballots is also widely practised. Although the process involved with individual paper ballots necessitiates hand counting, there are certain advantages which are achieved by such systems, notably there is a permanent record of the voting and each voter is secure in the knowledge that his selections are positively and unambiguously recorded. This confidence on the part of the voter is important in no small measure. The conventional type of individual paper ballot may be replaced by a standardized card ballot in which the voter by means of a suitable pencil or stylus either marks appropriate areas or punches holes therein so that the ballot in each case may be read out individually by a card reading device of one form or another.

With a conventional paper ballot voting system an invalid vote selection made by the voter causes rejection of his entire ballot and he will never be aware of this unless of course it is intentionally done. Thus, although the voter has confidence that his vote selections are clearly recorded, there is no certainty that the selections will in fact be reflected in the official totals. Because of positive interlocks employed in mechanical voting machines which prevent invalid vote selections, they provide the voter with an additional measure of security that the vote selections have in fact been duly recorded to be included in the official totals. This "interaction" between machine and vote is an important advantage with voting machines. However, with respect to a conventional paper ballot system, mechanical machines are characterized by the fact that they record only the vote tallies and cannot reflect, as do paper ballots, the histories of the individual voters' selections. For example, one can inspect paper ballots to ascertain various voting trends, i.e., split ticket voting, etc., whereas when totals only are recorded there can be no such "audit trail."

Various forms of electrical or electronic voting machines have also been proposed and they, in general, have tended to simulate the format of mechanical voting machines.

In all of the systems heretofore proposed, however, the provision of write-in voting presents unusual difficulties. Moreover, in all systems heretofore proposed, voting is restricted to the ballot at the precinct level. That is to say, each voter must proceed to his own percinct in order to vote on the ballot to which he is entitled, it being customary that different ballots apply to different precincts.

Further, previous voting machines have not been proposed wherein the combination of reasonable cost is coupled with a truly systemic concept, i.e., with an eye to creating a system of machines which is at once truly adaptable to many and varied ballot formats while displaying the capability for rapid and east set-up of the entire system of machines regardless of the complexity of ballot format requirements. Nor have previous machines lent themselves to adaptations which provide flexibility with respect to the many and varied voting regulations which may be encountered in practice.

BRIEF SUMMARY OF THE INVENTION

The present invention is concerned with a visual display type of voting machine, one in which the ballot is displayed to the voter. Moreover, this invention is concerned with a machine possessing great flexibility in that the ballot display may be different for different voters, depending upon their qualifications. Thus, the machine herein provides response to proper voter entry thereto by displaying to that voter the ballot format to which he is uniquely qualified. Thus, the machine interacts with the voter before the vote selection process commences to present proper ballot display for that voter. In consequence, the machine herein is capable of breaking the long established custom of requiring each voter to vote only in that precinct in which he is registered, i.e., the machine herein allows "open voting" by permitting a voter to vote on a machine even though it may be set up otherwise for voting in a jurisdiction in which that voter is not registered.

Thus, a characteristic of the present invention is a visual ballot display which is presented individually and in response to the voter having gained "entry" to the machine.

According to the present invention also, the visual display and vote selection process are closely interrelated by virtue of vote selection at or on the display itself, much in the fashion in which one might make a selection on a paper ballot. Thus, there need be no ambiquity as to the actual selection made. However, the machine herein also makes provision for displaying to the voter all of his actual selections when he requests "verification" from the machine. The ballot display is now replaced by the voter's selections and, if the voter is satisfied he may then "exit" from the machine thereby to extinguish all visual display and effect permanent recordation of the "verified" vote selections. In this context, the machine of the present invention also provides a recordation system in which, in response to voter request for verification, the vote selections are at that time transferred to the permanent record and the verifying display is generated from this record. In this way the voter may be assured that his selections have in fact been recorded. If the voter after verification is for any reason dissatisfied with his selections or for any reason changes his mind concerning the selections made, he may cause the machine to repeat the ballot display so that change in vote selection may be effected. In other words, at any time prior to exiting from the machine the voter may make changes, ultimately satisfy himself from the verification display which reflects these changes and then exit from the machine secure in the knowledge that hose vote selections last displayed to him are those which are permanently entered into the machine.

More particularly, the present invention is concerned with a voting machine which includes a microcomputer which is caused to be programmed in accord with all of the ballot formats which are to be called up for display by the voters so as to provide all of the necessary security interlocks which prevent all but valid vote selections to be made.

According to this invention, inputs from the voter as well as inputs from the voting official are effected to peripheral units through interfacing means associated with a processing arrangement in which a random access memory is provided with a temporary program according to the voting requirements of the election under consideration. The random access memory also stores the voter totals although the totals are transferred to a permanent record which may be in the form of magnetic tape, for example. The permanent record is redundant in that whereas one record is accessible for transport at the close of the election to a central processing station the permanent record remains with the machine. In this way, the machine may be used at some later date to display its totals and in general will contain a permanent record of the election process, it being understood that by permanent herein is meant that the record remains with the machine at least until the next election process. The record remaining with the machine is a duplicate of that which may be removed for tally purposes at a central station. The machine is programmed and tested in accord with the election and test program written on the removable record and as the machine is set up, this program is transferred to the permanent record. During the election process, the ballot displays are read from the permanent record and vote totals are transferred to both records. Audit trail is available from the records because the vote selections of each voter are recorded in discrete areas of the records and can be recovered just as if they were recorded on a paper ballot. Further, the system herein requires the use of a voter identification card which is read by the machine and contains data, which is recorded, including an identification of each voter. This enables the record to be used to update voter registration records. The voter identification, preferably in the form of a number, is recorded in a separate section of the record from that at which his selections are recorded, this latter being effected in random fashion through the use of a random number generator which arbitrarily determines the discrete area or region of the record at which the voter's selections are recorded. Write-in selection are uniquely recorded by the machine in a machine-readable format so that they may be tallied rapidly.

According to preferred embodiments, an improved form of voting system is provided in which a cathode ray tube is utilized to display, page-by-page if necessary, the ballot upon which the voter makes his selections. The selections are made by suitable means such as a light pen. A further object of this invention is to provide a system in which a card issued to the voter may be utilized not only call up the ballot upon which he is entitled to vote and to record the user's number but also to record information such as the dimensions of the thumb which are utilized for verification before he can gain entrance to the voting machine. The voting system includes a microcomputer section having a random access memory (RAM), a read only memory (ROM), a cenral processing unit (CPU) and an input-/output section (I/O) all interconnected by a two way street or bus. The input/output section is connected to a second two way street or bus to which is connected the voting assembly inclusive of the CRT section and a magnetic tape section which maintains a running total or tally of the vote selections. In this way, all of the advantages of a paper ballot are retained with the corresponding advantages of voting machines which include the automatic running total or tally.

Additionally, the present invention provides a unique write-in capability. Upon selection of the write-in mode of voting, the system displays on the CRT an alphabet from which the voter selects the proper letters to spell the name of the write-in candidate. The letters selected are displayed to the voter in the proper sequence.

The magnetic tape section of the voting assembly includes two magnetic tapes, one of which remains with the machine to provide the print-out and a duplicate tape which may be removed from the machine and utilized to transmit the information to a central data processor, as desired. In this respect, the voting assembly also includes or may include an accoustic coupler by means of which print-out may be effected over telephone lines to a central data processor or to a substation, which, in turn, transmits to the central data processor. Alternately, the removable tape may be physically removed and taken to a substation for subsequent transmission to a central data processor.

The voting assembly also includes a printer section which prints out the count recorded on the tapes, inclusive of any write-in selections.

The magnetic tapes record the ballot which is subsequently displayed to the voter through the CRT. This permits the capability of printing many ballots on the tapes so that voters from different precincts may vote on a machine most convenient to them irrespective of whether or not such machine is located physically within their own precinct. Thus, the magnetic tapes would store all ballots corresponding to a number of precincts in a given region and the voter, through appropriate means, calls up his own particular ballot format for which he is entitled to vote and this is displayed to him on the CRT, whereàfter the selections are made in the normal manner.

Another feature of the machine or system is the fact that after the voter has made all of his selections and has requested that they be verified or displayed to him, this display is effected from the information recorded in the magnetic tape so that the voter is assured that his correct information has been recorded. Thereafter, the voter may select to register or complete his vote which effects the permanent recordation of the selections on the magnetic tape, i.e., it does not permit thereafter any erasures to be made except incidental to erasing of the tapes subsequent to the entire voting process and after all of the votes have been counted.

The machine also has provision for a test run procedure in which, under the control of a voting official, the machine may be set up for performing all of the voting operations on any ballot which may be selected, with running tallies, write-in tallies and so forth but where termination of the test mode effects cancellation of all material placed on the tapes during the test procedure. This automatically effects reset to zero for the machine.

In accordance wih common voting procedure, the machine prints out a total at the beginning of an election day to assure that the count is at zero in all instances and this print-out is made a permanent record for that election together with the end-of-day print-out of the various totals. In this respect, the printer may make multiple copies of the information, one of which may be displayed at the precinct so that all voters may be able to see the vote totals for his particular precinct, another copy may be forwarded to appropriate election officials, etc.

The system according to the present invention also permits an audit trail to be made for the purpose of recovering information which is of value not only to the voting officials but to the electoral process as well. For example, various jurisdictions have different requirements as to voter registration. For example, if a voter votes regularly, he remains on the registration list but if he misses one or more elections in succession, he must reregister. The voter identification card associated with the machine may contain a user's number which, when the voter votes, records on an entirely separate section of the magnetic tapes so that the voting officials, by appropriate print-out of the user's numbers, maintain the proper registration system for the voters to determine who is or is not a properly registered voter in a subsequent election. The audit trail includes such features as recovering voter's individual selections without identifying the particular voter involved but illustrating such features as whether or not a straight party ticket has been selected, whether the voter has split his vote, etc., this audit trail being of inestimable value for many purposes.

The voting assembly includes control switches for achieving not only security interlocks for the machine and system but also to call for the individual or cumulative print-outs as may be required at the end of an election day.

BRIEF DESCRIPTION OF THE DRAWING FIGURES

FIG. 6A and 6B show the logic flow for a complete election process in somewhat simplified form;

Figure 6A:
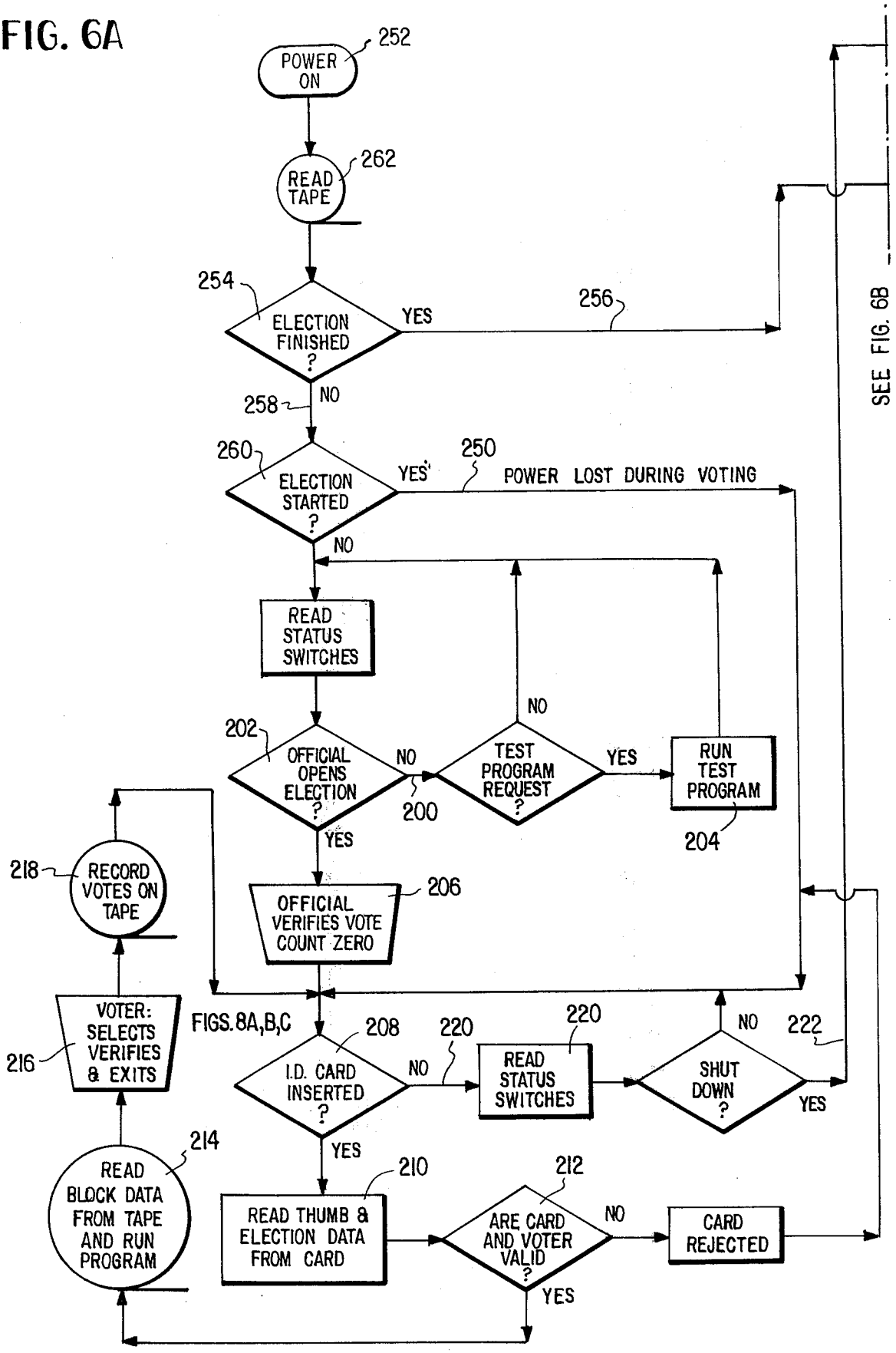
Figure 7A:
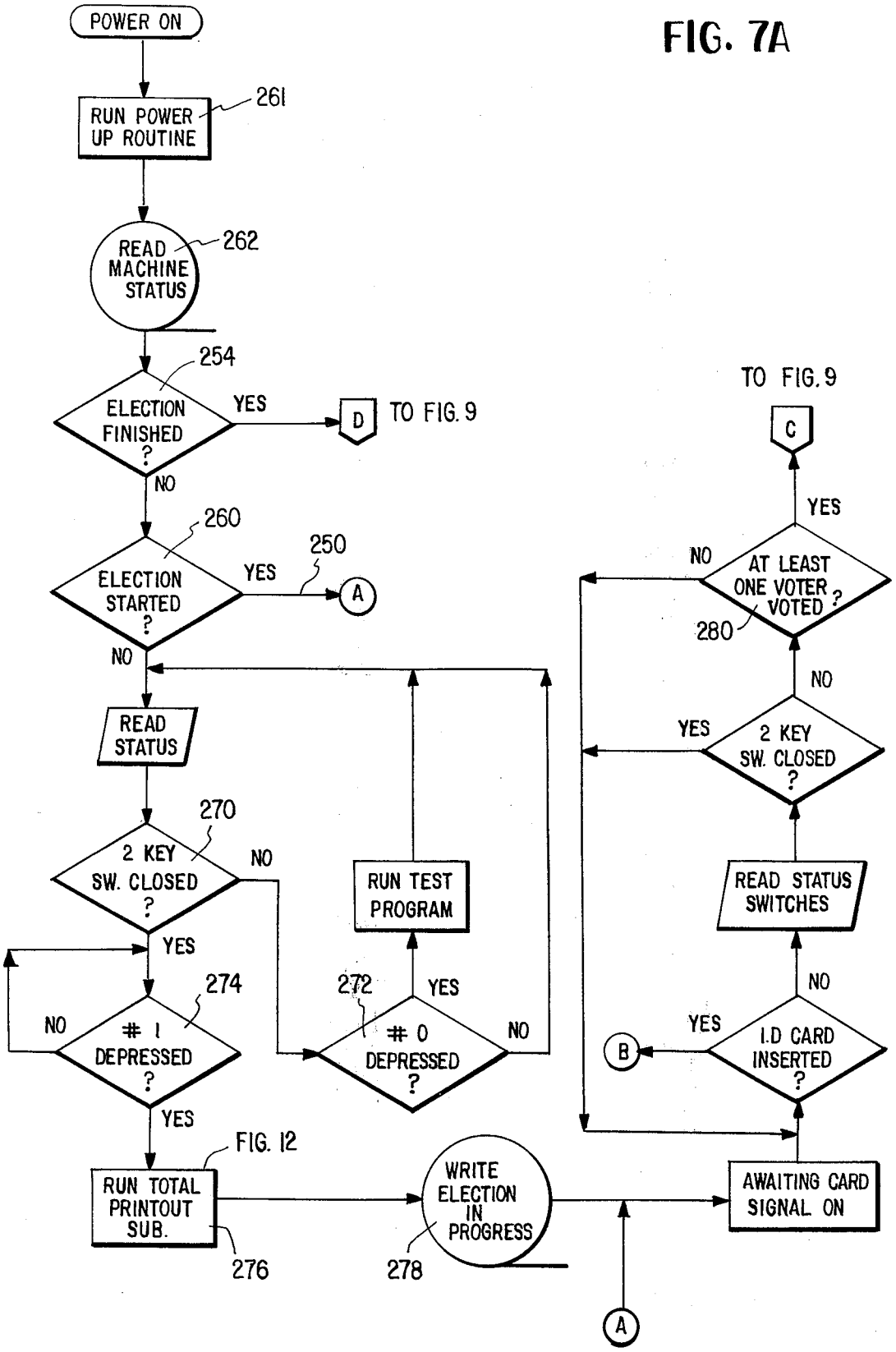
FIG. 7A and 7B is a more detailed logic flow diagram of a portion of FIGS. 6A and 6B.
Figure 7B:
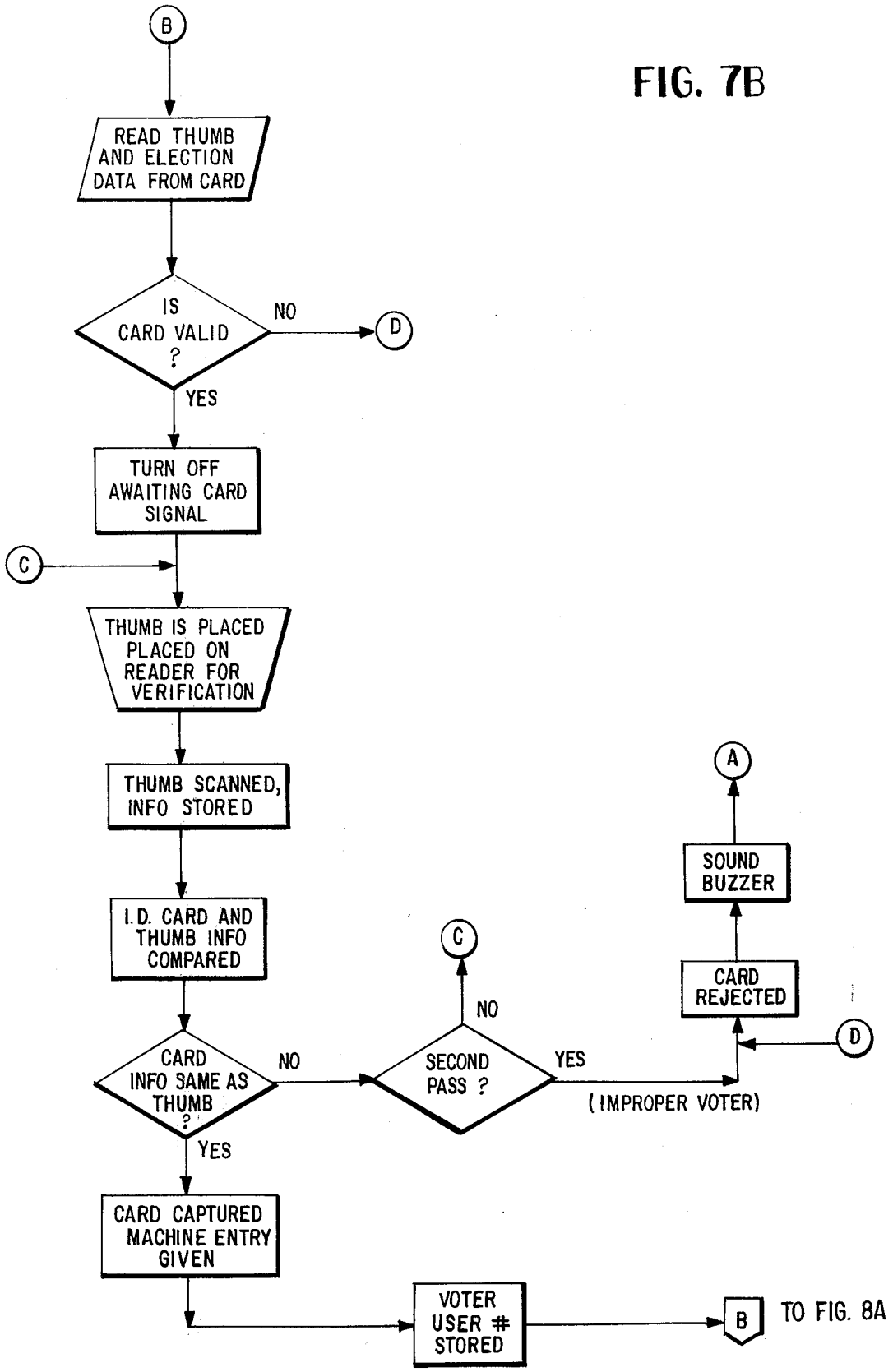
Figure 8A:
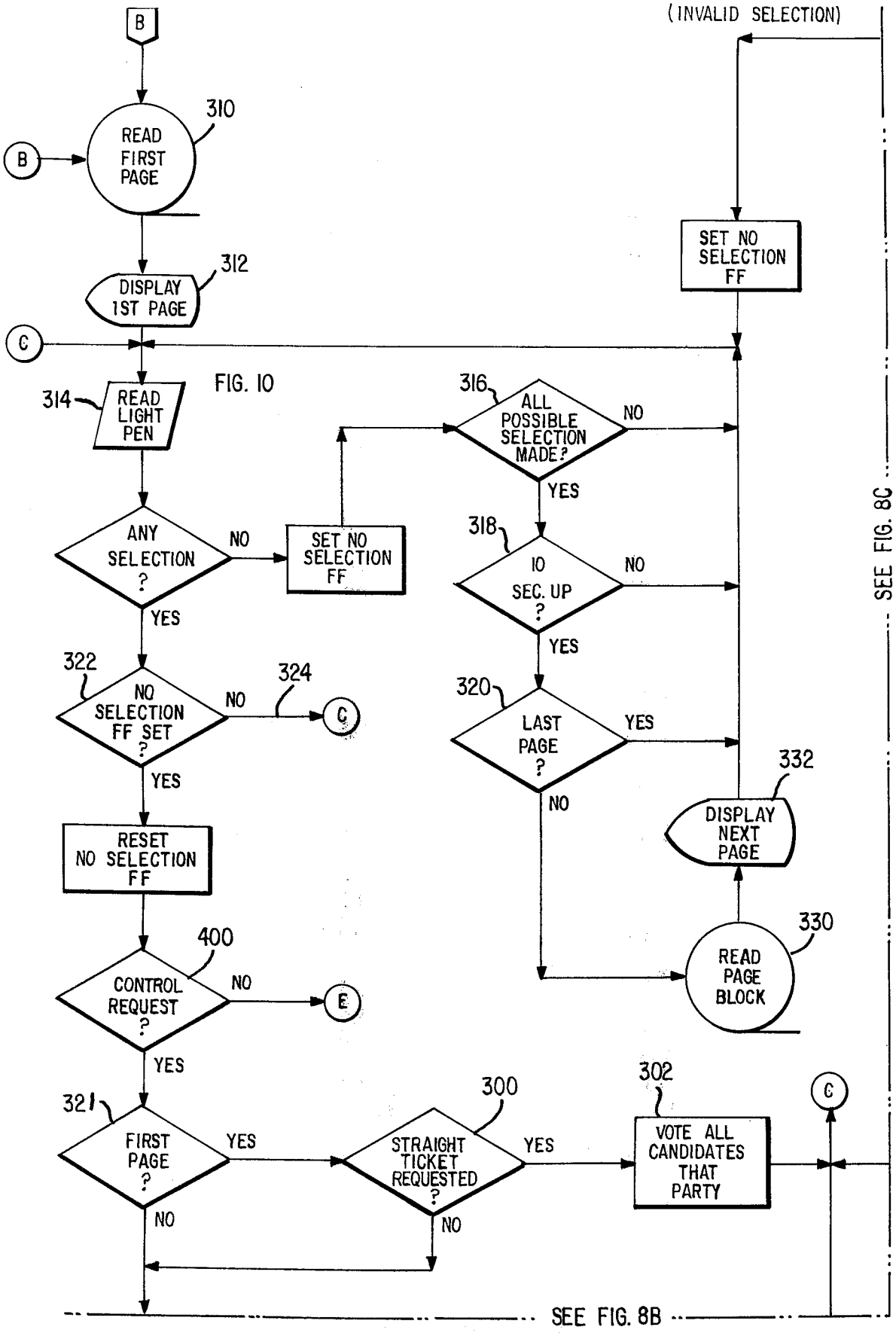
FIGS. 8A, 8B and 8C are expanded logic flow diagrams expanding one box of FIG. 6A.
Figure 8B:
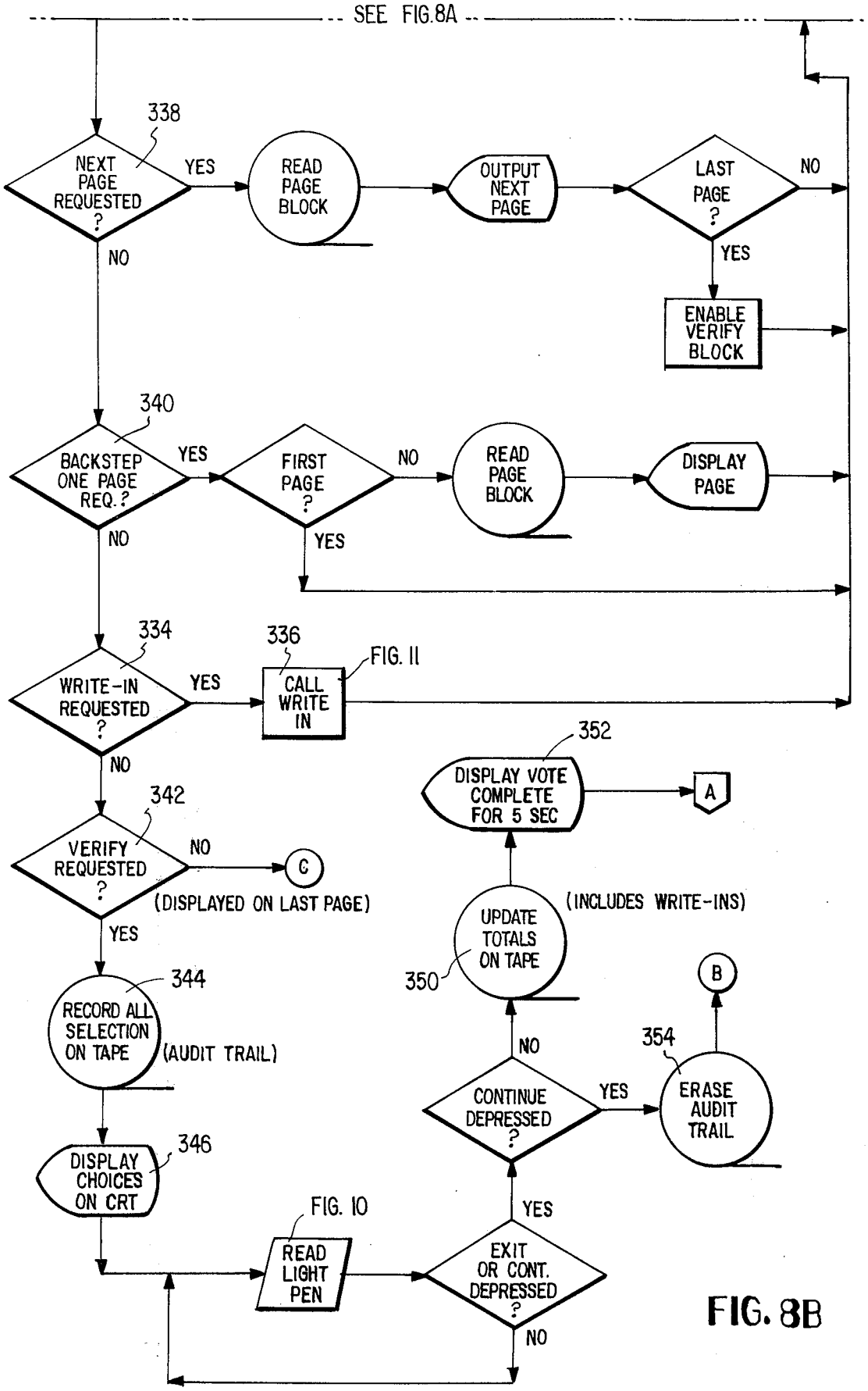
Figure 8C:
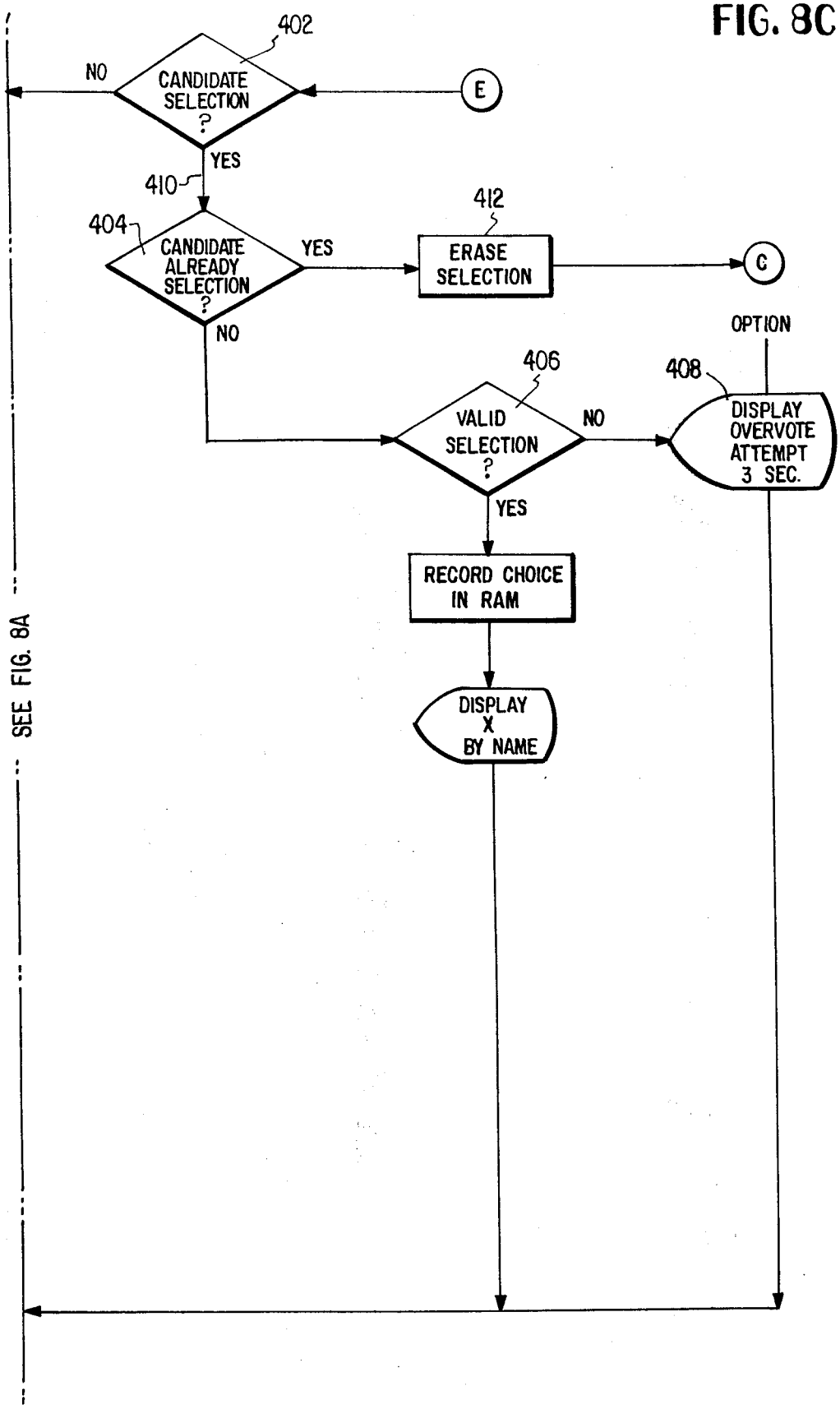
Figure 9:
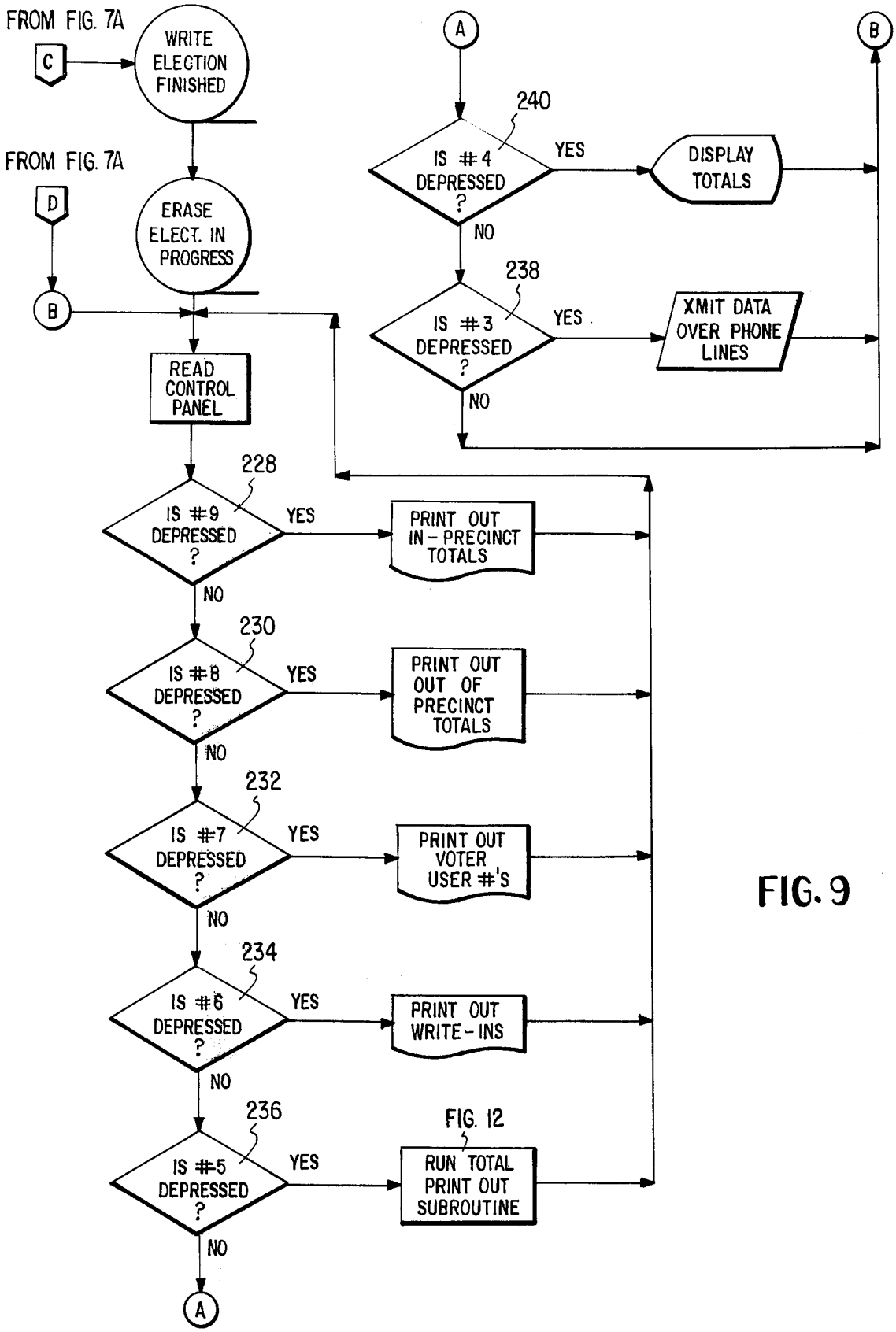
Figure 10:
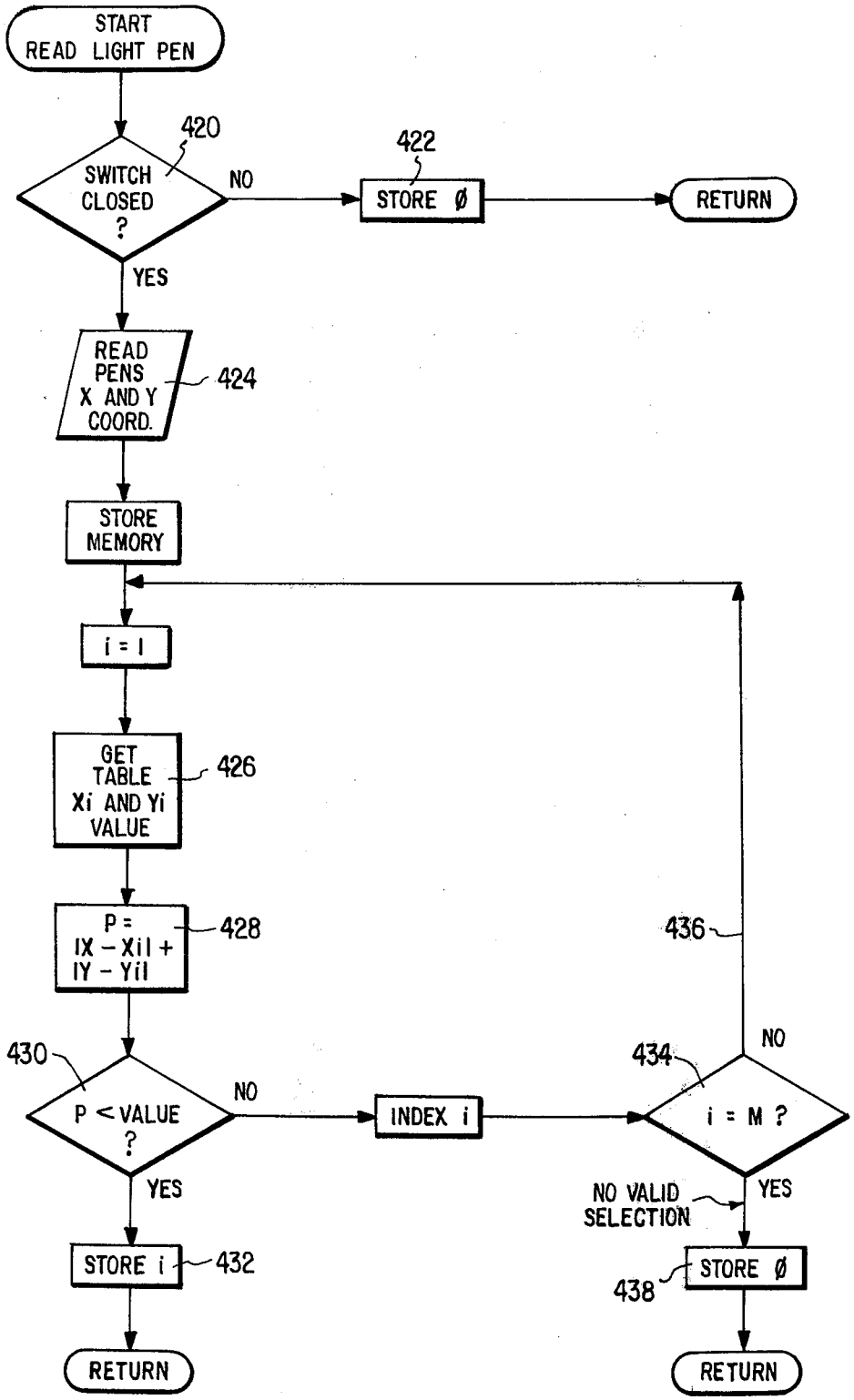
Figure 11:
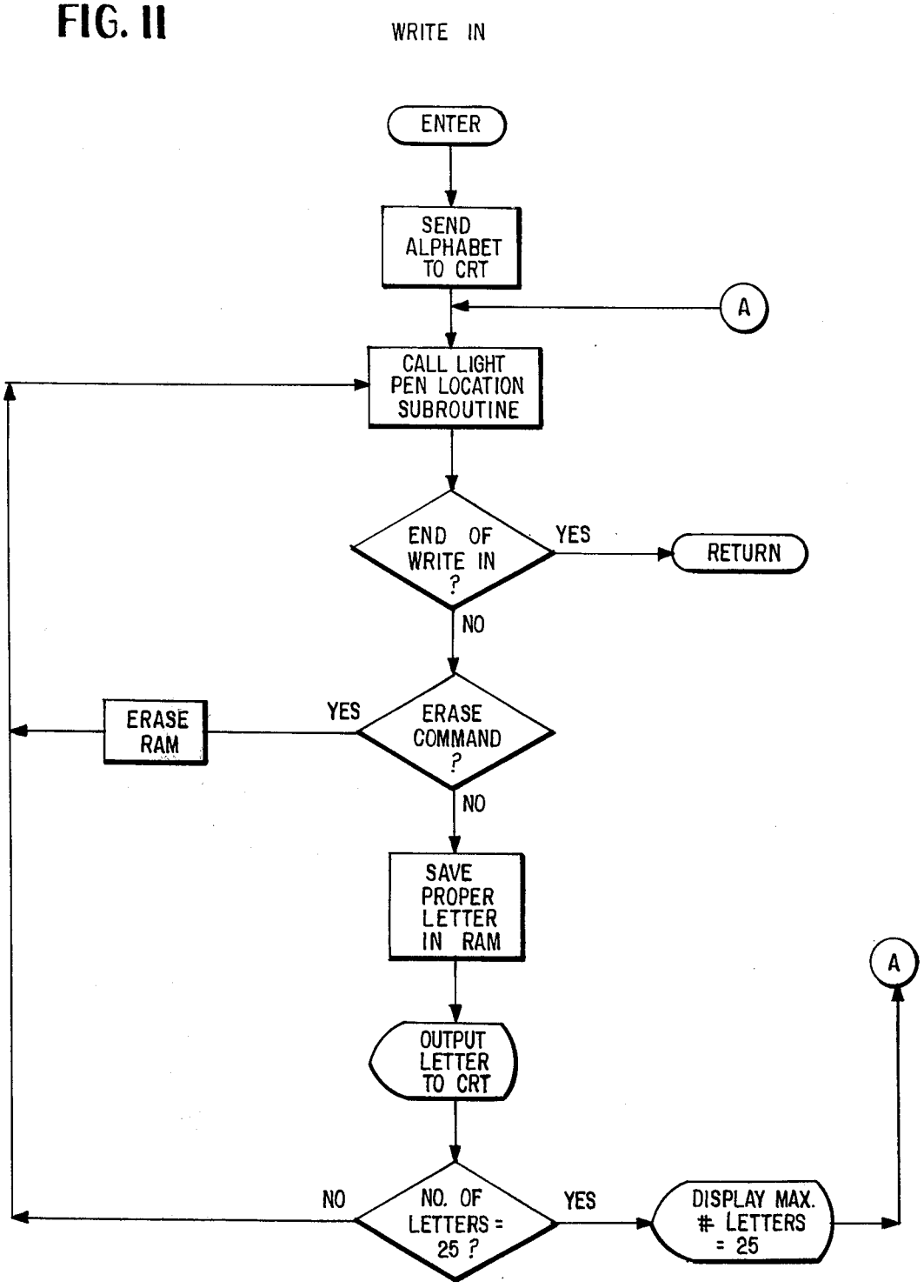
Figure 12:
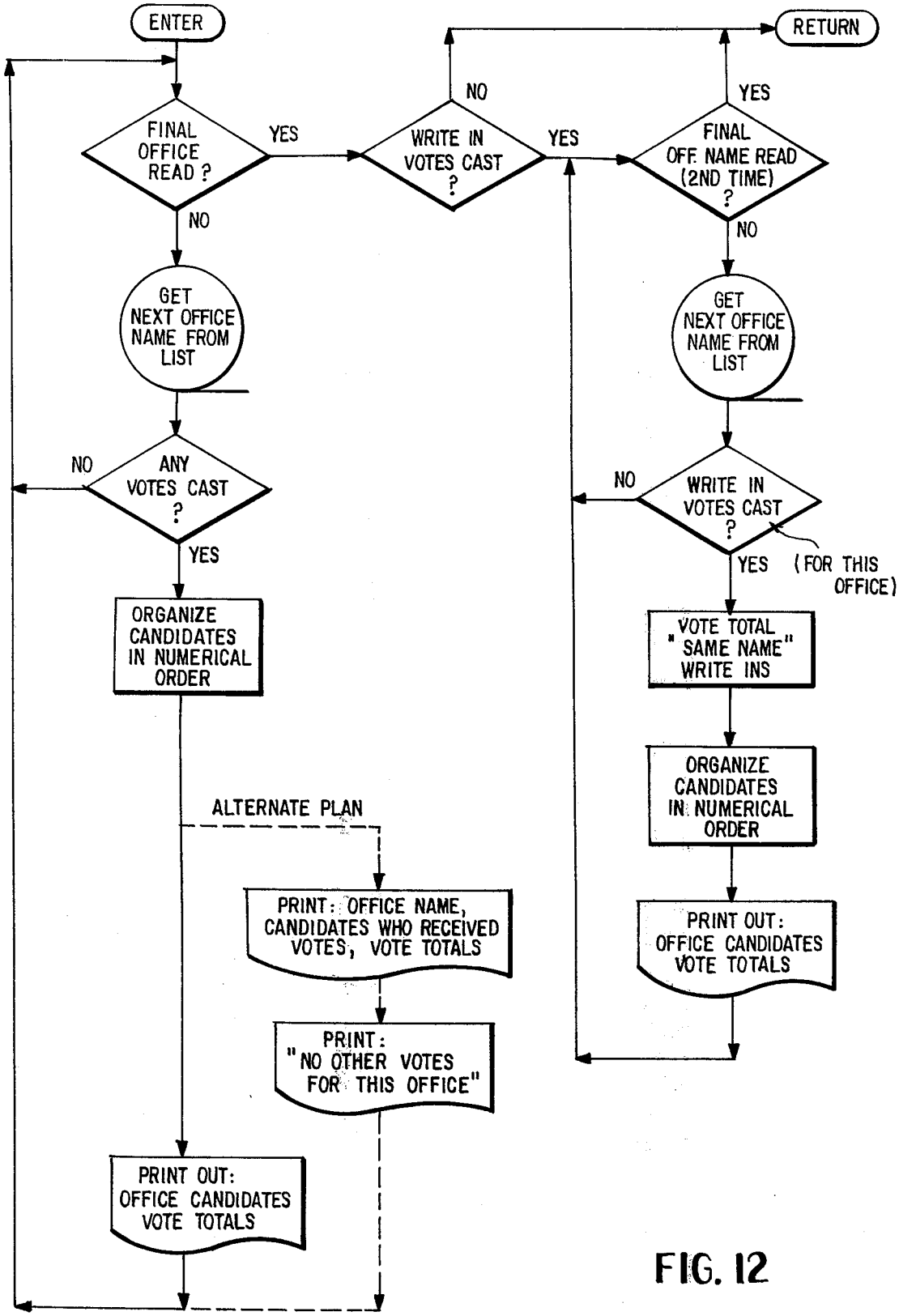
Figure 13:
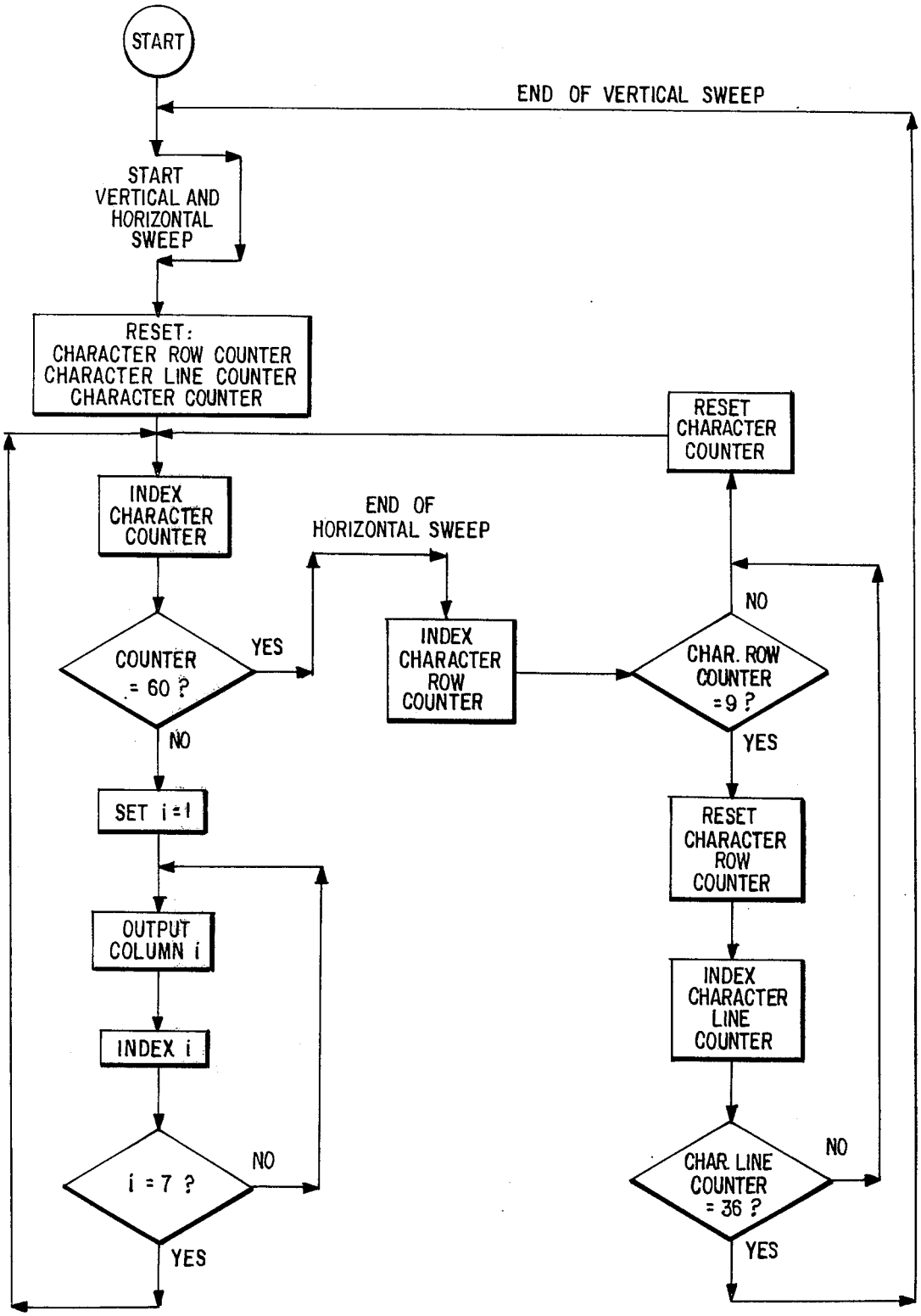
Figure 14:
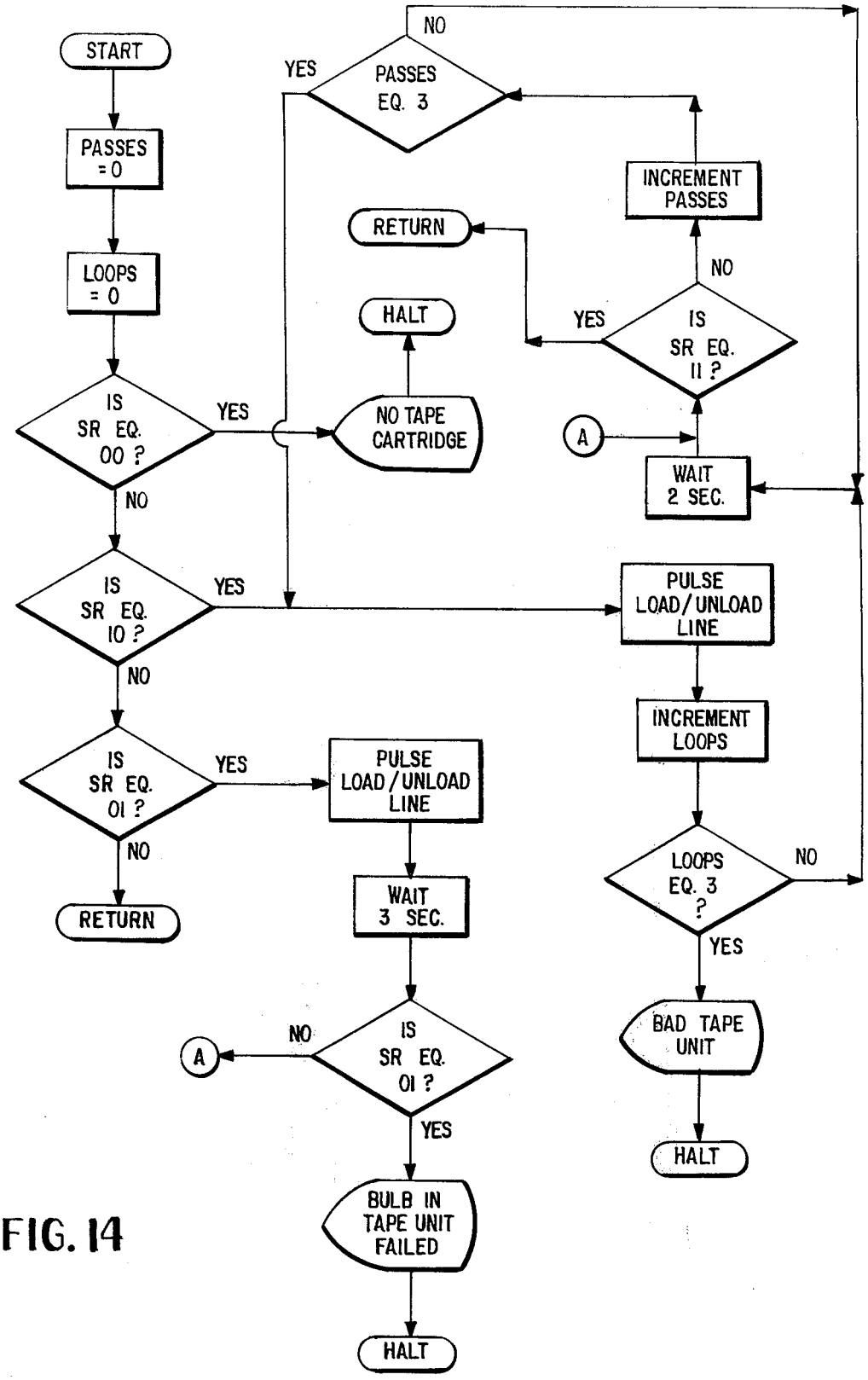
Figure 15:
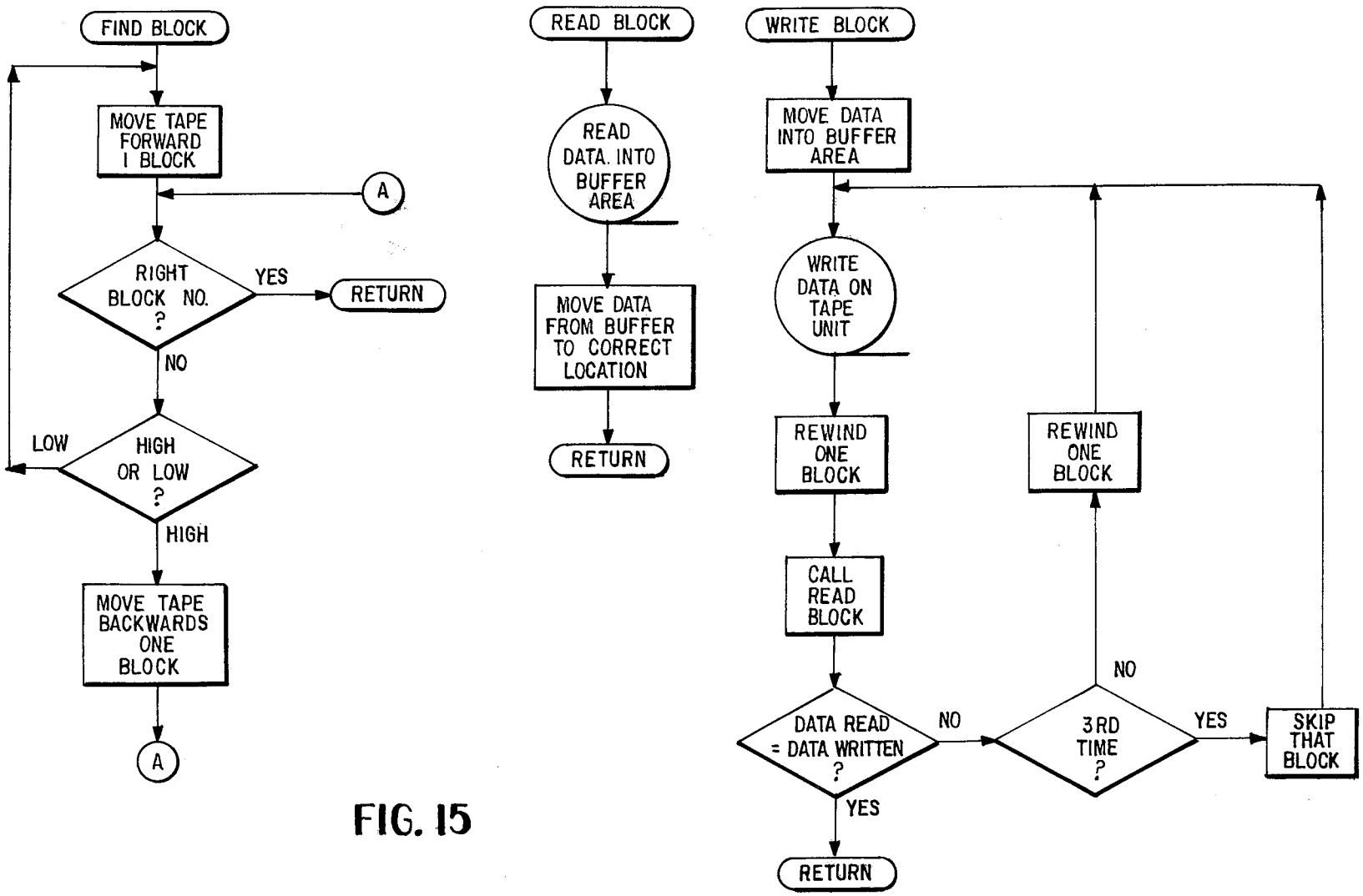
Figure 16A:
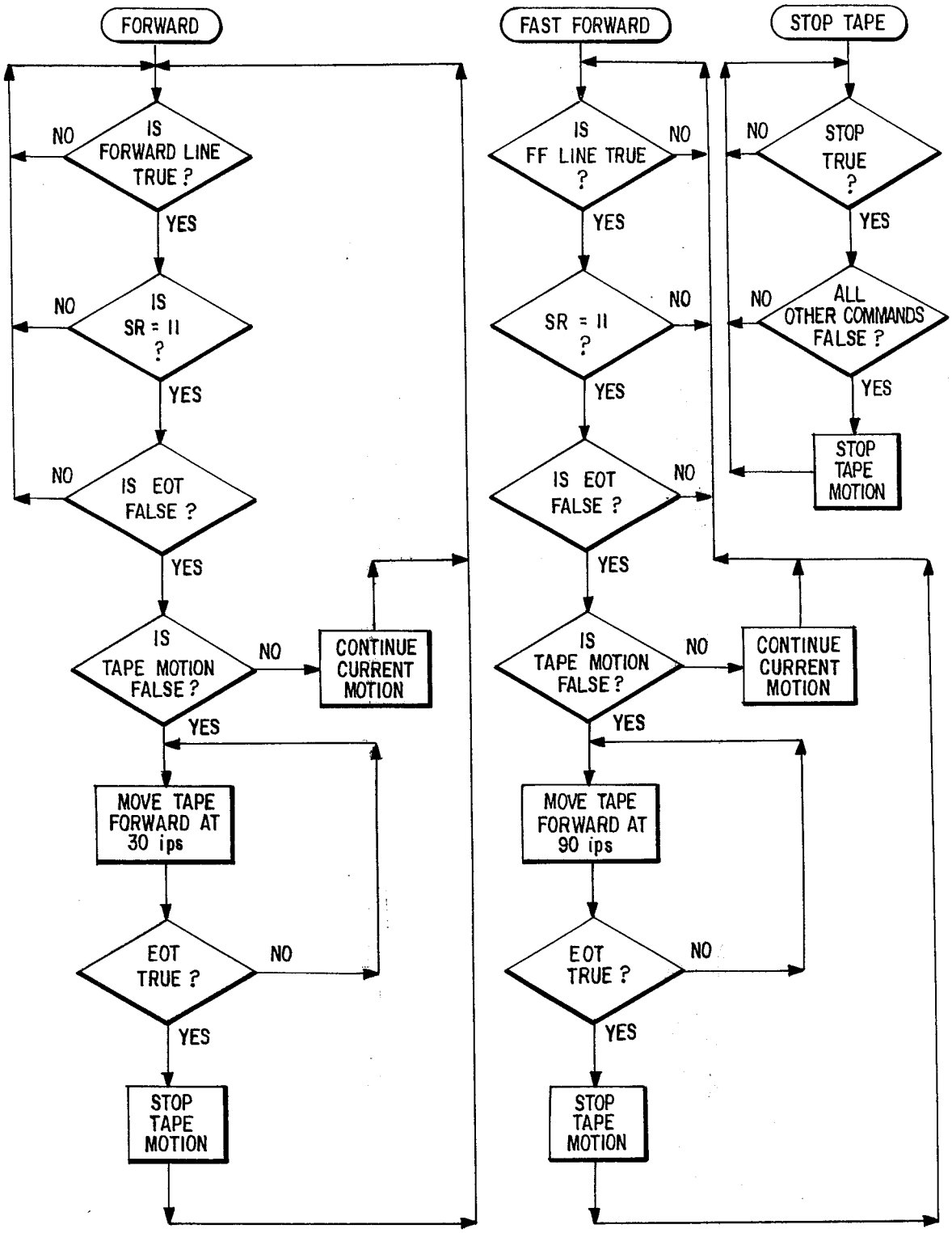
Figure 16B:
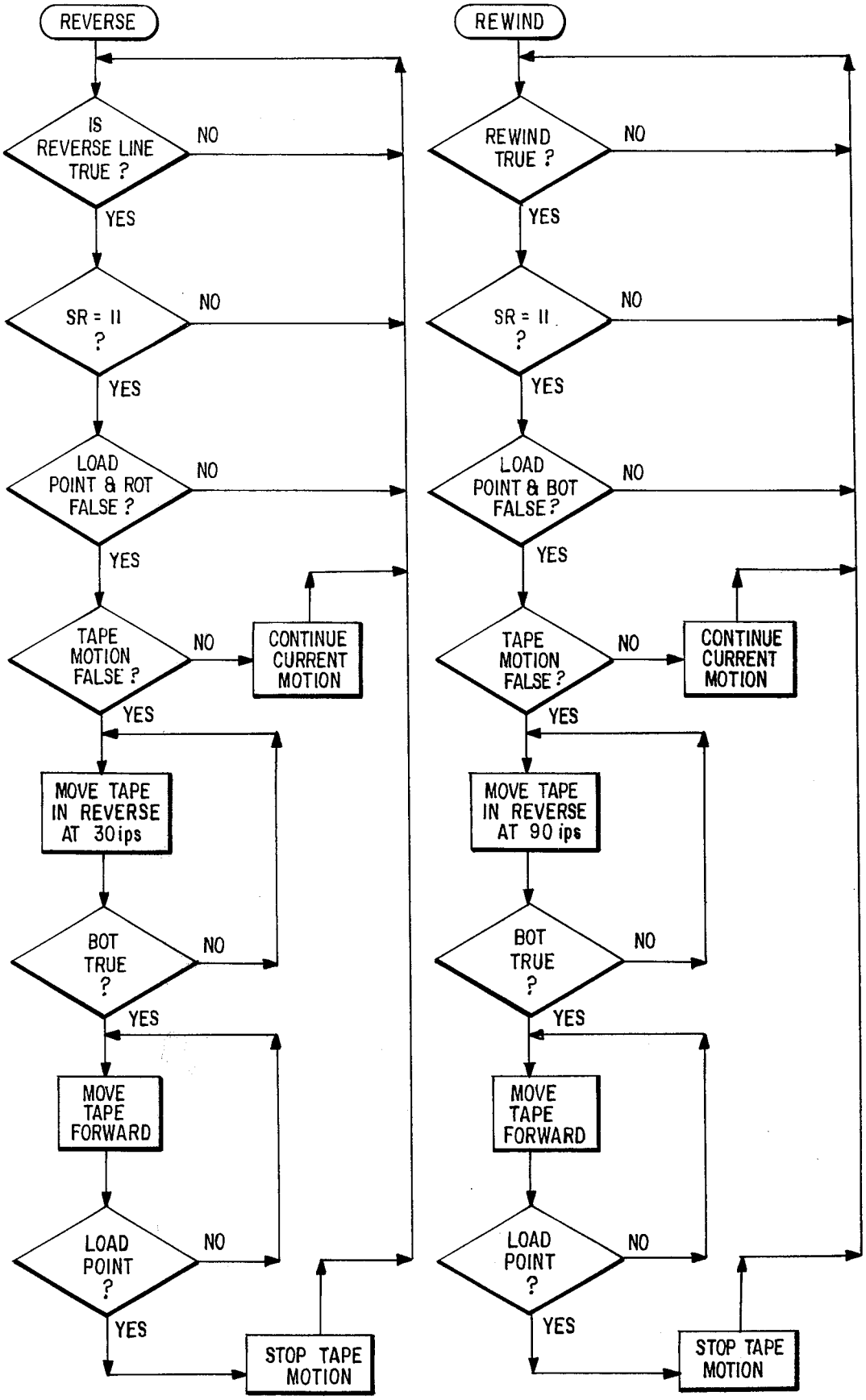
Figure 17:
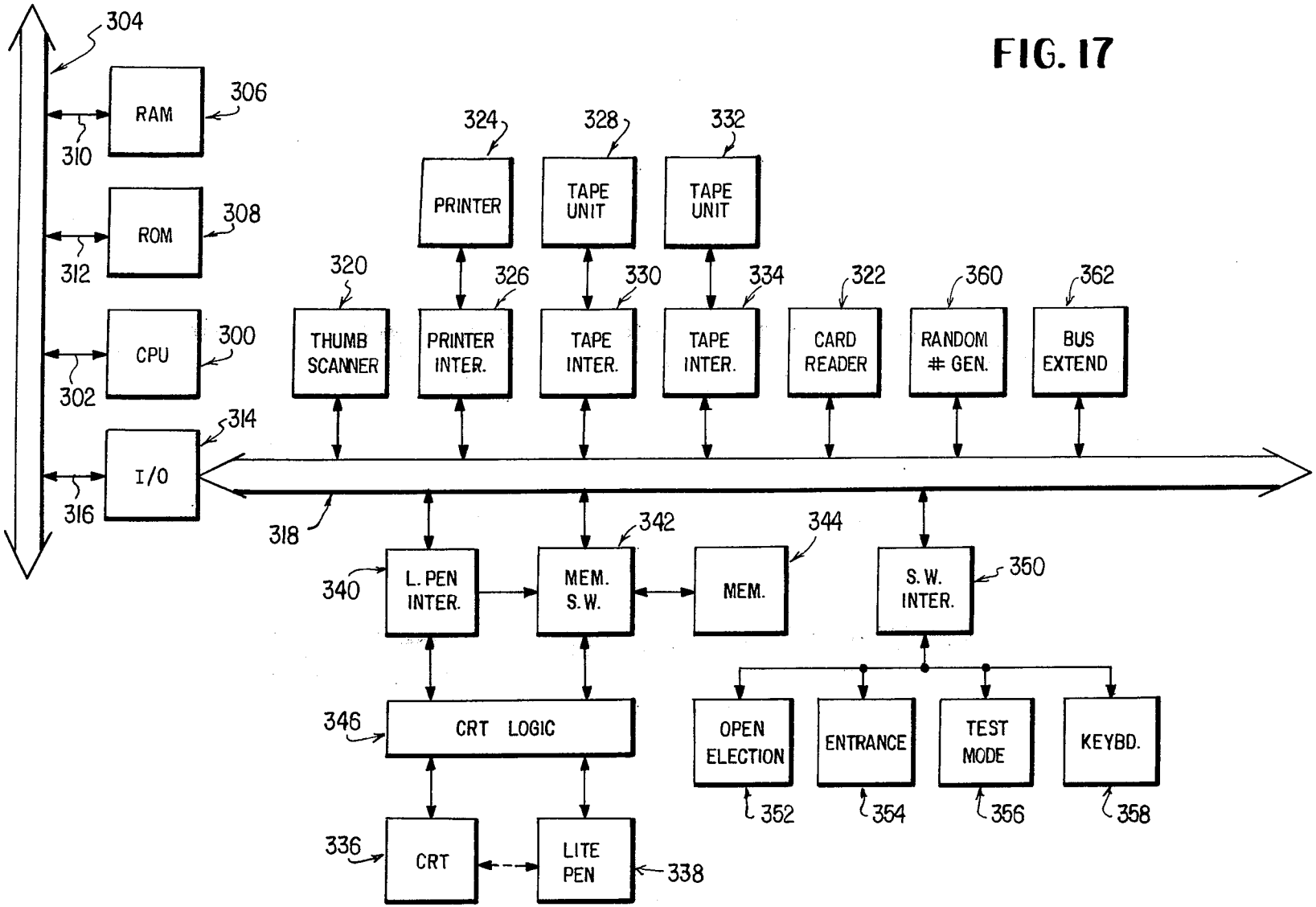
Figure 21A:
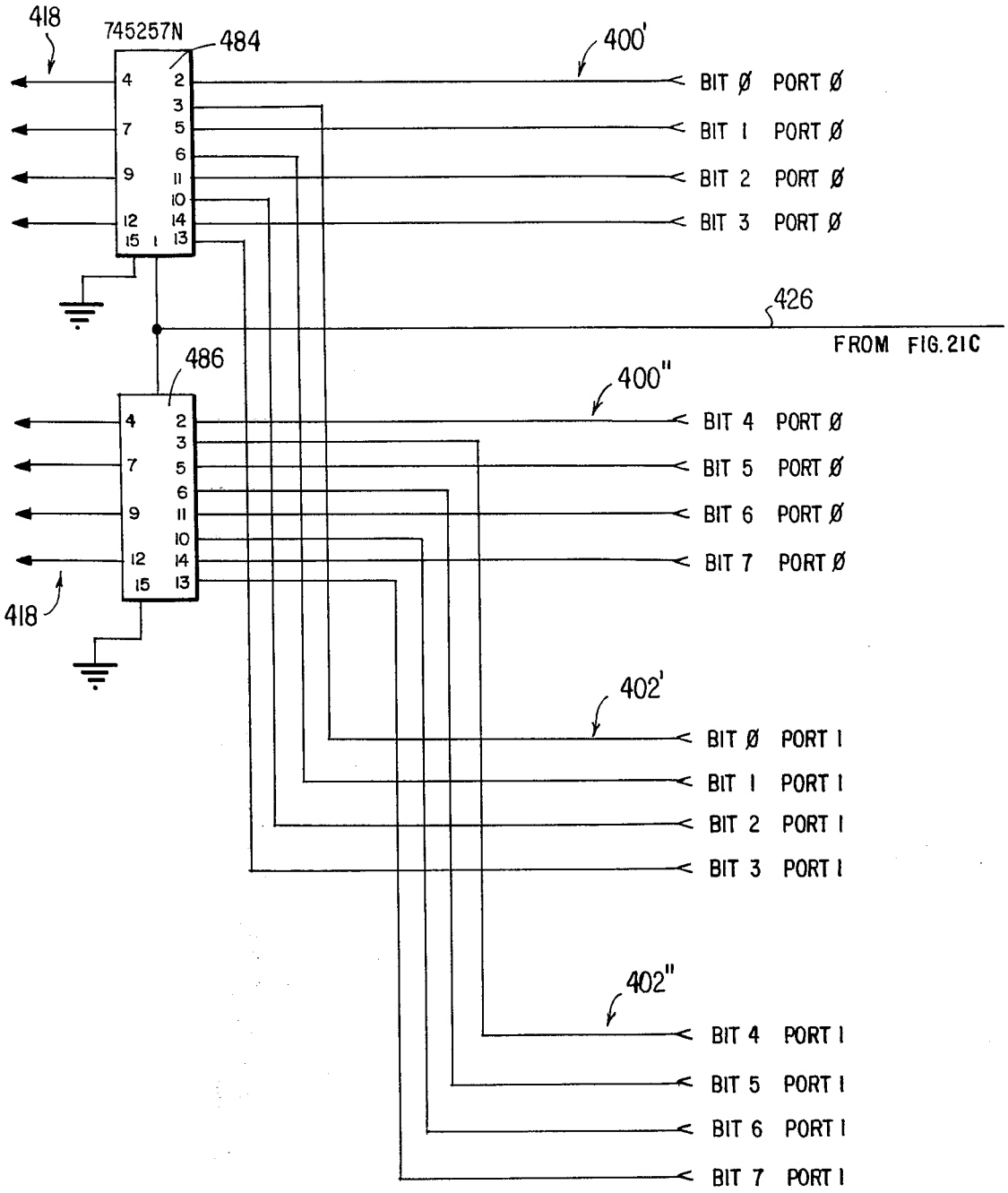
Figure 21B:
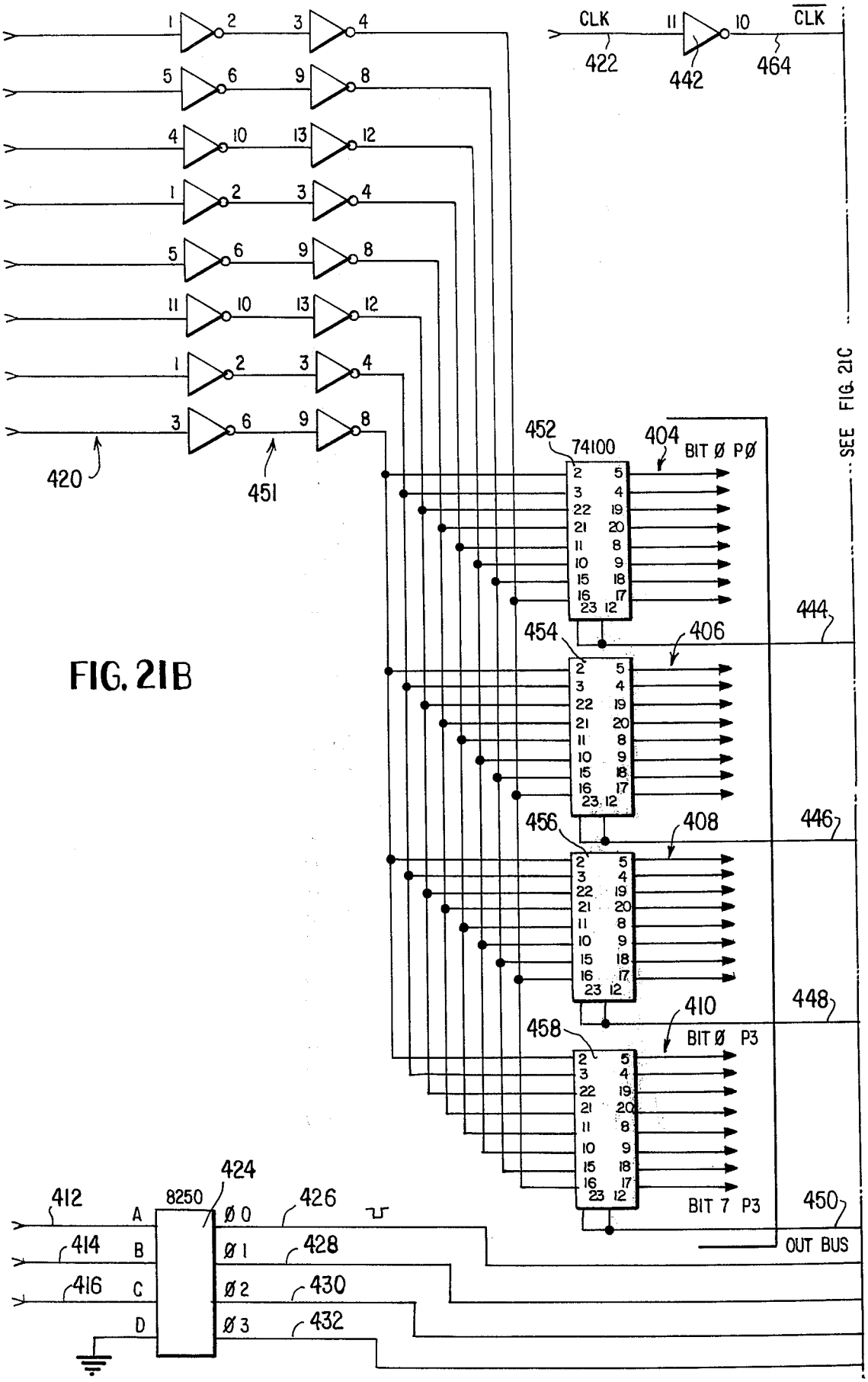
Figure 21C:
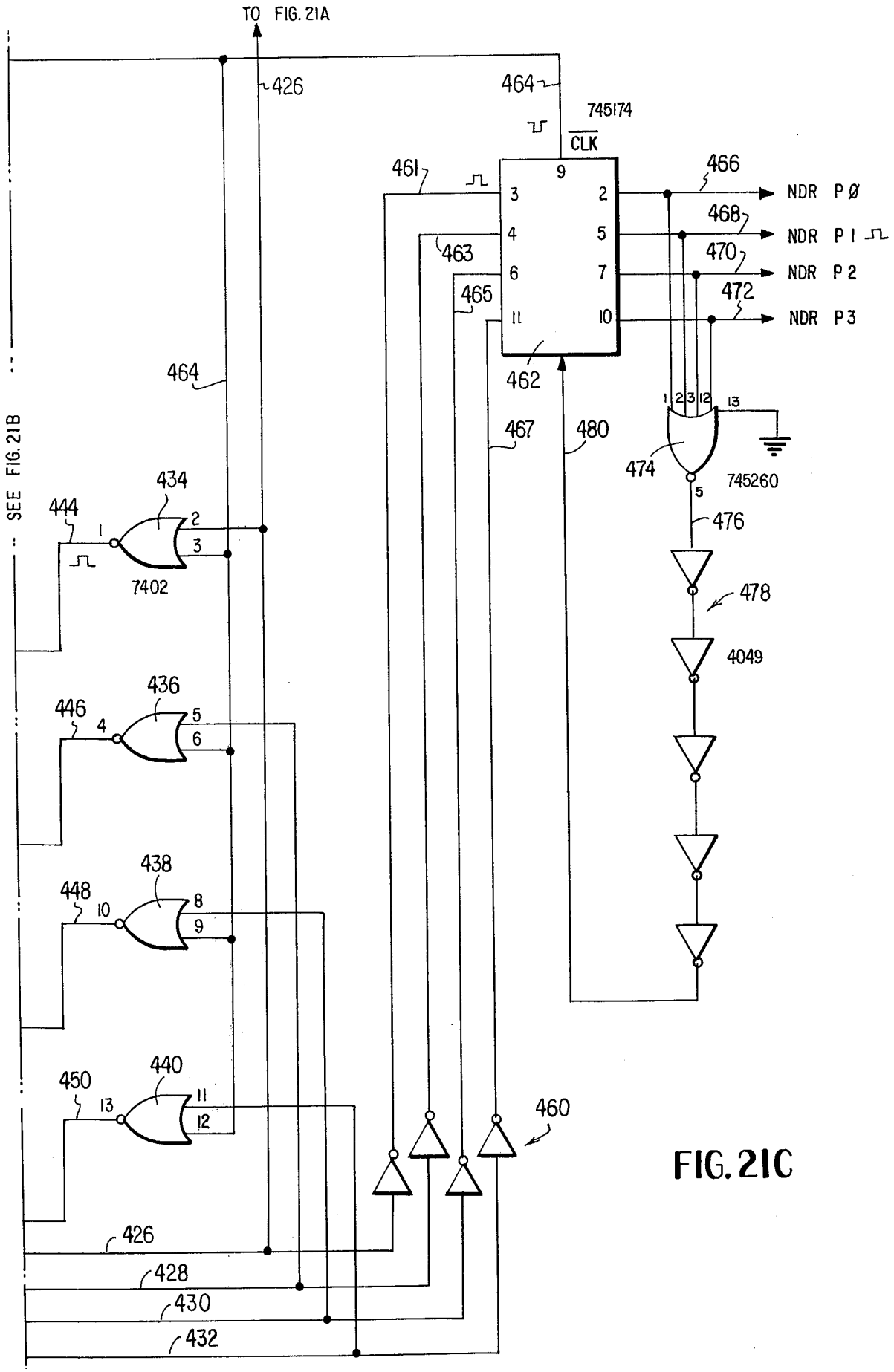
Figure 22A:
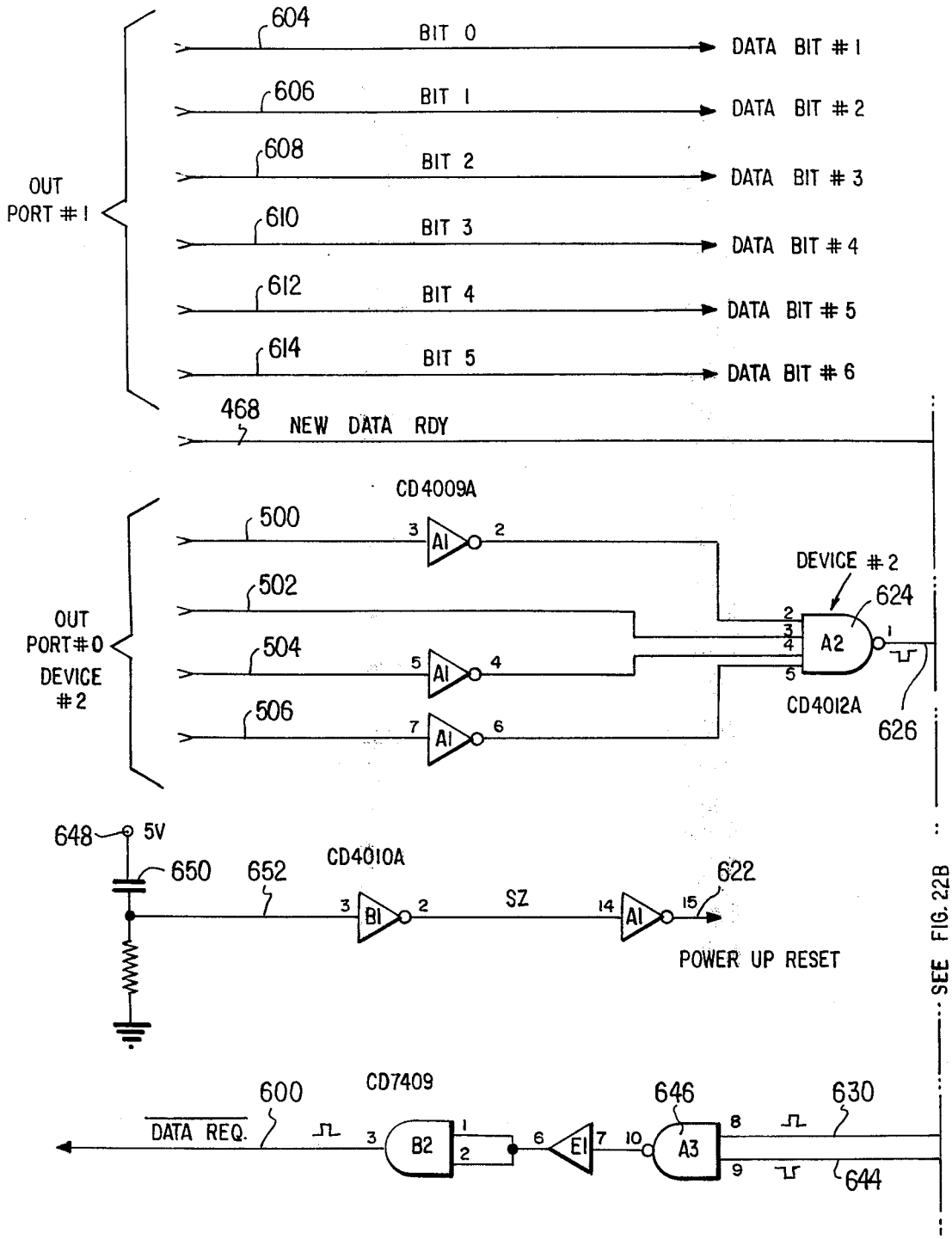
Figure 22B:
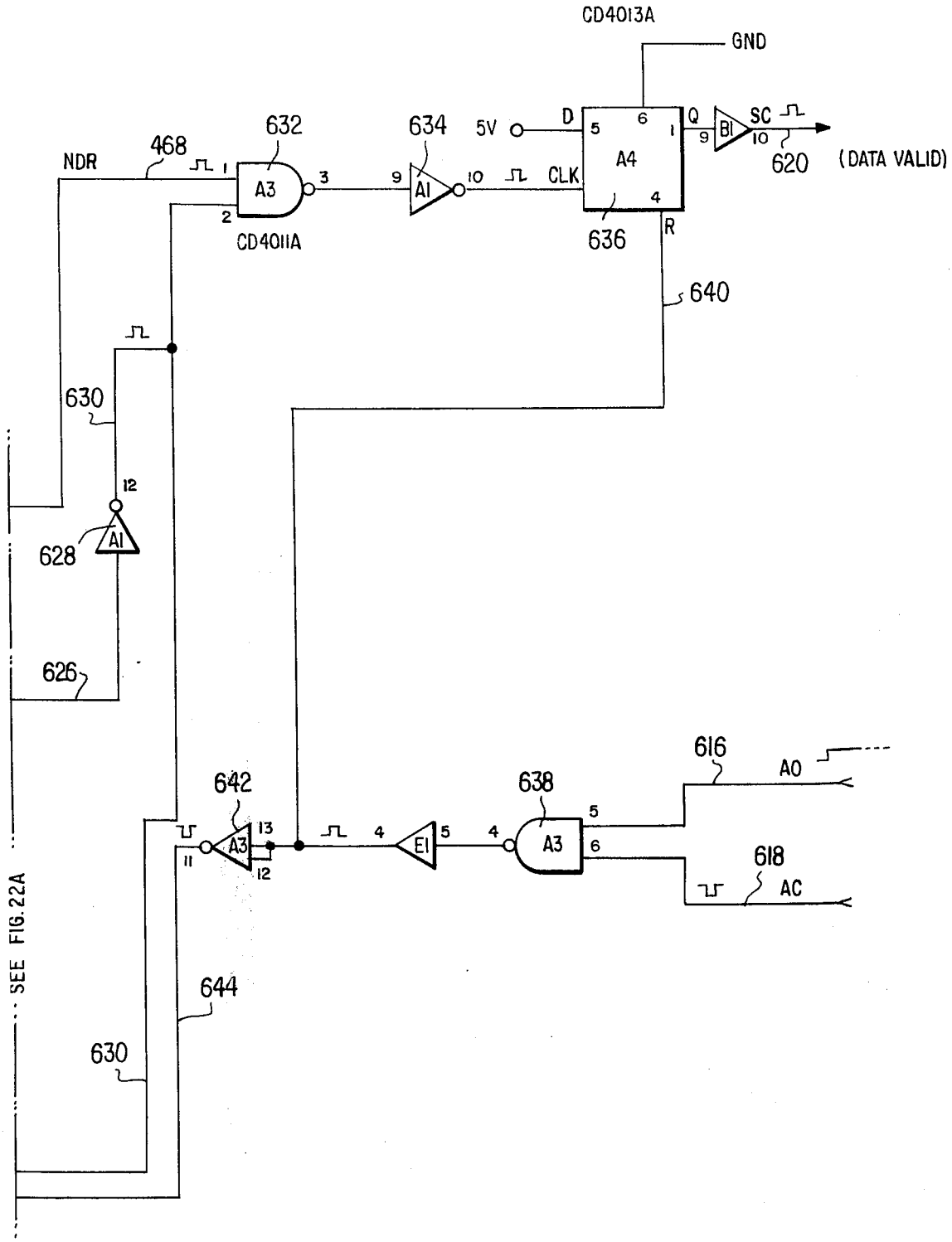
Figure 23A:
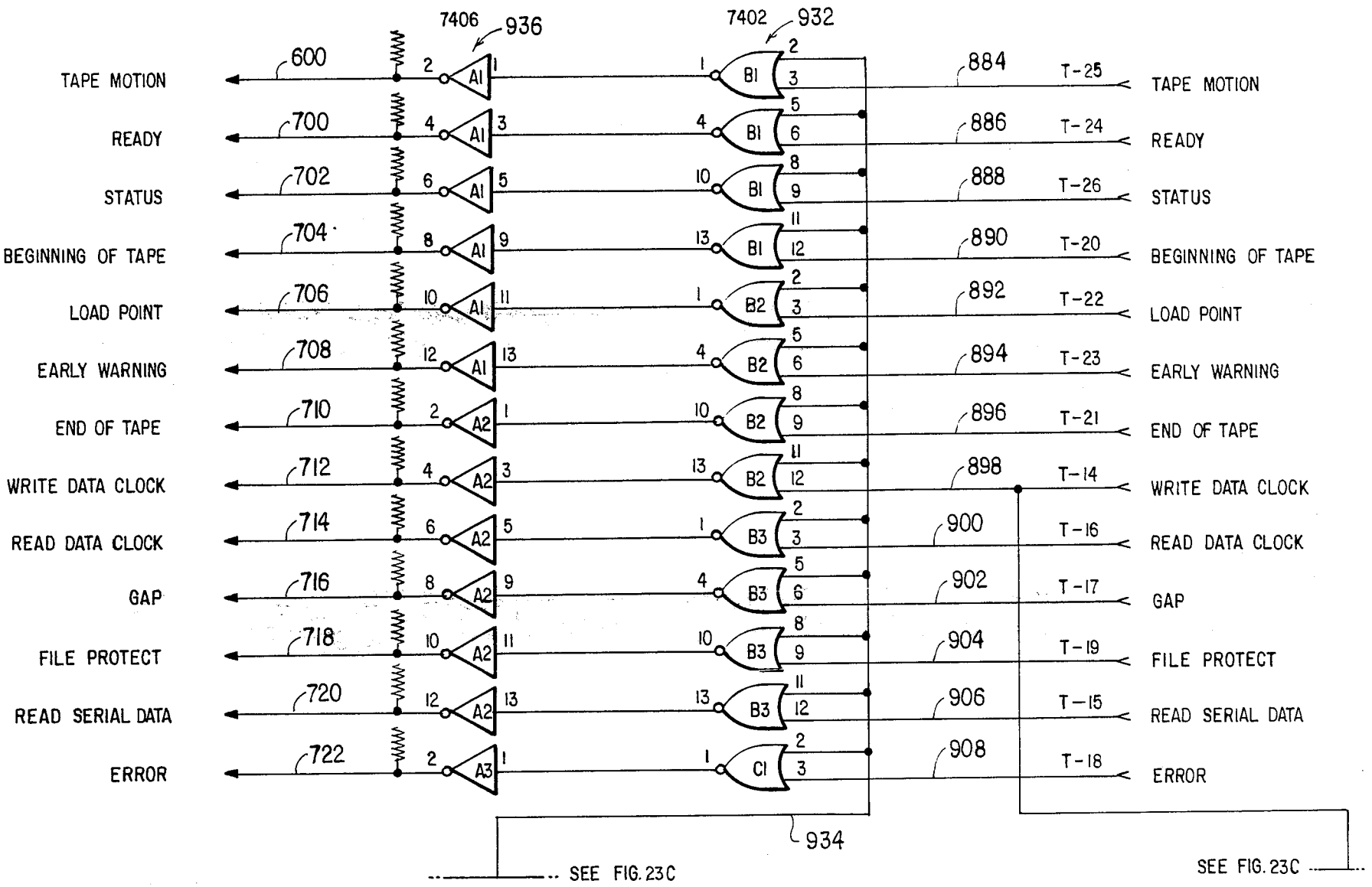
Figure 23B:
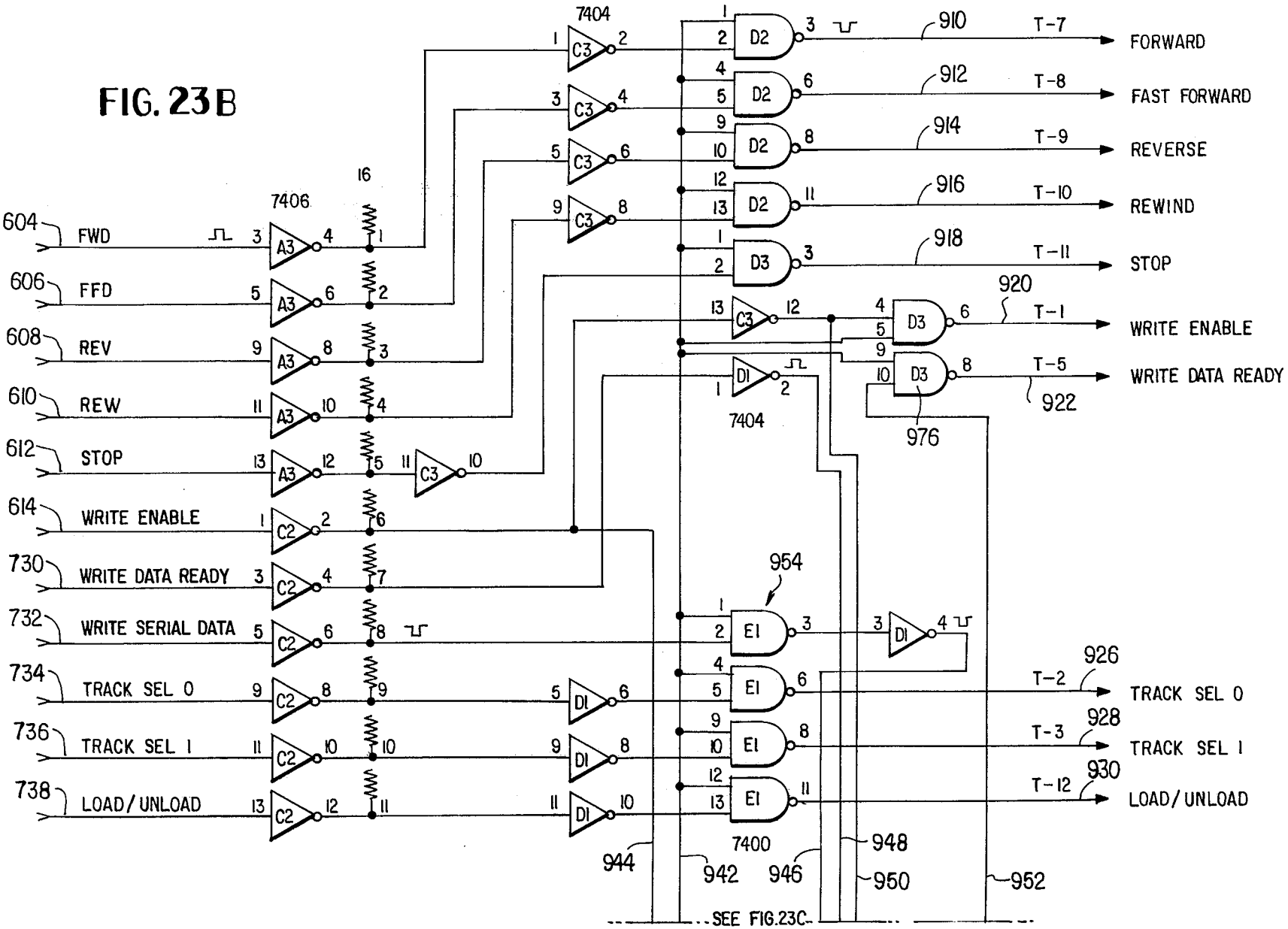
Figure 23C:
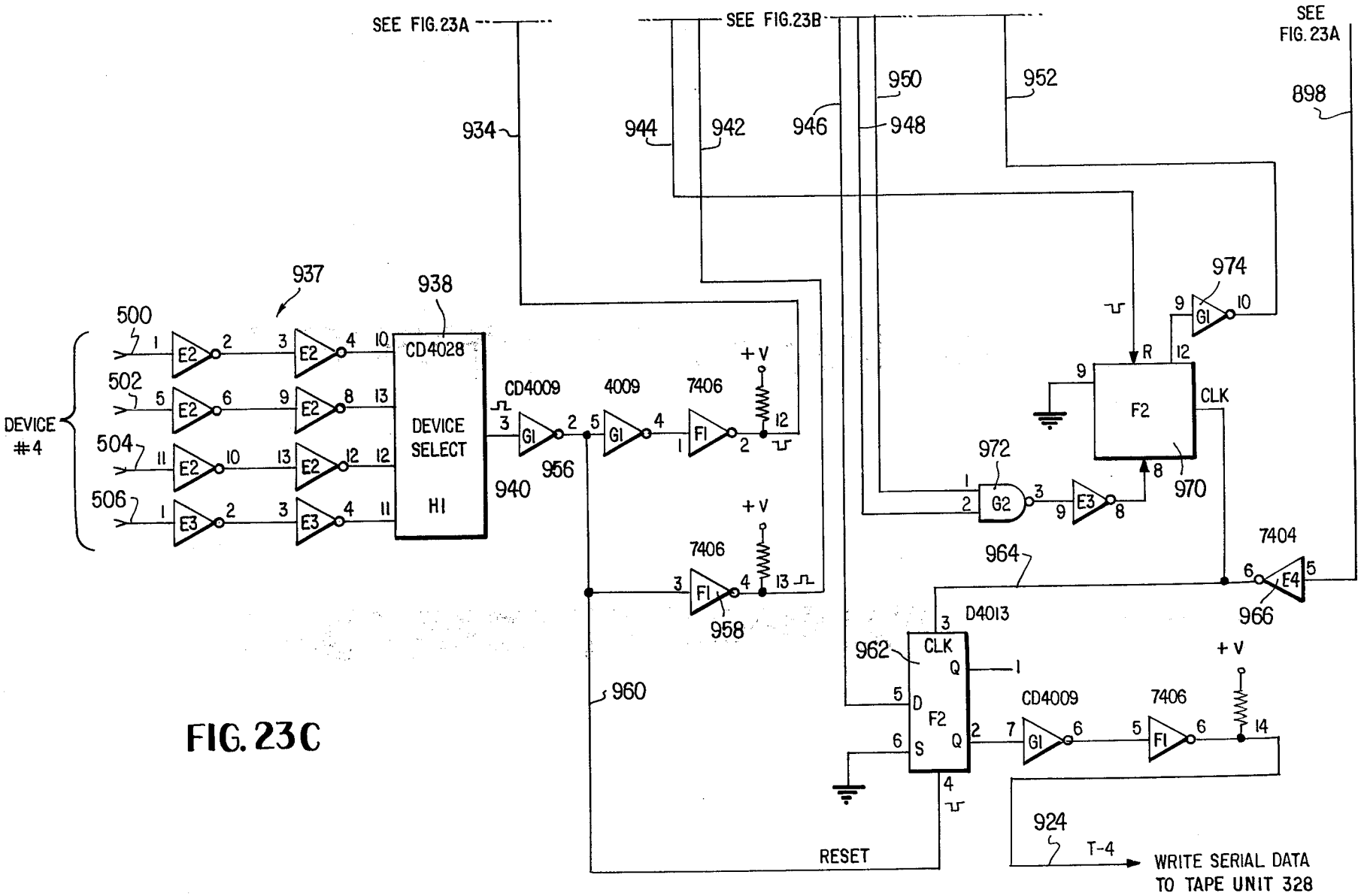
Figure 24A:
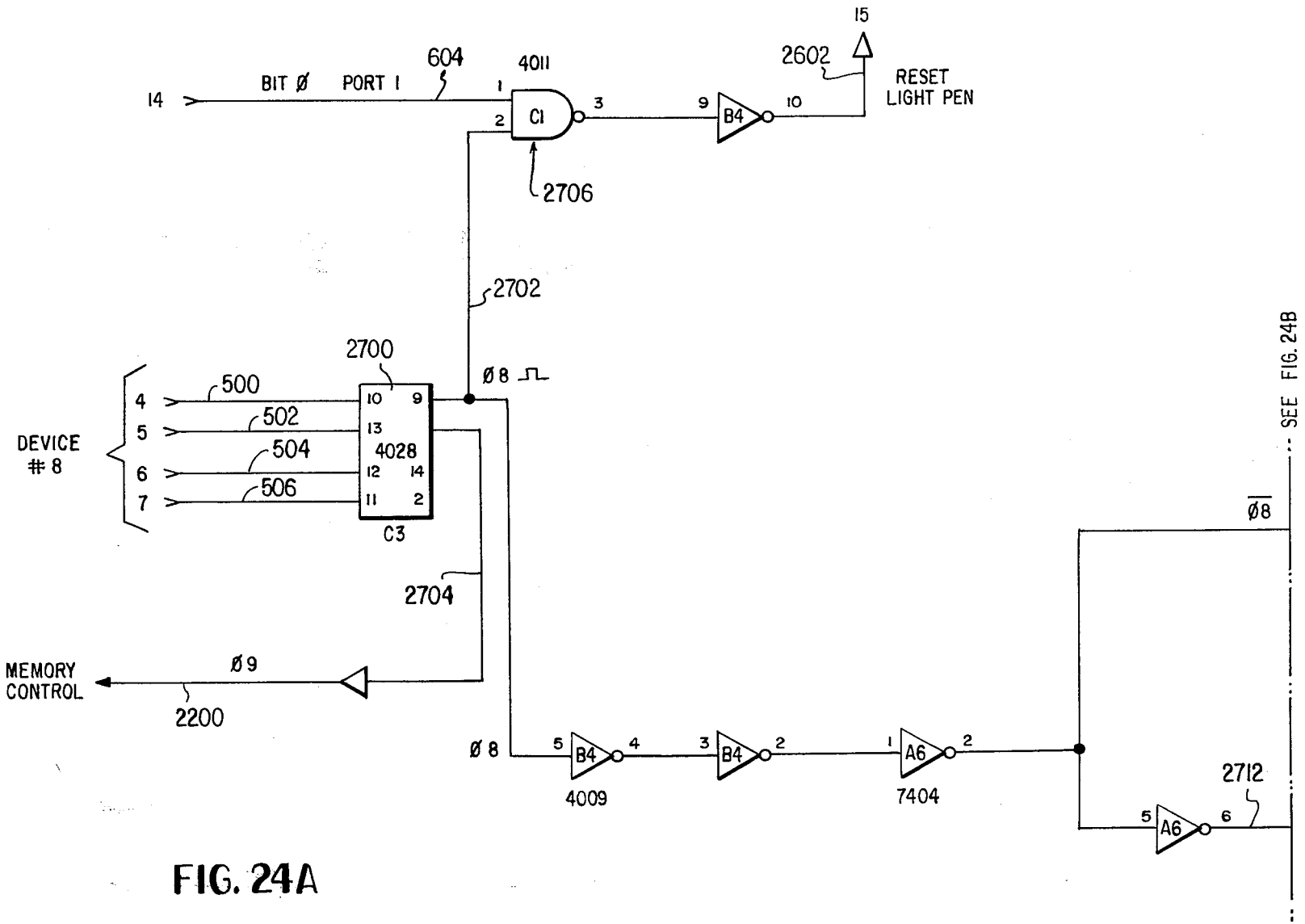
Figure 24B:
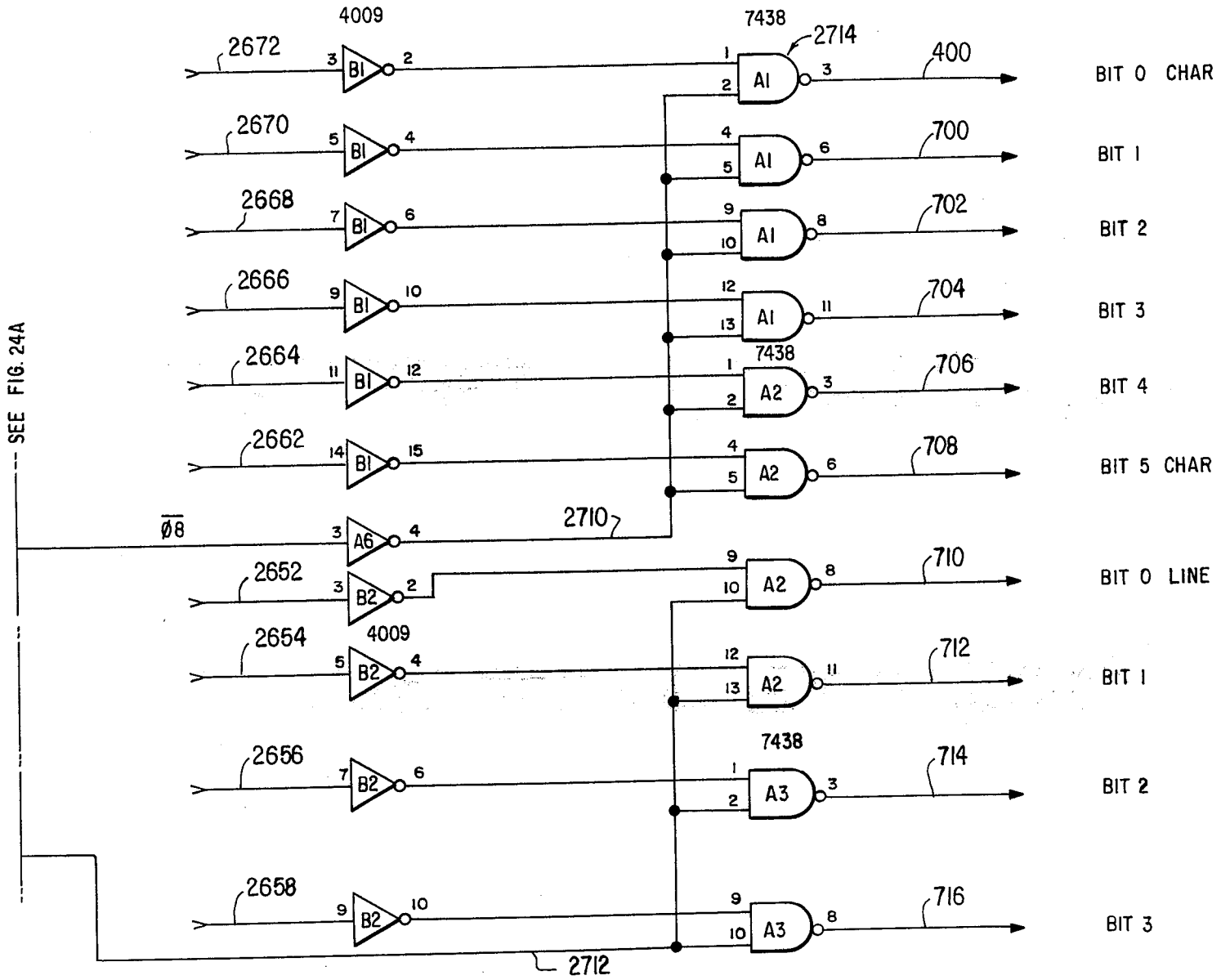
Figure 25A:
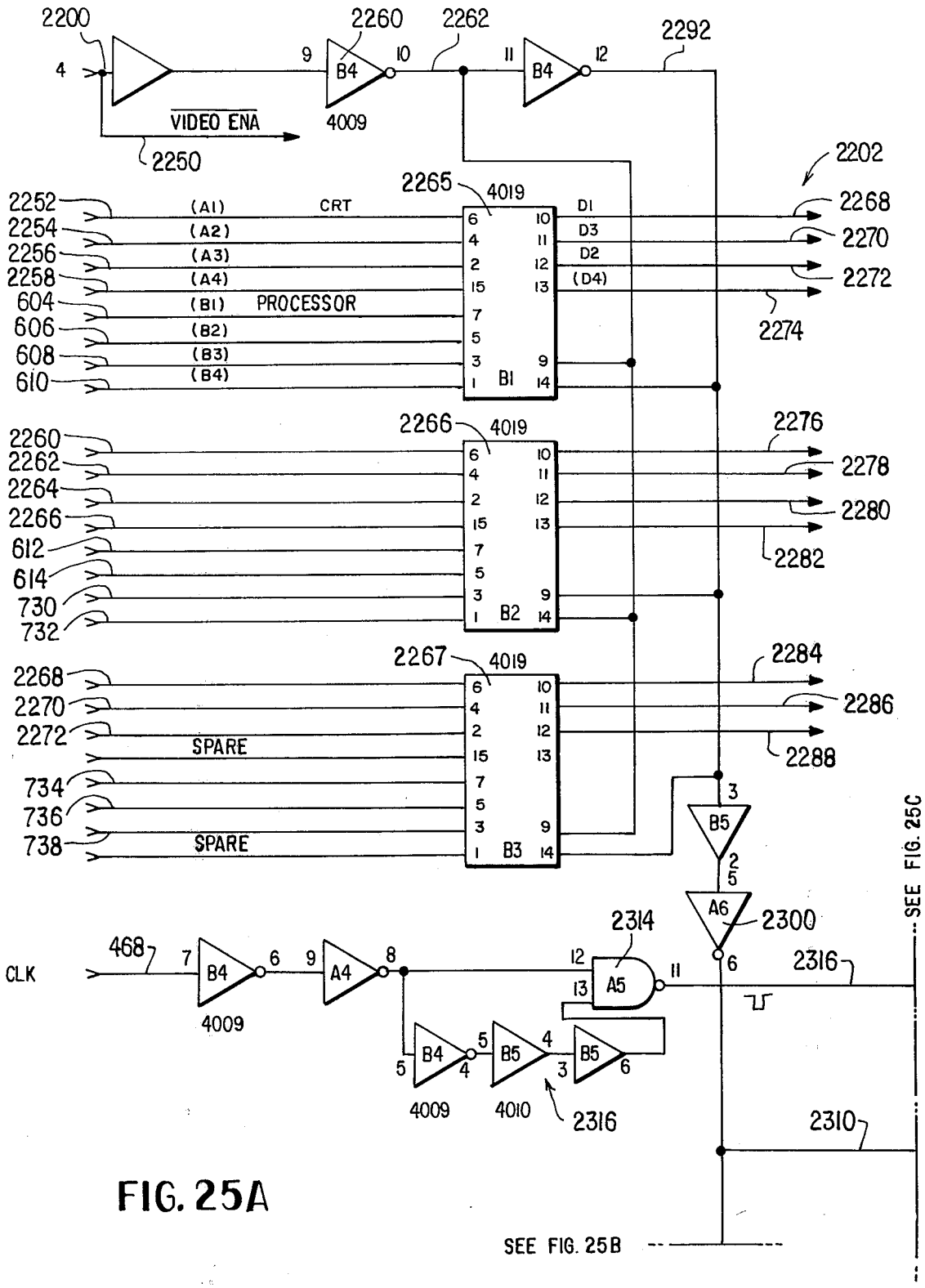
Figure 25B:
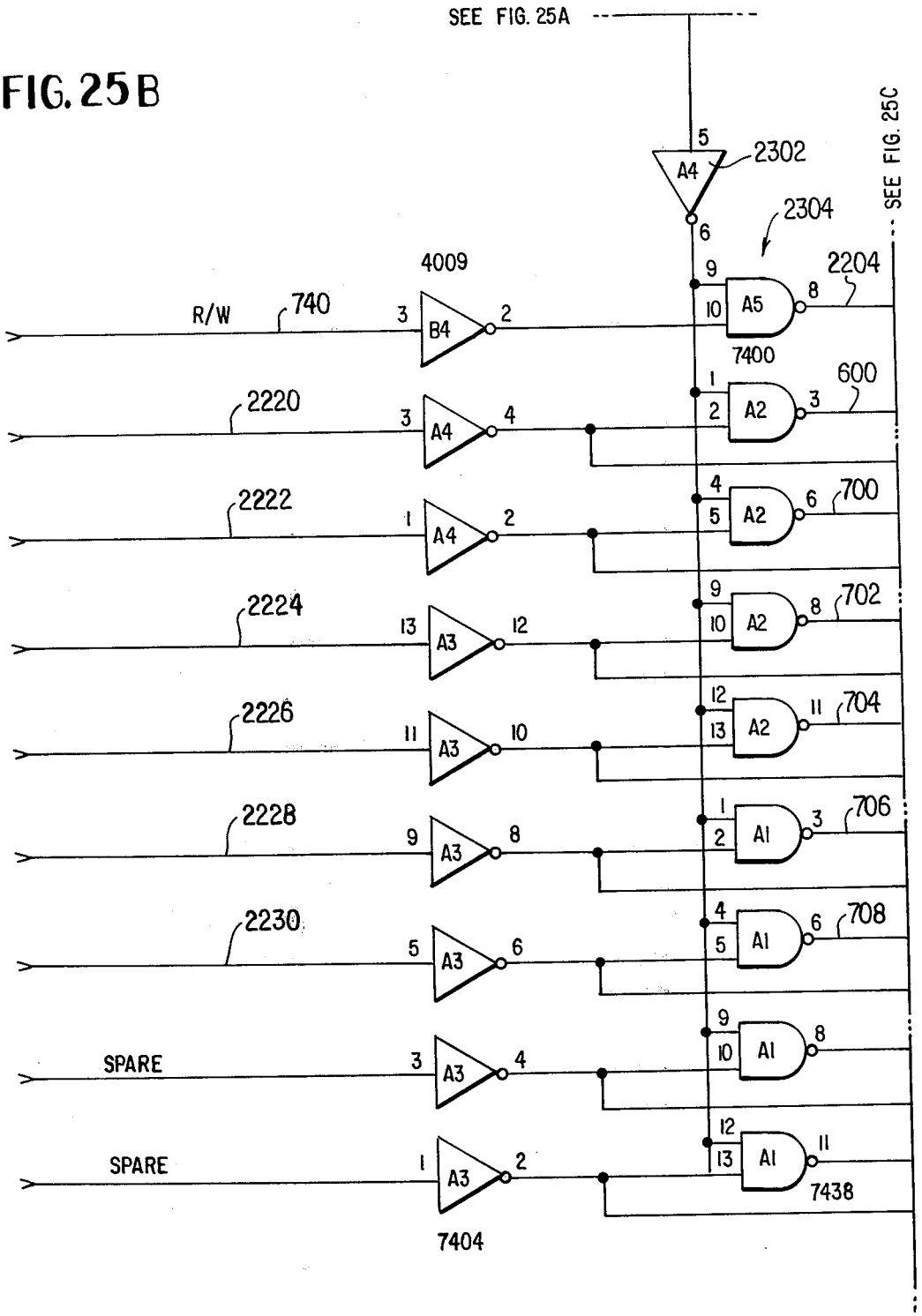
Figure 27A:
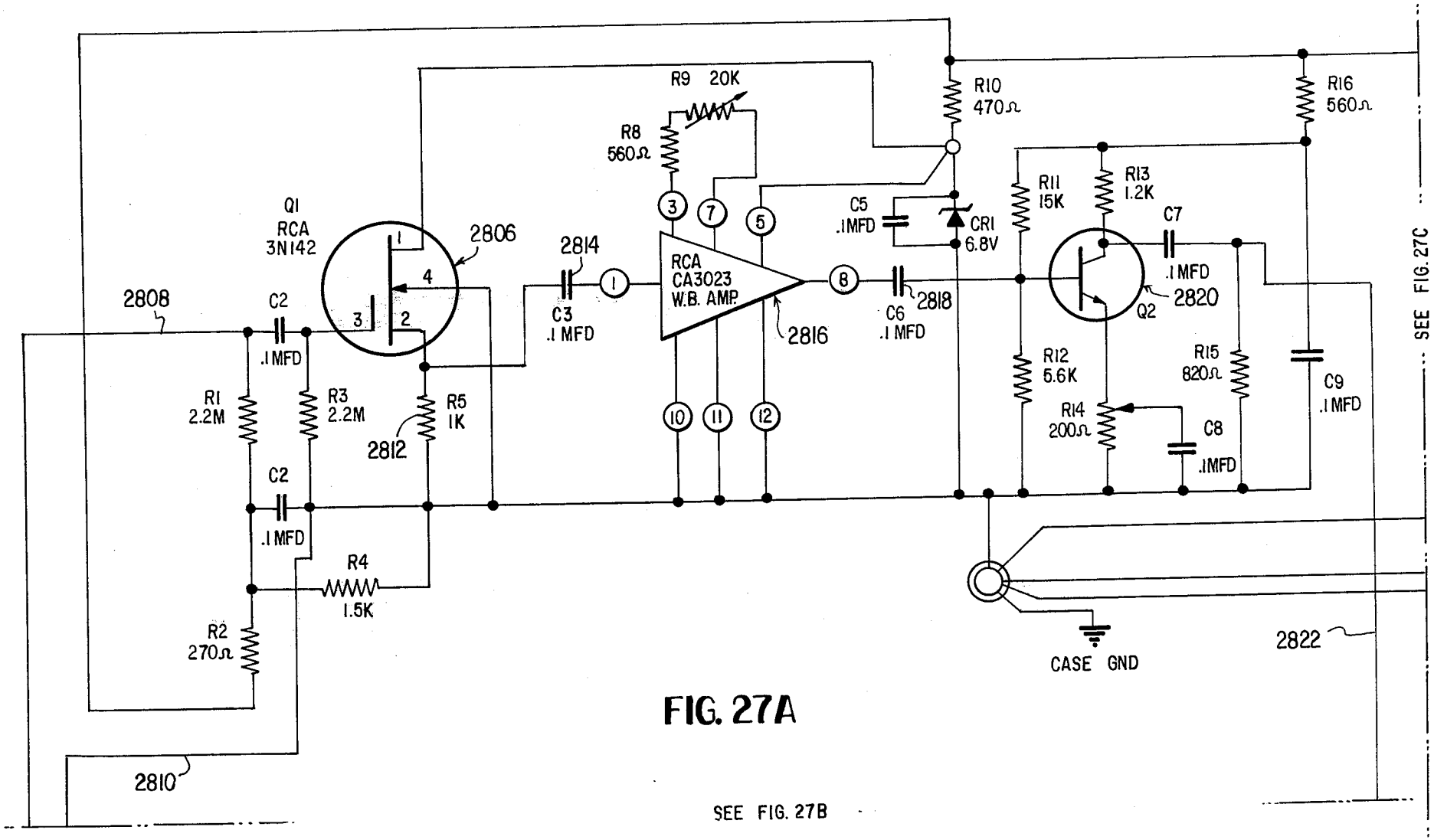
Figure 27B:
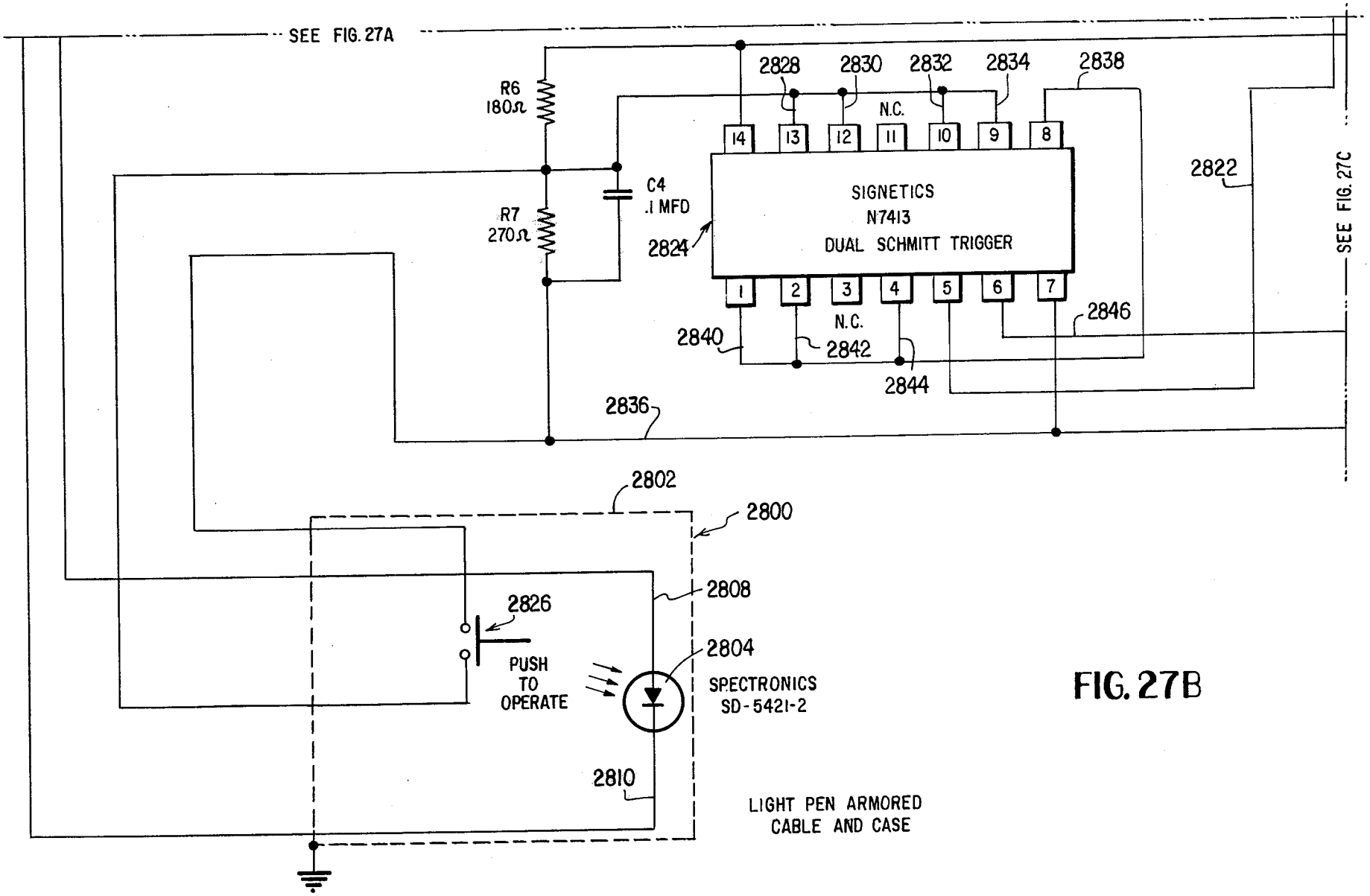
Figure 27C:
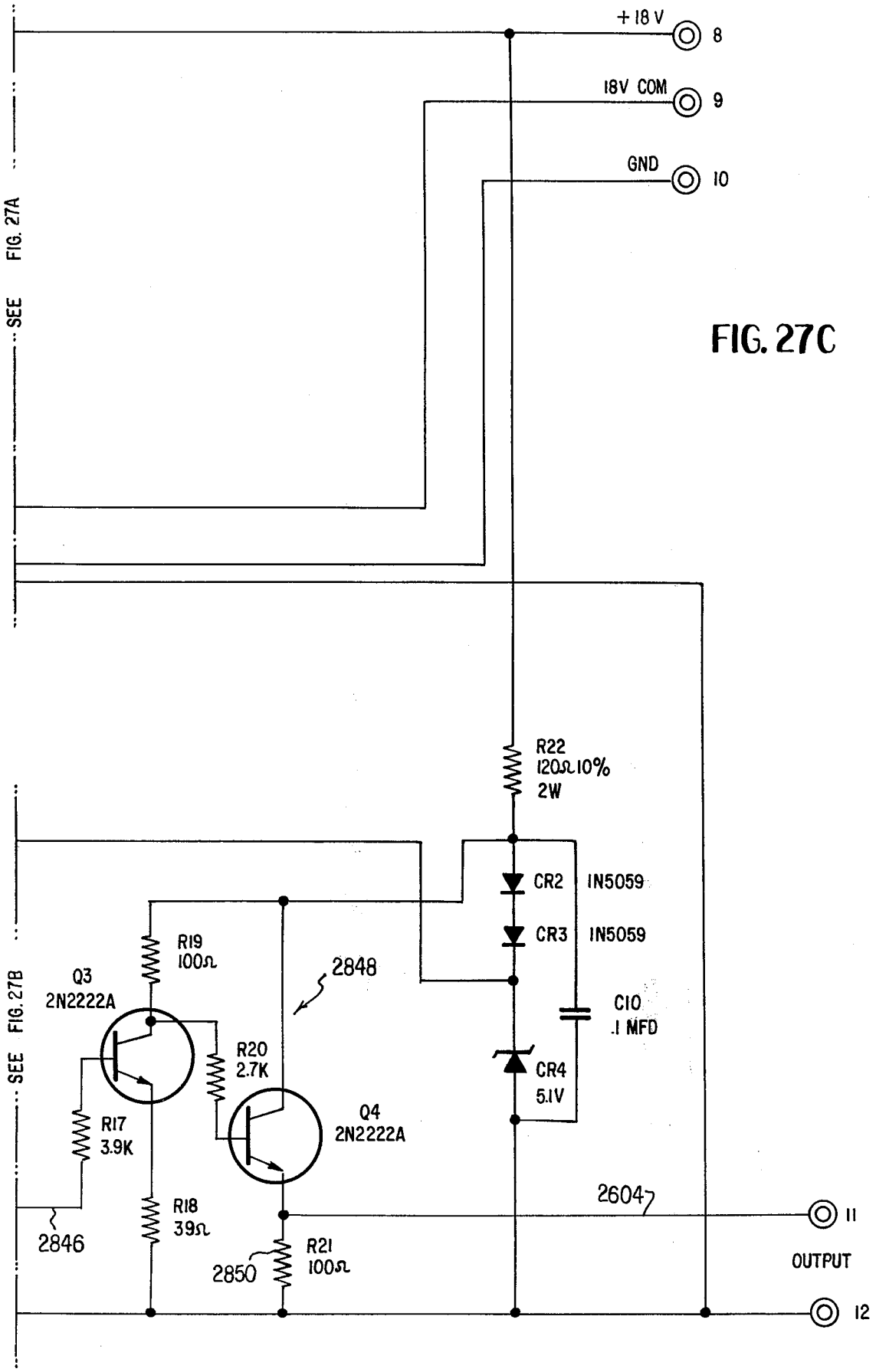
Figure 28A:
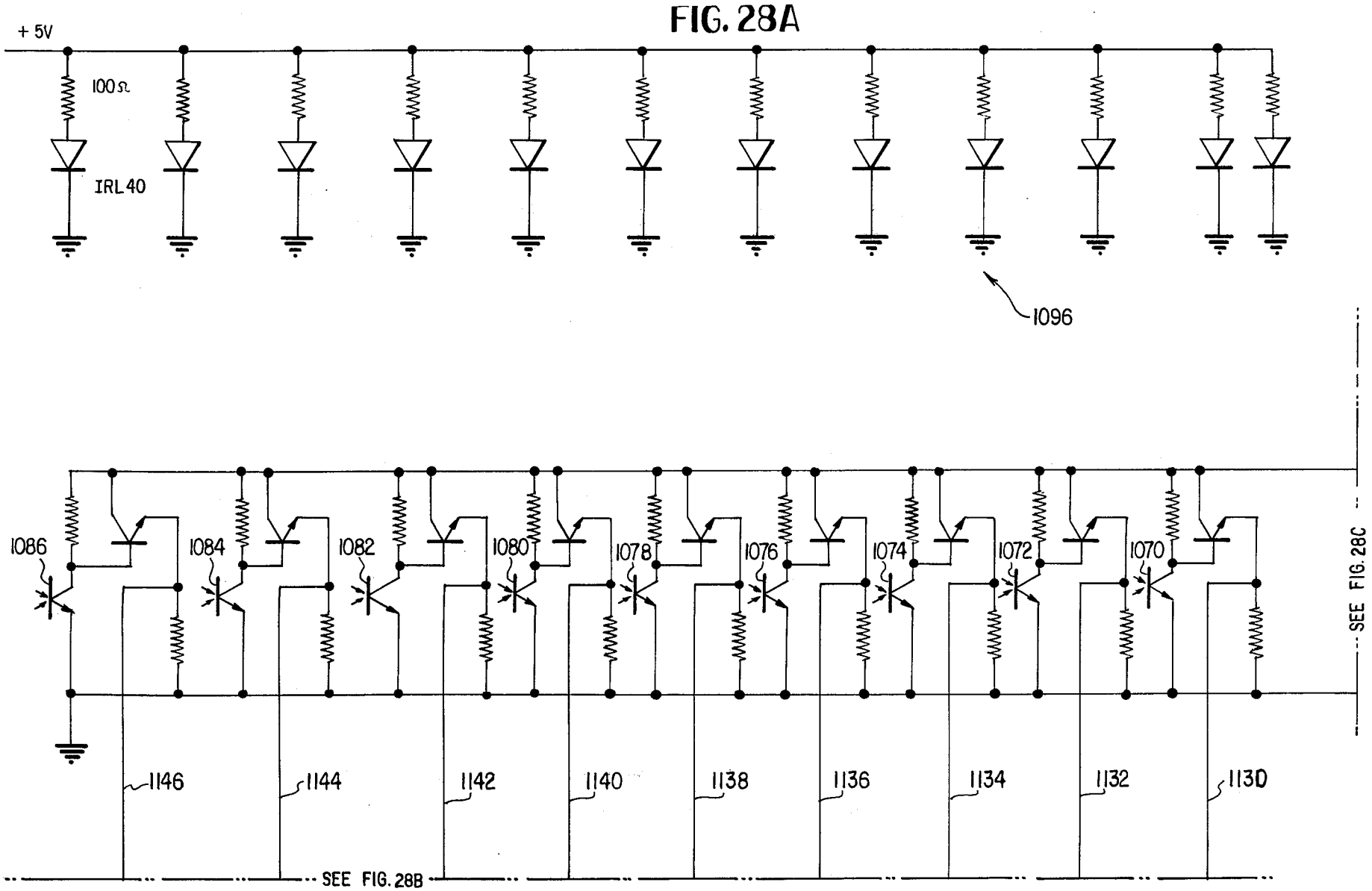
Figure 28B:
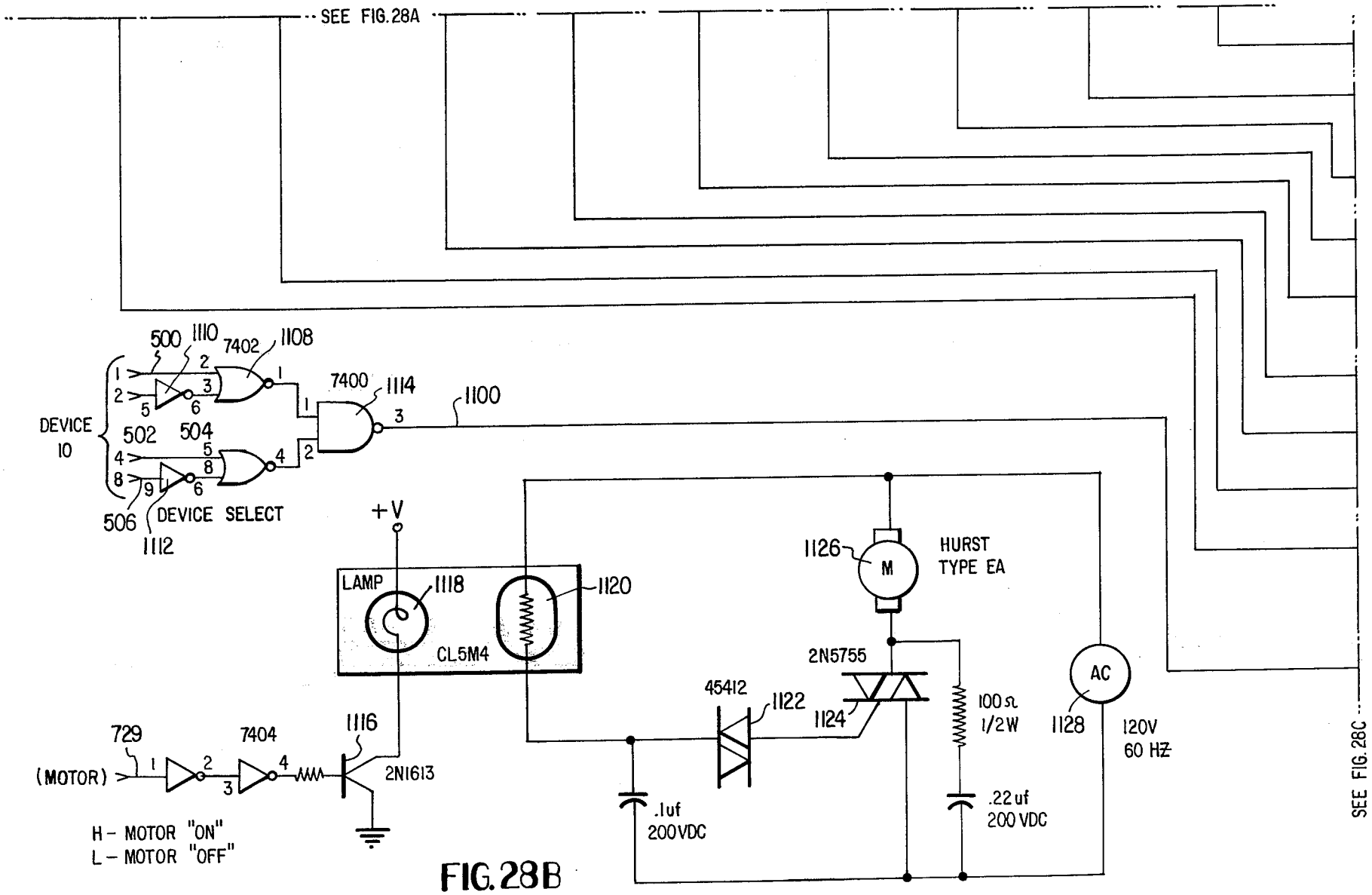
Figure 28C:
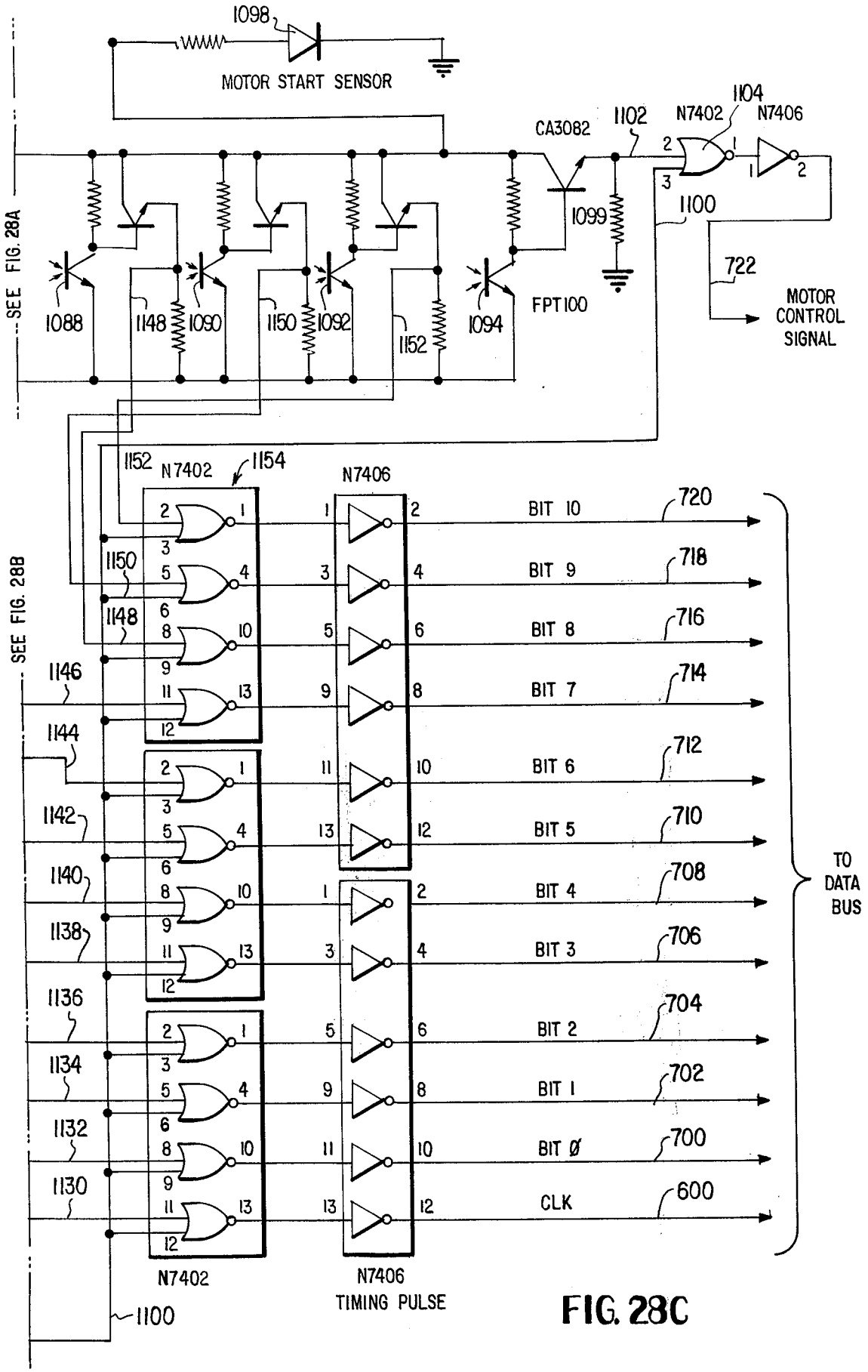
Figure 29A:
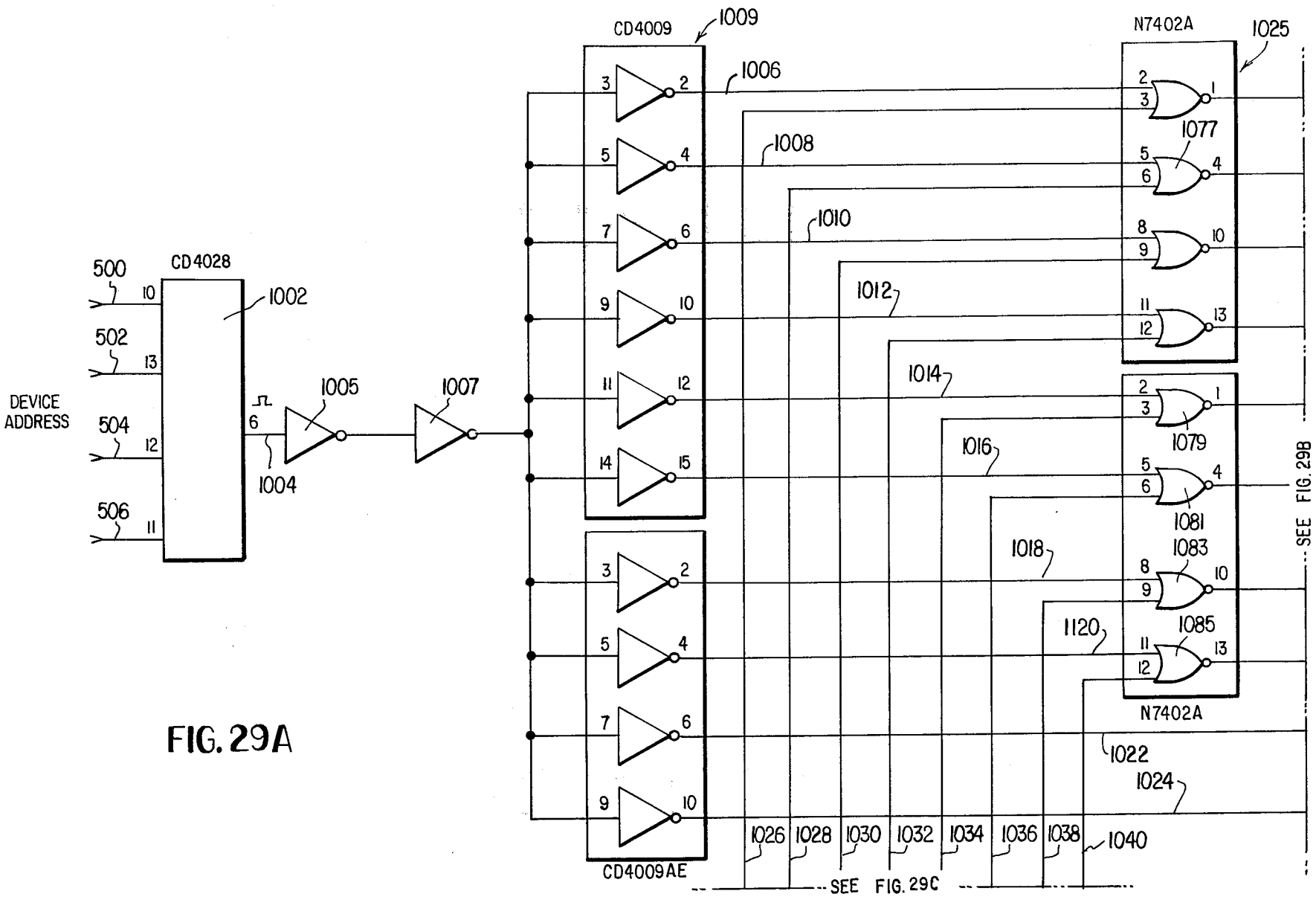
Figure 29B:
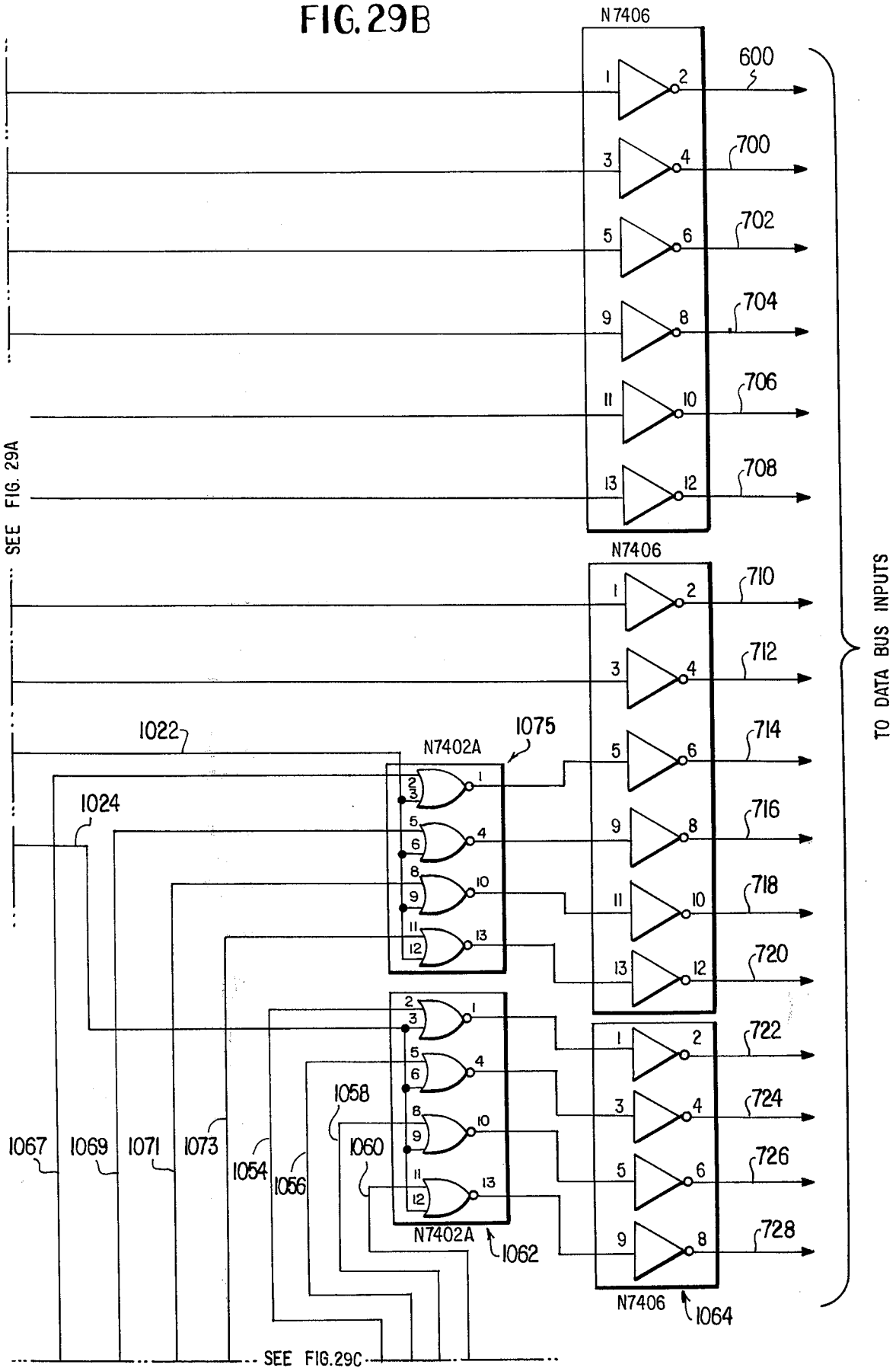
Figure 29C:
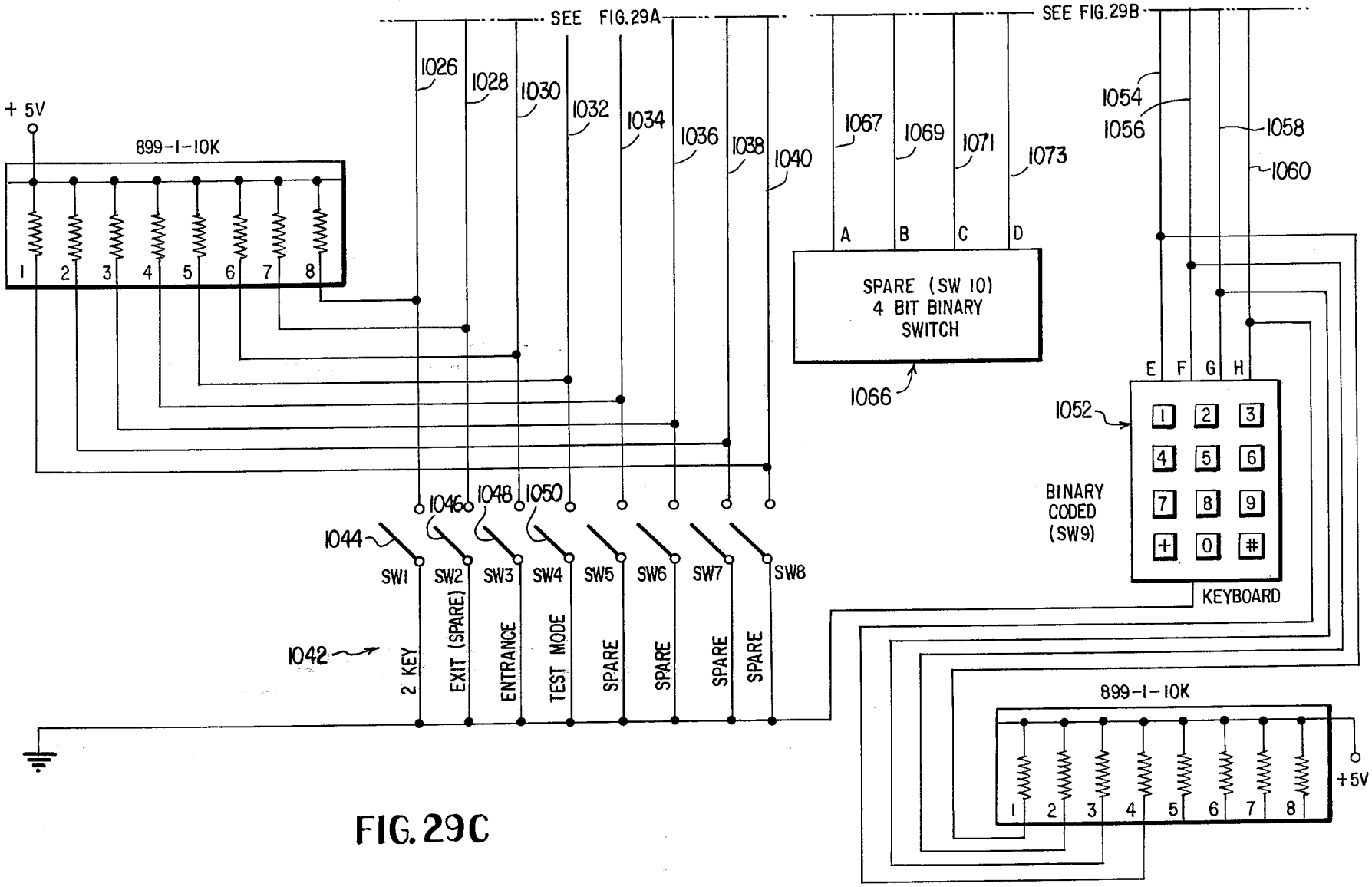
Figure 30A:
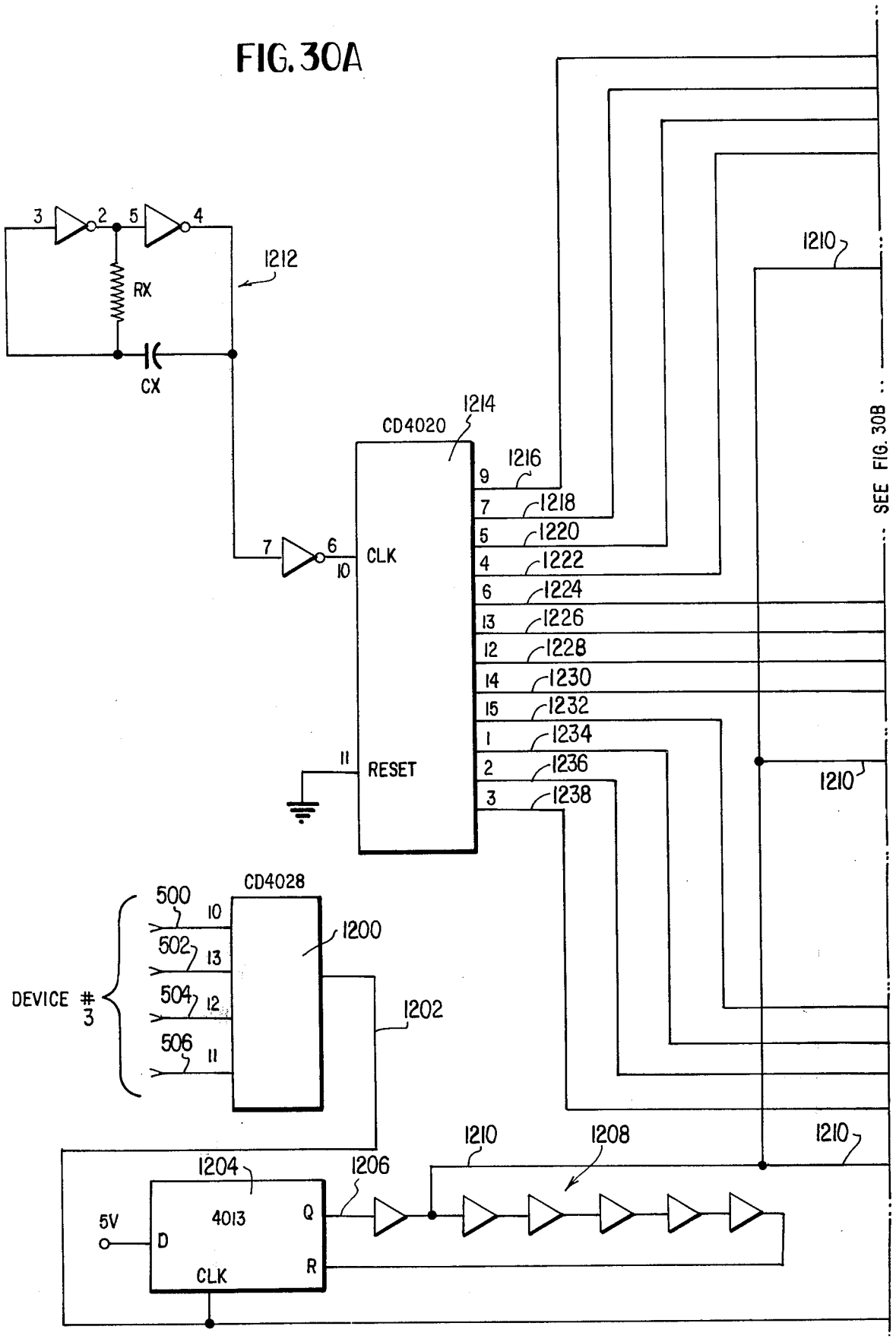
Figure 30B:
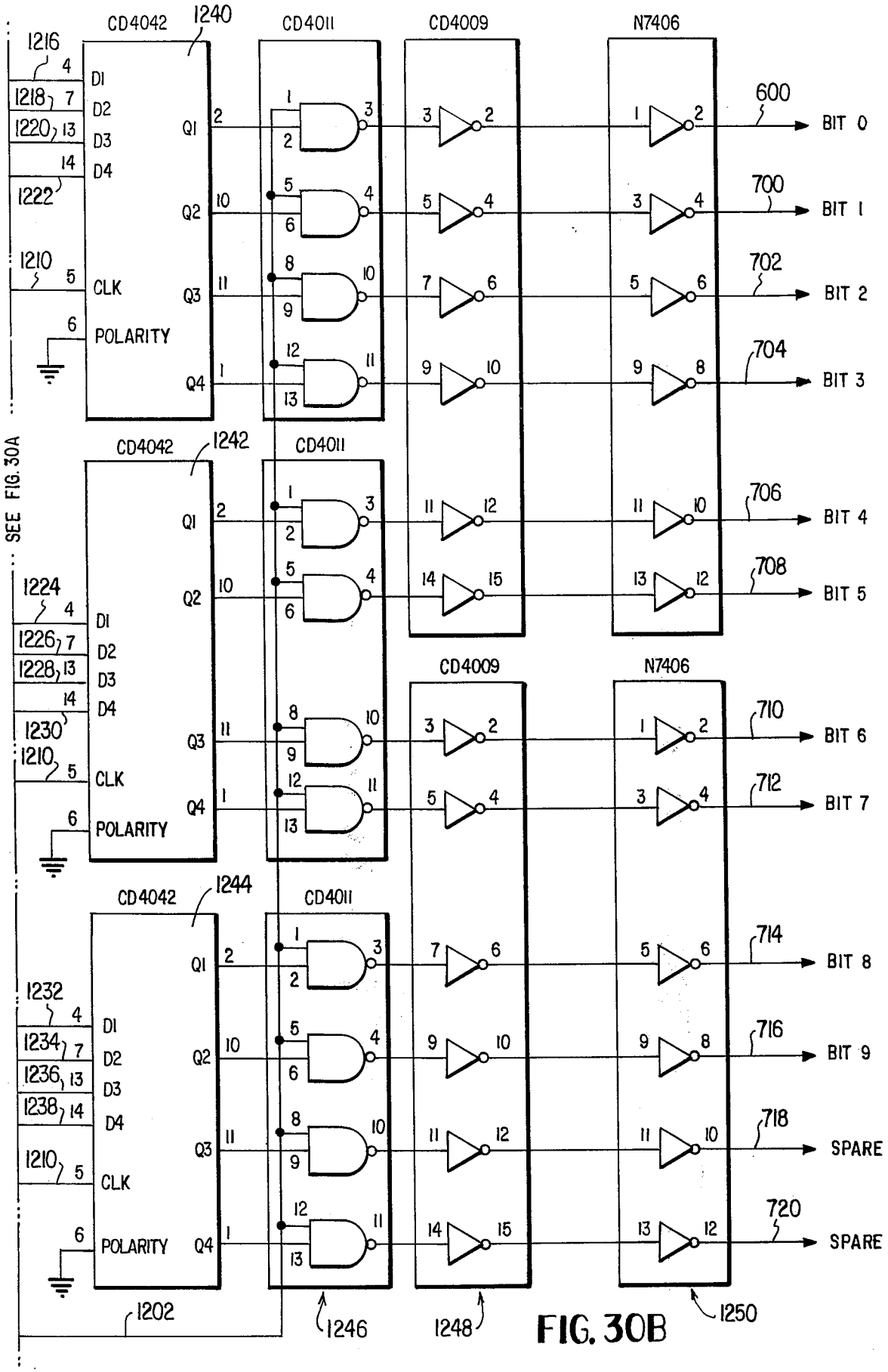
Figure 31A:
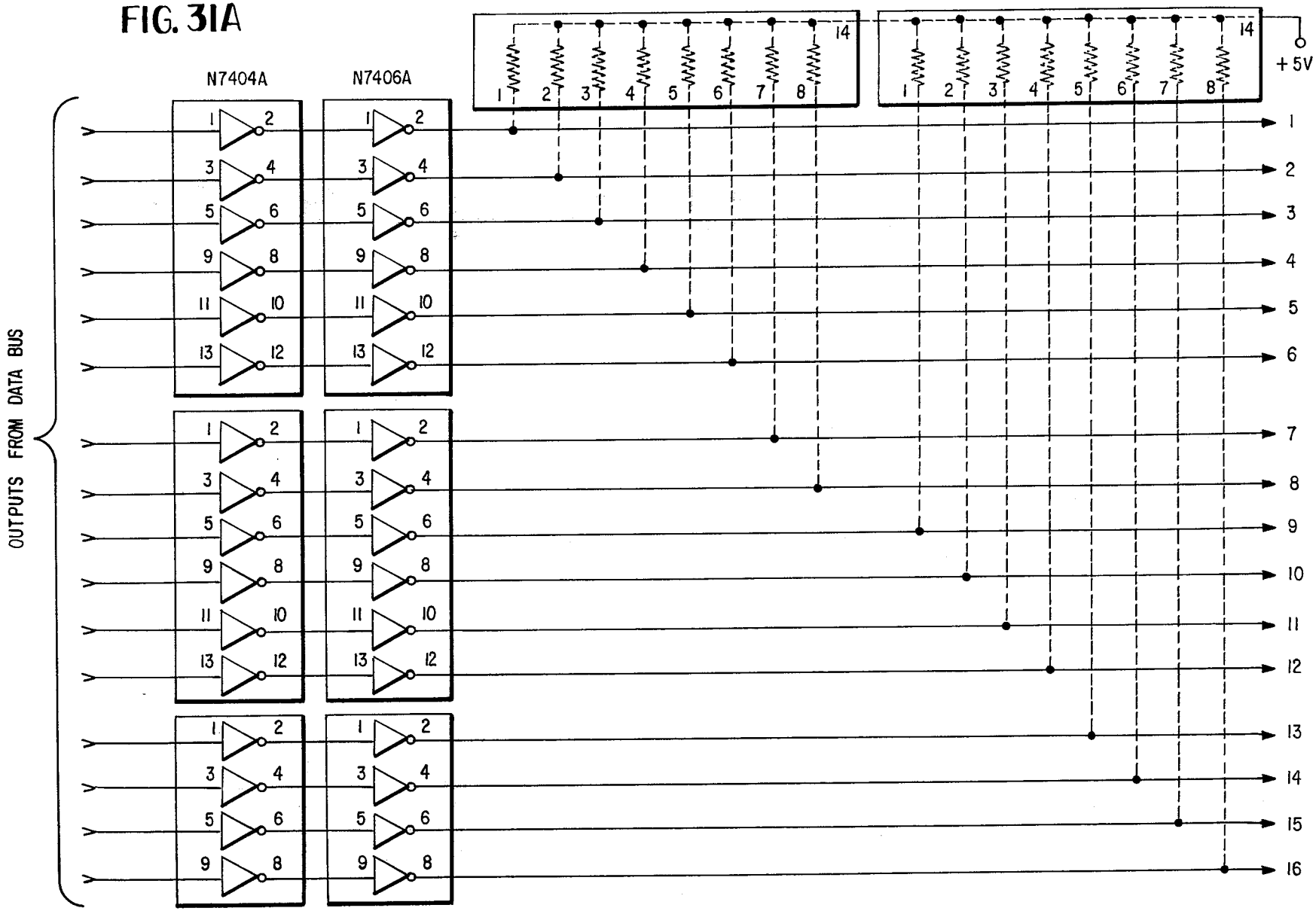
Figure 31B:
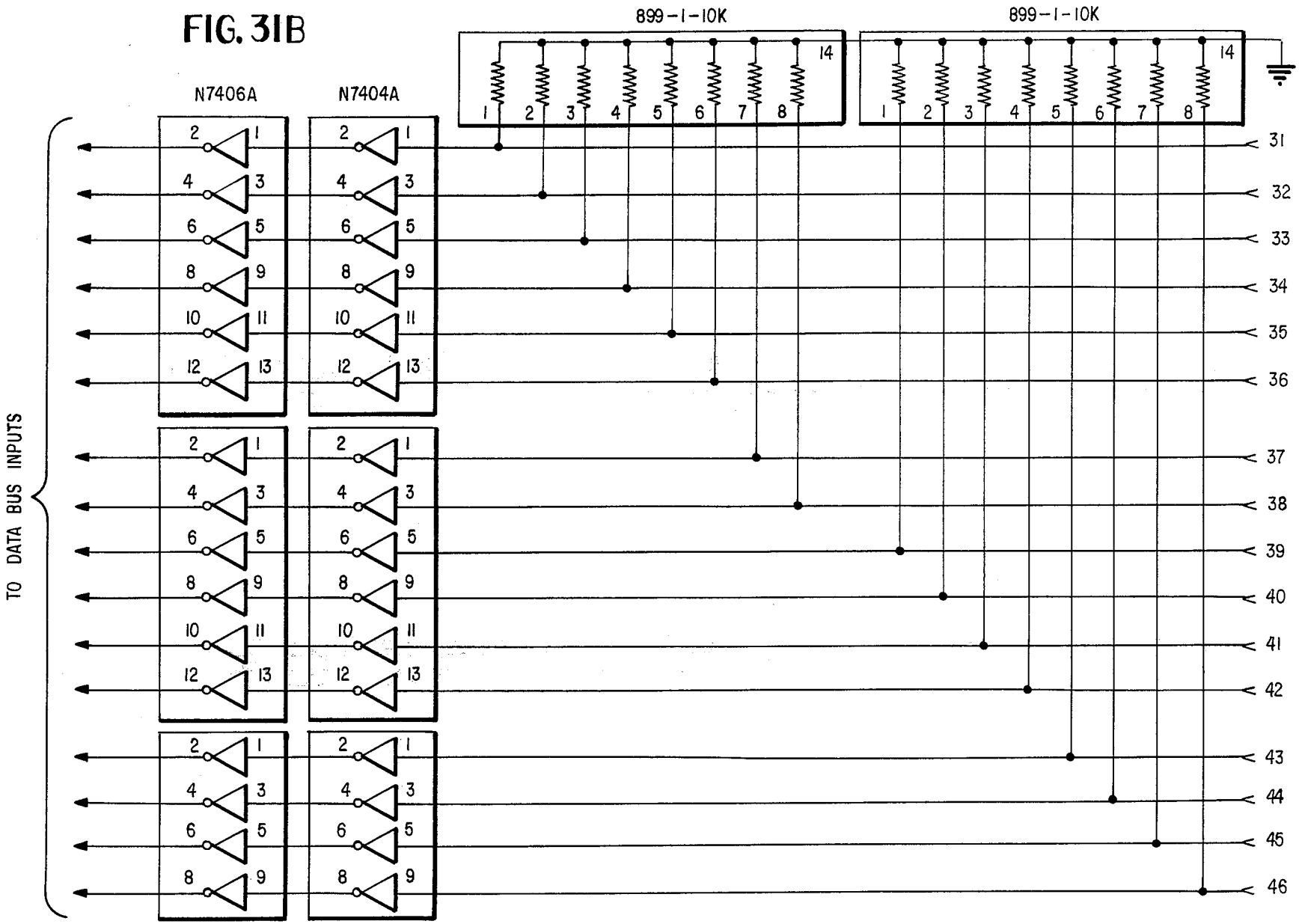

FIG. 9 together with FIGS. 7A and 7B and FIGS. 8A–C completed the logic flow as shown in FIGS. 6A and 6B;

FIG. 10 is a logic flow diagram illustrating the light pen subroutine;

FIG. 11 is a logic flow diagram showing the write-in subroutine;

FIG. 12 is a logic flow diagram showing the print-out subroutine:

FIG. 13 illustrates the CRT logic;

FIG. 14 illustrates the tape control logic;

FIG. 15 shows the input/output related to the magnetic tape unit;

FIGS. 16A and 16B show the logic for tape motions;

FIG. 17 is a block diagram of a preferred embodiment of the invention;

FIGS. 17A–17K cumulatively provide an expansion of the block diagram of FIG. 17;

FIGS. 18A–18H cumulatively provide circuit details of the processor;

FIGS. 19A–19F cumulatively provide circuit details of the read only memory;

FIGS. 20A–20I cumulatively provide circuit details of the random access memory;

FIGS. 21A 21C cumulatively provide circuit details of the input/output section;

FIGS. 22A and 22B provide circuit details of the printer interface;

FIGS. 23A–23C provide circuit details of a tape unit interface;

FIGS. 24A and 24B cumulatively provide circuit details of the light pen interface;

FIGS. 25A–25C cumulatively provide circuit details of the memory switching interface;

FIGS. 26A–26H cumulatively provide circuit details of the CRT logic;

FIGS. 27A–27C cumulatively provide circuit details of the light pen;

FIGS. 28A–28C cumulatively provide circuit details of the card reader interface;

FIGS. 29A–29C cumulatively provide circuit details of the switch interface and switches;

FIGS. 30A and 30B cumulatively provide circuit details of the random number generator; and FIGS. 31A and 31B cumulatively provide circuit details of the bus extender.

DETAILED DESCRIPTION OF INVENTION

Figure 1:
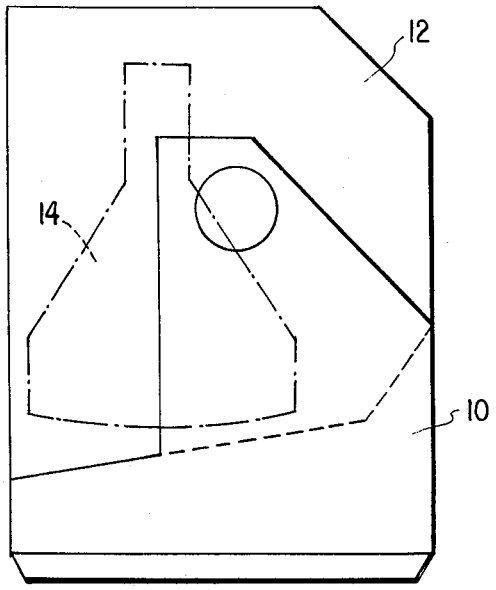
FIGS. 1 and 2 are views illustrating a typical machine in one embodiment thereof in closed and open positions respectively.
Figure 2:
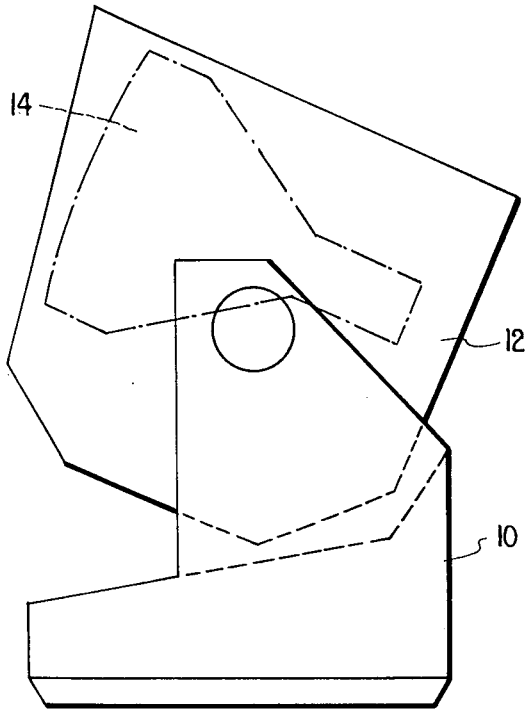

A typical machine is shown in FIGS. 1 and 2 and will be seen to include the base portion 10 and a pivotal cover or top section 12, the latter of which carries the CRT 14 which is displayed for viewing in the open position of the machine as shown in FIG. 2. Obviously, various and different physical configurations may be employed for the voter-viewing portion of the machine and it is to be under stood that the base portion 10 of the machine typically would include the majority of the requisite electronic components although a separate voting official control panel as for example which contains the control switches hereinafter described may be remotely located as may be desired.

Figure 3:
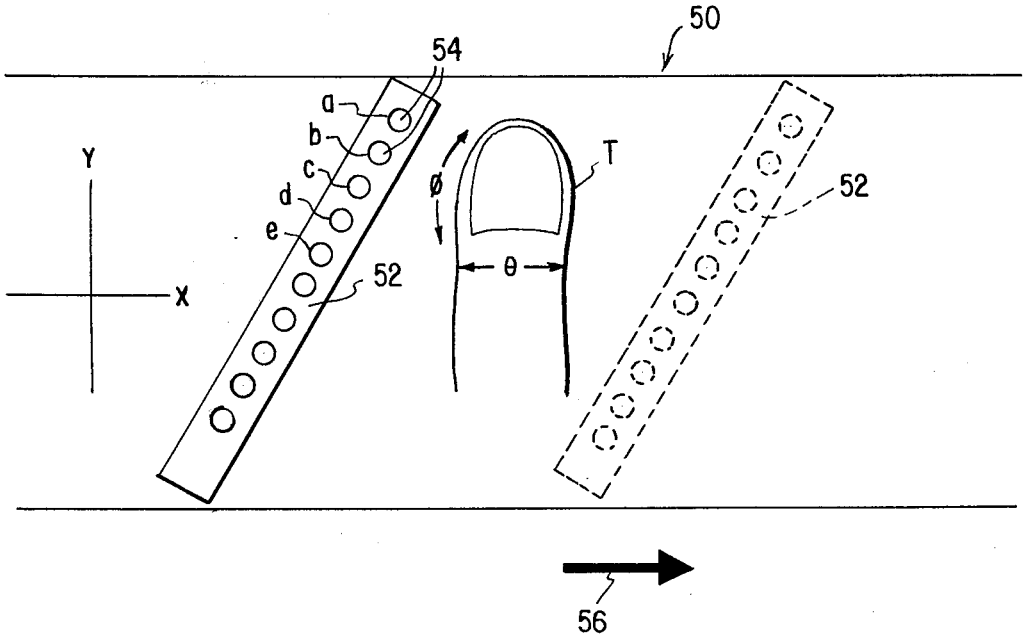
FIG. 3 shows diagrammatically one form of voter verification.

The thumb scanning arrangement is shown somewhat diagrammatically in FIG. 3 in which the reference character 50 indicates in general a plate or platform provided with a suitable trough or indentation for grossly locating the prospective voter's thumb and in such manner as fairly well locates the thumb in the X direction, allowance being made for some variation in the Y axis placement of the thumb. Located beneath the plate is a carrier 52 angularly related to the platform 50 as is shown and mounting thereon an array of phototransistors 54. The platform 50 is mounted so as to float, for example, it may be hinged along the upper edge as shown in FIG. 3 and movement of the carrier 52 is dependent upon the depressed position of the platform 50. This action not only initiates translational movements of the carrier 52 but also assures that the readout of the thumb is more uniform. That is to say, by requiring a more or less fixed pressure to be exerted by the thumb, the probability is greater that each time the measurement is made it will be uniform. The carrier 52 is translated in the direction indicated by the arrow 56 to move from the full to the dashed line position shown in FIG. 3 and, in so doing, a prescribed number of the elements 54 operate to read the curvature at one side of the thumb and the thickness dimension thereof as indicated in FIG. 3. A suitable light source is positioned above the platform 50 and it too is actuated when the platform is depressed by the thumb so as to initiate movement of the carrier 52.

Figure 4:
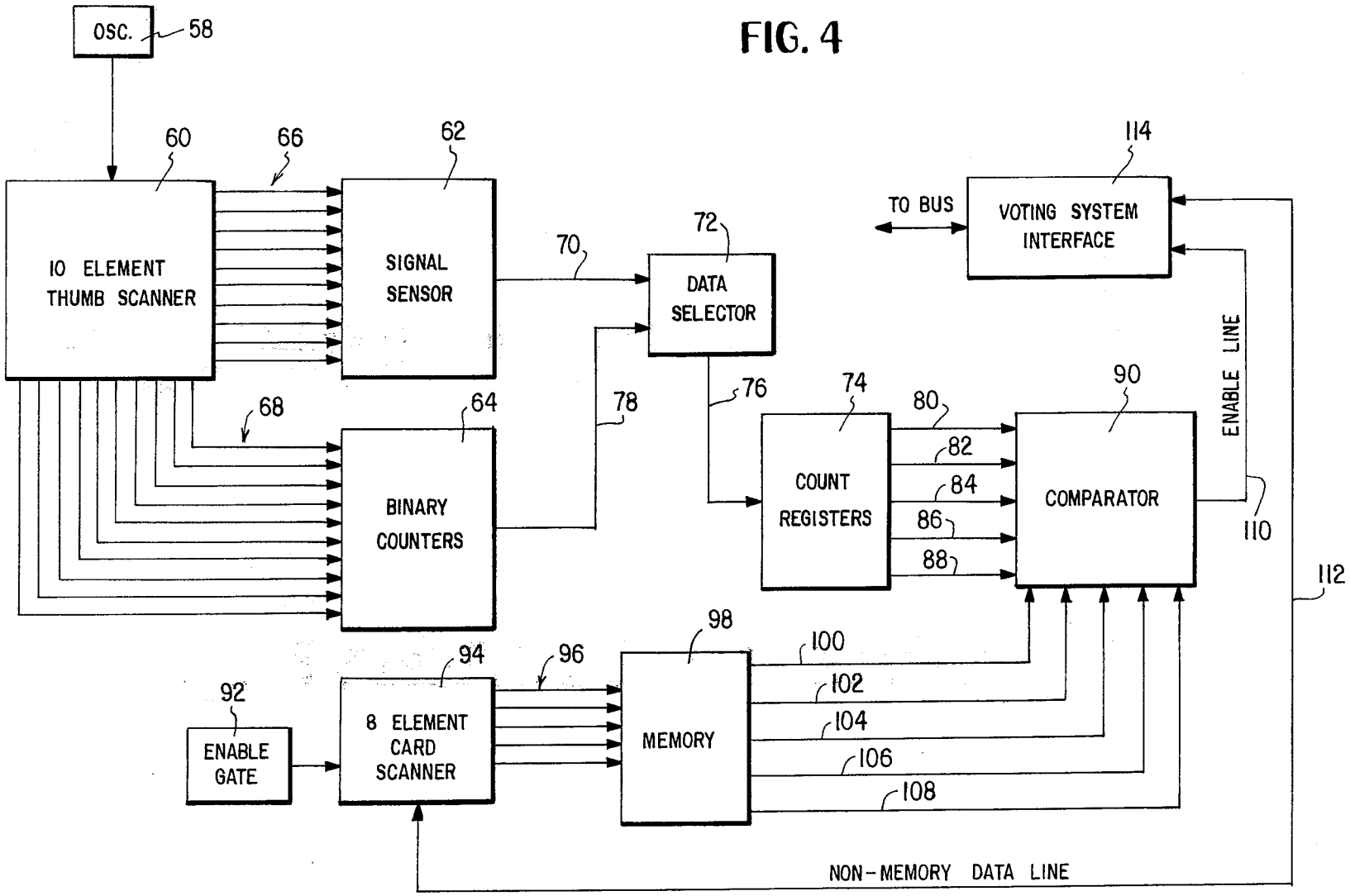
FIG. 4 is a block diagram showing the card reading and voter verification section of the voting assembly.

The operation of the thumb scanning arrangement will be apparent from FIG. 4 which shows a block diagram of the necessary components to read the characteristics of the thumb and correlate this information to that information encoded on the voter's card. With reference to FIG. 4, the oscillator 58 is provided for the purpose of generating counting pulses related to the translational movement of the carrier 52 as shown in FIG. 3 such that for a particular thumb each element 54 in passing beneath the thumb and thus being obscured from the light source will pass a predetermined number of count pulses which should compare reasonably well with the data stored on the voter's card. The carrier 52 and its element 54 in conjunction with the associated circuitry is indicated by the box 60 in FIG. 4 and the outputs from the ten elements are passed in parallel to the signal sensor 62 and to binary counters 64, as indicated by the corresponding sets of output lines 66 and 68. It is a function of the sensor 62 to determine the location of the thumb in the Y direction by producing an output at the conductor 70 corresponding to the first sensor 54 which passes beneath the thumb. This signal at 70 is passed to the data selector 72 which functions to gate that signal which caused the output at 70 and the outputs of the next four successive elements 54 to the count registers 74, through the output lines 76 shown for convenience as a single line in FIG. 4. The single line 78 in FIG. 4 is in reality ten lines corresponding one to each of the elements 54 and it is the output on the first element obscured by the thumb and the next following four elements which are passed through the lines 76 to the count register 74. For example, if the uppermost element indicated at *a* in FIG. 3 is the first obscured by the thumb during translation of the carrier 52, only those counting signals from that sensor *a* and the next four *b*, *c*, *d* and *e* are translated to the counter registers 74 and the corresponding counts from these five elements appear at the output lines 80, 82, 84, 86 and 88 which are applied as one set of inputs to the comparator 90.

The voter identification card in the particular form envisaged for the purposes of the present invention contains a number of columns for receiving punched information. Typically, the first five columns contain the thumb count information corresponding to the five sensors selected for input to the comparator 90 and all columns are contemplated to include eight data positions one of which is for column identification purposes and the remaining seven in each case define the requisite binary number. Prior to the thumb scanning operation, the voter has inserted his identity card into the machine and a suitable light beam circuit is broken in response to the insertion of the card. A predetermined and prelocated stop for the card activates the enable gate 92 which starts translational movement of the card initially to read the first five columns as effected by the eight element card scanner 94 which produces the outputs corresponding to these five columns at the conductor 96 as inputs to the memory 98. The memory device 98 is provided simply to hold the information on the corresponding output lines 100, 102, 104, 106 and 108 which should contain the same information read from the thumb and as produced at the inputs 80, 82, 84, 86 and 88 respectively.

It would be unreasonable to assume that exact correspondence will be obtained in all circumstances as between the inputs at 80–88 and those from the card at 100–108 and so long as a predetermined correspondence is had therebetween, the comparator 90 will produce an output at the conductor 110 effectively to enable the subsequent operation of the machine. It has been determined, in this respect, that although exact correspondence between the inputs at 80–88 and 100–108 almost invariably will not be attained, there nevertheless is a close correspondence therebetween as determined by repeated testing which permits this information positively to verify or identify the voter.

The enabling input at 110 causes the machine to demand the scanner 94 to advance the card and read the remaining columns thereof, which remaining columns contain pertinent voter data which typically may include a user number and a ballot number, the latter of which will cause the machine to draw the proper ballot for that particular voter for subsequent display on the CRT, as hereinafter more particularly described. The two way street 112 is utilized in FIG. 4 to illustrate the demand signal for the additional information after output at the line 110 and to illustrate that the requisite information is fed to the voting machine at the voting system bus interface indicated generally by the reference character 114.

Figure 5:
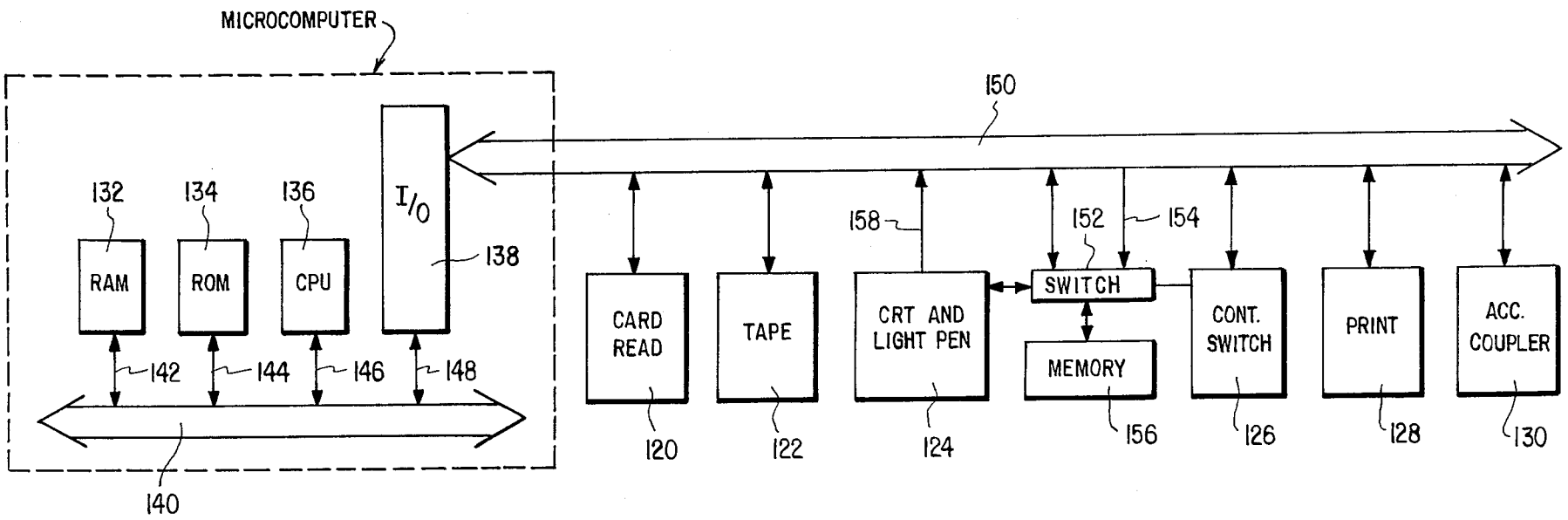
FIG. 5 is a block diagram illustrating the entire voting system.

A block diagram of the entire system is illustrated in FIG. 5 and will be seen to include the microcomputer section encompassed within the dashed line as illustrated and a number of peripheral devices indicated generally by the reference character 120, 122, 124, 126, 128 and 130. The microcomputer includes the read/write random access memory section 132, the read only memory section 134, the central processing unit section 136 and the input/output section 138. The sections 132, 134, 136 and 138 are interconnected by the bus 140 through wo way streets 142, 144, 146 and 148. However, all signals on the bus 140 are not common to all of the sections. For example, address lines on the bus do not go to the input/output section 138.

The input/output section 138 drives the bus 150 to which all of the peripheral devices 120–130 are connected as shown. In the system disclosed herein, the bus 150 contains twenty-four output lines and sixteen input lines in which four of the output lines operate to select a particular device 120–130, these four lines giving a capability of utilizing for selection up to sixteen devices.

When a device is selected, it has control over the sixteen input lines to the microcomputer and these input lines all are normally high, the devices being ORed such that they can drive the input lines low only when selected. Also, data from the microcomputer is fed in parallel to all of the peripheral devices 120–130 but is acted upon only if a particular peripheral device is selected.

The operation of the peripheral device 120 has already been described in conjunction with FIG. 4 and further description is not believed to be necessary. The peripheral device 122 which is labeled "tapes" consists of two cartridge tapes one of which remains with the machine and the other of which may be removed therefrom after the polls are closed for transmitting the data to a substation or to a central data processing unit as hereinafter described. The tapes store all of the ballot formats of the individual precincts on a particular counter and the peripheral device 120, as has been previously described, causes the voter's particular ballot or ballot format to be drawn from one of the tapes in the section 122. The sequence of operation is that when the ballot format is drawn from the tape of the device 122, the proper information is read into the random access memory 132 and the peripheral device 124 is thereafter selected at which time the switch 152 is actuated over the line 54 causing the ballot formation information to be read into the memory device 156 and the switch is then commanded to transfer this data to the CRT for page-by-page display of the ballot format as hereinafter described.

The light pen which the voter uses in association with the CRT to select his candidates or alternatively to provide write-in selections is in the form of a conventional light pen which at its tip is provided with a switch actuated by contact with the face of CRT to energize the light pen and thus easily allow the voter to place the point of the light pen against the selected target area of the CRT corresponding to the candidate which he desires to select.

Specifically, the target areas are located in unique rectilinear coordinate locations and when the light pen activates a corresponding location this information is applied over the line 158 and is read into the random access memory 132. As previously noted, each ballot format may take several "pages" although of course it is entirely possible that the entire ballot format may be displayed on a single page presentation on the CRT. In the case of multiple pages, each page will be provided with two separate unique target locations for increment and decrement to select the preceding page or the succeeding page and, in addition, the last page of the format will contain a uniquely located "verify" target area which when sensed by the light pen, causes a summary of the selections to be displayed on the CRT. Typically, this display will include a summation of all of the offices and questions to be voted upon even though not selected so that the voter may be apprised of having missed a selection.

The tapes in the section 122 are provided not only for the previously described purpose of storing the requisite ballot format but also are utilized to store not only a running total of the votes cast but also the audit trail of each individual vote.

After a voter has made his selections and has verified same, he depresses a separate button on the machine comprising one of the control switches of the section 126. This action causes his selections to be registered. In this respect, it is preferred that when the voter verifies his selections, the data on the tapes 122 is updated and the display on the CRT in response to this verification command is displayed from the tapes rather than from the random access memory 132. In this way, there is absolute certainty that the verification stems from the section of the machine in which the final read out is to be taken. In the event that the voter changes his mind after requesting verification, and wishes to go back and change a selection or selections, the act of doing this will erase the information from the tapes 122 so that the updating of the tapes is permanently effected only after verification and subsequent vote registration by actuation of the appropriate switch of the section 126.

The write-in capability of the present system is extremely unique in that the write-in selection or selections are recorded in computer readable fashion rather than in handwritten fashion as is ordinarily the case. For purposes of a write-in selection, a unique target area is provided for each office which, when actuated, causes the CRT to display an alphabet and the voter simply "spells" out the desired candidate's name by actuating the selected letters with the light pen and the selected letters are simultaneously displayed to spell out the selected candidate's name. As in all cases, of selection in connection with the present machine, the voter can change his mind and erase a write-in selection or any other selection simply by placing the light pen a second time on the appropriate target area and pressing against the light pen to actuate it and thereby automatically erase the previously made selection.

At this point, it might be mentioned that the tapes 122 also contain a separate and distinct region for storage of the voter's user number as previously mentioned. This permits a capability for purging the registration list whenever a voter has not voted in previous elections with sufficient regularity as to qualify him automatically for the next subsequent election.

It is to be noted that the storage of this information is entirely separate from the rest of the information so that the audit trail cannot reflect the identity of a particular voter with a particular vote selection sequence.

The section 126, as previously described, includes the vote registration switch which is to be actuated by the voter when he wishes his vote to be registered. In addition, further control switches may be utilized in this section. For example, a security key switch is utilized for opening and closing the election and, further, a test key is also provided in the device 126. The test key, when actuated, allows any ballot to be called and voted upon and the machine to operate in an entirely normal fashion so as to check proper operation of the machine prior to election. However, the test mode is so effected that when it is terminated, all data is erased and the machine is zeroed.

The peripheral device 128 which is labeled "printer" is simply a tape printer which, upon closing of the machine reads the subtotals on the tapes 122 and provides an automatic print-out thereof. Typically, multiple copies are made of this print-out, one of which may be displayed at the voting place and others of which may be utilized for purposes of internal control, etc.

The last peripheral device 130 illustrated in FIG. 5 is an acoustic coupler which provides the capability for transmitting the data from the tapes 122 over phone lines to a central data processor.

It is to be appreciated that various other capabilities exist for the machine or system as disclosed generally above. For example, entrance to the voting system may be effected in what is more or less a conventional mode of operation, i.e. the voter presents himself to the voting officials, signs his name and is verified from his signature and other information which he gives to the voting official. Such a system would not utilize the voter card verification and voter verifying sections of the system hereinbefore described but it is entirely possible that one may simply utilize a particular voting system in either of these modes of operation, as desired.

If multiple precinct voting is to be achieved on the system, all of the ballots for the various precincts involved are recorded on the magnetic tapes prior to the election day and before the polls are opened, the voting official may run a test program on these ballots which, as previously mentioned, does not enter any permanent records on the magnetic tapes because provision is made to erase all information recorded during the test run when the test run mode is terminated, thus automatically zeroing the machine. In accordance with conventional practise, in opening the machine for voting at the beginning of an election day, the voting official must print-out the tallies on the machine at that time to assure that they are all at zero before the system can be operated by any subsequent voter.

The magnetic tapes can be used to perform either a function (i.e. the removable tape) of being transported to a substation which accepts a number of precincts and subsequently forwards their information to a central data processor or, alternatively, each system may include its own accoustic coupler which transfers, during print-out, the tallies to the central data processor.

In FIGS. 6A, 6B, 7A, 7B, 8A, 8B, 8C, 9–15, 16A and 16B of the drawing, the blocks utilized identify particular operations in accordance with the following:

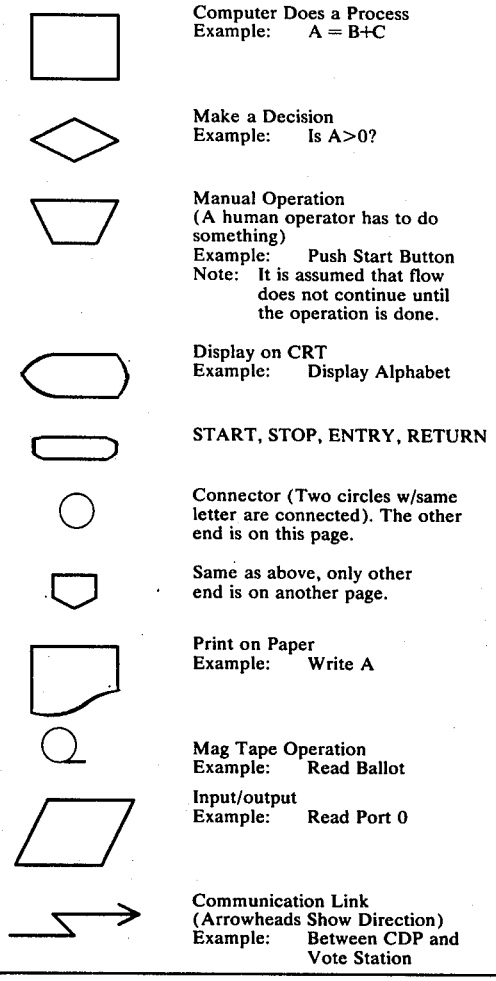

Reference is now had to FIGS. 6A and 6B which should be considered together. Prior to opening the polls, the voting official prepares the machine during which time, prior to opening the election, the logic flow is at the line 200 from the operation 202 to determine whether or not a test program is requested and, if so to run the test program as indicated at 204. After termination of the testing mode, the election official opens the system for voting but before any voter actually operates the system, the official must verify that the vote count is zero as indicated at 206. If the vote count is indeed zero, the first voter may gain entrance to the system by inserting his I.D. card as indicated at 208 followed by the thumb and election data reading at 210 which, if everything is in proper order, is verified at 212. At this point, the block data (ballot format) from the magnetic tapes which were previously read into these tapes is recovered for presentation to the CRT, the ballot called up by the voter's I.D. card being that selected, as indicated at 214. The block 216 indicates the voter selections, verification and exits or vote complete operation and at 218 the recordation of the votes is indicated, whereupon the machine or system is now ready for the next voter.

If no I.D. card is inserted, the line 220 is activated and the status switches or control switches are read as indicated at 220 which may or may not indicate that the system is to be shut down. If not, the logic recycles to the section 208 as indicated. If the shut down of the system is commanded by the voting official, the line 222 is activated which disables further voting as indicated at 224 and the control panel is read as indicated at 226. The control panel includes a number of switches which, as indicated by blocks 228, 230, 232, 234 and 236 effect various print-outs as illustrated. For example, the number 9 switch or switch key if depressed causes a print-out of the tallies corresponding to the vote selections made with respect to the precinct with which the particular machine is associated. The number 8 control switch as indicated at 230 causes a print-out of tallies of those precincts which do not correspond to the particular machine. As indicated at 232, 234, 236, print-out of the voters' user numbers, the write-ins and the total print-out may be effected as desired. As indicated by the block 238, another switch is provided which allows the totals to be transmitted over phone lines through the appropriate acoustic coupler and a further switch is provided as indicated at 240 to cause the CRT to display the totals.

Returning to FIG. 6A, the line 250 is employed to recover the voting process at the point at which power may have been lost during the voting sequence to the extent only that the process starts again at the point at which the voter attempts entrance to the system. If power is resumed after having been lost, as indicated at 252, and the election is finished as indicated at 254 and more particularly the line 256, the print-out controls are possible. This allows the information to be recovered after a machine is shut down at the end of an election day and then is repowered for the purpose of obtaining a further print-out. If the election is not finished as indicated at the line 258 and has been started as indicated at 260, indicating that the power was lost during voting, the line 250 is actuated and the next voter may gain access to the system.

FIGS. 7A and 7B are to be considered together as one page. These two FIGURES illustrate in greater detail the logic associated with a portion of FIGS. 6A and 6B and illustrate, for example, that a power up routine is provided as indicated at 261 and that the read tape operation of FIG. 6A at 262 in both FIGS. 6A and 7A is in effect a machine status reading. One of the control switches is a security switch operated by a key in possession of the appropriate voting official, such key being termed conventionally the "2 key". If this "2 key" switch is not closed, as indicated at 270, it is possible to depress the number 0 control switch as indicated at 272 to run the test program as described previously. Once the "2 key" switch is closed, the system can be prepared for voting by depressing the number 1 switch as indicated at 274 which causes the total print-out subroutine at 276 to be effected and the tapes are caused to record the fact that the election is in progress as indicated at 278 which is the status read at 262 previously described. The remaining blocks of FIGS. 7A and 7B are believed to be self-evident with the possible exception of the block 280 which is utilized to prevent the system from being closed before at least one voter has voted. This is an additional security interlock of conventional nature.

FIGS. 8A, 8B and 8C continue from FIG. 7B and, among other things, indicate that a straight party ticket vote may be effected as indicated at the block 300 which correspondingly votes all candidates of the selected party as indicated at 302. At this point, the first page of the ballot is read and is displayed as indicated respectively at 310 and 312, it being appreciated that normally each ballot will occupy several pages on the face of the CRT. At this point, the light pen is read, detail of which are shown in FIG. 10, this operation being indicated at 314. Initially, no selection will be made and the logic functions at 316, 318 and 320 will be processed normally to recycle and read the light pen again. Once the first page has been displayed as determined at 321, the straight ticket may be voted as permitted by the block 300 but the process of making a selection as by depressing the light pen against a target area on the CRT resets the no selection flip flop so that at 322, the logic is recycled on the line 324 back to reading the light pen again and of course the first that takes place is that the logic functions 316, 318 and 320 are again read. Thus, after all possible selections have been made on a page, the logic 316 responds and after a ten second delay as indicated at 318 and so long as the ballot is not being displayed as of its last page, the tape is read at 330 and the next page is displayed at 322. If at any time instead of making a selection with the light pen on a target area adjacent a programmed candidate's name, the voter calls for a write-in selection, a specific target area being provided on each page for such write-in selection adjacent each office in question, the logic at 334 responds and the write-in subroutine as shown in FIG. 11 is effected as illustrated at 336.

In the event that the voter does not wish to vote all selections possible, he may request the next page to be displayed as indicated at 338. On the last page of the ballot a target area is displayed for verification of the voter's selection as indicated at 342 at which time all selections are recorded on tape as indicated at 344 and they are displayed on the CRT as indicated at 346. If the voter now wishes to change his mind, he can depress the continue control button and make appropriate selection changes ultimately to request verification again whereupon, if he is satisfied with all selections, he depresses the exit button and so long as the continue button is not also depressed, the tape will be updated as to the totals as indicated at 350, including the write-in selections and a vote complete display is maintained for five seconds as indicated at 352. It will be noted that if the voter wishes to continue in his selections, the audit trail is erased as indicated at 354 same having been recorded previously as indicated at 344. It will be noted that the no selection flip flop performs the function of preventing the computer from reading the same data many times.

In FIG. 8A, if no control request is made at 400, the logic proceeds to FIG. 8C and under normal circumstances since the light pen must be activated in order to reach this stage of the logic, the logic question at 402 is answered in the affirmative and the logic proceeds to the block 404. If the candidate has not already been selected, it is checked at 406 for validity of the selection and if valid, the choice is recorded in the RAM and the candidate is displayed by name. If, however, the voter has attempted to overvote, the validity of the selection is negative and the voter is apprised of his attempt to overvote by a display on the CRT as indicated at 408.

Each target area of the CRT normally is a square and when the voter presses the light pen against this target area and depresses same sufficiently to activate the light pen, this square should change to an X which creates the "yes" logic as for example at the line 410 in FIG. 8C. However, if this same candidate has previously been selected so that the logic is "yes" the second actuation of the light pen against the already selected target area causes the selection to be erased as indicated at 412. This function is utilized throughout the system. In other words, an erasure of a selection is effected simply by depressing the light pen against the target area previously selected.

With the exception of FIG. 10, FIGS. 11–15, 16A and 16B of the drawing are believed to be self-explanatory. In FIG. 10, the logic at 420 simply is the condition of the light pen switch. If the light pen is not actuated, a zero is stored as indicated at 422 and the logic recycled. Once a selection is made, the X and Y coordinates of the pen are read at 424 and this is stored in the memory an an index i. The index will correspond to the candidate selected and may be one of M candidates, for example. Each candidate is assigned X and Y values as indicated at 426 and the block 428 determines the absolute value P of the light pen location with respect to a particular target area and so long as this value of P is not greater than some predetermined value as indicated at 430, the index will be stored as indicated at 432. In other words, when P is a radius or value of error by which the light pen is not exactly on the target area. If the radius value P is too large, the index i is checked at 434 to determine whether or not the index is within the possible selection of candidates. If it is not, the voter simply has not targeted a candidate selection and this activates the line 436 and recycles the logic. On the other hand, if the voter has attempted to choose a candidate but the value of P is too large, this simply indicates that he has made no valid selection because of the lack of proper placement of the light pen and another zero is stored at 438 and the logic is returned for a more accurate placement of the light pen.

Referring at this time more particularly to FIG. 17, a block diagram is shown of a modification of a system generally set forth as shown in FIG. 5, previously described. FIG. 17 illustrates in a very diagrammatic manner the interrelationship among the component parts of the system whereas FIG. **17*a*–17*k*** illustrate the detailed interconnections among the units.

In FIG. 17, reference character 300 indicates in general the central processing unit which is shown diagrammatically connected at 302 to the combined memory and control bus 304. The random access memory unit 306 and the read only memory unit 308 are likewise connected at 310 and 312 respectively to the memory section of the bus 304, whereas the input/output section 314 is connected as indicated at 316 to the control section of the bus 304. Extending from the input/output section 314 is the peripheral bus 308 to which a plurality of peripheral units are connected. The peripheral units 320 and 322 respectively perform the thumb scanning function and the voter card reading function although both of these units are photoelectric scanners which may in fact be identically constructed although performing scanning functions on different entities. Specifically, the thumb scanner 320 scans the contours of a voter's thumb whereas the card reader 322 scans the data which may be holes or marks on voter identification cards.

The peripheral unit 324 is a printer which performs the function of providing a zero print-out before the polls are open in order to assure that the tape cassette is zeroed and that there are no counts on the machine. It also performs the function of printing out the vote total at the close of the polls and also prints out write-in votes at the end of the election process. The printer 324 is interfaced with the peripheral bus 318 through the intermediary of a printer interface circuit indicated generally by the reference character 326.

The peripheral unit 328 is a tape unit which receives a tape cassette which is placed into the machine under the control of an election official and which contains all the voting requirements and all the ballot information such as names of candidates, offices, party affiliation and questions or other information as needed. The unit 328 is interfaced to the peripheral bus 318 by means of the tape interface circuit indicated generally by the reference character 330.

An additional tape unit 332 provides a permanent record and security function for the machine. It is interfaced to the bus 318 through the circuit 334 similar to the fashion in which the unit 328 is interfaced through the circuitry 330. The two tape units 328 and 332 both are under the control of the election official and prior to opening of the polls, two tape cassettes are inserted by the election official into the units 328 and 332. These two tape cassettes contain identical programs one of which is utilized to affect the variables applying to a particular election whereas the other program is utilized to check the accuracy of the program effected by the other. For example, the program on the tape of the unit 328 is read by the machine to program the RAM 306 according to the variables which apply to that particular election and then the program so stored is compared with the program on the other tape 332 as a security measure to check the accuracy of the input information. Among the information read into the processor and stored temporarily in the RAM 306 are the actual ballots to be displayed on the CRT 336 presented to the voter, if being understood that ordinarily the ballot display will be a page-by-page display. During the voting process, according to the credentials presented by the voter and the selection of ballot effected thereby, voter selections upon the displayed ballot temporarily are stored in the RAM 306 until the voter requests verification of his selections, at which time the selections are transferred from the RAM 306 to both of the tape units 328 and 332. In other words, at the end of an election, the information stored on the two tape units 328 and 332 is identical and includes the original program, all of the voter selections inclusive of write-ins and a registration listing of voters who have utilized the machine during the voting day. That is to say, when entrance is given a voter to the machine, the machine records a unique code which identifies that particular voter. However, the recorded information concerning the identification of each voter as compared with the recorded information concerning voter selections effected by the same voter are scrambled so that the tapes 328 and 332 cannot be utilized to identify a particular voter with a particular ballot selection or voting position.

A further peripheral unit is the CRT 336 as previously mentioned and the light pen 338 utilized in association with the CRT display. These units are interfaced with the peripheral bus 318 through the intermediary of the light pen interface circuitry 340. This portion of the circuitry functions in response to voter card information input to display the ballot on which he is entitled to vote on the screen of the CRT 336. The initial ballot is read through the tape unit 328 to the RAM 306 and then through the memory switching circuitry 342 to the memory 344. At this point, the CRT logic 346 cycles through the memory contained at 344 and displays same on the screen. The voter, by physical placement of the light pen 338 on the screen of the CRT 33 generates X and Y coordinates of his vote selection which progresses through the CRT logic 346 and is interfaced to the bus 318 by the light pen interface 340 to transfer the information to the RAM 306. The central processor 300 acts upon the light pen input to provide a variety of functions including such as requesting of the next page, requesting of previous page, requesting a write-in selection, selection of candidates and questions, verification and the exiting functions. When a write-in is requested by selection of coordinates on a ballot page corresponding to a write-in selection for a particular office, an alphabet is displayed on the CRT and the voter by selection of the letters displayed can spell out the write-in selection for that particular office. Upon completion of the write-in vote, the write-in selection is stored on the tape units and the ballot is returned for display on the CRT 336. As previously noted, when verification is requested by a voter, the vote selections are transferred from the RAM 306 to the tape unit 328 and the tape unit 332.

Upon a voter request for verification, the information stored on the tapes is displayed on the CRT 336 so that the voter can be assured that the actual selections made by him have been in fact processed and stored permanently on the tape units 328 and 332. If the voter is satisfied with the verification, he may then exit from the machine at which time his selections remain recorded on the tapes or, if he does not, the selection corresponding to that voter are erased from the magnetic tapes. The voter may then continue his selection process making such changes or additions as he deems desirable, ultimately to again request verification and subsequent exit.

The two photoelectric scanning devices 320 and 322 are utilized to allow a voter to gain access to the machine. As has been previously described, the scanning device 320 identifies the voter according to contours of his thumb and the card reader 322 identifies the voter according to information written into a voter identification card. The voter identification card contains the previously mentioned voter registration code, the voter qualifications which controls the ballot which ultimately will be displayed to him, and the thumb information which must be compared to the information read by the scanning device 320. This provides positive identification of the voter and precludes fraudulent use of the voter's identification card.

The switch interface circuit 350 provides an interface between the bus 318 and the peripheral units 352, 354, 456 and 358. The peripheral unit 352 is a unit utilized to open the election and is controlled by the election official's two key and of course this two key as is conventional also achieves the closing of the election. The entrance unit 354 consists simply of a switch under control of a precinct worker which when depressed gives the voter entrance to the machine and activates the card reader 322 and the thumb scanner 320. The test mode unit 356 is a switch which permits a voting official to make test votes on the machine prior to opening of the election so as to check the program read into the machine, the test format being such as to test at least in major portion of not all of the ballot formats to make certain that valid voter selection and no others are permitted thereby. When the test mode is terminated, all of the voting official's vote selections for the test are erased and the machine should then be capable of providing a zero print-out. The keyboard 358 includes a switch to effect such zero print-out so as to assure that when the election is opened, there will be no accululated selections on the tapes. The keyboard 358 also performs a final print-out function upon demand a the close of the elections and may also include other switches such as a command-to-transmit switch which would cause the totals accumulated on the tape 328 and 332 to be read out to a further peripheral unit (not shown) for transmission to some remote facility such as a central data processing center. Such information could for example be transmitted over existing telephone lines.

The random number generator 360 operates in response to the aforesaid request for verification made by the voter to generate a random number which controls the position on the tapes 328 and 322 at which the voter's selections are recorded, same being distinctly differently from the sequential entry of the voter registration number previously described. Thus, when the voter verifies his selections, they are recorded on the tapes in a unique and unpredictable fashion and are retained there if the voter subsequently requests exit from the machine. As previously noted, if the voter does not exit from the machine, the recorded material is erased and the vote selection process may be repeated by the voter until he is satisfied with his selections.

The bus extender 362 serves the function of permitting a supplementary peripheral bus connected to peripheral units of a second machine to be connected to the common processing section consisting of the elements 300, 306, 308, 314. For this second machine, all of the peripheral units shown in FIG. 17 may not be necessary. For example, common card readers 322 and thumb scanner 320 may be utilized for both voting stations or machines and the printer 324, tape units 328 and 332 as well as the units 352, 354, 356 and the unit 358 and the unit 360 may also be shared as between the two machines. In other words, the second machine need only consist of the peripheral units 336 and 338, the other units being common to the two machines.

Figure 17A:
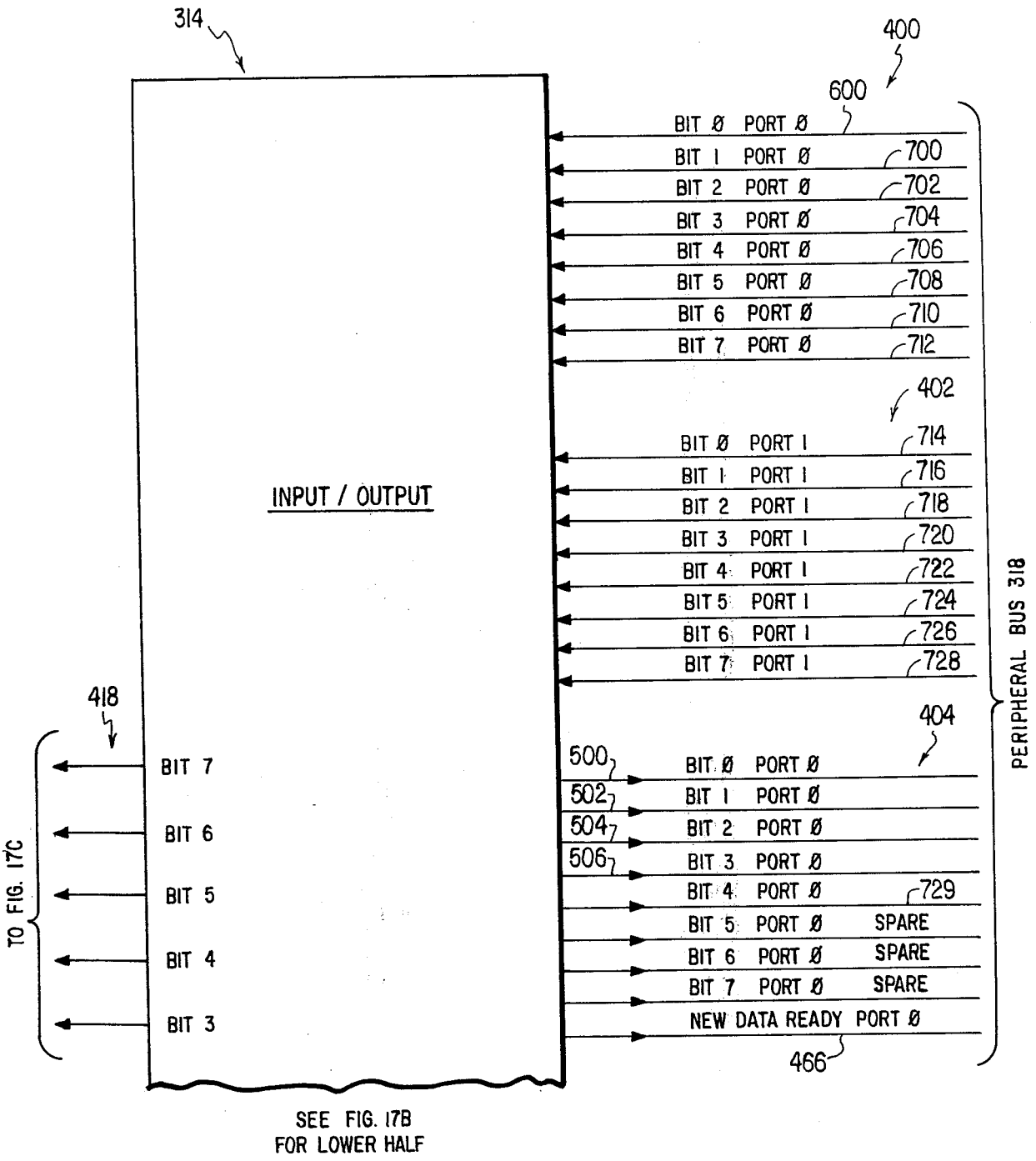
Figure 17B:
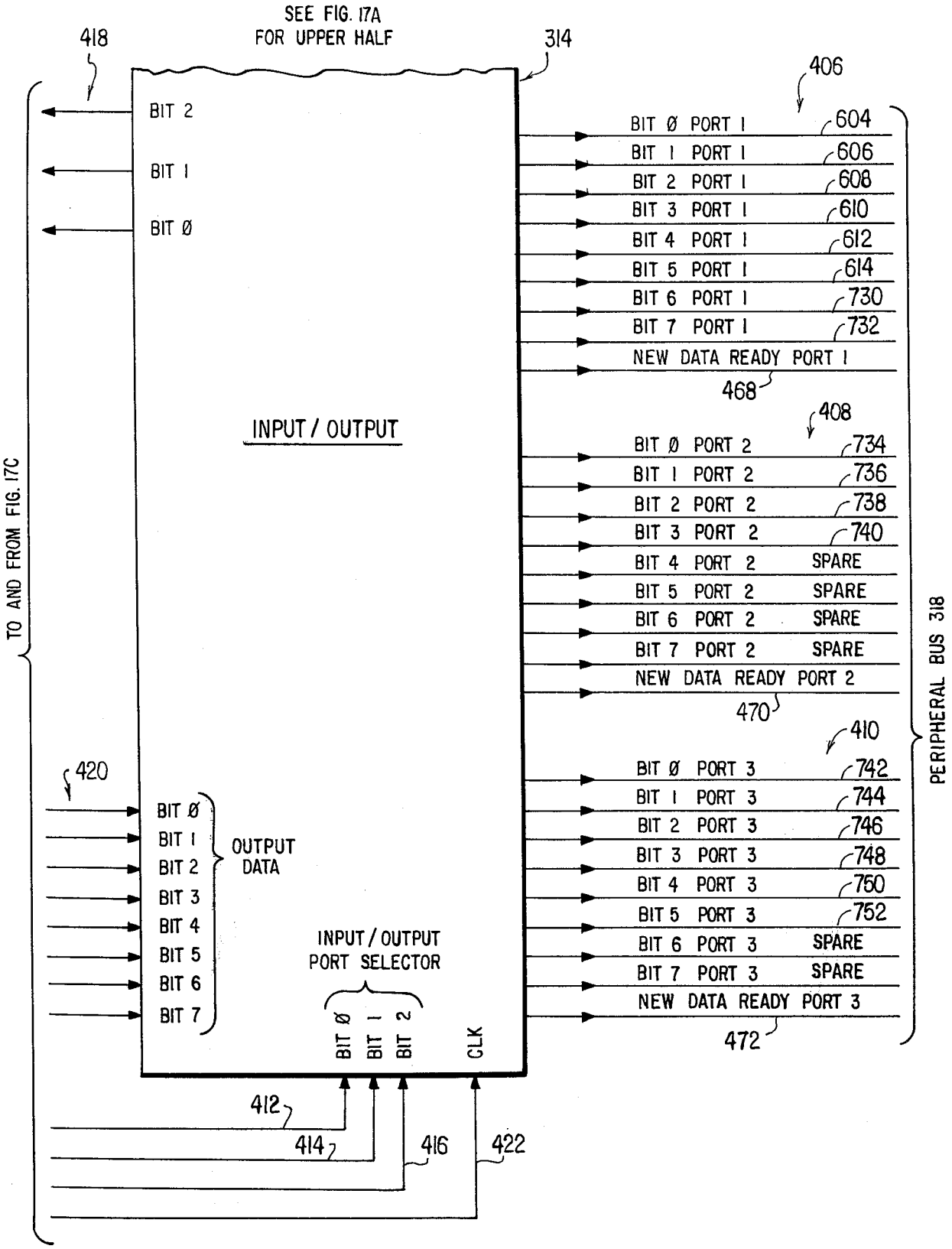

The input-output section 314 illustrated in FIG. 17 is shown in greater detail in FIGS. 17 and 17*b* and in still greater particularity in FIGS. 21*a*–21*c*. Referring at this time more particularly to FIGS. 17*a* and 17*b*, it will be seen that the peripheral bus 318 consists of sixteen input lines, the group of eight input lines indicated generally by the reference character 400 and the group of eight input lines indicated generally by the reference character 402 as well as 36 output lines divided into four groups of nine as indicated generally by the reference characters 404, 406, 408 and 410. The port selector lines 412, 414 and 416 provide a binary coded input to the circuitry 314 providing capability for selection of up to eight ports, the details of which will be pointed out hereinafter in connection with FIGS. 21*a*–21*c*. When input data is selected at one of the port groups 400 or 402, same is transmitted over the lines indicated generally by the reference character 418 which form part of the control section of the computer bus 304. Data coming into the input-output section 314 over the lines 420 is outputed over one of the groups of lines 404, 406, 408 and 410, again controlled by the inputs at 412, 414 and 416 as will be specified in detail hereinafter and the transfer of data is issued by the out clock signals CLK at the line 422.

Referring now more particularly to FIGS. 21–21*c* which show details of the input/output section and in particular at this time to FIG. 21*b*, it will be noted that the three lines 412, 414 and 416 are connected to a decoder 424 to produce a port select output at one of the lines 426, 428, 430 and 432, in accord with the binary code input at the lines 412, 414, 416. When any one particular line 426–432 is selected, the signal thereon goes low to provide a corresponding low input to one of the NOR gates 434, 436, 438 and 440 as shown in FIG. 21*c*. The other input to the gates 434–440 is the CLK signal at the line 464 obtained from the CLK signal at the line 422 and inverted at 442 as shown in FIG. 21*b* correspondingly to provide a high output signal pulse from one on the gates 434–400 at one of the lines 444, 446, 448 or 450. This output signal selects one of the latches 452, 454, 456 or 458 to which the data over the lines 420 is applied through the buffers 451. Selection of a particular latch 452–458 determines at which of the groups of lines 404, 406, 408 or 410 the outputs will appear corresponding to the data at lines 420. The ninth output of each of the groups of lines 404, 406, 408 or 410 is for the purpose of indicating that new data is ready to be applied to a peripheral unit and is provided by a delayed pulse in which the delay is sufficient to assure that the outputs of the selected latch have stabilized. The circuitry for performing this function is shown in FIG. 21*c*. As noted before, the signal effecting port selection at one of the lines 426–432 goes low for selection and it is inverted by one of the inverters of the group 460 to provide a positive pulse input to the flip-flop 462. The flip-flop 462 is clocked by the trailing edge of the CLK signal input at 464 to provide the delayed pulse output NDR at one of the lines 466, 468, 470 and 472, corresponding to that one of the port selection lines 461, 463, 465 or 467 which is inputted. The outputs at the lines 466–472 are positive pulses and when one of them occurs to the inputs to the NOR gate 474, the output thereof at 476 is delayed by a series of inverters 478 to provide a reset pulse at the line 480 to the flip-flop 462.

Referring back to FIG. 21*a*, two multiplexers 484 and 486 are provided for the two groups of input lines 400 and 402. The upper four bits of the port 0 on lines 400' and the upper four bits of the port 1 on lines 402' are applied to the multiplexer 484 and the lower four bits of these two ports on lines 400'' and 402'' are applied to the multiplexer 486. The two elements 484 and 486 are two-line-to-one-line data selectors/multiplexers. These multiplexers are switched by means of the output of the line 426 from the decoder 424 either to the condition in which the inputs at lines 400' and 400'' appear at the outputs 418 or to the condition in which the inputs at lines 401' and 402'' appears at the outputs 418. That is to say, when the signal at 426 goes low corresponding to port 0 selection it switches the inputs 400' and 400'' to the outputs 418 and when it goes high, it switches the inputs 402′ and 402″ to the outputs 418.

Referring back to FIG. 17*a*, the first four lines 500, 502, 504 and 506 of the group 404 effect selection of a particular peripheral device. All of the lines 400 and 402 are wire ORed to all of the peripheral devices and the signals thereon normally are high. However, only that peripheral device selected by the four lines 500–506 can cause signals on the groups 400–402 to go low. In this fashion, data from a large number of devices can be conducted over a relatively few lines 400, 402. Correspondingly, when data output is present on any of the groups 404, 406, 408 or 410, and a new data ready signal pulse NDR signifies that new data is available, only that peripheral device selected by the lines 500–506 will respond. Similarly, in this fashion, a limited number of output lines can output data to a large number of peripheral devices.

Figure 17C:
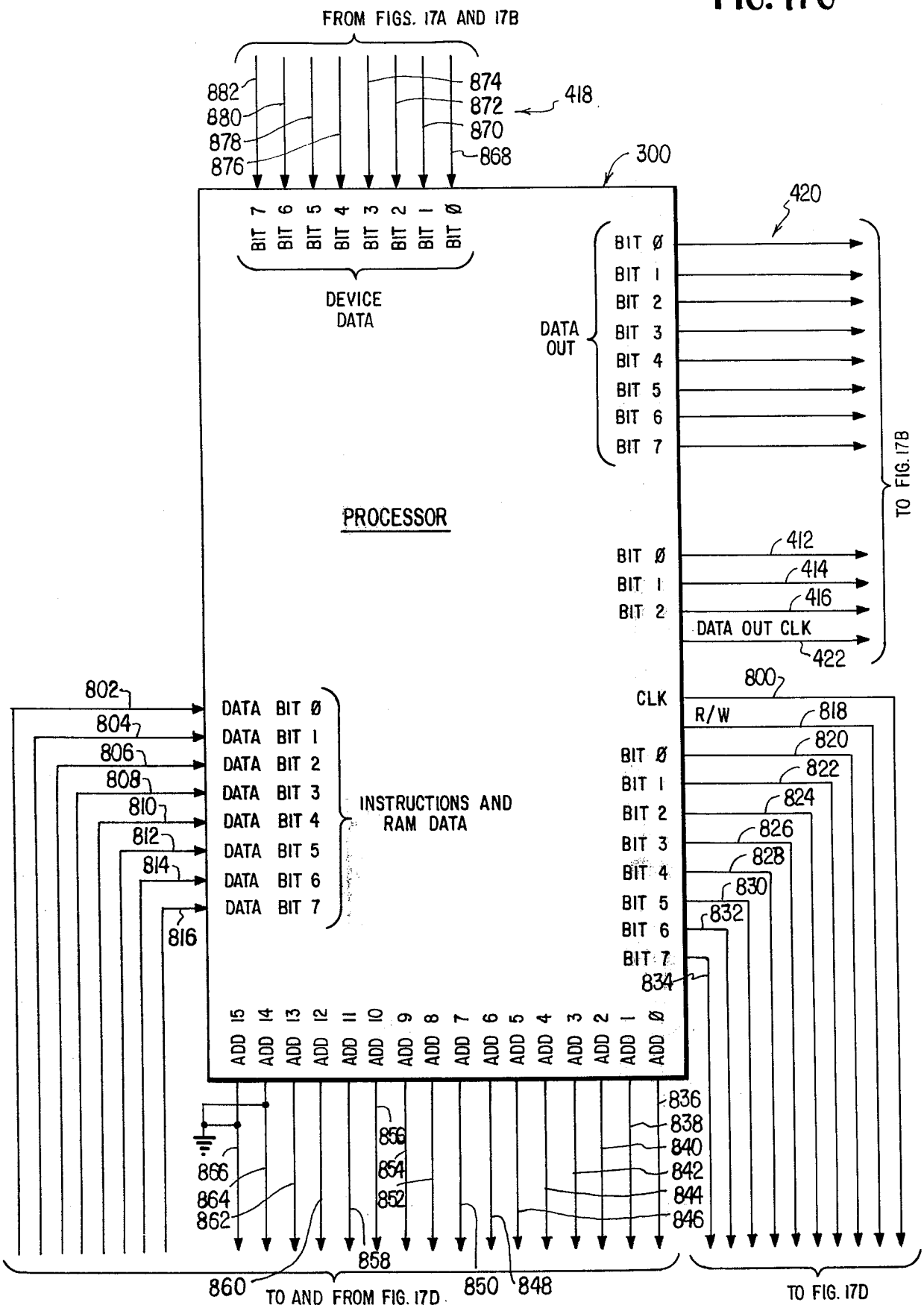
Figure 17D:
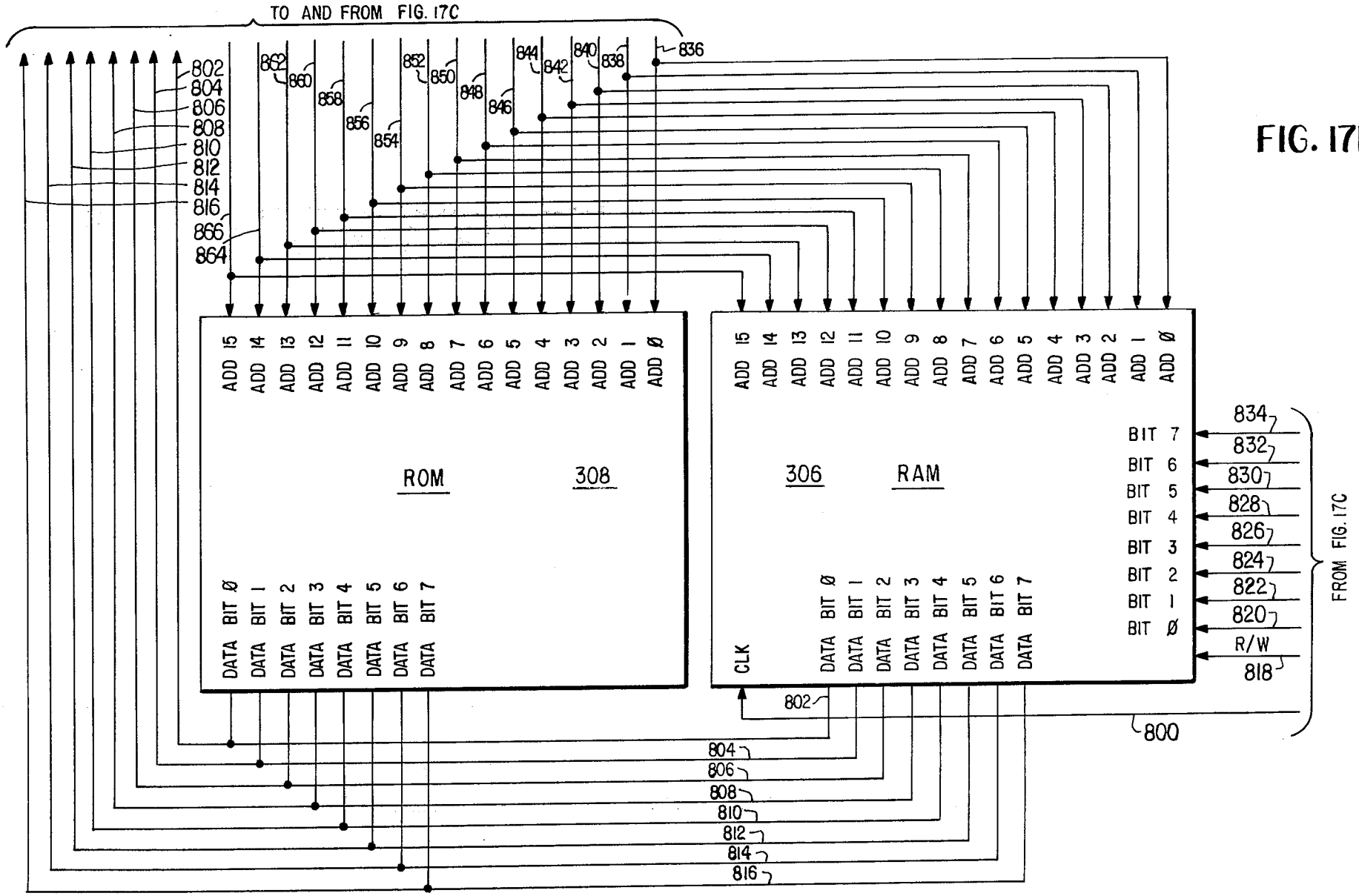
Figure 17E:
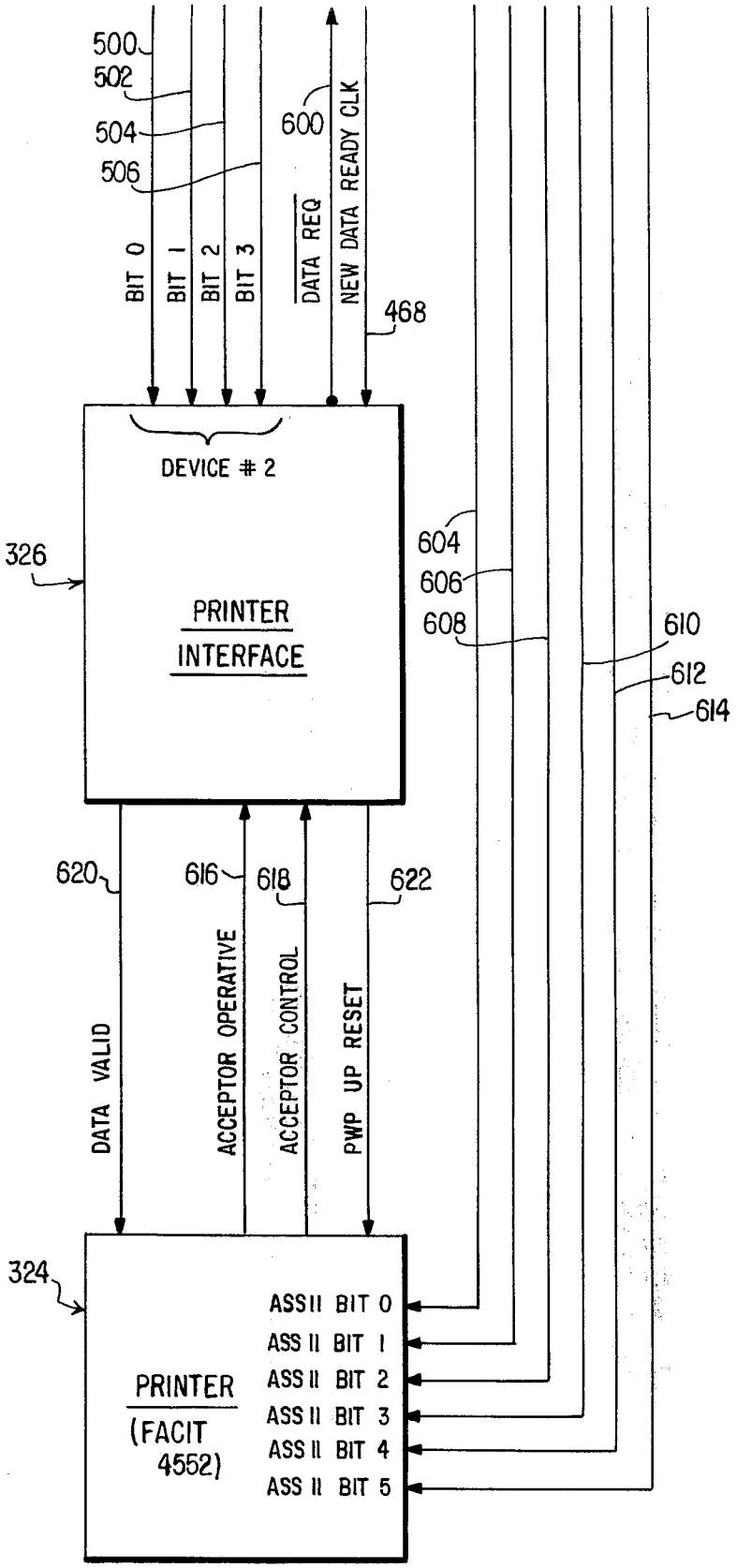
Figure 17F:
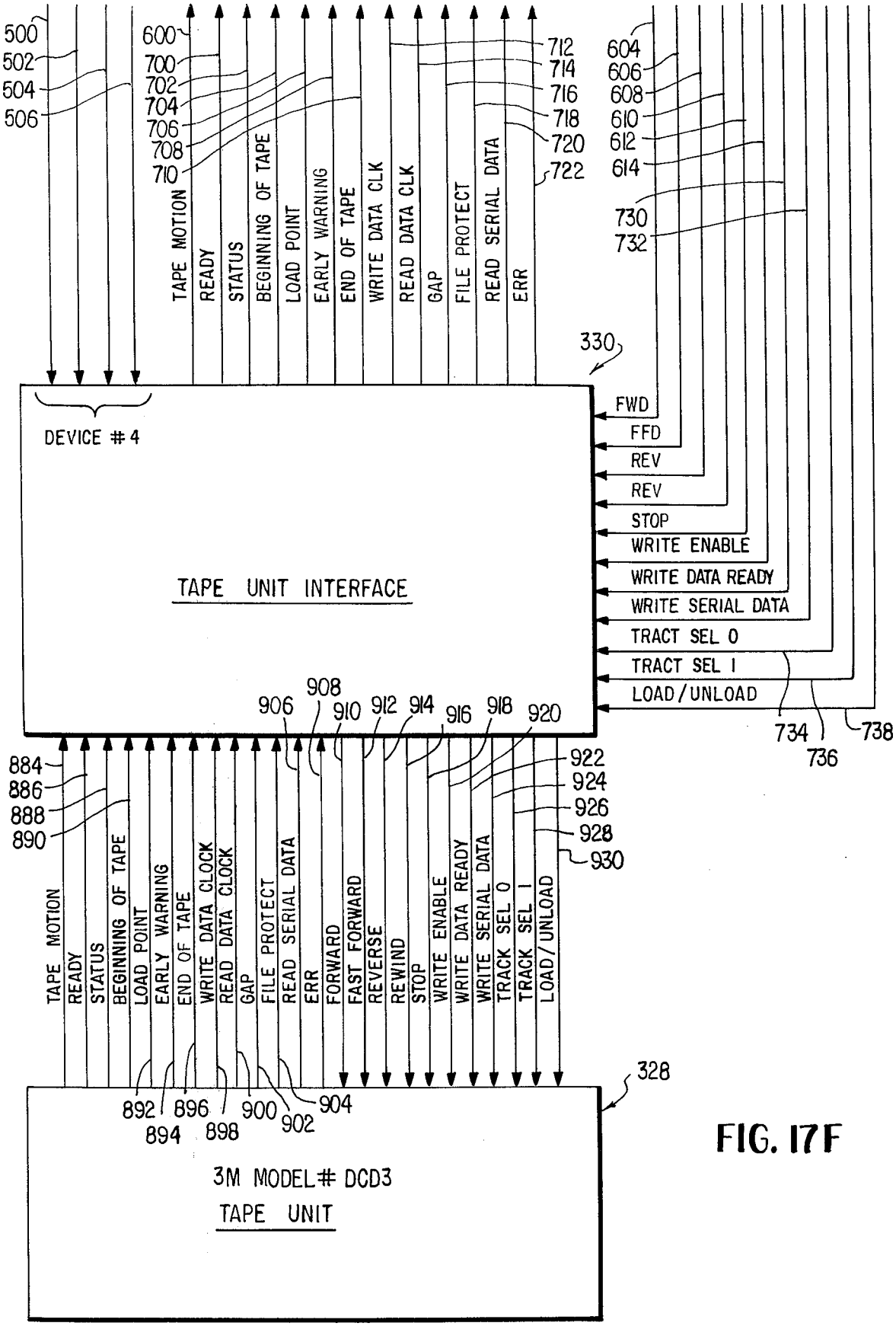

With reference to FIG. 17*e*, the printer interface circuit 326 receives inputs from the peripheral device select lines 500–506 and if this particular device is selected, it outputs to the computer through the bus 318 a request for data signal $\overline{\text{DATA REQ}}$ over the line 600 which, in the particular embodiment shown is that line corresponding to bit 0, port 0 to the input/output section 314, see particularly FIG. 17*a*. In response, the computer outputs through the section 314 as shown in FIG. 17*b*, the new data ready signal NDR at the line 468 and data over the lines 604, 606, 608, 610, 612 and 614 which are bits 0–5 of port 1 in FIG. 17*b*. The printer 324 correspondingly removes the data request signal $\overline{\text{DATA REQ}}$ at the line 600 under control of the lines 616 and 618 as decoded into the line 600 and the printer prints the complete character corresponding to the inputs at the lines 604–614 whereafter a new data request signal $\overline{\text{DATA REQ}}$ is generated at 600 and the process is repeated. The DATA VALID signal appearing at the 620 tells the printer that the character at the lines 604–614 is a character to be printed. The purpose of the power up reset line 622 will be described hereinafter.

Referring now more particularly to FIGS. 22*a* and 22*b* wherein details of the printer interface circuit 326 are shown, it will be seen that when the port select signals at the lines 500–506 output the binary signal 0100, all inputs to the NAND gate 624 will be high because of the decoding provided by the inverters 623, 625 and 627. The gate 624 provides a low pulse output at the line 626 when the printer peripheral device is selected. As shown in FIG. 22*b*, this signal indicating printer selection is inverted at 628. When the delayed new data ready signal NDR is present at the line 468 and the output at the line 630 is high, the NAND gate 632 provides a low output which is inverted at 634 providing a clock pulse to the binary device 636 correspondingly to produce a high output at its line 620 which constitutes the DATA VALID signal previously described in conjunction with FIG. 17*e*. The signal at the line 616 is high so long as the machine is powered and when the printer accepts the data, the signal at the line 618 goes low to perform two functions, first to reset the binary device 636 and the second is to remove the data request signal $\overline{\text{DATA REQ}}$. Upon completion of the printing, the signal at 618 will go high again so that the next data can be accepted. When the signal at 618 goes low, the output of the gate 638 goes high to provide the reset at the line 640 and this signal is also inverted at 642 to provide momentarily a low input at the line 644. As illustrated in FIG. 22*a*, the two signals at 630 and 644 are applied to the NAND gate 646 such that when the signal at 630 is high indicating that that particular device is selected, and the signal at 644 goes low indicating that the data to be printed has been accepted but not as yet printed, the signal at the lines 600 goes high momentarily removing the data request signal $\overline{\text{DATA REQ}}$. FIG. 22*a* also illustrates the power up reset signal which resets all of the internal flip-flops and latches of the printer when power is initially applied to the machine. When power first goes up at the terminal 648 the capacitor 650 charges momentarily providing a high input signal at the line 652 correspondingly to provide a momentary high pulse at the output 622 which constitutes the power up reset signal previously described in conjunction with FIG. 17*e*.

Referring now more particularly at this time to FIGS. 17*f* and 23*a*–23*c*, details of the tape unit interfaces 330 and 334 and of the tape units 328 and 332 will be seen. At the outset, it is to be understood that these two assemblies or peripheral systems are identical except that each has a different device number. For example, the unit 330 is specified as device 4 and details thereof will be now described.

The tape units are 3M model DCD3 units which are pulse operated units and the function of the tape unit interface simply is to receive inputs from the tape unit 328 over one of the lines 884, 886, 888, 890, 892, 894, 896, 898, 900, 902, 904, 906 or 908 when the device is selected according to the input at the lines 500–506 and to relay this information over the relevant lines 600, 700, 702, 704, 706, 708, 710, 712, 714, 716, 718, 720 and 722 to the input/output section 314 for processing whereby the data inputs at the line 604, 606, 608, 610, 612, 614, 730, 732, 734, 736 and 738 may be acted upon by the tape unit interface 330 correspondingly to provide the instruction or controls to the tape unit 328 over the lines 910, 912, 914, 916, 918, 920, 922, 924, 926, 928, 930.

More specifically as is shown in FIG. 23*a*, the inputs from the tape unit at the lines 884–908 provide corresponding high outputs from the gates 932 when a device select signal appears at the line 934 enabling such gates. Since a high bus is used, a set of inverters 936 is employed to provide the signals in a proper form. As discussed previously, in conjunction with device selection, as is shown in FIG. 23*c*, the four lines 500–506 are applied to a decoder chip 938 through the buffers 937. The characteristics of the decoder chip 938 are such that when the proper binary code 0010 corresponding to device number 4 (the unit 328) is present at the lines 500–506 and consequently at the inputs to the chip 938, its output 940 goes high correspondingly to provide a low signal at the line 934 which is applied as the SELECT signal to the gates 932 as previously described in conjunction with FIG. 23A. The data inputs to the tape unit interface from the input/output section 314 are shown at the left-hand side of the FIG. 23B and some of the corresponding outputs to the tape unit are shown at the right-hand side of this Figure. Positive pulse inputs from the input/output section 314 at the lines 604–614 and 730–738 effect inputs to a set of NAND gates indicated generally by the reference character 954 correspondingly to provide the proper outputs at the lines 910–930 to the tape unit. The line 942 provides an enabling high signal to all of these gates 954 when the tape unit device is selected, the signal emanating from the circuitry shown in FIG. 23*c* wherein it will be seen that the combination of the inverters 956 amd 958 provides the complement of the signal at the line 934 to effect the proper logic level for application to the gates 954. At the same time, it will be appreciated that the signal at the line 960 goes low in response to tape unit selection to remove the reset from the flip-flop device 962, the flip-flop 962 being provided to produce the WRITE SERIAL DATA signal to the tape unit 328 at the line 924 previously described. The flip-flop 962 is clocked at 964 which emanates from the WRITE DATA CLOCK signal appearing at the line 898 from the tape unit 328, see FIG. 23*a*, suitably inverted at 966. The data at the input line 946 to the flip-flop 962 appears at the trailing edge of the clock signal provided at 964 to produce the output to the tape unit at the WRITE SERIAL DATA line 924. At the same time, the flip-flop 970 is also clocked at a signal at 964. This flip-flop is set in response to output from the NAND gate 972 which has its inputs from the line 948 and 950 which, as can be seen from FIG. 23*d*, emanate from inputs at the line 614 and 730. The first clock through after response at gate 972 outputs the data at the line 952 through the inverter 974 to provide the other input to the NAND gate 976 to produce the WRITE DATA READY signal at the line 922. This flip-flop 970 is reset by input from the line 944 which is connected to the WRITE ENABLE input line 614 from the tape unit and when this signal is not present, reset is effected.

Figure 17G:
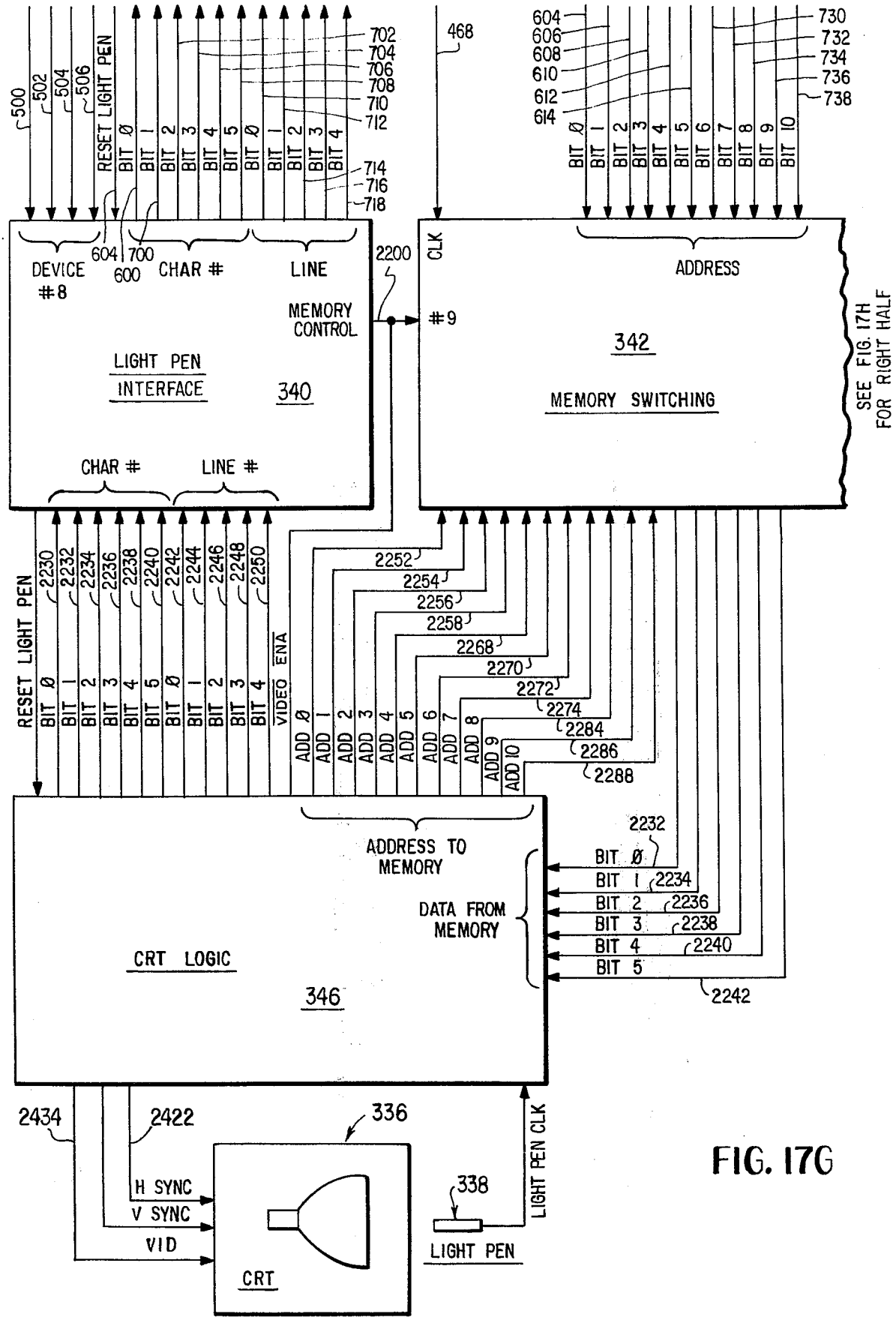
Figure 17H:
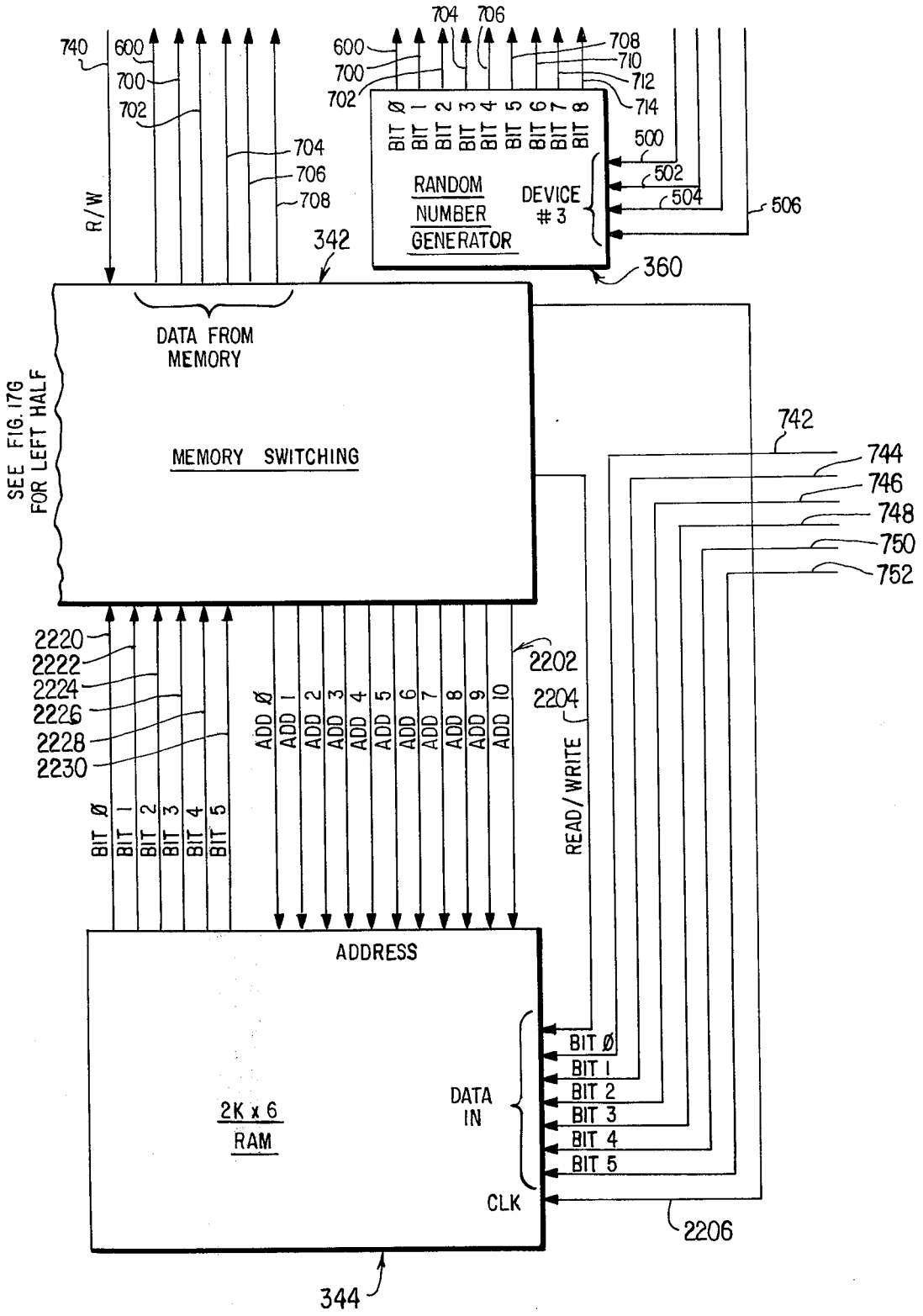
Figure 17I:
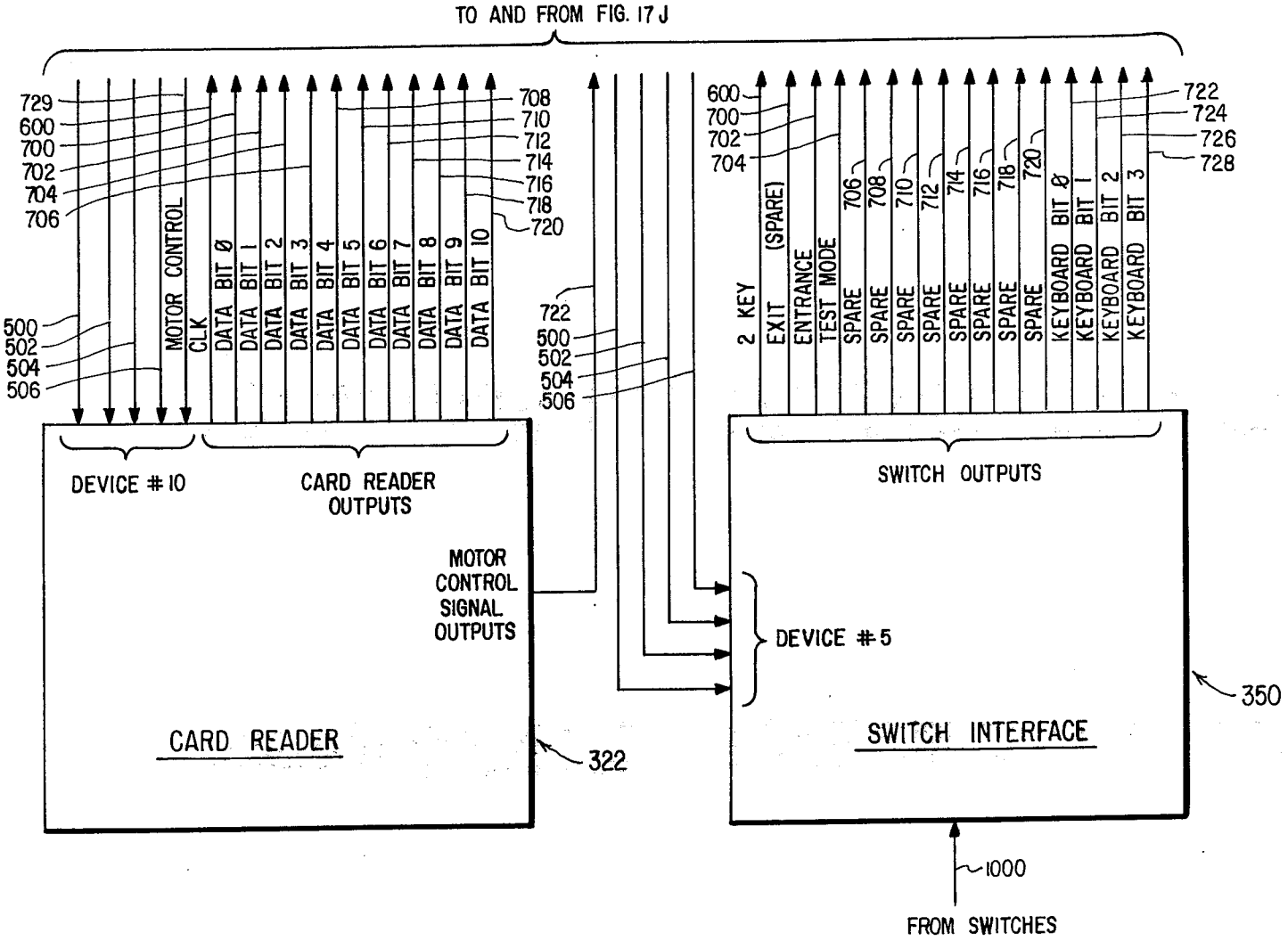
Figure 17J:
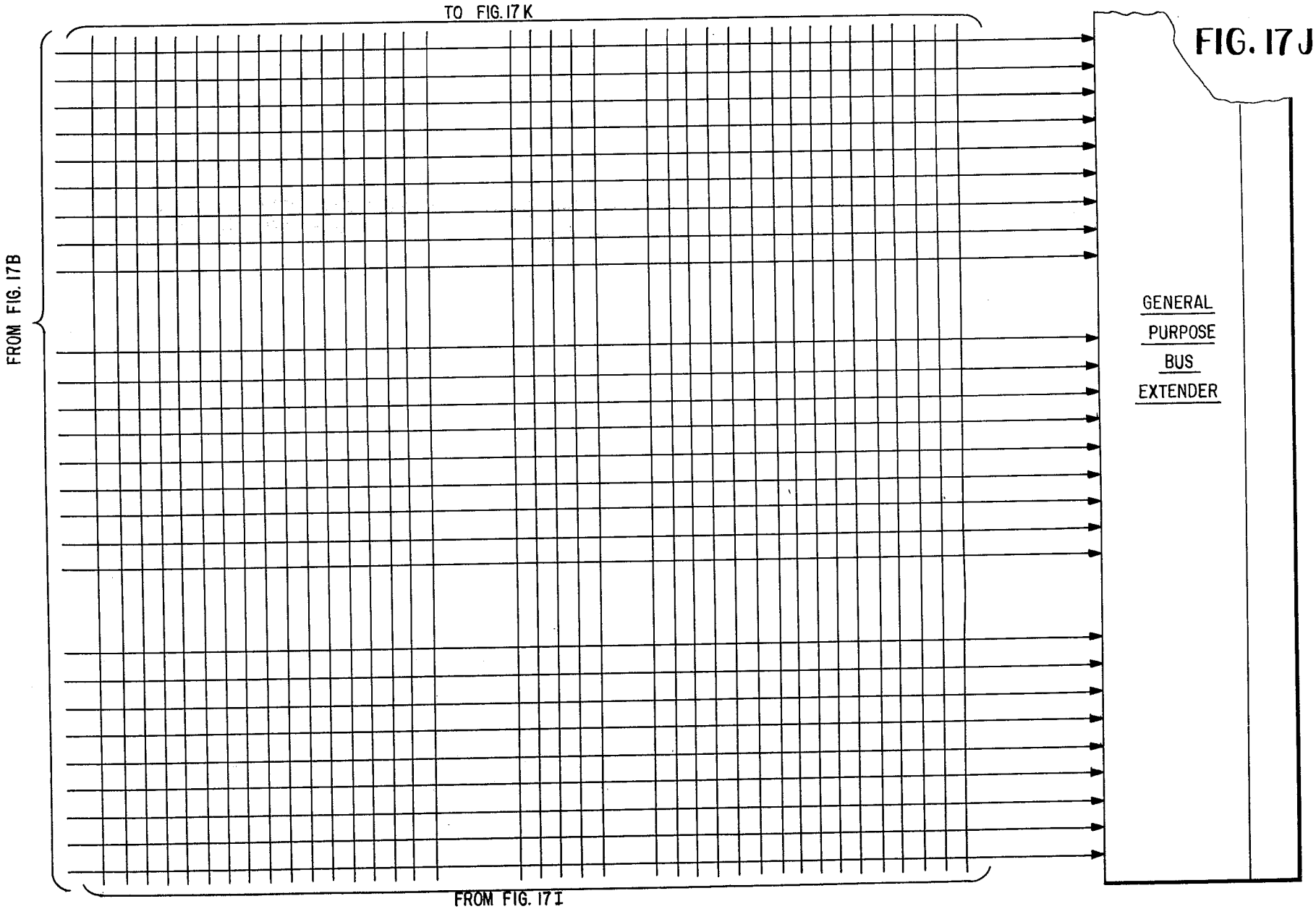
Figure 17K:
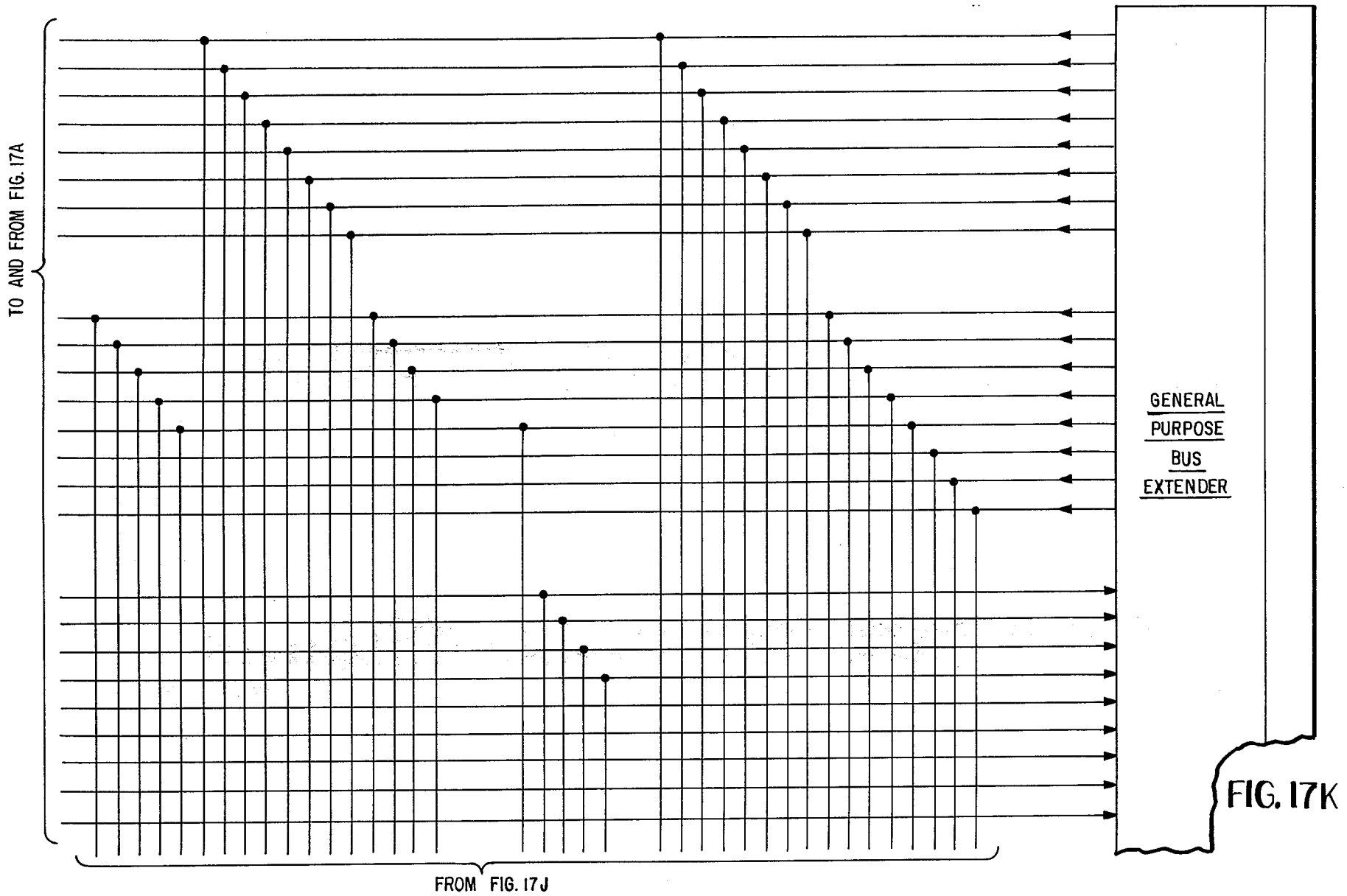

Referring at this time more particularly to FIG. 17I and FIG. 29*a* and FIGS. 29*b*, it will be seen that the switch interface circuit 350 provides proper output to the bus 318 over the lines 600, 700, 702, 704, 706, 708, 710, 712, 714, 716, 718, 720, 722, 724, 726 and 728 when this device is selected by proper input at the lines 500–506. As illustrated in FIG. 29*a*, the decoder chip 1002 responds to proper input at the lines 500–506 (binary five) to produce a high output at 1004 correspondingly to provide low outputs at lines 1006–1024 as one input to each of group of gates indicated generally by the reference character 1025. The inverters 1005, 1007 and the bank of inverters 1009 provide the proper logic. The other inputs to the gates 1024 are provided at the lines 1026–1040 in response to operation of switches of the group 1042 illustrated in FIG. 29*c*. As illustrated in FIG. 29*c*, certain of the switches of the group 1042 are spare but the switches 1044, 1046, 1048 and 1050 are as shown operatively associated with the system. However, the exit switch 1046 may be a spare also because exit from the machine in the specific embodiment disclosed here preferably is effected by the voter through operation of the light pen 338 as is described later. The switch 1044 is of course the convention 2-key switch operated by the voting official to perform the normal functions for this switch as described elsewhere herein. The voting official also operates the entrance switch 1048 to give a voter entrance to the machine at the proper time and the test mode switch 1050 is also under control of the voting official for preparing the machine for voting as previously described.

The keyboard 1052 is utilized to perform such functions as final read out or to effect other various functions or options which the machine may perform. The keyboard 1052 provides a binary coded output at the lines 1054–1060 which are applied, as can be seen in FIG. 29*b* to the bank of NOR gates 1062 whose outputs after inversion at 1064 provide the outputs at the lines 600 and 700–728 as previously described in conjunction with FIG. 17I. A further four bit binary switch 1066 may also be provided which in the embodiment herein is a spare. The switch 1066 has four output lines 1067, 1069, 1071 and 1073 applied to the bank of NOR gates 1075, FIG. 29*b*.

When the switch interface unit is addressed by the binary number five, causing the chip 1002 to provide a high output at the line 1004, the lines 1006–1020 provide enabling inputs to the bank of NOR gates 1025, the line 1022 provides enabling inputs to the bank of NOR gates 1075, and the line 1024 provides enabling inputs to the bank of NOR gates 1062. As noted, only the keyboard 1052 and the switches 1044, 1048 and 1050 are used normally so that the NOR gates 1075 and their corresponding outputs at the lines 714–720; the NOR gates 1077, 1079, 1081, 1083 and 1085 and their corresponding outputs at the lines 700, 706, 708, 710 and 712 are not employed in the system as embodied herein.

Referring now more particularly to FIG. 17i and FIGS. 28*a*–28*c*, the card reader peripheral unit will now be described. Referring to FIG. 28*a* and 28*c*, there is a bank of thirteen phototransistors 1070–1094, twelve of which read holes in the voter identification card, and the thirteenth transistor 1094 is utilized to sense the presence of the voter identification card in the reader devices. Twelve light emitting diodes indicated generally by the reference character 1096 are provided in cooperation with the twelve phototransistors 1070–1092 to provide the lights sources therefor and a thirteenth light emitting diode 1098 is provided in association with the thirteenth phototransistor 1094. When a card is inserted, light from the light emitting diode 1098 to the phototransistor 1094 is blocked and the transistor 1099 is turned on so that the input at 1102 to the NOR gate 1104 goes high. The signal at 1100 emanates from the data select circuit shown in FIG. 28*b* receiving inputs from the lines 500–506 which are gated by the two NOR gates at 1108 in conjunction with the inverters 1110 and 1112 to respond to the binary number ten whereby to activate the NAND gate 1114 and produce the enabling signal at 1100. The motor signal at the input line 729 (FIGS. 17*i* and 28*b*) is utilized to turn on the transistor 1116 whereby to energize the lamp 1118 and lower the resistance of the photocell 1120 whereby to exceed the threshold voltage of the DIAC 1122 which in turn turns on the TRIAC 1124 whereby to energize the card reader motor 1126 from the a.c. source 1128. Thus, the card is transported to scan the information thereon which is in the form of suitable holes which are read by the phototransistors 1070–1092. The outputs of the phototransistors appear at the lines 1130–1152 and are applied to the bank of NOR gates 1154 to provide one input to each of them, the other input to each being from the device select signal at their line 1100, correspondingly to produce the outputs at 600 and 700–720 as previously described.

Reference is had at this time more particularly to FIGS. 17*h* and FIG. 30*a* and FIG. 30*b* for details of the random number generator. As shown in FIG. 30*a*, the device select signal at the lines 500–506 are applied to a decoder 1200 which in response to the binary number three input at the lines 500–506 corresponding to the device provides a high output at the line 1202 which clocks the flip-flop 1204 to produce a high output at the line 1206 which is delayed through several buffer gates 1208 ultimately to reset itself and provide the clock pulse output at the line 1210. A free running oscillator 1212 provides a continuous train of clock inputs to the counter 1214. Thus, a continuously changing number appears at the output lines 1216–1238 of the counter 1214 and when the device select signal appears at the line 1210, each of the latches 1240, 1242 and 1244 latches the number present on the input lines at that particular instant. The outputs of the latches 1240, 1242 and 1244 are applied to the bank of NAND gates 1246, the enabling inputs of which are provided by the device select signal at the line 1202. Two banks of the buffers 1248 and 1250 provide the outputs at the lines 600 and 700–720 which go to the bus 318. The processor receives this randomly generated number and acts upon it to transfer the voter selections to the nearest section of the tape available corresponding to such number, thereby placing the voters' selections on the tape unit while, as described before, the voter registration number read from his voter identification card is stored in a sequential fashion for all of the voters. The selection of the random number generator device which causes the decoder 1200 to respond occurs in response to request by the voter for verification of his voting selections, as previously described.

FIGS. 17*j*, 17*k*, 31 and 31*b* show details of the bus extender 362. As previously stated, this extender simply is to provide an extension of the bus 318 for a second unit or partial unit as previously described and it is believed that the functioning of the circuit shown in FIGS. 17*j*, 17*k*, 31*a* and 31*b* will be obvious by inspection thereof.

Figure 18A:
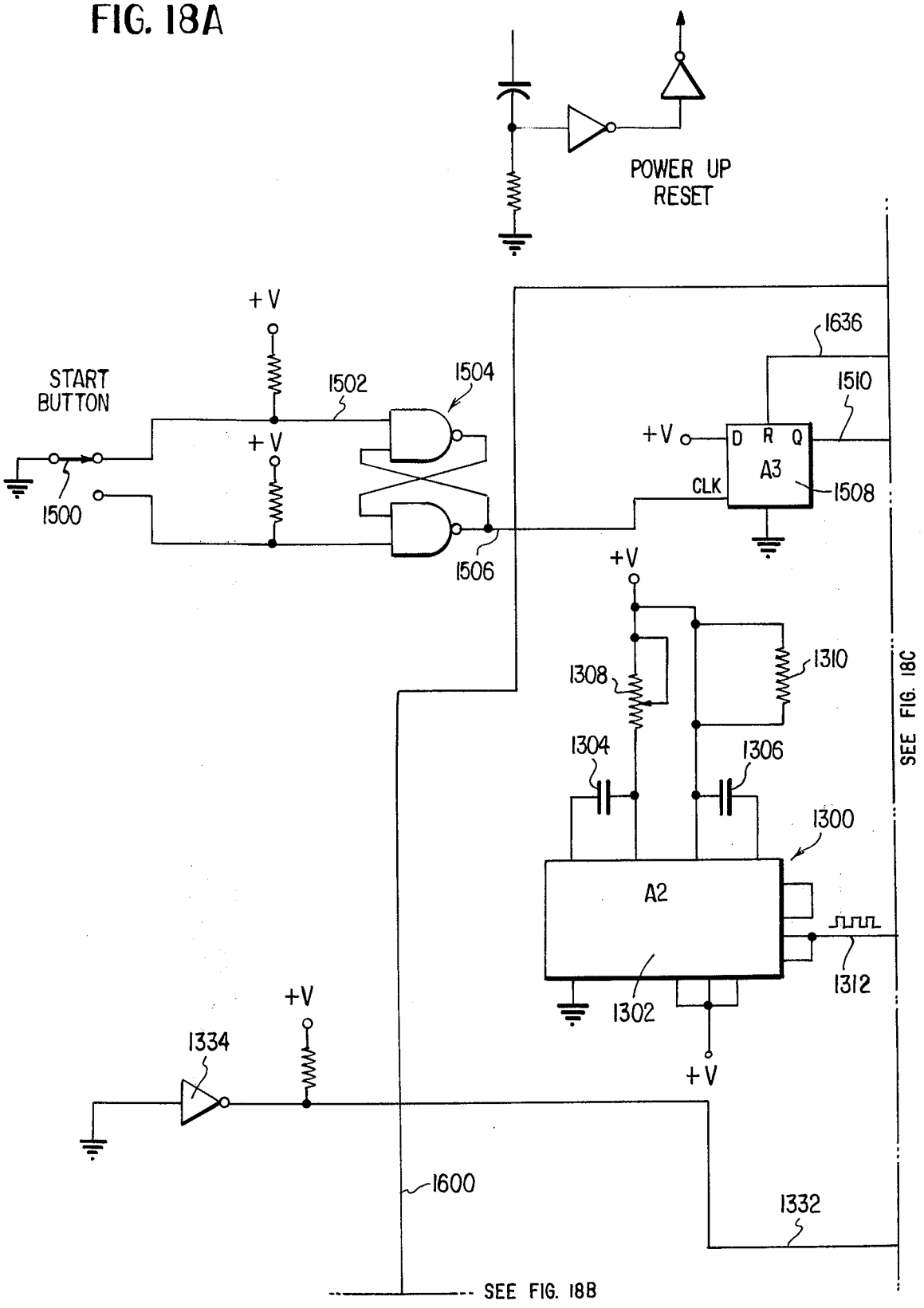
Figure 18B:
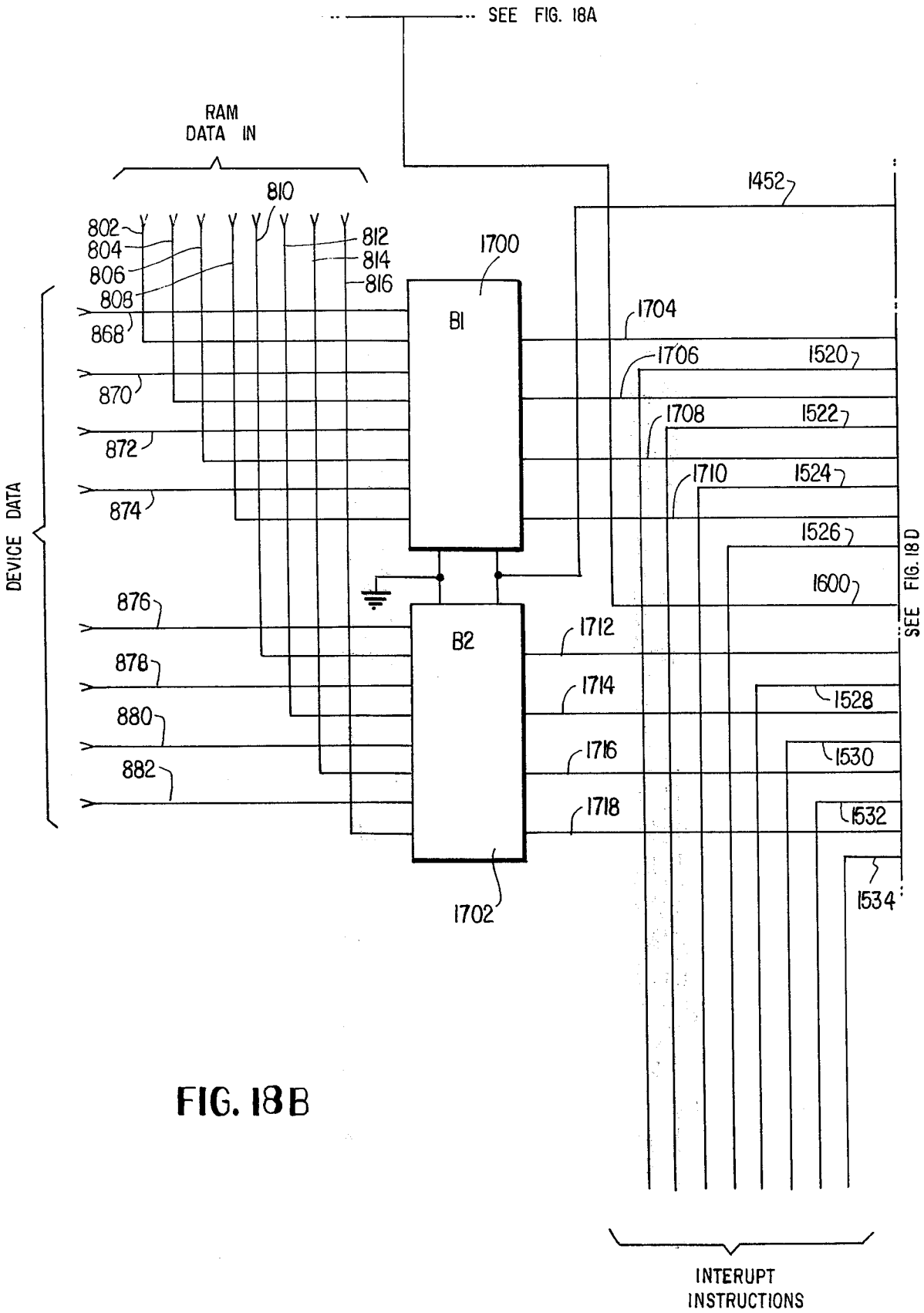

Referring at this time more particularly to FIG. 17*c* and FIGS. 18*a*–18*h*, details of the processor 300 will now be described. Referring now in particular to FIG. 17*c*, the device data lines 418 from the input/output section 314 are designated by reference characters 838–882 whereas instructions from the ROM and RAM data input lines are indicated by reference characters 802–816. Additionally, there are a number of data-to-memory lines indicated by the reference characters 800–834 and memory address lines indicated by reference characters 836–866 in addition to the output lines 420 and 412, 414, 416 and 422 previously described. Referring to FIG. 18*a*, the internal clock for the computer is illustrated generally by the reference character 1300 and comprises a dual multivibrator chip 1302 provided with external timing capacitors 1304 and 1306 and timing resistors 1308 and 1310 to produce the clock output at the line 1312.

Figure 18C:
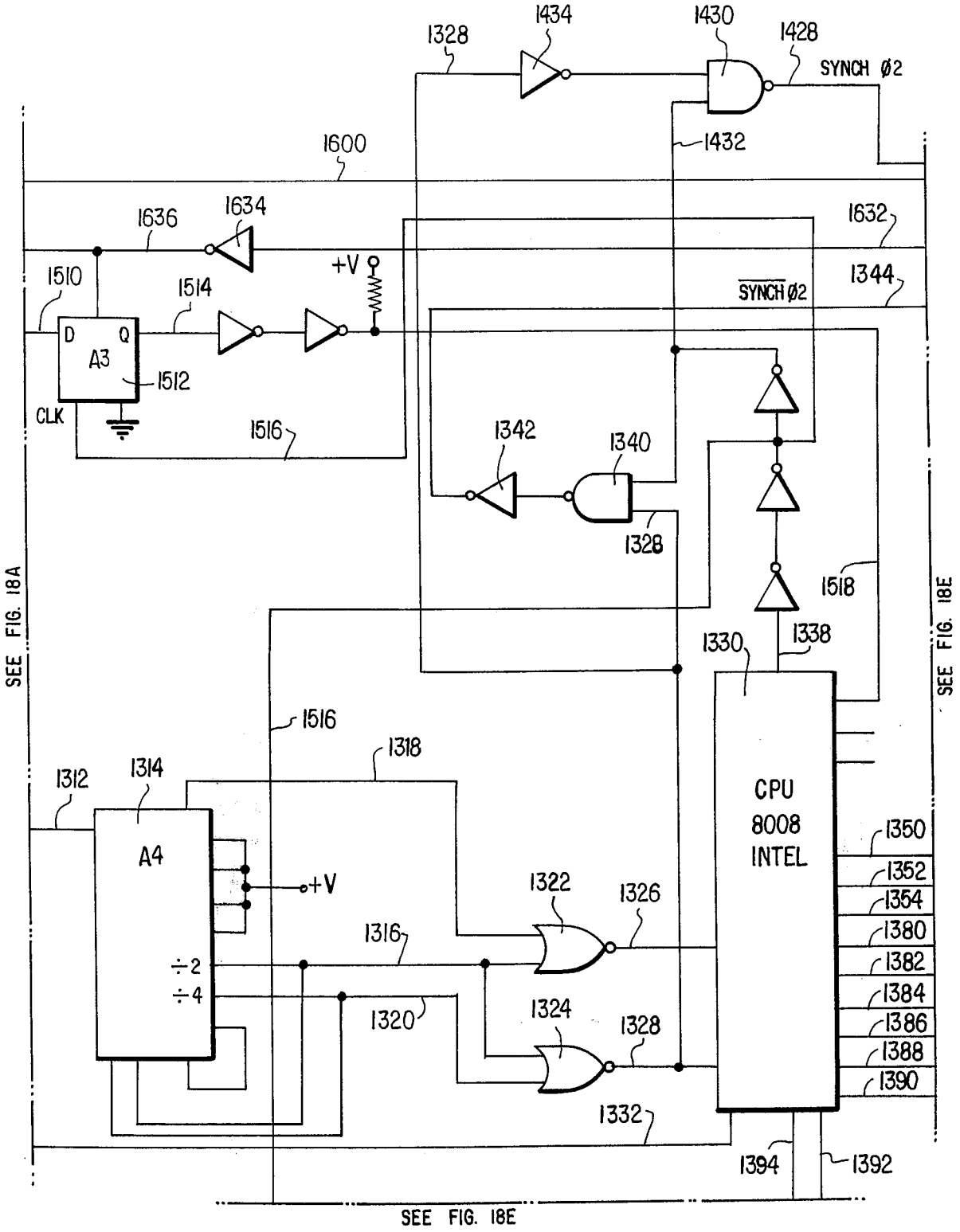

Referring to FIG. 18*c*, the clock signal on the line 1312 is applied to a dual flip-flop circuit 1314 wired to provide a divide-by-two output at the line 1316, a divide-by-four output at the line 1318 and the complement of the divide-by-four output at the line 1320. These signals are applied to the NOR gates 1322 and 1324 to provide a one-of-four duty cycle at the lines 1326 and 1328, which are staggered and applied to the 8008 Intel CPU 1330. The line 1332 shown connected to the unit 1330 is connected to that pin thereof which accommodates for use of a slower memory than is incorporated in the present embodiment, and consequently, to which a high input is connected through the grounded inverter 1334 shown in FIG. 18a. The line 1338 is connected to the processor 1330 to provide an output clock therefrom which is slaved to the two inputs at 1326 and 1328 to provide, in conjunction with the NAND gate 1340 and inverter 1342, the SYNCH $0_2$ output signal at the line 1344. The characteristics of the processor 1330 are such that it has five main states identified as T1, T2, T3, T4 and T5. In the T1 state, the lower eight bits of the memory address are outputed, in the T2 state the higher six bits of the memory address and two control bits which designate the type of operation to be performed are outputed, in the T3 state either the processor reads an instruction from the ROM, reads the data from the RAM or outputs eight bits of data to the input/output section or to the RAM.

States T4 and T5 are used for execution of internal instructions only. The signals representing the state control coding of the processor 1330 appear at the lines 1350, 1352, and 1354 and they are applied to the decoder chip 1356 shown in FIG. 18*e*.

Figure 18D:
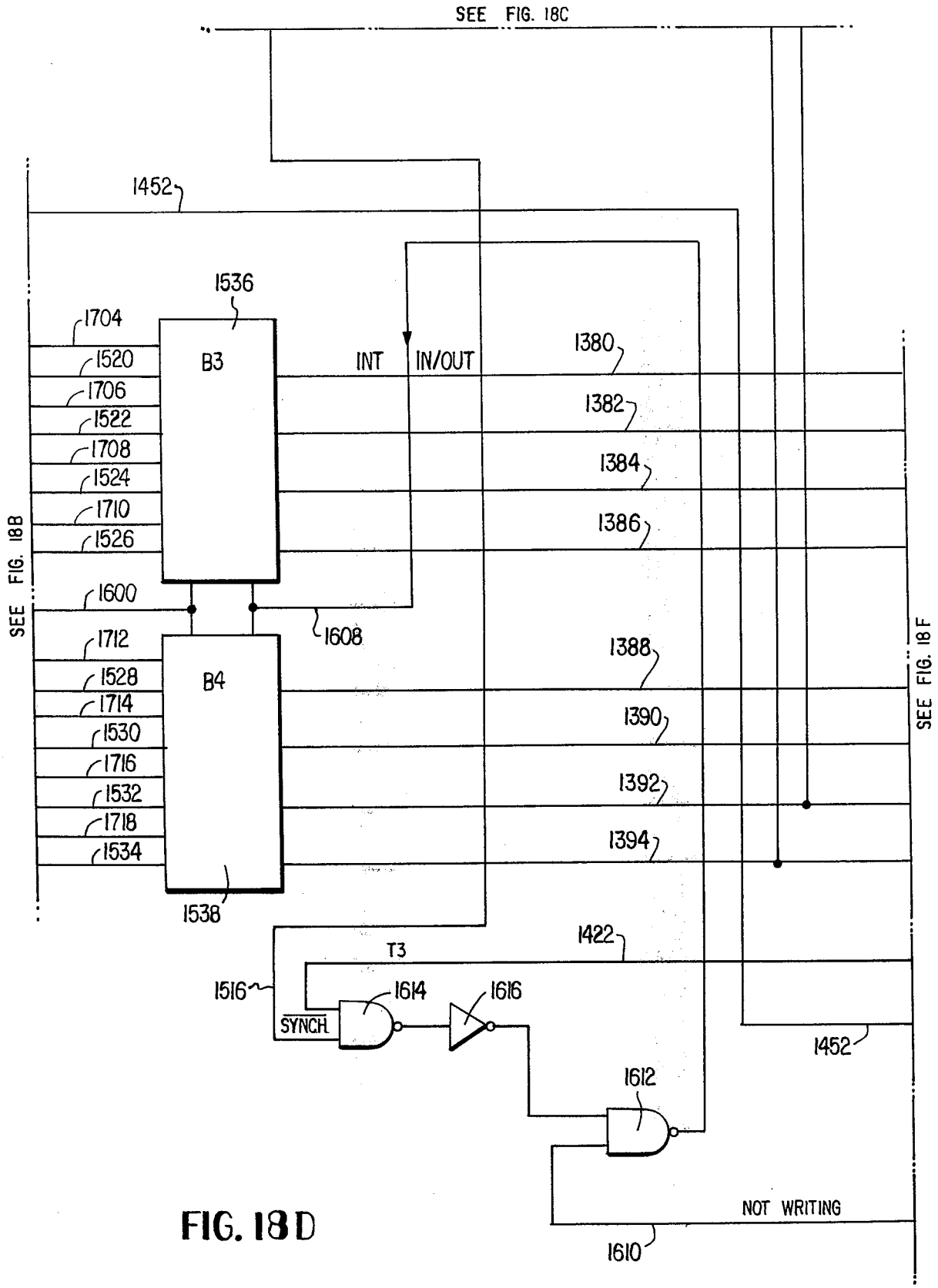

The state control coding signals cause the output from the decoder 1356 providing a $\overline{T1}$ signal at the conductor 1358 and a $\overline{T1}$ interrupt state signal at the conductor 1360, the $\overline{T2}$ signal at conductor 1362 and the $\overline{T3}$ signal at the line 1364. Referring to FIGS. 18*g* and 18*h*, the latches 1370, 1372, 1374, 1376 are shown which receive outputs from the central processor 1330, the two latches 1370 and 1372 latching this data when the central processor is in the T1 state and the other two 1374 and 1376 latching the data when the processor is in the T2 state. This data is obtained from the lines 1380, 1382, 1384, 1386 1388, 1390. 1392 and 1394 from the processor 1330, these signals being applied to the buffer banks 1400 and 1402 providing the memory data outputs 820–834 as described in conjunction with FIG. 17*c*. These are the signals which are also applied to the latches 1370, 1372, 1374 and 1376, as is illustrated in FIGS. 18*g* and 18*h*. In order to write data into the memory during the T3 state, the two outputs at the lines 1400 and 1402, see FIG. 18*h*, are high providing corresponding inputs to the NAND gate 1404 which provide the input to the flip-flop 1406 which is clocked by the T3 state on the line 1408 to provide the R/W (read/write) signal at the line 818. The writing function is performed with respect to the output to the RAM over the lines 820–834 in consonance with the memory clock signal on the line 800, see FIG. 18*e*. The signal from the NAND gate 1404 in FIG. 18*h* is inverted at 1410 to provide a signal at the line 1412 which is applied as an input to the NAND gate 1420 in FIG. 18*g*. The other two inputs to the gate 1420 appear at the line 1422 which is derived from the $\overline{T3}$ signal at line 1364 in FIG. 18e, as inverted at the inverter 1424. The remaining input at 1428 is obtained from the gate 1430 in FIG. 18*c* whose inputs at the conductor 1432 and the conductor 1328 as inverted by the inverter 1424 are NANDed. Thus, insofar as the gate 1420 is concerned, the signal at 1428 represents the SYNCH $0_2$ state, that at 1422 represents the T3 state and that at 1412 represents the read/write state. The output of the gate 1420 as it appears at the line 1438 is applied to gate 1440 in FIG. 18e which triggers the one shot multivibrator 1442 to provide the proper pulse width for the memory clock signal at the line 800. During a memory read cycle the lower address is out of the latches 1370 and 1372 and the upper address is out of the latches 1374 and 1376 and the output from the line 1400 in FIG. 18h will be high while that on the line 1402 will be low so that the gate 1450 provides a low output at the line 1452 which is inverted at 1454 to provide the high signal at the line 1456. The signal at the line 1456 provides an enabling input to the gate 1458 in FIG. 18e. The $\overline{T2}$ signal at the conductor 1362 is inverted at 1457 to provide the T2 signal at the line 1460 which is applied as the second enabling input to the gate 1458. The remaining input to the gate 1458 is the $\overline{SYNCH}$ $0_2$at the line 1444. Thus, the gate 1440 acts as an inverted OR gate to provide the memory clock pulses at the line 800 during the read instruction in the T2 state. During the T2 state and in response to the $\overline{SYNCH}$ $0_2$ signal at the line 1344, the gate 1470 in conjunction with the inverter 1472 provides a clocking pulse at the line 1460 used for latching at the latches 1374, 1376 as previously described. Similarly, for the latching signal during the T1 state, the gates 1474 and 1476 respond in the presence of the $\overline{SYNCH}$ signal at 1344 to provide an output at the gate 1476 which is inverted at 1478 and provides a proper clocking pulse at the line 1480 which is applied to the two latches 1370 and 1372 in FIG. 18*b* and 18*h*.

Referring to FIG. 18*a*, it will be noted that a start button switch 1500 is provided which in the position shown provides a low input at 1502 to the upper of the cross coupled NAND gate arrangement 1504 whereby the output at 1506 normally is low. For starting, the switch 1500 is moved to the other position which toggles the flip-flop provided by the cross coupled NAND gates 1504 to provide a high or positive going signal at the line 1506 which clocks the D type flip-flop 1508 which provides a high signal at its Q output 1510. The signal at 1510 is also provided as the D input to the flip-flop 1512 (FIG. 18*c*) and whose Q output at 1514 upon receiving a SYNCH signal at the line 1516 goes high providing a high input at 1518 to the interrupt pin of the CPU 1330. As a result, the processor will read the interrupt instruction present at the line 1520–1534 shown in FIG. 18*d*. The signals are multiplexed by the chips 1536 and 1538, these chips being two-line-to-one line data selectors/multiplexes with tri-state outputs and which multiplex the interrupt instructions at lines 1380–1394 previously described.

Figure 18E:
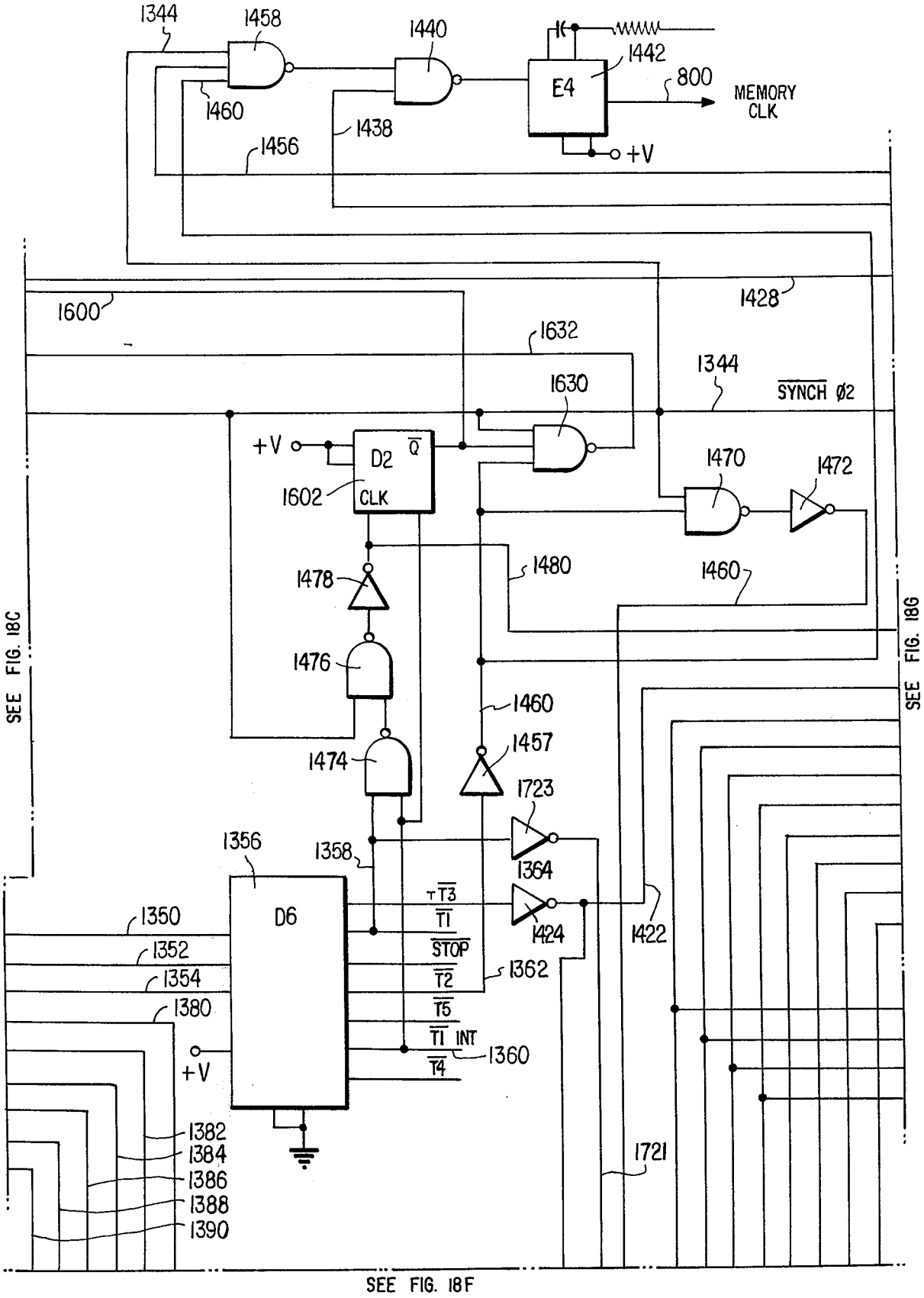
Figure 18F:
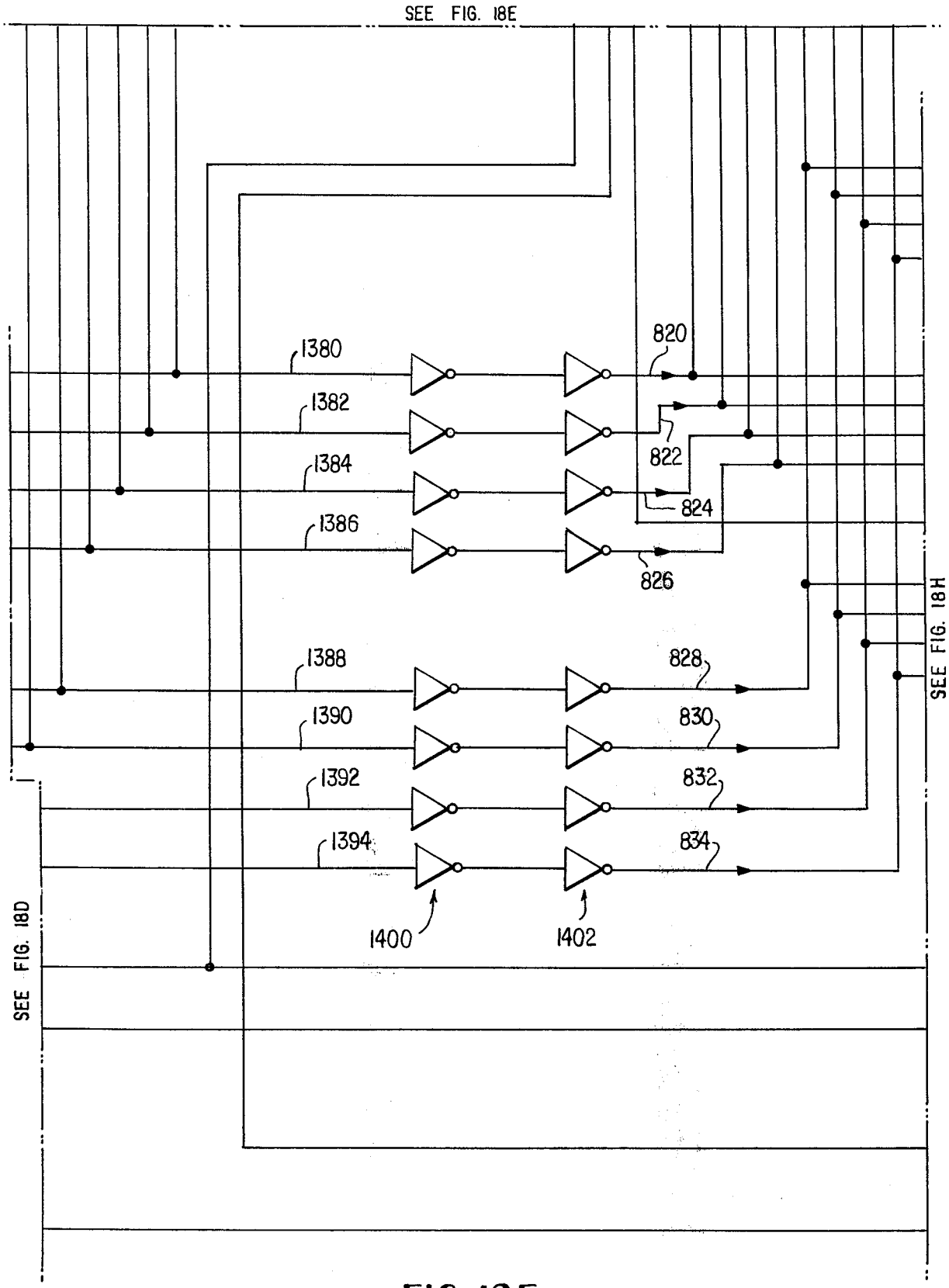
Figure 18H:
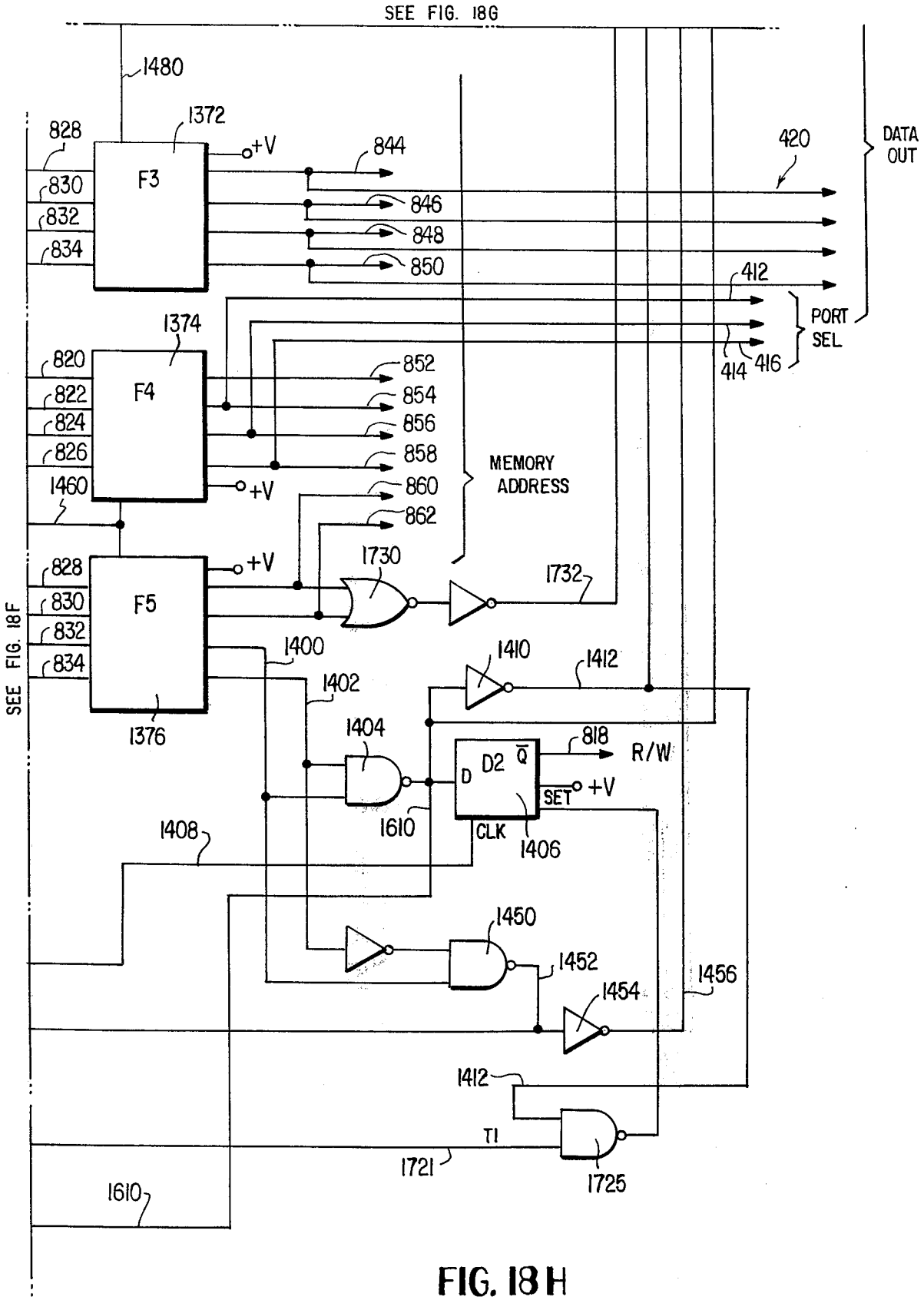

The selector signal at the line 1600 is provided by the $\overline{Q}$ input of the D type flip-flop 1602 FIG. 18*e*) in response, during the T1 interrupt state, to the SYNCH $0_2$ signal at 1344 to the gate 1476. At this time, only the interrupt instructions are multiplexed by the chips 1536 and 1538. The signal at the line 1608 to the multiplexers 1536 and 1538 is derived from the NAND gate 1612 (FIG. 18d) one input to which at the line 1610 is indicative that a writing function is not being performed and the other input to which is derived from the gate 1614 having the $\overline{SYNCH}$ input at 1516 and the T3 state input at the line 1422, the output after inversion at 1616 being applied to the gate 1612. The function performed is that the multiplexers 1536 and 1538 are momentarily taken out of the tri-state output so that data can be outputed through the lines 1380–1394 to the CPU 1330. The instruction which is put into the CPU is that which starts the processor at memory location zero.

The gate 1630 in FIG. 18e had three inputs, the $\overline{SYNCH}$ signal at 1544, the $\overline{Q}$ output of the flip-flop 1602 and the signal at 1460 which is the T2 state signal. The signal at 1632 as is shown in FIG. 18*c* is inverted at 1634 and provides a reset signal on the line 1636 to the flip-flops 1512 and 1508, the latter of which is shown in FIG. 18*a*. This resets the flip-flop which initiated the interrupt state.

The two multiplexers 1700 and 1702 are identical to those described in conjunction with FIG. 18*d* with reference to the entities 1536 and 1538. The multiplexers 1700 and 1702 receive device data inputs over the lines 868–882 and RAM data inputs over the line 802–816. The signal at 1452 is controlled by the cycle coding correspondingly to control the multiplexers 1700 and 1702 such that when the input at 1452 is low, the RAM data input lines 802–816 are multiplexed over the lines 1704–1708 and when the signal at 1452 is high, the device data over the lines 868–882 is multiplexed at the lines 1704–1718.

During an output instruction a high signal is present at the conductor 1400 in FIG. 18*h* and a low signal will be on the line 1402 to provide a high signal at the line 1456 as previously described. Also, it will be noted that during an output cycle to the input/output section, one of the signals to the NOR gate 1730 will be high correspondingly to provide a high output at the line 1732 in FIG. 18*h* which together with the signals at 1344, 1422 and 1456 to the gate 1734 produces the output clock at the line 422 previously described in conjunction with FIG. 17*c*. Just prior to a clock signal at the line 422, the data for outputing has been latched to the latches 1370 and 1372, the port designation at the lines 412–416 is effected and the signal at 1732 is also generated at this time.

During a write function, a high signal is at the conductor 1412 in FIG. 18*h* and the signal at 1721 goes high when the $\overline{T1}$ signal at 1358 in FIG. 18*e*, inverted at 1723 appears. Thus, the gate 1725 sets the flip-flop 1406 such that its $\overline{Q}$ output goes low, in effect providing a reset for the WRITE ENABLE signal provided at the line 818.

Referring at this time more particularly to FIG. 17d and in particular to the read only memory section 308 thereof, the lines 836–866 which are the address lines represent a capability for 64000 words, the lower 4,000 of which words, designated 0–3 k, are utilized to address the ROM 308 whereas the words designated 4–8k are utilized to address the RAM 306. Accordingly, the two address lines 864 and 866 shown in FIG. 17*d* are not used in this particular embodiment and may simply be grounded as will appear more clearly hereinafter.

Figure 19A:
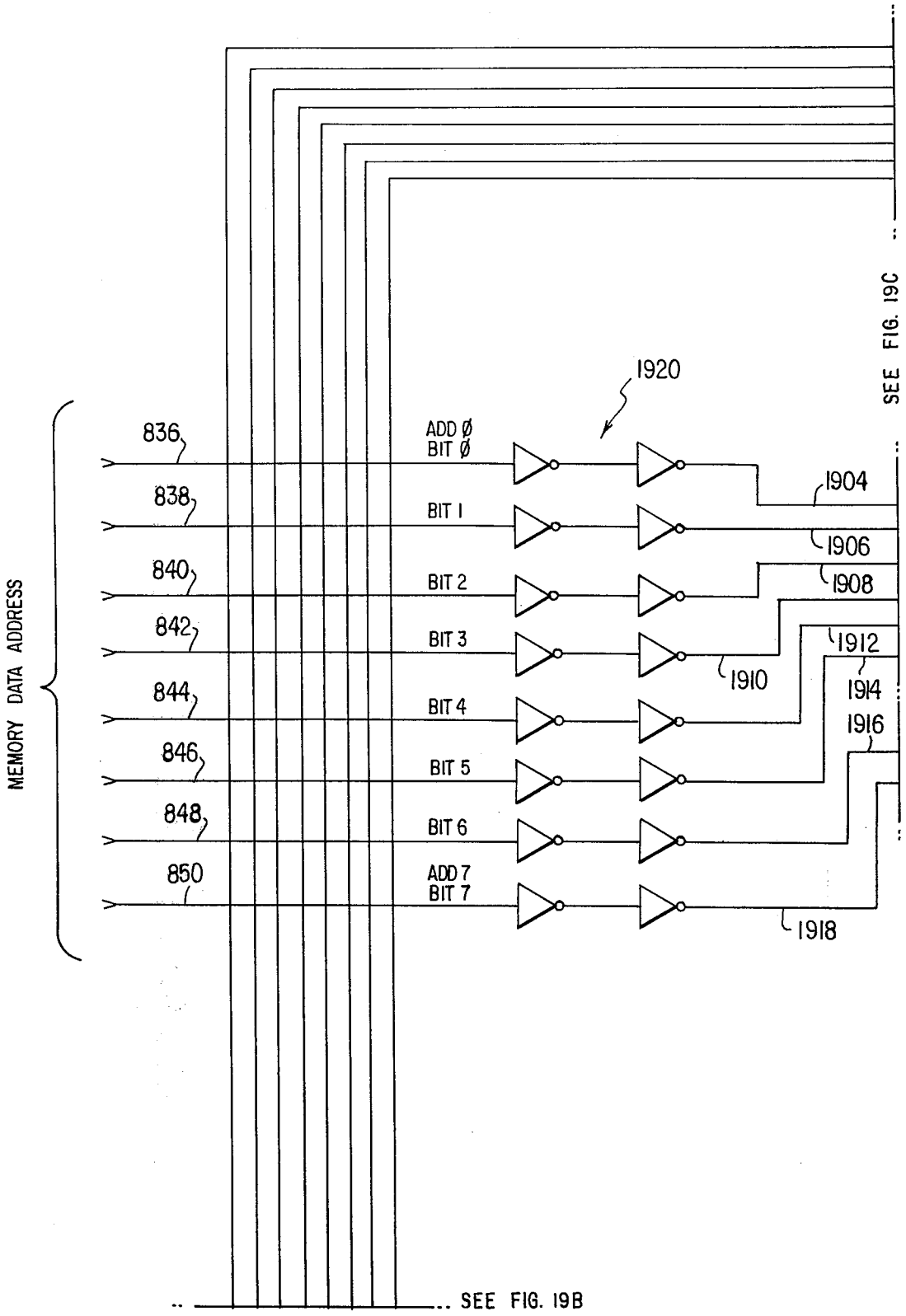
Figure 19B:
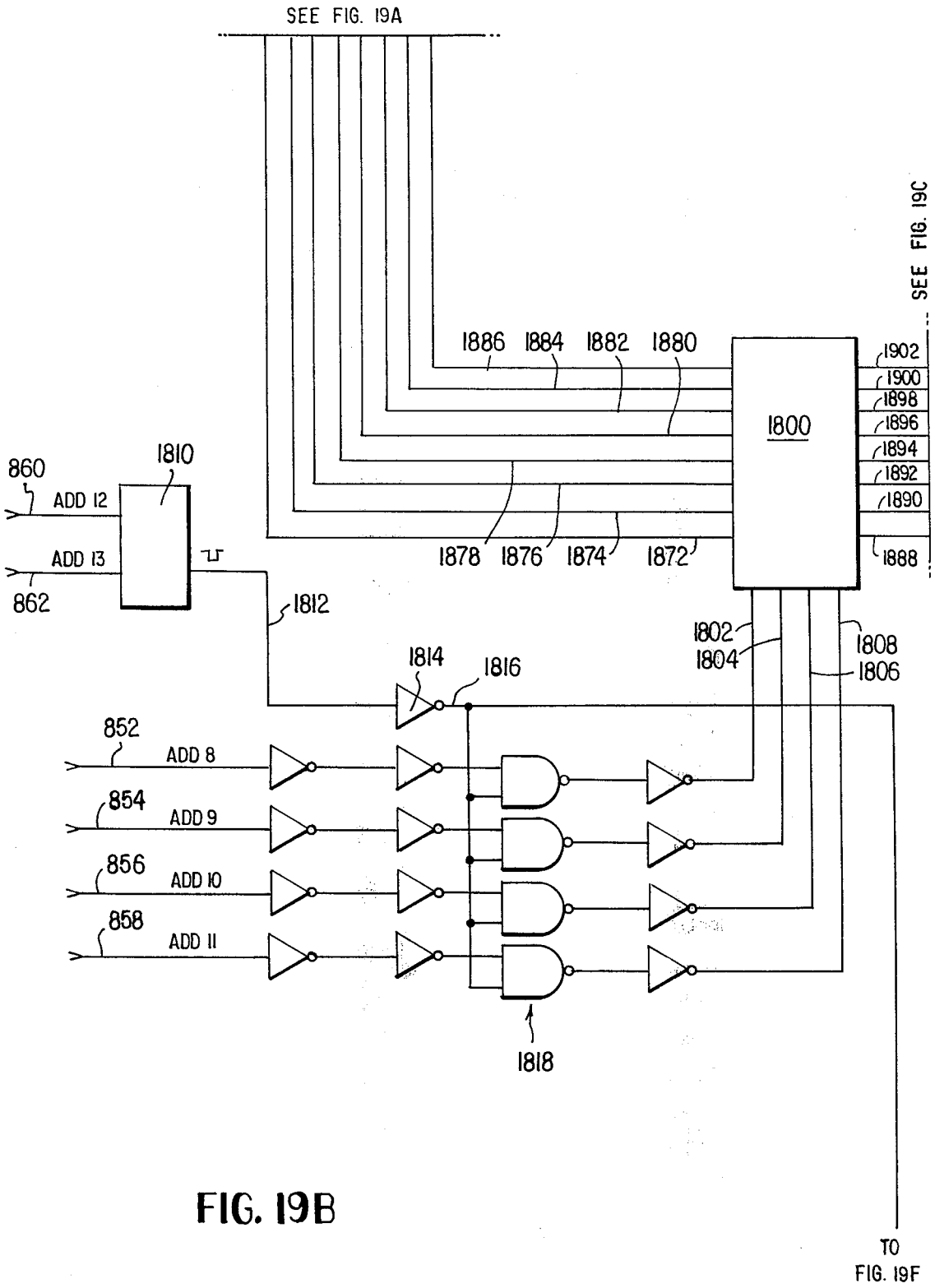
Figure 19C:
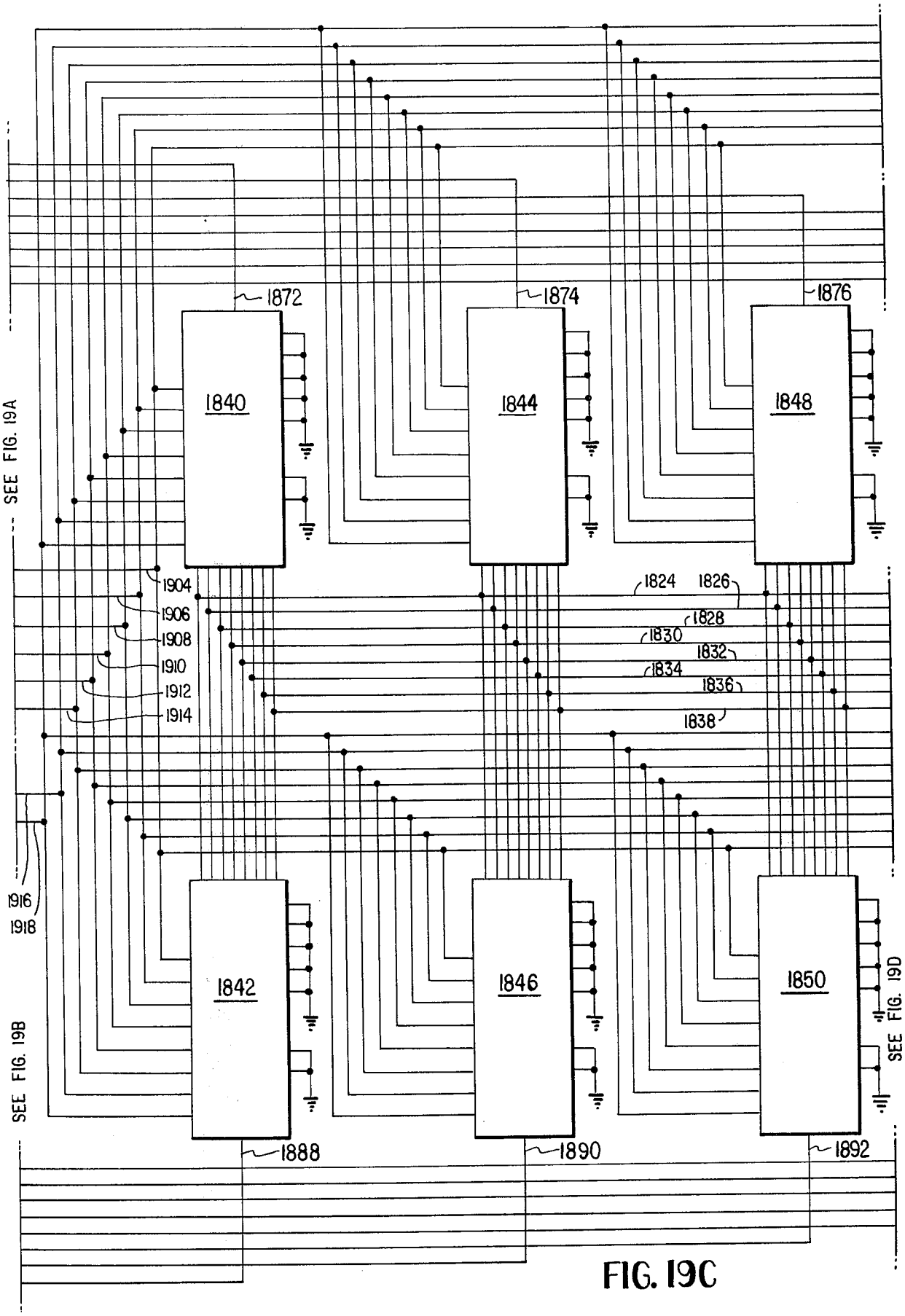
Figure 19D:
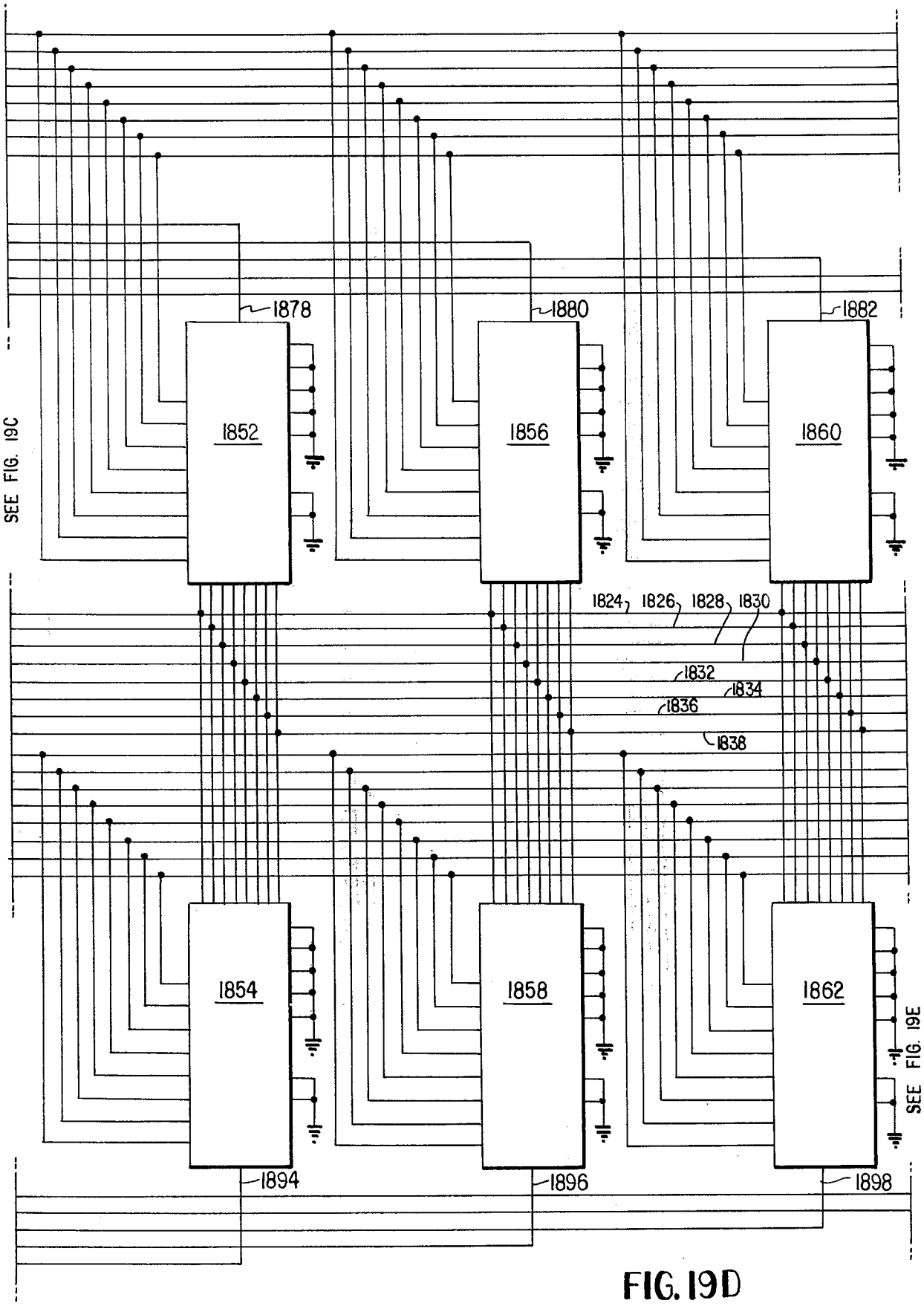
Figure 19E:
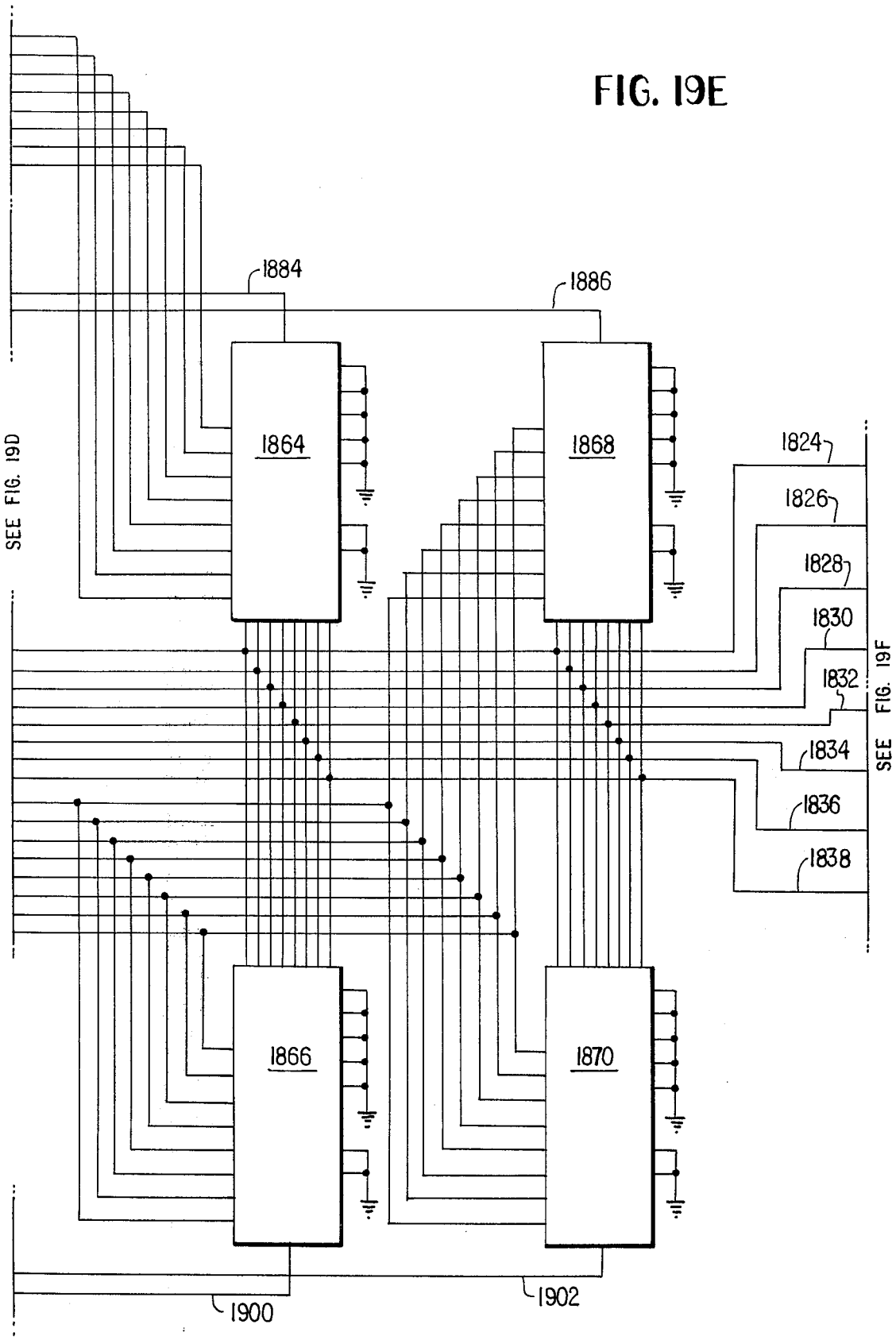
Figure 19F:
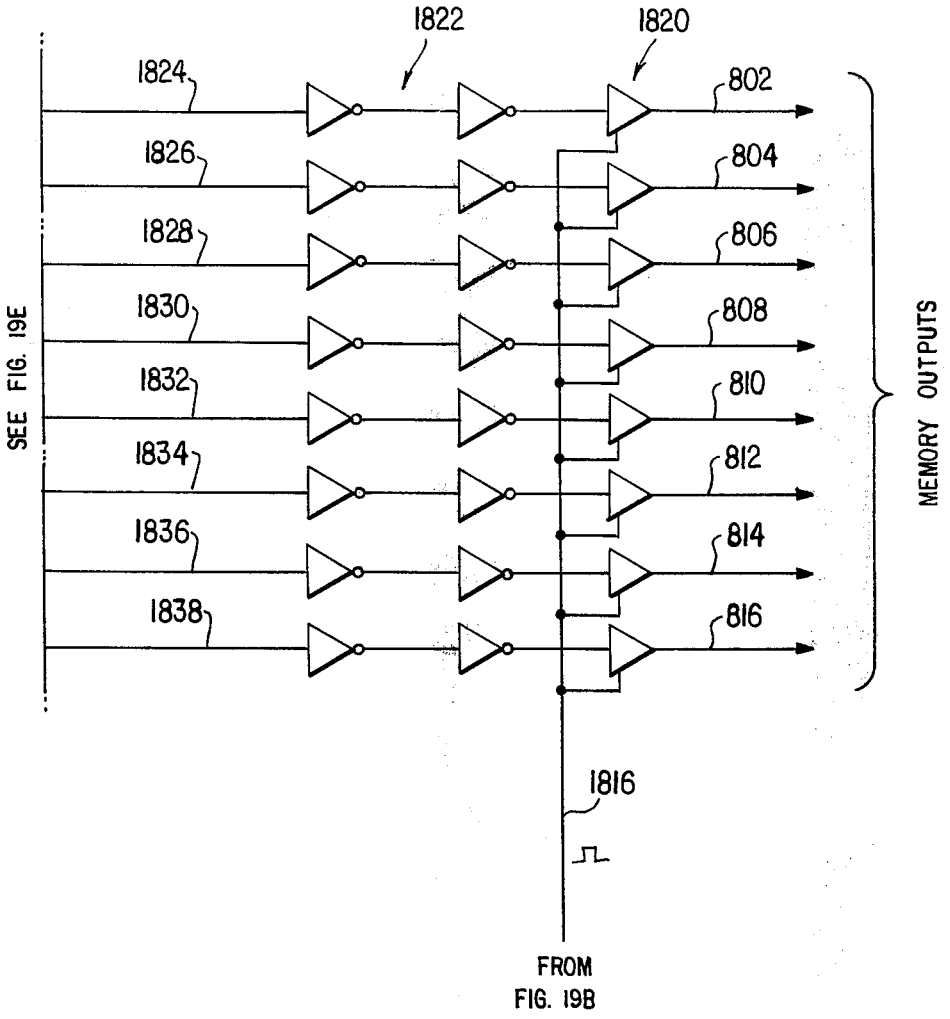

The details of the ROM 308 are shown in FIGS. 19*a*–19*f* and the address selection thereof will now be described in detail with respect to FIG. 19*b*. As shown, a one-of-sixteen decoder chip 1800 is provided with four input lines 1802, 1804, 1806 and 1808, which inputs select which of the memory chips hereinafter described are selected for address. The signals at 1802–1808 are derived from the address signals at the lines 852, 854, 856 and 858. As previously stated, the address to the ROM is the lower address and when the signals at the lines 860 and 862 are both zero the one-of-four decoder 1810 provides a low output at its zero line 1812 which is inverted at 1814 to provide a high signal at the line 1816 correspondingly providing high inputs at each gate of the bank of NAND gates 1818 so as to enable them, allowing the inputs to the line 852–858 to provide the proper outputs at the lines 1802–1808. The signal at the line 1816 is also applied to the memory output section shown in FIG. 19*f* and in particular is applied to the tri-state buffers 1820 so that when the signal at 1816 is high the buffers 1820 go from a high impedance state to a state in which their inputs are reflected at the lines 802–816. The buffers 1822 receive the memory outputs over the lines 1824–1838 and provide the inputs to the tri-state buffers 1820. The lines 1824–1838 represent the tri-state outputs of the memory chips 1840-1870 shown in FIGS. 19*c*, 19*d* and 19*e*.

The enable signals for the chips 1840, 1844, 1848, 1852, 1856 1860, 1864 and 1868 appear one at a time at the lines 1872–1886 whereas the enable signals for the remaining chips appear one at a time at the lines 1888–1902. All of these enable signals are provided by the one-of-sixteen decoder 1800 as is shown in FIG. 19*b*. These enable signals are low signals and the decoder 1800 is such that only one of these signals may go low at any time corresponding to the coding provided by the four binary inputs 1802–1808. The enable signals cause the normally high impedance outputs from the individual chips which are commonly connected to the memory output lines 1824–1838 to go out of the tri-state or high impedance mode. Each of the memory chips 1840–1870 contain 256 eight bit words and when any chip is enabled, the work corresponding to the address thereto at the lines 1904–1918 is outputed over the lines 1824–1838. As is shown in FIG. 19*a*, the signals at 1904–1918 are derived from the inputs at 836–850 suitably buffered as at 1920. The sixteen groups of 256 words provided by the memory chips effects the four K memory capability of the ROM, the CPU 300 containing the logic which interprets these words to act upon them and effect the necessary operations.

Referring now more particularly to FIGS. 20*a*–20*i*, details of the RAM 306 will appear. As described in conjunction with FIG. 17*d*, the processor provides inputs over the lines 800 and 818–834 and also provides address over the lines 836–866, the output from the RAM being over the lines 802–816 back to the processor. As previously described, the RAM 306 provides the upper or 4–7K words. The RAM 306 contains four rows of eight read/write memory chips, the first or upper row of which is designated by reference character 2000–2014, the second row of which is designated by reference character 2016–2030, the third row of which is designated by reference characters 2032–2046 and the last row of which is designated by reference characters 2048–2062. The ten address lines 2064–2082 are provided in parallel to all of the memory devices 2000–2026 and are generated from the ten address lines 836–8534 through the buffer units indicated generally by the reference character 2084. The four signals which select one each of the four rows of chips are provided by the lines 2086–2092, only one of which is outputed at a time from the one-of-four decoder chip 2094, FIG. 20*b*. The inputs to this chip 2094 are provided by signals at the lines 856 and 858 which are address lines from the processor 300 which are binary coded to provide the four separate outputs at 2086–2092. Although a series of inverters are shown connected between the lines 856 and 858 and the chip 2094, it will be appreciated that the connections could be made directly. The next two address lines 860 and 862 from the processor are applied to a one-of-four decoder 2096 which will provide a low signal at its output line 2098 only if the combination of a high signal at 860 and a low signal at 862 appears. The signal at 2098 is applied to the tri-state buffer bank 2100 (FIG. 20*h*) which respond such that when the signal at 2098 goes low, the tri-state buffers are no longer in their tri-state output mode so that the data at the inputs 2102–2116 suitably buffered as at 2118 may appear as the outputs at the lines 802–816. The line 2102 is connected in parallel to all of the first column of chips 200, 2016, 2032 and 2048; the line 2104 is connected to the next column and so forth for the eight columns of chips. Thus, The one-of-four decoder 2094 enables the particular row of read-write memory chips which brings the data out of the corresponding read/write memory chips over the lines 2102–2116. As previously stated, when the enable signals at 2086–2092, go low one at a time, the corresponding row of chips are brought out of their tri-state mode to output the bits at the lines 2102–2116.

Figure 20A:
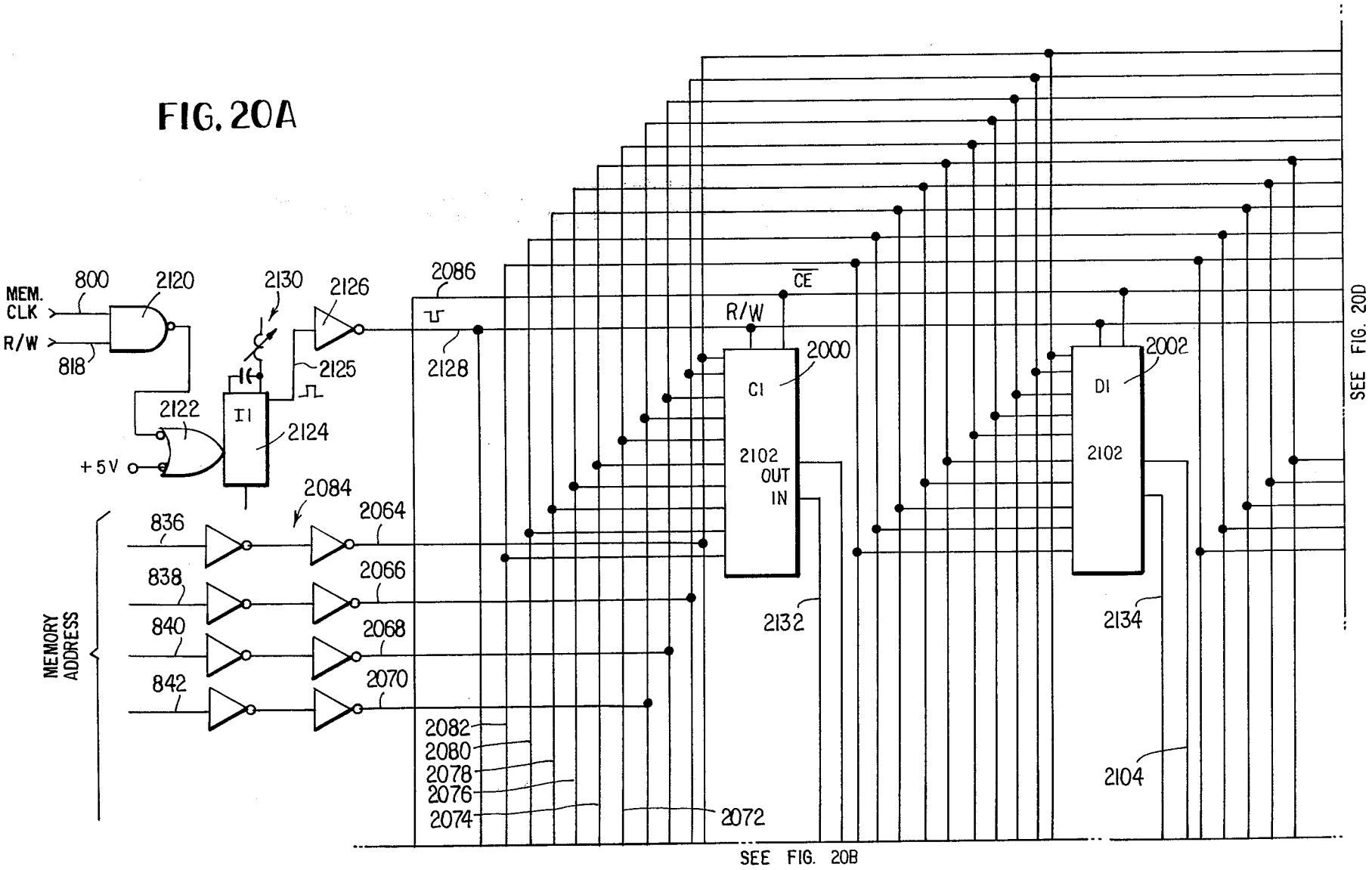
Figure 20B:
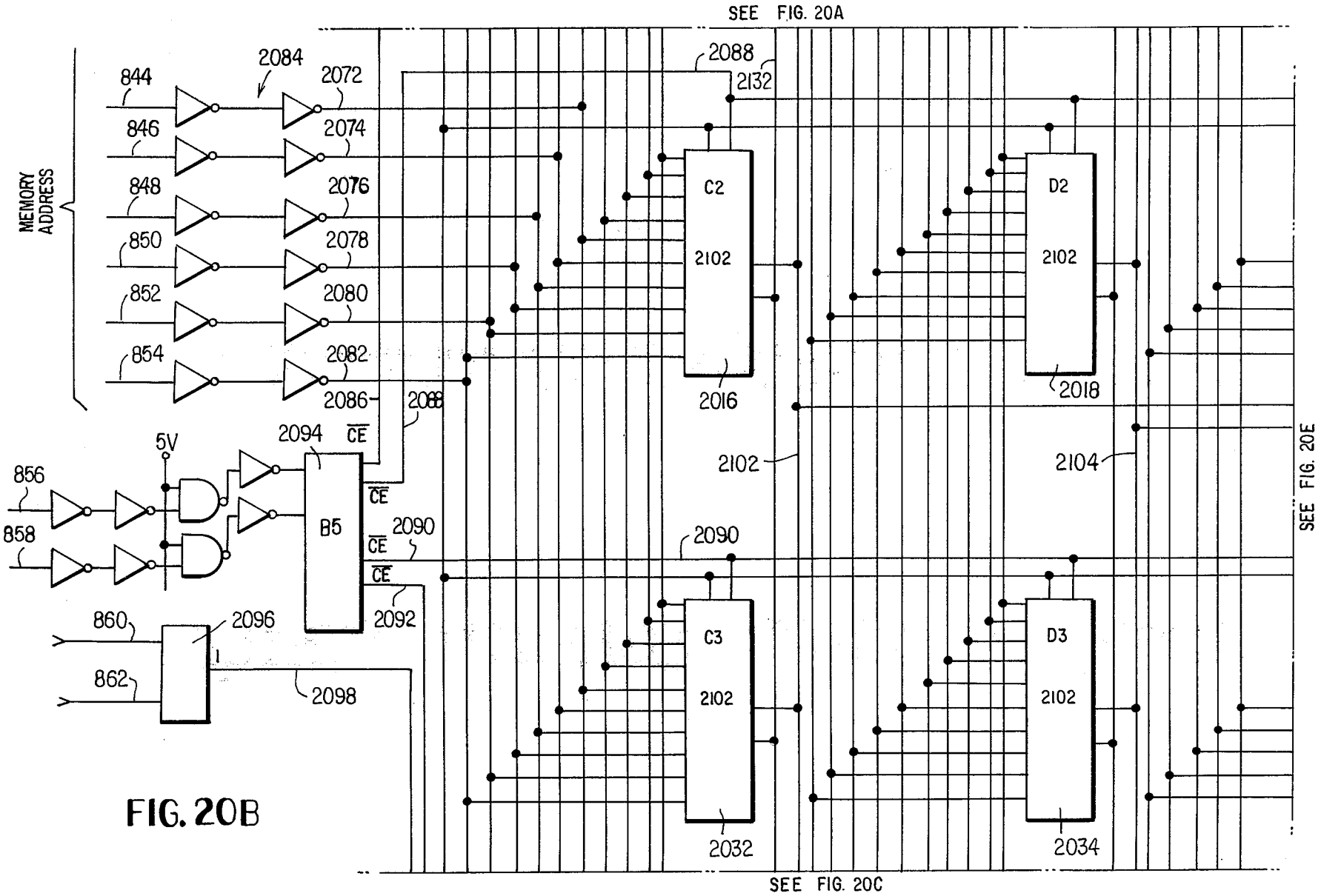
Figure 20C:
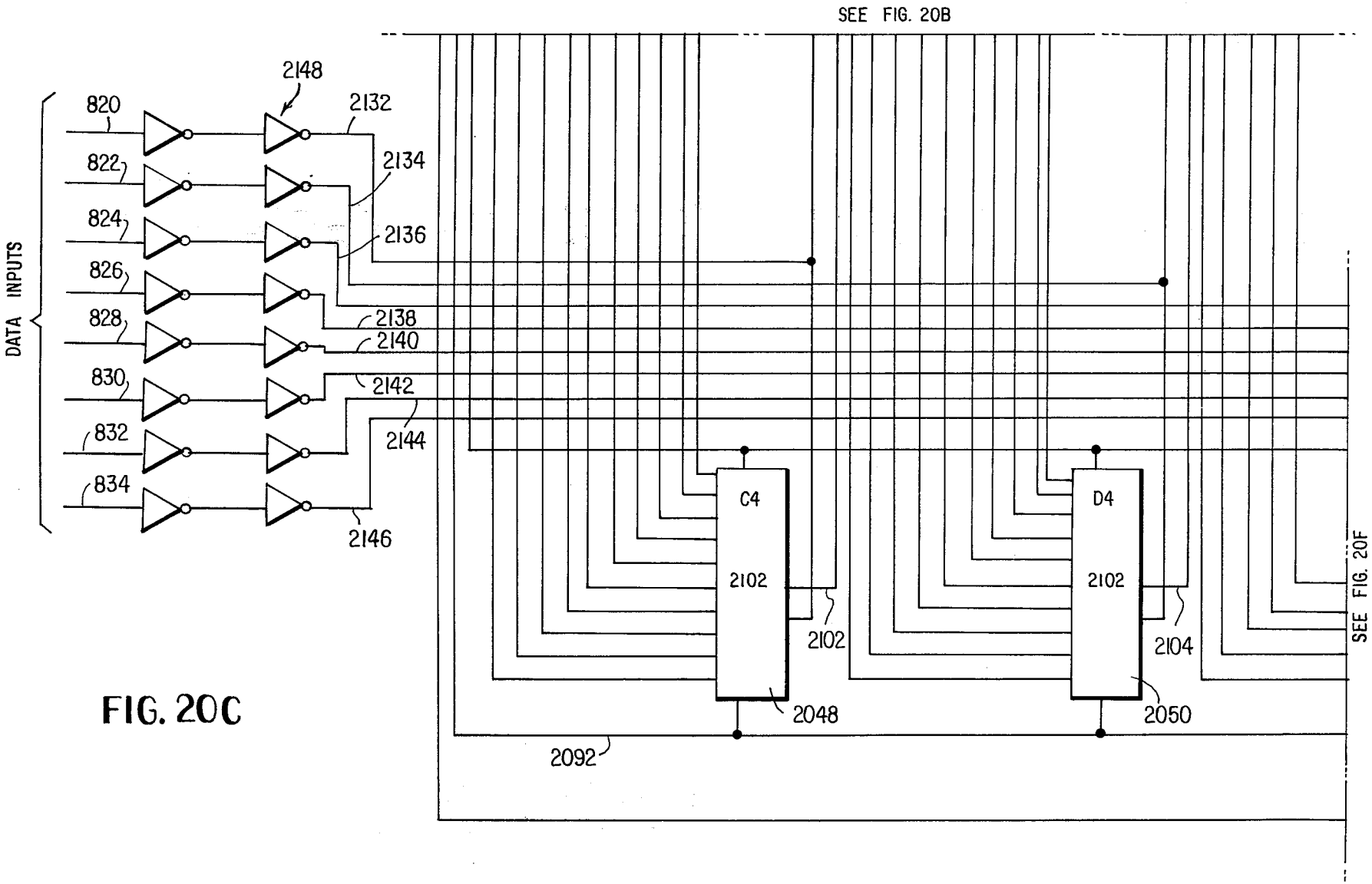
Figure 20D:
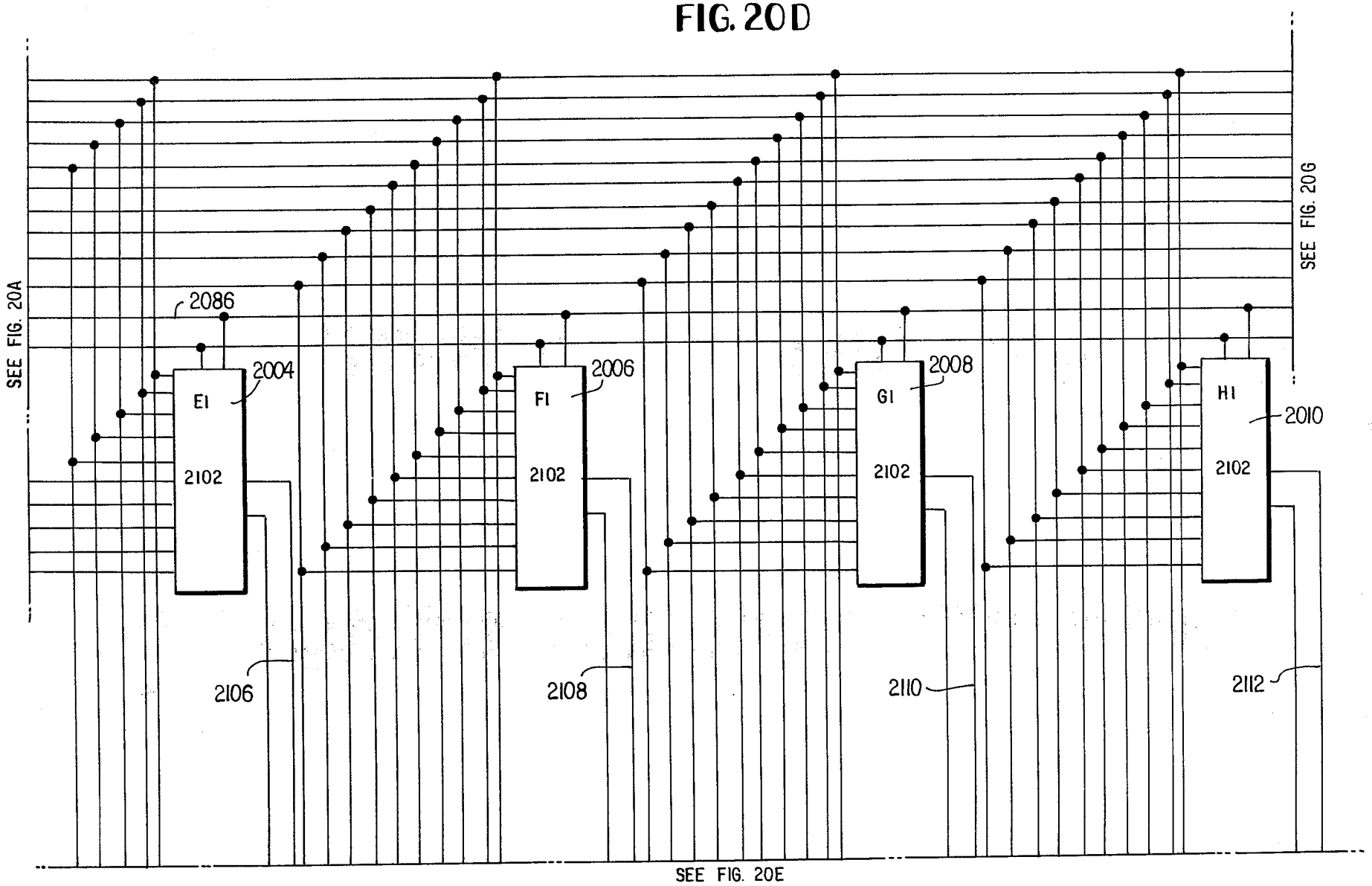
Figure 20E:
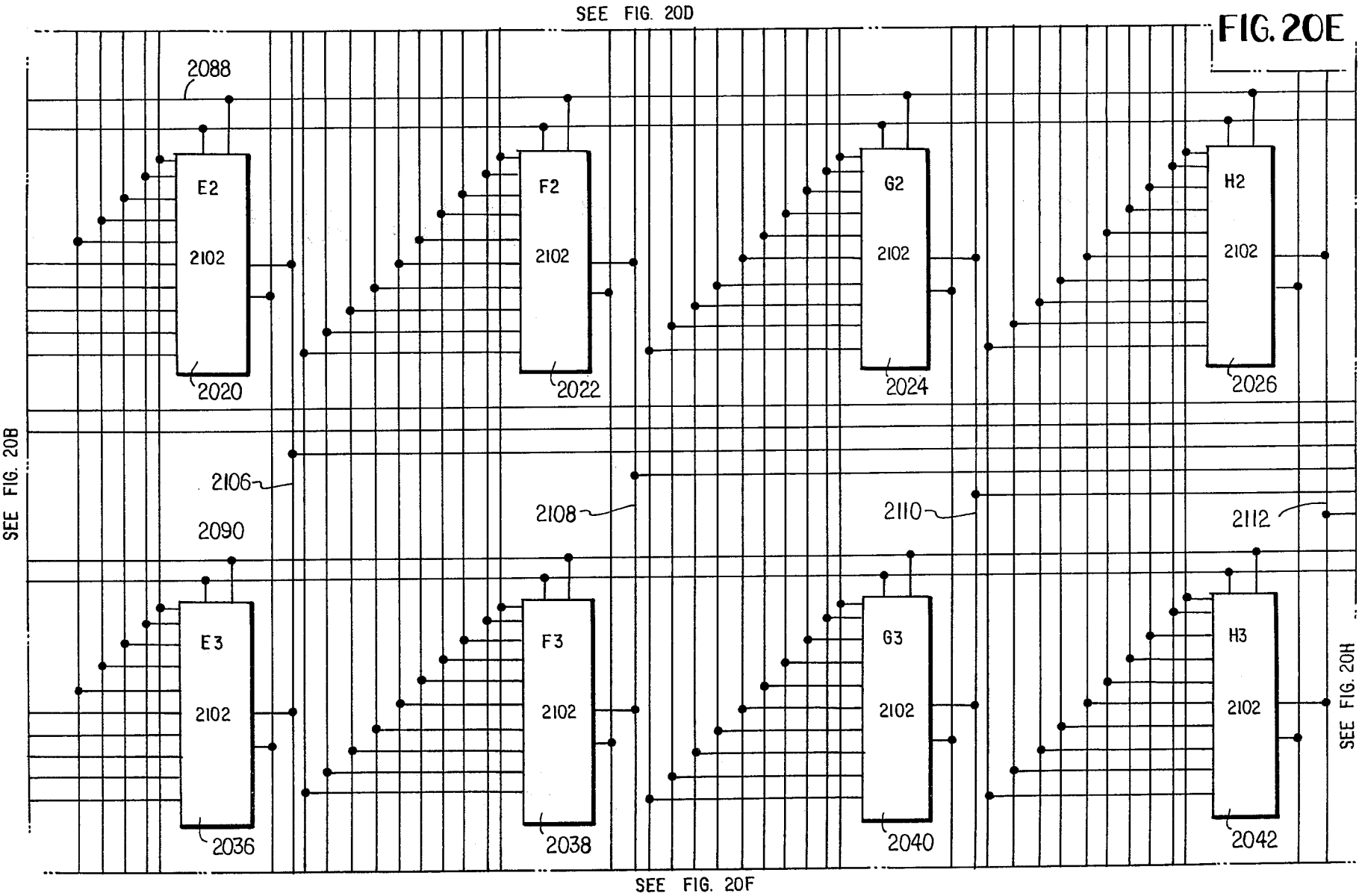
Figure 20F:
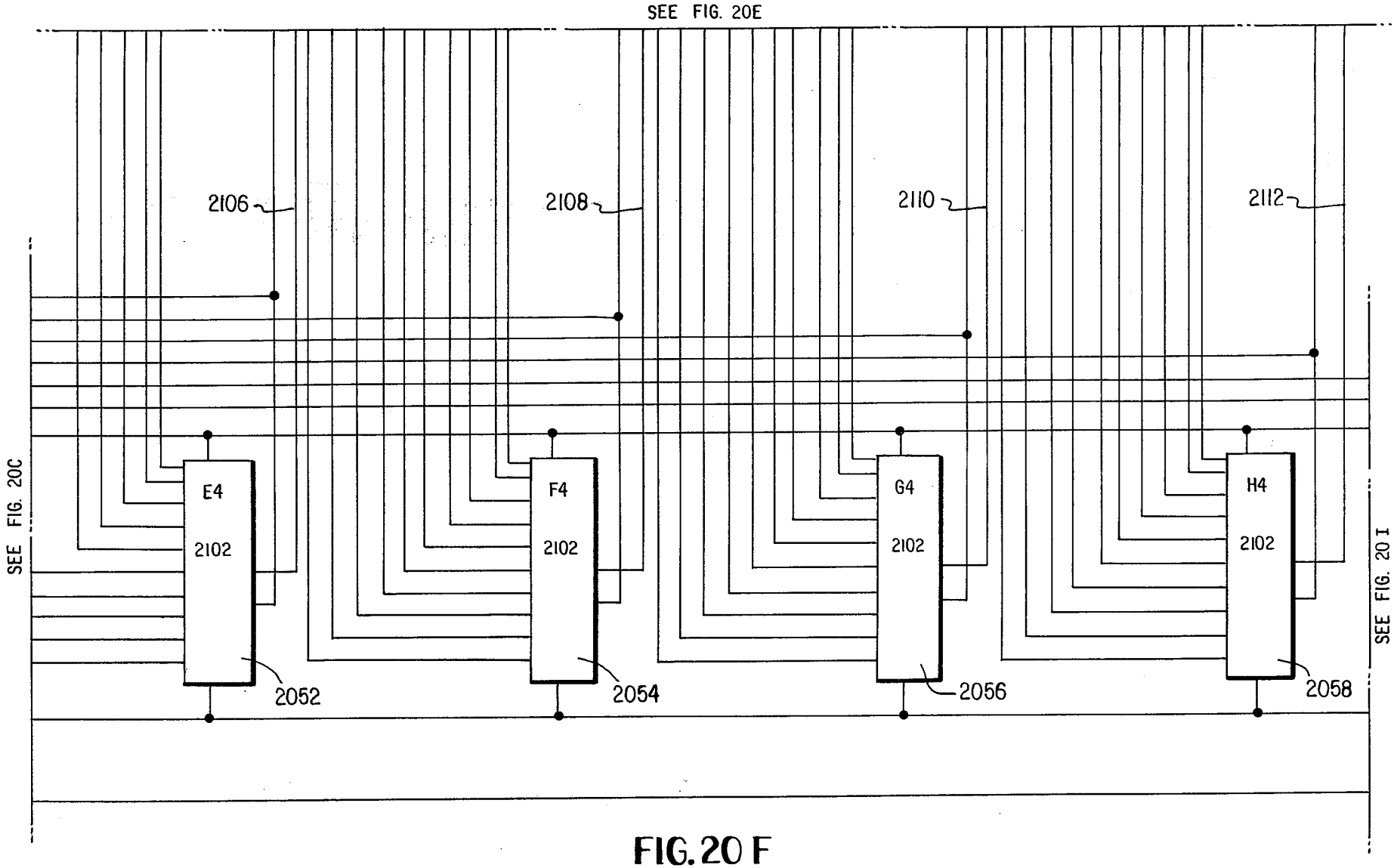
Figure 20G:
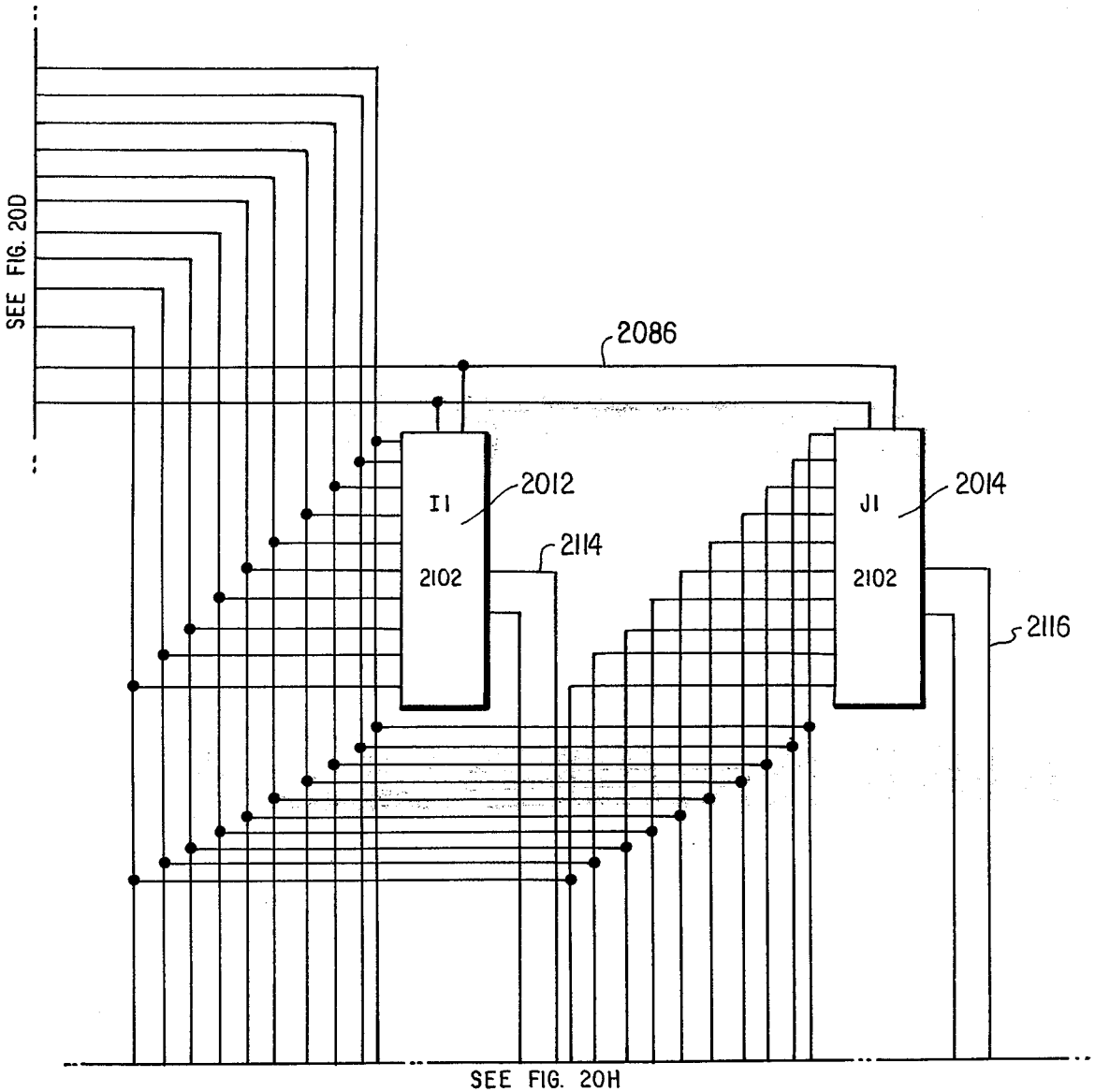
Figure 20H:
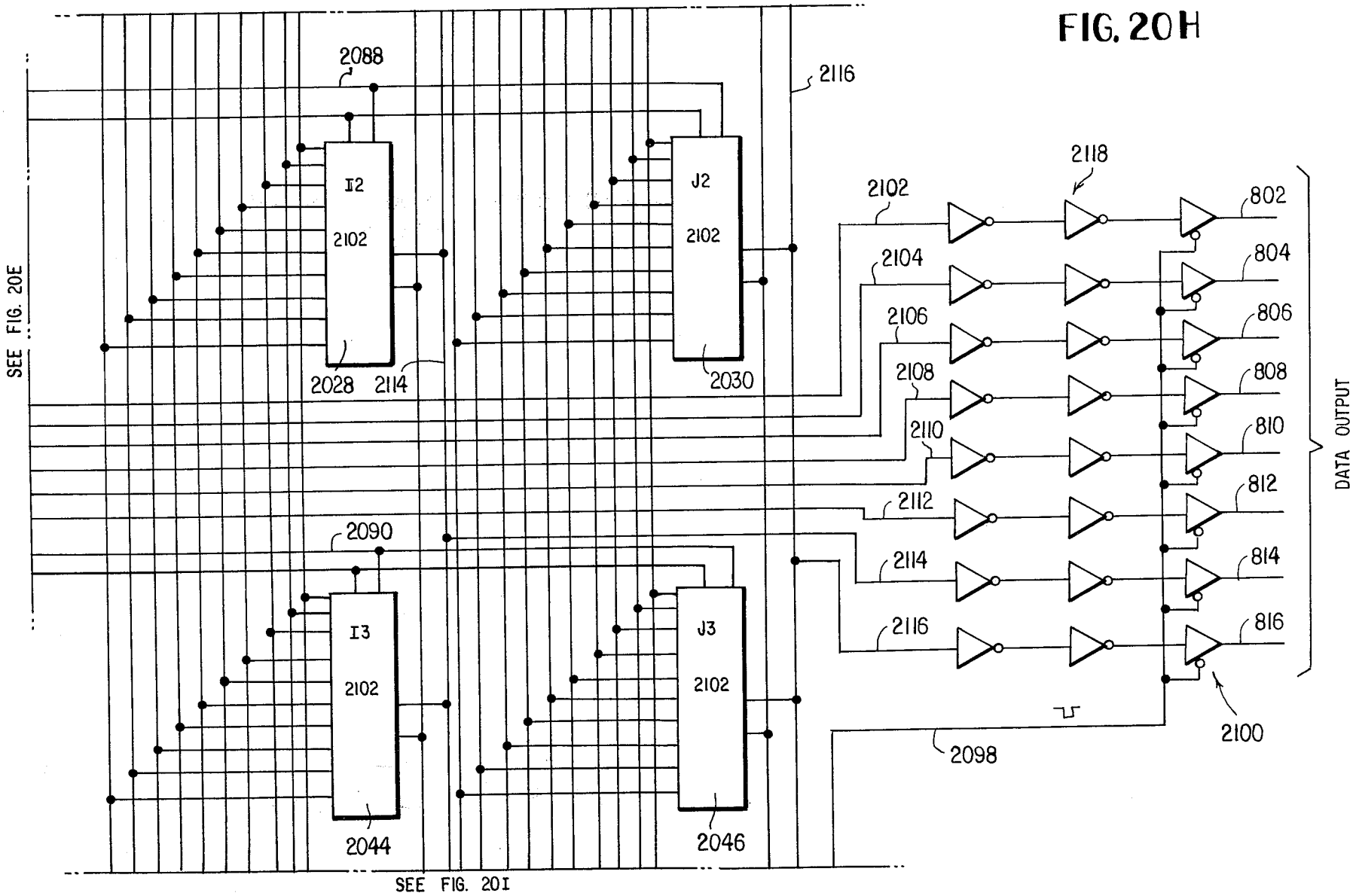
Figure 20I:
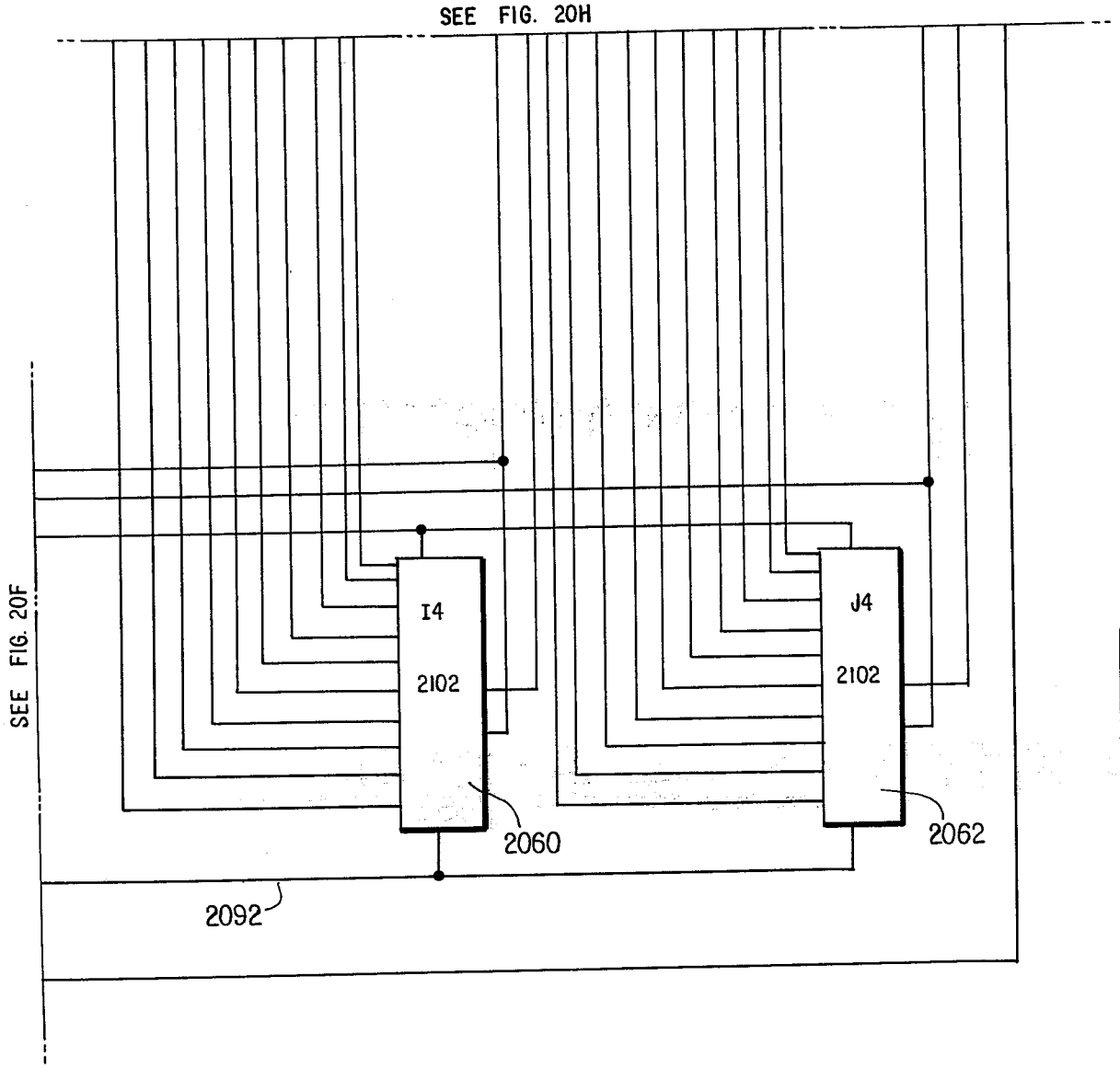
Figure 20:
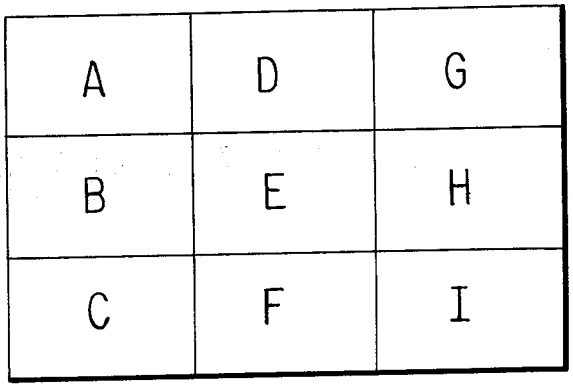

To read data into the RAM, the memory clock signal at line 800 and the read/write signal at line 818 are applied as shown in FIG. 20*a* to the gate 2120 so that during a write operation the signal at 818 will be in a high state and when the memory clock 800 is also high, the gate 2120 operates the gate 2122 to provide the TRIGGER signal to the one shot circuit 2124 to provide a high output at the output line 2125. This output is inverted at 2126 to provide the low R/W (read/write) output signal at the conductor 2128. The RC circuit 2130 is simply a timing or pulse shaping circuit associated with the one shot multivibrator 2124. The signal at 2128, then, provides both the read and the write condition, when the signal is low, the write condition is permitted provided the $\overline{CE}$ signal to that particular chip is also low, in which case the chip can accept the information at the line 2132, as shown for example in connection with the chip 2000 in FIG. 20*a*, to write in such information corresponding to the location designated by the address at the lines 2064–2082. The write inputs to the memory chips at the conductors 2132, 2134, 2136, 2138, 2140, 2142, 2144 and 2146 are provided respectively parallel to the columns of read/write memory chips and are generated from the data inputs at the conductors 820–834 as shown in FIG. 20*c* after suitable buffering as at 2148.

With reference now more particularly to FIG. 17*g* and 17*h*, the light pen interface circuit 340, the CRT logic circuit 346, the memory switching circuit 342 and the memory 344 have been previously described. At this point, a further explanation of the interrelationship among these circuits will be described first of all with reference to FIG. 17*g* and 17*h* and then with respect to the detail circuits depicted in FIGS. 24, 25, 26 and 27.

Briefly stated, as is shown in FIGS. 17*g* and 17*h*, the memory circuit 344 operates functionally in a manner identical to that described in conjunction with the RAM 306 previously described except, in the case of the memory 344, there are two rows of read/write memory chips, each containing six memory circuits. Otherwise, the functional operation is the same. Briefly stated, the memory switching circuitry 342 is controlled from the interface circuitry 340 over the line 2200 to perform a two-to-one switching over a large number of lines. In one state of the signal at the line 2200, the lines which are inputs to the memory switching circuitry 342 are connected to the output lines thereof. That is to say, in one state of the signal at 2200, the bus 318 has control of the memory 344 by virtue of the address lines 604–614 and 730–738 which are brought out over the lines indicated generally by the reference character 2202 while the bus lines 742–750 provide input into the memory and in this state the read/write signal at the line 740 is brought out at line 2204 whereas the clock 468 is brought out at line 2206. Also, the lines 2220–2230 are brought out to the bus over the lines 600 and 700–708 at the same time the signal at line 2200 provides the $\overline{\text{VIDEO ENA}}$ signal which blanks the CRT 336.

In the opposite state of the signal at line 2200, the memory 344 is interrogated by the CRT logic 346 over the address to memory lines 2252–2258, 2268–2274 and 2284–2288 which are outputed to the memory 344 over the conductors 2202 and the output to the lines 2220–2230 provide data input from the memory to the CRT logic 346 for display on the CRT 336. From the CRT logic circuit 346 there are a plurality of lines defining the coordinate of the light pen on the face of the CRT 336 which are brought out over the lines 2230–2250 and which are outputed to the bus over the lines 600 and 700–718 from the light pen interface 340.

Referring to the memory switching circuit in FIG. 25a, when the signal at 2200 is high, the screen is blanked and the control signal as inverted at 2260 provides a signal at 2262 which is low to the multiplexers 2265, 2266, and 2267 so as to connect the lines 604–610 to the corresponding lines 2268, 2270, 2272 and 2274; the lines 612, 614, 730 and 732 to the corresponding output lines 2276, 2278, 2280 and 2282; and the lines 734, 736 and 738 to the corresponding output lines 2284, 2286 and 2288. The signal at the line 2292 is of course high at this time. When the signal at 2200 changes state so as to enable the CRT display to be made, the signals at 2262 and 2292 respectively are high and low so that the lines 2252–2258 are brought out at the lines 2270–2276; the lines 2260–2266 are brought out at the lines 2278–2284 and the lines 2268–2272 are brought out at the lines 2286, 2288 and 2290 respectively.

When the signal at 2200 is high so that the CRT screen is off, the signal at 2292 is brought through the inverter 2300 and the inverter 2302 of FIG. 25*b* so as to enable the bank NAND gates 2304 so that the character from the memory 344 is brought out to the bus over the lines 2220–2230 tp appear at the lines 600 and 700–708. The read/write control signal at line 740 is also passed by a gate of the bank 2304 to provide a signal over the line 2204 to the memory 344. At the same time the output of the inverter 2300 provides a signal at line 2310 providing one input to the NAND gate 2312 of FIG. 25*c*, the other input being provided by the NEW DATA READY signal from port 1 of the input/output section 314 (FIG. 17*b*) at the conductor 468 which is provided to the NAND gate 2314, FIG. 25*a*. The other input to the gate 2314 is the signal at 468 delayed by the circuit 2315 to provide a short duration, negative-going output pulse at the conductor 2316 thereby to provide the clock signal output from the gate 2312 at 2206.

The CRT logic circuitry is illustrated in FIGS. 26*a* –26*h* and in order best to understand its operation, a general description will be given first. The purpose of this circuitry is to provide synchronization with the CRT and, to this end, a free-running oscillator 2472 is provided which cooperates with a set of counters 2442, 2428, 2429, 2426, 2486, 2496, 2400 and 2401 to provide the horizontal sync signal at line 2422 and the vertical sync signal at line 2423 which are applied to the CRT to control the CRT raster. Further, these counters cyclically interogate the memory 344 (FIG. 17*h*) which has the ballot format stored therein from the processing system. This interogation is effected over the address lines 2252, 2254, 2256, 2258, 2268, 2270, 2274, 2284, 2286 and 2288. In response to this interrogation, the character data or code is received from the memory 344 over the lines 2232–2242. The character generator 2450 decodes the character data and under control of the slice converter 2468. This converter is clocked by the oscillator 2472 to provide the video information serially shifted from the converter 2468 at the frequency of the oscillator 2472. This video information causes either the presence or absence of a dot of video information at the CRT display.

The CRT display format is a 5 × 7 dot character in which the individual characters are separated by two dot spaces in the horizontal direction and three dot spaces vertically. In the embodiment illustrated, provision is made for thirty two characters in the horizontal direction and for sixteen horizontal lines of characters, although it is to be understood that a great many more characters may be utilized dependent upon the size of the CRT screen and the memory capability.

The counters 2400 and 2401 determine the number of characters displayed in a line while the counter 2442 determines the number of lines of characters displayed. To provide coordinate information synchronized with the CRT, these counters are connected to the latches 2624, 2626 and 2628 and to identify the coordinates of a character point selected by the voter through use of the light pen at the CRT display, a clock input at the line 2604 from the light pen initiates latching of the coordinate information. This coordinate information appears at the lines 2230–2236 and 2240–2250 (FIG. 17*g*) for passing the information through the light pen interface circuit 340 to the bus 318.

Figure 26A:
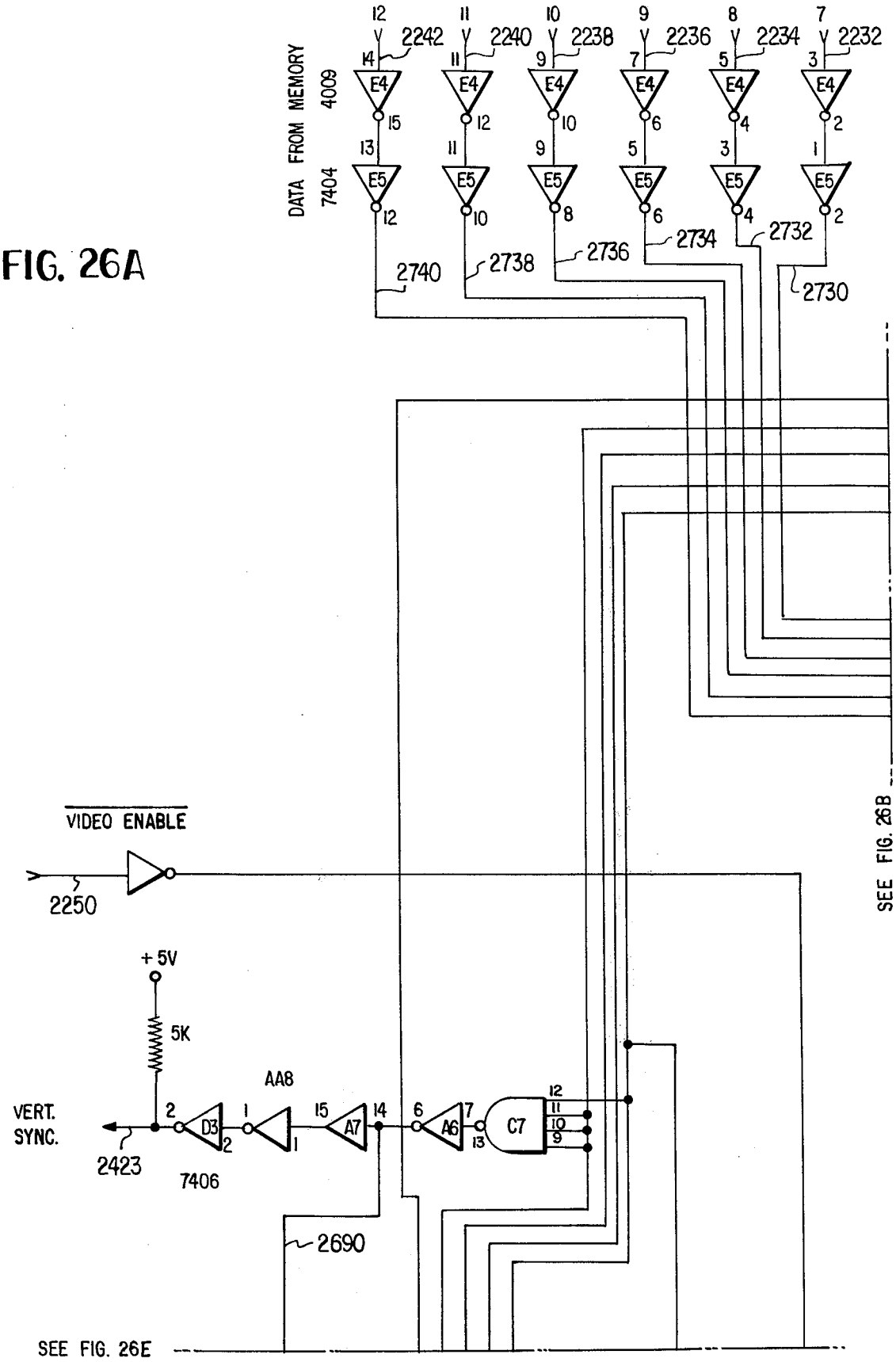
Figure 26B:
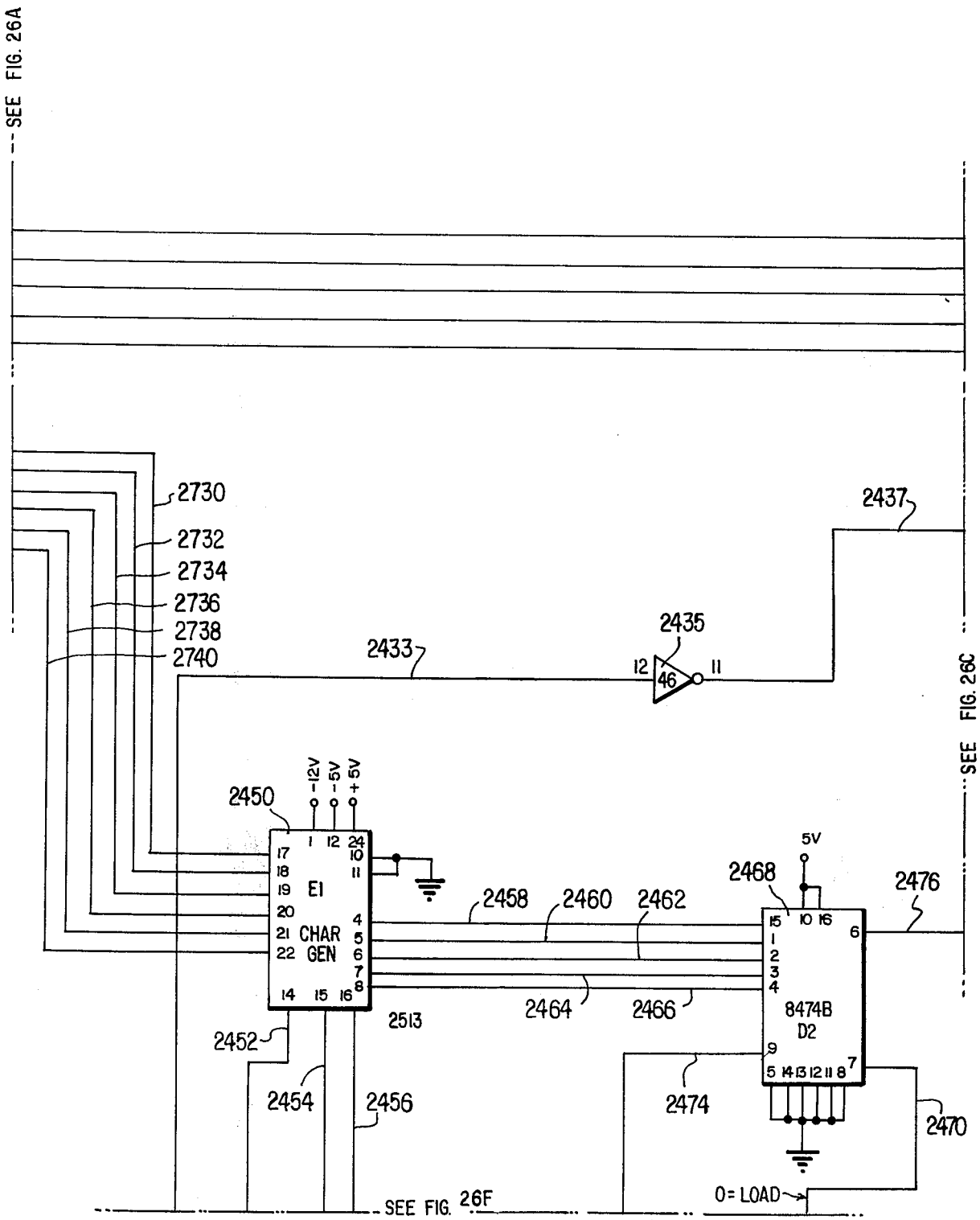
Figure 26C:
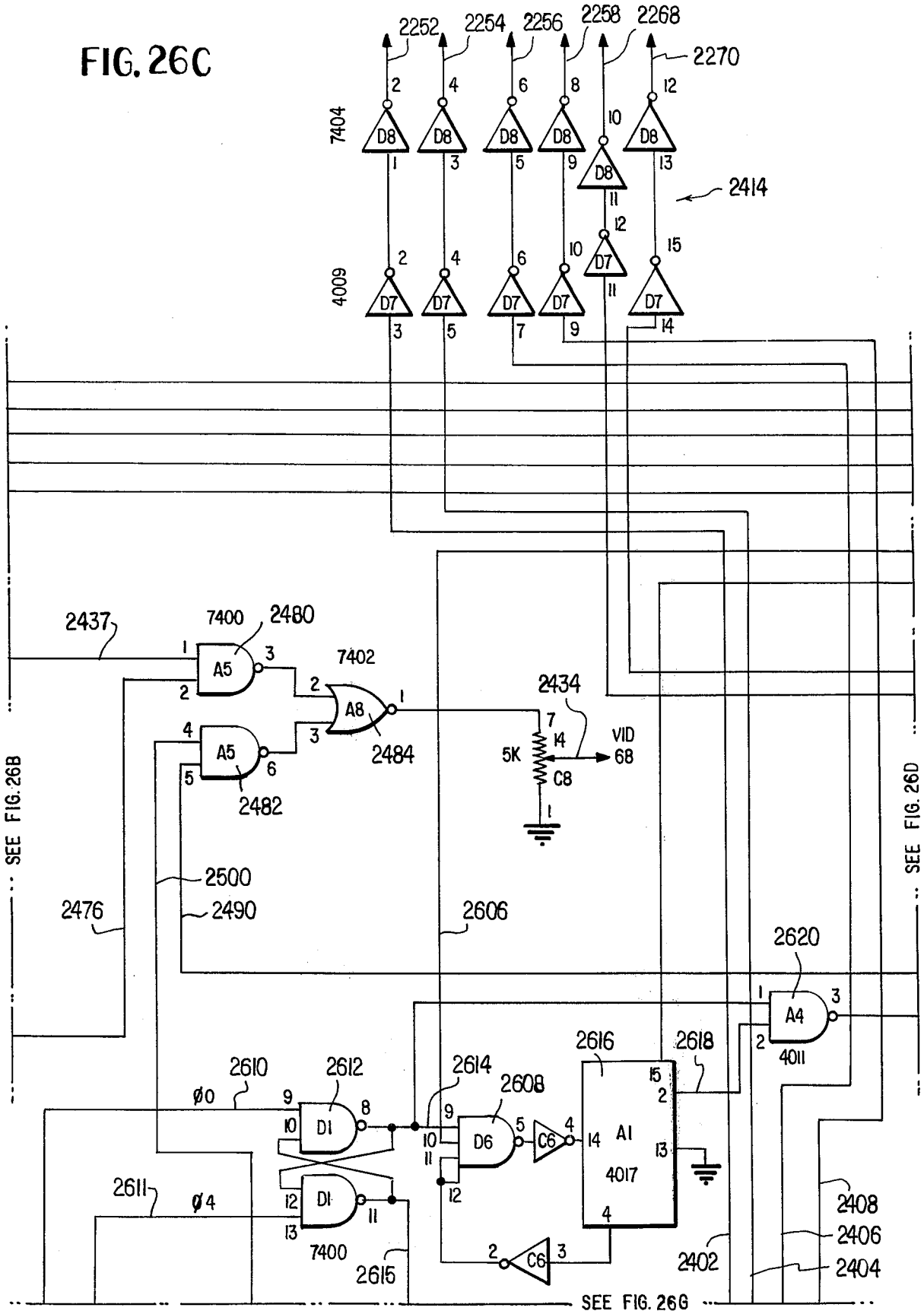

With reference to circuit details, the oscillator 2472 is shown in FIG. 26 f and its output is inverted at 2473 to provide a clocking input at the line 2474 applied to the counter 2486 and to the parallel-to-serial converter 2468 (FIG. 26b). The counter 2486 is connected to the decoder 2472 such that at the first count (phase zero) an output appears at the conductor 2610, at the fifth count (phase four) an output appears at the conductor 2611, at the seventh count an output appears at the conductor 2470, and provision is made through the resetting NAND gate 2522 (FIG. 26*g*) to provide a reset signal at the conductor 2523 which resets the counter 2486 to zero every eighth count. Since each pulse from the oscillator 2472 corresponds to a character dot position and each character is five dots wide, the aforesaid two dot spacing horizontally between characters is achieved.

The line 2470 is connected to the converter 2468 (FIG. 26*b* ) and causes the character generator information at the lines 2458–2466 to be loaded into the converter every seventh clock input so that this information is stored and shifted out serially at line 2476 during a succeeding series of five clock pulses.

At the beginning of each horizontal scan of the CRT, the blanking counter 2496 (FIG. 26*g*) has been reset to zero by a signal at the line 2520 so that at the beginning of each scan, the enabling input at line 2500 to the NAND gate 2502 is low until eight characters have been counted by the counter 2486, the clock input to the counter 2496 being over the line 2492 to the NAND gate 2504. The enabling input at line 2507 to the gate 2504 remains high until the signal at the line 2500 goes high, because of the inverter 2505. As soon as the blanking counter 2496 produces its output at the line 2500 such output is held because the enabling input to the gate 2504 is removed and this counter will not count again until reset.

The signal at the line 2500 provides an enabling input to the NAND gate 2502 so that now the clock signals at the line 2492 may be passed to the character number counter 2400. At the same time, the enabling input to the NAND gate 2482 (FIG. 26) is provided so tha the enabling input at the line 2488 to the NOR gate 2484 is also provided, thus now allowing video dot information output at the line 2434. In consequence, the counter 2496 in effects blanks the CRT during the beginning of each horizontal sweep so as to provide a margin. The margin at the end of every horizontal sweep is determined by the number of characters displayed in each line.

Figure 26D:
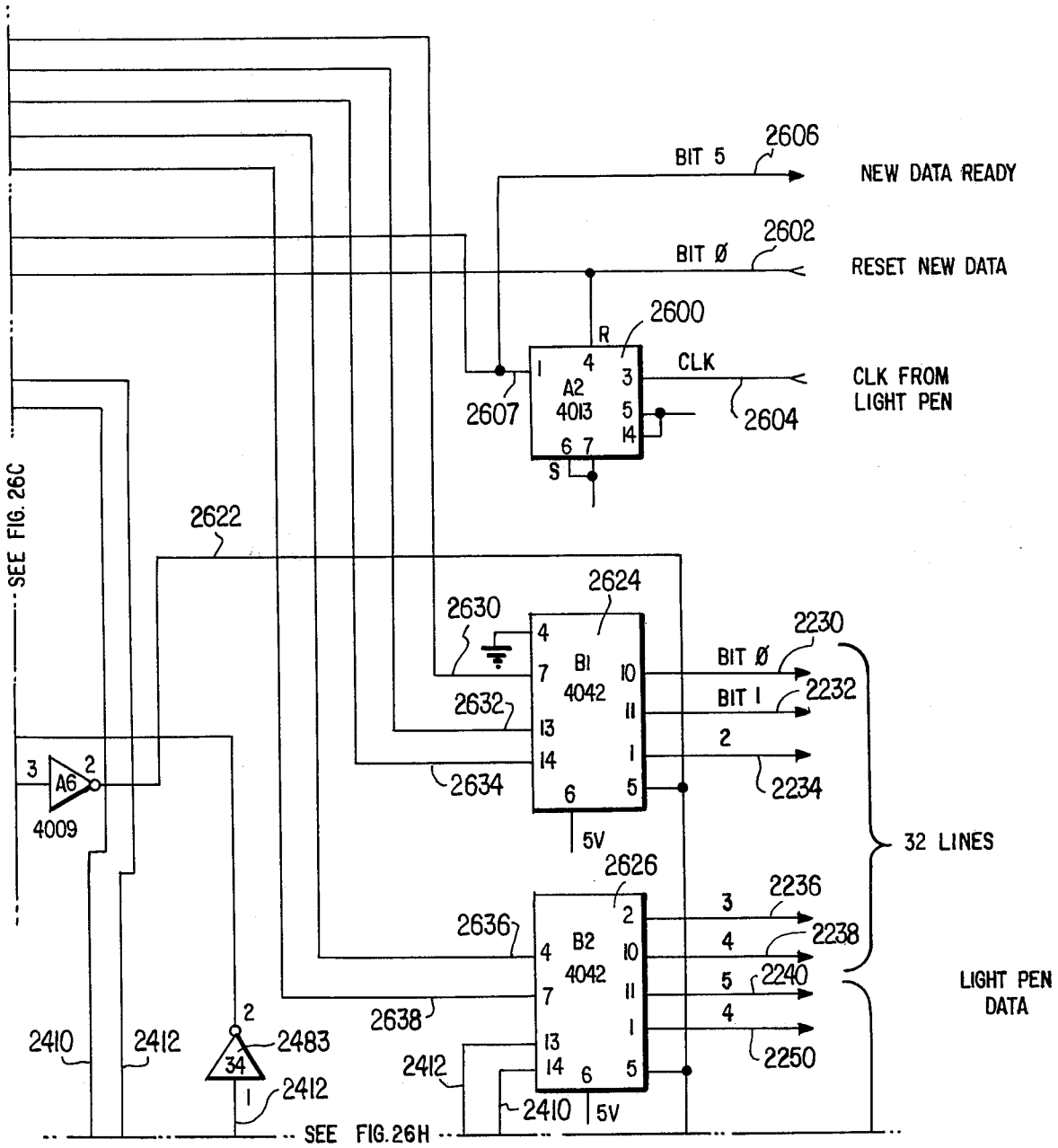
Figure 26E:
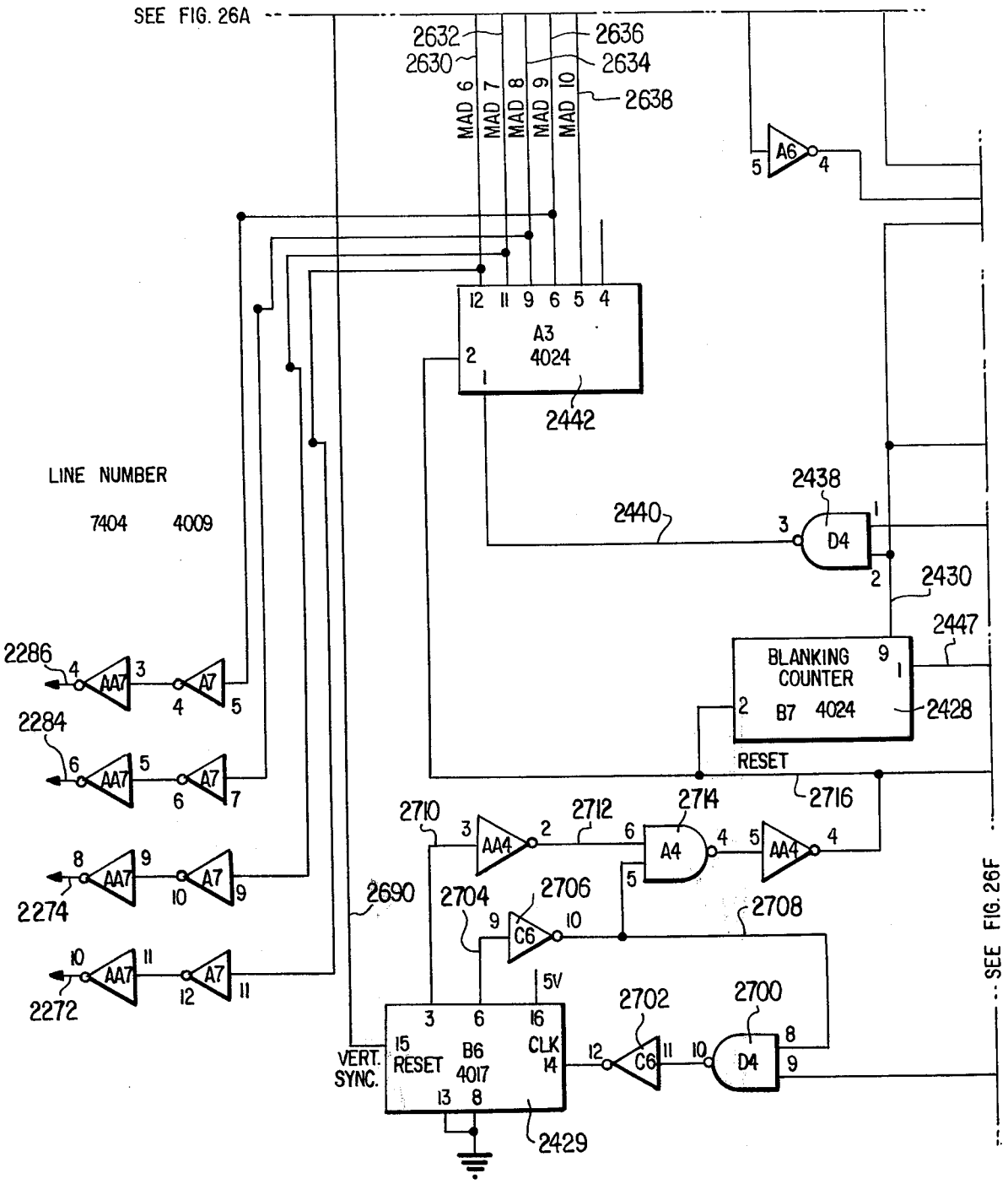

The character number count is effected by the two counters 2400 and 2401 whose outputs at the lines 2402–2412 provide capability for a maximum of sixty four characters although the resetting circuitry therefore allows them to count only to forty eight characters. The outputs from the counters 2400–2401 provide, through the buffers 2414, the address outputs at the lines 2252, 2254, 2256, 2258, 2268 and 2270 to the 2K × 6 memory 344. Athe same time, the memory chip rows are addressed over the lines 2274, 2284, 2286, and 2288 under control of the counter 2442. The outputs of the counter 2442 at the lines 2630, 2632, 2634, 2636 and 2638 are applied to the latches 2624 and 2626 (FIG. 26*d*) whereas the outputs of the counters 2400 and 2401 at the lines 2402, 2404, 2406, 1408 1410 and 2412 are applied to the latches 2626 and 2628 (FIGS. 26*d* and 26*h*).

Figure 26F:
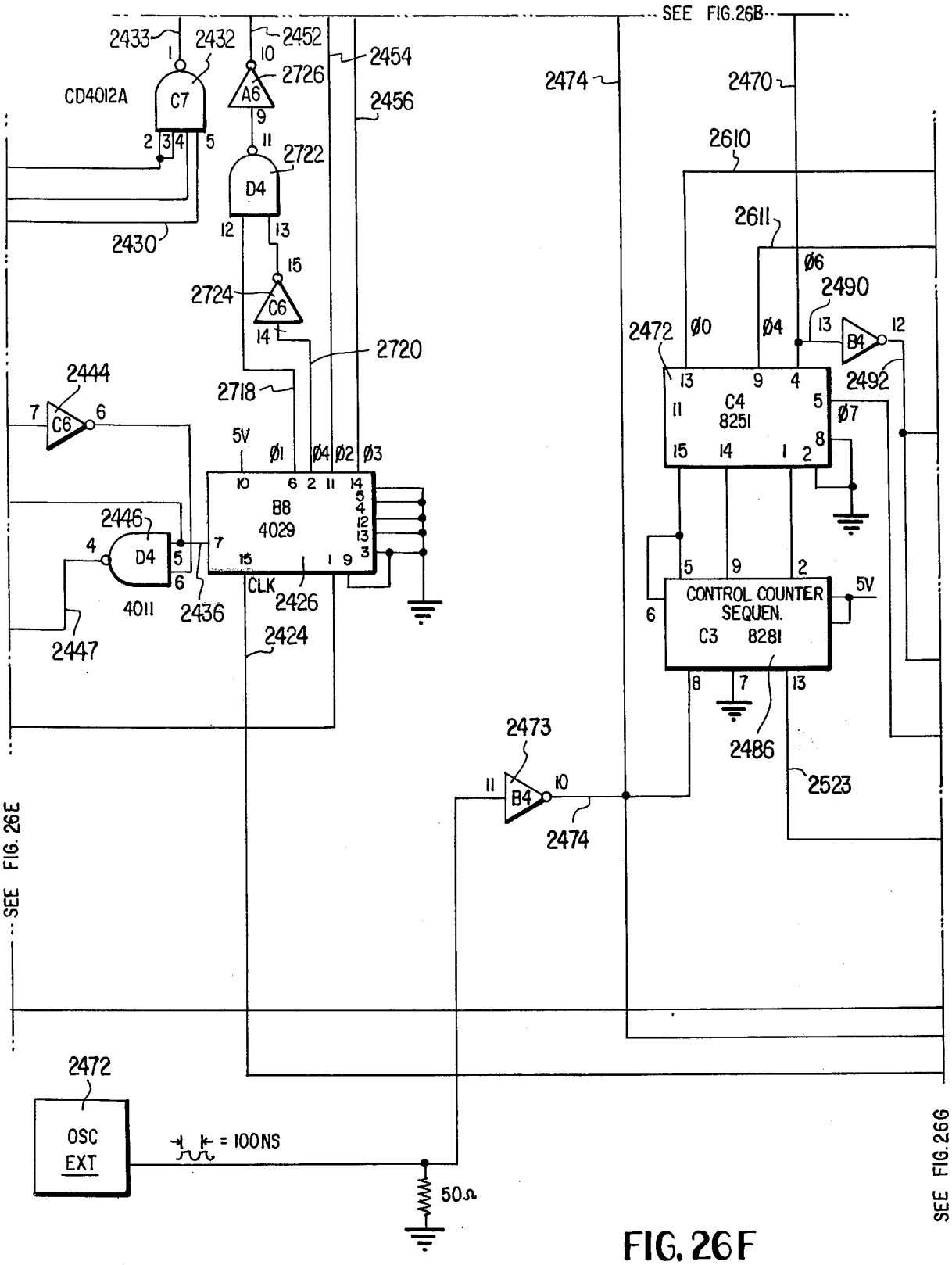
Figure 26G:
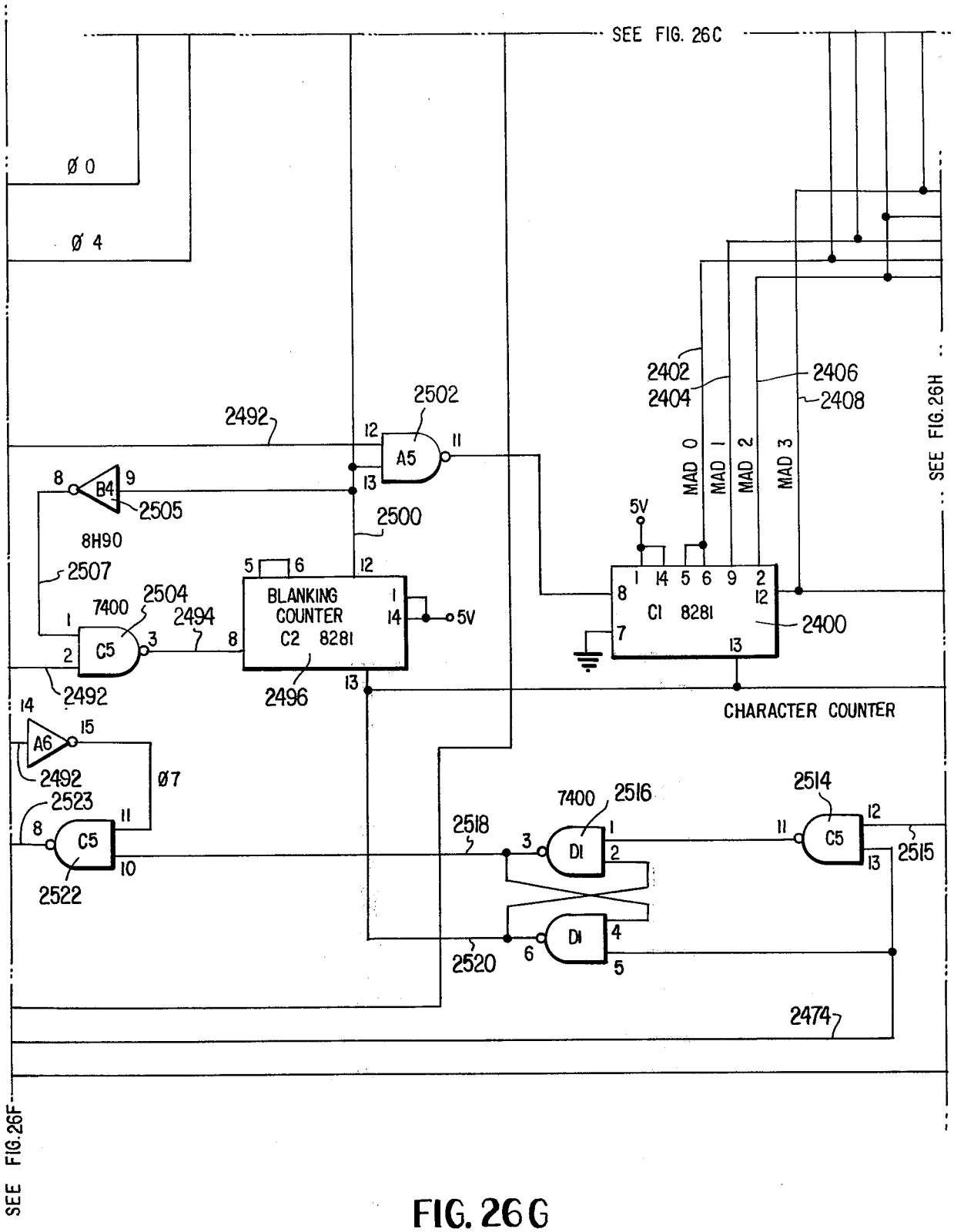
Figure 26H:
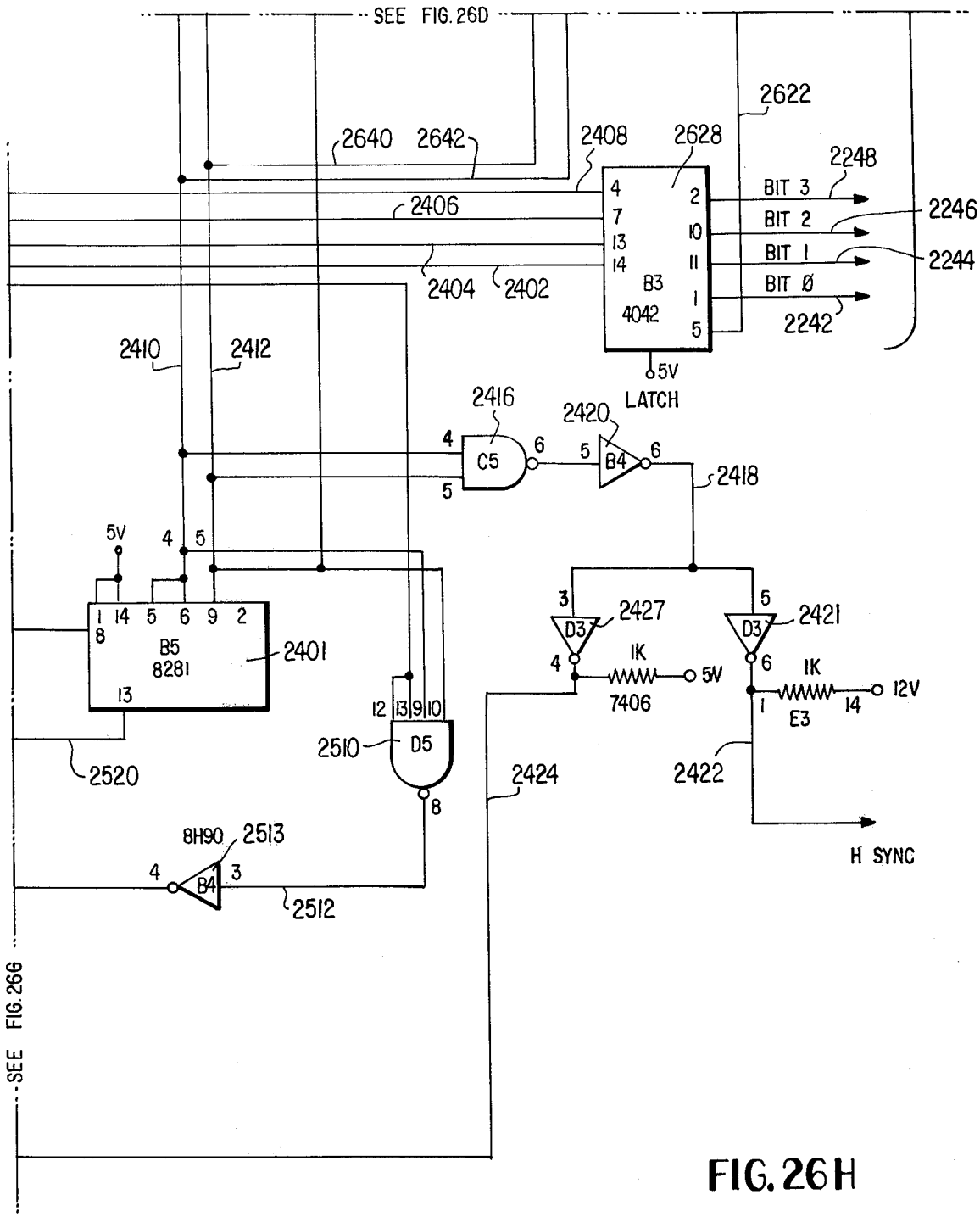

To produce the horizontal sync signal, the NAND gate 2416 is connected to the lines 2410 and 2412 from the counter 2401 and its output, through the inverters 2420 and 2421 appears at the line 2422 (FIG. 26*h*). At the same time, the inputs at the lines 2406, 2410 and 2412 to the NAND gate 2510 are high so that its output conductor provides a high signal, after inversion at 2513, in the line 2515 thereby to enable the NAND gate 2514 so that in the next interpulse period of the oscillator 2472, the output of the gate 2514 goes low to trigger the cross-coupled NAND gates 2516 thereby to reset the counters 2496, 2400 and 2401.

At the same time, the inverter 2427 (FIG. 26*h*) provides a high signal at the line 2424 for clocking the counter 2426 (FIG. 26*f*). The counter 2426 is decode counter so that, within the context of the 5 × 7 character matrix, three dot spaces are provided vertically between lines of characters. When the counter 2426 counts up to ten from the character line clock inputs thereto at the conductor 2424, the signal at the line 2436 goes high to the NAND gate 2446, the enabling input thereto from the inverter 2444 normally being high. The low signal now appearing at the line 2447 clocks the blanking counter 2428 so that its normally low output at the line 2430 now goes high, thus enabling the NAND gate 2438 to allow clock input to the counter 2442 over the line 2440. These clock inputs are provided by the output at the line 2436 of the decade counter 2426 so that the counter counts at every eleventh raster line, the inverter 2444 holding the output of the counter 2428 at the line 2430 high because the gate 2446 is not disabled. Until the signal at the line 2430 goes high, the NAND gate 2432 is disabled so that its output at the line 2433 is high to provide, through the inverter 2435, a low signal at the line 2437 which disables the NAND gate 2480. Thus, if either the horizonal blanking counter 2496 has not provided a high output at the conductor 2500 or the vertical blanking counter 2428 has not provided a high output at the conductor 2430, no video dot information can pass the NOR gate 2484. The actual dot information input is at the line 2476 associated with the gate 2480 whereas the gate 2482 acts to enable the gate 2484. The input at line 2490 to the gate 2482 is provided through the inverter 2483 from the output line 2412 of the counter 2401.

It will be noted that CPU resets the flip-flop 2600 over the line 2602 when new data is desired and it will also be noted that a clock input is provided at the line 2604 whenever the electron beam scans past the light pen placed at the face of the CRT to toggle the flip-flop 2600 causing a high output at the conductor 2606.

The signal at the conductor 2606 also provides the NEW DATA READY signal which is outputted to the bus in addition to providing one of the enabling inputs to the gate 2608. When the signal at conductor 2610 goes high, it toggles a flip-flop 2612 and provides the last enabling input at the conductor 2614 to count the counter 2616 which provides a high input at the conductor 2618 to the gate 2620 to produce a high pulse at the output conductor 2622 which causes the latches 2624, 2626 and 2628 to latch the information at the inputs thereto.

The flip-flop 2612 also provides a clock input to the counter 2429 over the line 2615 through the NAND gate 2700 and the inverter 2702, causing the counter 2429 to count. When the counter 2429 reaches the count of seven, the output at the line 2704 goes high so that after inversion at 2706 the signal at the line 2708 goes low to prevent further counting. When a vertical sync signal appears at the line 2690, the counter 2429 is reset and its output at the line 2710 is high. However, this output goes low for the following five clock inputs from the flip-flop 2612 so that output at the line 2712 is high. During these same five counts the output at the line 2704 is low so that the inverter 2706 provides the other high input to the NAND gate 2714 so that a high reset signal appears at the line 2716. The output at the conductor 2704 goes high on the seventh count, thus terminating the reset signal on the line 2716 and, of course, on the first count or reset of the counter 2429, the signal at the line 2710 is high to prevent the reset signal at the line 2716.

The character generator 2450 accepts the character code at the lines 2730–2740 and outputs at the lines 2458–2466 the five bits corresponding to a character slice data in response to the coding at the lines 2452, 2454 and 2456 derived from the slice counter 2426, each slice corresponding to one raster line.

When all of the signals at the lines 2452, 2454 and 2456 are low, the blank condition of the data at the lines 2458–2466 is present. Conditions one through seven provided by the code on the lines 2452–2456 selects the proper slice data to display the number corresponding to the code input at the lines 2730–2740. When the signal at the line 2720 goes high during the eighth and ninth clock inputs the NAND gate 2722 is disabled due to the presence of the inverter 2724, providing zero code on the three lines 2452–2456. The counter phases of the lines 2718, 2720, 2454 and 2456 are as shown in FIG. 26*f*.

The construction and function of the light pen will be seen by reference to FIGS. 27*a*–27*c*. the pen itself is designated generally by the reference character 2800 and includes a suitable casing 2802 having a tip portion housing a photosensitive diode 2804. The diode 2804 is a high impedance device and an impedance matchuing unity gain FET 2806 is connected to the terminals 2808 and 2810 of the diode to provide an output signal across the load resistor 2812. This output, dependent upon exact placement of the pen and its diode 2804, may have as many as seven peaks corresponding to the seven lines of the raster illuminated in a target area of the CRT which are provided for voter selection. This signal is coupled through the capacitor 2814 to a wide band amplifier 2816 which separates the aforesaid peaks of the signal into separate pulses. These pulses are differentiated by the capacitor 2818 and applied to the pulse-shaping transistor 2820 whose output at the conductor 2822 is applied to one input of the dual Schmitt trigger circuit 2824.

When the voter depresses the switch 2826, the four inputs 2828, 2830, 2832 and 2834 to one of the Schmitt triggers are connected to the ground conductor 2836, thus to provide the output from this trigger at the conductor 2838. This output provides the inputs to three of the four inputs of the other Schmitt trigger at the terminals 2840, 2842 and 2844 while the fourth input is provided from the transistor 2830. This causes output from the circuit 2824 at the conductor 2846 which is applied to the high gain amplifier arrangement 2848 to effect, across the load resistor 2850, the light pen clock signal at the conductor 2604 as previously described.

What is claimed is:

1. An electronic voting machine comprising, in combination:

processor means for processing selections made by a voter;

visual display means connected to said processor means for displaying a ballot to a voter; and vote selection means connected to said processor means for allowing a voter to make selections from the displayed ballot;

said processor means including storage means for storing valid selections made by a voter, including recording means connected to said processor means for recording the valid selections made by a voter, verification means under control of a voter for causing display of the valid selections on said visual display means, said verification means effecting transfer of the valid selections from said storage means to said recording means whereby the displayed verification is identical with recorded information.

2. An electronic voting machine as defined in claim 1 including exit control means under control of a voter for committing said displayed verification to said recording means.

3. An electronic voting machine as defined in claim 1 wherein said vote selection means is effective to allow a voter to alter his selections after verification.

4. An electronic voting machine as defined in claim 2 wherein said vote selection means is effective to allow a voter to alter his selections after verification.

5. An electronic voting machine comprising, in combination:

processor means for processing selections made by a voter;

visual display means connected to said processor means for displaying a ballot to a voter;

vote selection means connected to said processor means for allowing a voter to make selections from the displayed ballot;

said processor means including storage means for storing valid selections made by a voter; and means for causing said visual display means to display the alphabet in response to write-in request by a voter, and wherein said processor means stores as a write-in vote sequentially those letter selections effected from the alphabet display.

6. An electronic voting machine as defined in claim 5 including recording means connected to said processor means for recording the valid selections made by a voter.

7. An electronic voting machine as defined in claim 5 including verification means under control of a voter for causing display of the valid selections on said visual display means.

8. An electronic voting machine as defined in claim 5 including exit control means under control of a voter for committing said displayed verification to said recording means.

9. An electronic voting machine as defined in claim 6 including verification means under control of a voter for causing display of the valid selections on said visual display means, said verification means effecting transfer of the valid selections from said storage means to said recording means whereby the display verification is identical with recorded information.

10. An electronic voting machine as defined in claim 7 wherein said vote selection means is effective to allow a voter to alter his selections after verification.

11. An electronic voting machine as defined in claim 9 wherein said vote selection means is effective to allow a voter to alter his selections after verification.

12. An electronic voting machine as defined in claim 8 wherein said vote selection means is effective to allow a voter to alter his selections after verification.

13. An electronic voting machine comprising, in combination:

processor means for processing selections made by a voter;

visual display means connected to said processor means for displaying a ballot to a voter; and vote selection means connected to said processor means for allowing a voter to make selections from the displayed ballot;

said processor means including storage means for storing valid selections made by a voter;

said visual display means being in the form of a cathode ray tube and said vote selection means being in the form of a light pen.

14. An electronic voting machine as defined in claim 13 wherein each ballot contains discrete target areas corresponding to vote selection points and said visual display means includes circuitry for identifying the coordinates of a point on the display at which the light pen is placed, said processor means being effective to store a valid vote selection when the coordinates identified by said visual display means coincide with a discrete target area.

15. An electronic voting machine as defined in claim 13 including recording means connected to said processor means for recording the valid selections made by a voter.

16. An electronic voting machine as defined in claim 15 wherein each ballot contains discrete target areas corresponding to vote selection points and said visual display means includes circuitry for identifying the coordinates of a point on the display at which the light pen is placed, said processor means being effective to store a valid vote selection when the coordinates identified by said visual display means coincide with a discrete target area.

17. An electronic voting machine as defined in claim 13 including means for causing said visual display means to display the alphabet in response to write-in request by a voter, and wherein said processor means stores as write-in vote sequentially those letter selections effected from the alphabet display.

18. An electronic voting machine as defined in claim 14 wherein said light pen includes a light-sensitive diode and circuit means for producing an output pulse in time-related reference to the visual display.

19. An electronic voting machine as defined in claim 14 wherein said light pen includes a light-sensitive diode and circuit means for producing an output pulse in time-related reference to the visual display.

20. An electronic voting machine as defined in claim 15 including verification means under control of a voter for causing display of the valid selections on said visual display means, said verification means effecting transfer of the valid selections from said storage means to said recording means whereby the displayed verification is identical with recorded information.

21. An electronic voting machine as defined in claim 15 including exit control means under control of a voter for committing said displayed verification to said recording means.

22. An electronic voting machine as defined in claim 16 wherein said light pen includes a light-sensitive diode and circuit means for producing an output pulse in time-related reference to the visual display.

23. An electronic voting machine as defined in claim 17 including verification means under control of a voter for causing display of the valid selections on said visual display means.

24. An electronic voting machine as defined in claim 23 wherein each ballot contains discrete target areas corresponding to vote selection points and said visual display means includes circuitry for identifying the coordinates of a point on the display at which the light pen is placed, said processor means being effective to store a valid vote selection when the coordinates identified by said visual display means coincide with a discrete target area.

25. An electronic voting machine as defined in claim 24 wherein said light pen includes a light-sensitive diode and circuit means for producing an output pulse in time-related reference to the visual display.

26. An electronic voting machine as defined in claim 20 wherein each ballot contains discrete target areas corresponding to vote selection points and said visual display means includes circuitry for identifying the coordinates of a point on the display at which the light pen is placed, said processor means being effective to store a valid vote selection when the coordinates identified by said visual display means coincide with a discrete target area.

27. An electronic voting machine as defined in claim 21 wherein each ballot contains discrete target areas corresponding to vote selection points and said visual display means includes circuitry for identifying the coordinates of a point on the display at which the light pen is placed, said processor means being effective to store a valid vote selection when the coordinates identified by said visual display means coincide with a discrete target area.

28. An electronic voting machine as defined in claim 27 wherein said light pen includes a light-sensitive diode and circuit means for producing an output pulse in time-related reference to the visual display.

29. An electronic voting machine as defined in claim 17 wherein each ballot contains discrete target areas corresponding to vote selection points and said visual display means includes circuitry for identifying the coordinates of a point on the display at which the light pen is placed, said processor means being effective to store a valid vote selection when the coordinates identified by said visual display means coincides with a discrete target area.

30. An electronic voting machine as defined in claim 29 wherein said light pen includes a light-sensitive diode and circuit means for producing an output pulse in time-related reference to the visual display.

31. An electronic voting machine comprising, in combination:

a processor means including a read only memory, a random access memory, a central processing unit and an input/output section;

visual display means for displaying a ballot to a voter;

vote selection means for allowing a voter to make selections in response to the displayed ballot;

recording means for recording selections made by a voter; and bus means connecting said processor means with said visual display means, said vote selection means and said recording means, verification means under control of a voter for effecting transfer of valid selections made by the voter from said processor means to said recording means and for displaying such transferred information on said display means.

32. An electronic voting machine as defined in claim 31 including exit control means under control of a voter for committing said displayed verification to said recording means.

33. An electronic voting machine as defined in claim 32 wherein said vote selection means is effective to allow a voter to alter his selections after verification.

34. An electronic voting machine comprising, in combination:

a processor means including a read only memory, a random access memory, a central processing unit and an input/output section;

visual display means for recording a ballot to a voter;

vote selection means for allowing a voter to make selections in response to the displayed ballot;

recording means for recoring selections made by a voter; and bus means connecting said processor means with said visual display means, said vote selection means and said recording means;

said visual display means being in the form of a cathode ray tube and said vote selection means being in the form of a light pen.

35. An electronic voting machine as defined in claim 34 wherein each ballot contains discrete target areas corresponding to vote selection points and said visual display means includes circuitry for identifying the coordinates of a point on the display at which the light pen is placed, said processor means being effective to store a valid vote selection when the coordinates identified by said visual display means coincide with a discrete target area.

36. An electronic voting machine as defined in claim 35 wherein said light pen includes a light-sensitive diode and circuit means for producing an output pulse in time-related reference to the visual display.

37. An electronic voting machine comprising, in combination:

a processor means including a read only memory, a random access memory, a central processing unit and an input/output section;

visual display means for displaying a ballot to a voter;

vote selection means for allowing a voter to make selections in response to the displayed ballot;

recording means for recording selections made by a voter;

bus means connecting said processor means with said visual display means, said vote selection means and said recording means; and verification means under control of a voter for effecting transfer of valid selections made by the voter from said processor means to said recording means and for displaying such transferred information on said display means;

said visual display means being in the form of a cathode ray tube and said vote selection means being in the form of a light pen.

38. An electronic voting machine as defined in claim 37 wherein each ballot contains discrete target areas corresponding to vote selection points and said visual display means includes circuitry for identifying the coordinates of a point on the display at which the light pen is placed, said processor means being effective to store a valid vote selection when the coordinates identified by said visual display means coincide with a discrete target area.

39. An electronic voting machine as defined in claim 38 wherein said light pen includes a light-sensitive diode and circuit means for producing an output pulse in time-related reference to the visual display.

40. An electronic voting machine comprising, in combination:

a processor means including a read only memory, a random access memory, a central processing unit and an input/output section;

visual display means for displaying a ballot to a voter;

vote selection means for allowing a voter to make selections in response to the displayed ballot;

recording means for recording selections made by a voter;

bus means connecting said processor means with said visual display means, said vote selection means and said recording means;

verification means under control of a voter for effecting transfer of valid selections made by the voter from said processor means to said recording means and for displaying such transferred information on said display means; and exit control means under control of a voter for committing said displayed verification to said recording means;

said visual display means being in the form of a cathode ray tube and said vote selection means being in the form of a light pen.

41. An electronic voting machine as defined in claim 40 wherein each ballot contains discrete target areas corresponding to vote selection points and said visual display means includes circuitry for identifying the coordinates of a point on the display at which the light pen is placed, said processor means being effective to store a valid vote selection when the coordinates identified by said visual display means coincide with a discrete target area.

42. An electronic voting machine as defined in claim 41 wherein said light pen includes a light-sensitive diode and circuit means for producing an output pulse in time-related reference to the visual display.

43. An electronic voting machine comprising, in combination:

a processor means including a read only memory, a random access memory, a central processing unit and an input/output section;

visual display means for displaying a ballot to a voter;

vote selection means for allowing a voter to make selections in response to the displayed ballot;

recording means for recording selections made by a voter;

bus means connecting said processor means with said visual display means, said vote selection means and said recording means;

verification means under control of a voter for effecting transfer of valid selections made by the voter from said processor means to said recording means and for displaying such transferred information on said display means; and exit control means under control of a voter for committing said displayed verification to said recording means;

said vote selection means being effective to allow a voter to alter his selections after verification;

said visual display means being in the form of a cathode ray tube and said vote selection means being in the form of a light pen.

44. An electronic voting machine as defined in claim 43 wherein each ballot contains discrete target areas corresponding to vote selection points and said visual display means includes circuitry for identifying the coordinates of a point on the display at which the light pen is placed, said processor means being effective to store a valid vote selection when the coordinates identified by said visual display means coincide with a discrete target area.

45. An electronic voting machine as defined in claim 44 wherein said light pen includes a light-sensitive diode and circuit means for producing an output pulse in time-related reference to the visual display.

46. An electronic voting machine comprising, in combination:

processor means for processing selections made by a voter;

visual display means connected to said processor means for displaying a ballot to a voter;

vote selection means connected to said processor means for allowing a voter to make selections from the displayed ballot;

said processor means including storage means for storing valid selections made by a voter;

exit control means under control of a voter for committing said displayed verification of said recording means; and said visual display means being in the form of a cathode ray tube and said vote selection means being in the form of a light pen.

47. An electronic voting machine as defined in claim 46 wherein each ballot contains discrete target areas corresponding to vote selection points and said visual display means includes circuitry for identifying the coordinates of a point on the display at which the light pen is placed, said processor means being effective to store a valid vote selection when the coordinates identified by said visual display means coincide with a discrete target area.

48. An electronic voting machine as defined in claim 46 including recording means connected to said processor means for recording the valid selections made by a voter.

49. An electronic voting machine as defined in claim 46 including verification means under control of a voter for causing display of the valid selections on said visual display means.

50. An electronic voting machine as defined in claim 46 wherein said vote selection means is effective to allow a voter to alter his selections after verification.

51. An electronic voting machine as defined in claim 47 wherein said light pen includes a light-sensitive diode and circuit means for producing an output pulse in time-related reference to the visual display.

52. An electronic voting machine as defined in claim 48 including verification means under control of a voter for causing display of the valid selections on said visual display means, said verification means effecting transfer of the valid selections from said storage means to said recording means whereby the displayed verification is identical with recorded information.

53. An electronic voting machine as defined in claim 49 wherein said vote selection means is effective to allow a voter to alter his selections after verification.

54. An electronic voting machine as defined in claim 48 wherein said vote selection means is effective to allow a voter to alter his selections after verification.

55. An electronic voting machine comprising, in combination:

a processor means including a read only memory, a random access memory, a central processing unit and an input/output section;

visual display means for displaying a ballot to a voter;

vote selection means for allowing a voter to make selections in response to the displayed ballot;

recording means for recording selections made by a voter; and bus means connecting said processor means with said visual display means, said vote selection means and said recording means, said visual display means being in the form of a cathode ray tube and associated logic circuitry; a second random access memory; a memory switching interface; a light pen; and a light pen interface; said memory switching interface and said light pen interface being connected to said bus means; said logic circuitry being connected to said light pen interface and to said memory switching interface; said second random access memory being connected to said memory switching interface and to said logic circuitry; and said light pen forming part of said vote selection means.

56. An electronic voting machine as defined in claim 55 wherein each ballot contains discrete target areas corresponding to vote selection points and said visual display means includes circuitry for identifying the coordinates of a point on the display at which the light pen is placed, said processor means being effective to store a valid vote selection when the coordinates identified by said visual display means coincide with a discrete target area.

57. An electronic voting machine as defined in claim 56 wherein said light pen includes a light-sensitive diode and circuit means for producing an output pulse in time-related reference to the visual display.

58. In an electronic voting machine, in combination;

record means for containing a plurality of permissible ballots and for recording voter selections;

processor means for processing selections made by a voter;

visual display means connected to said record means through said processor means for displaying any of said ballots; and voter identification means connected to said processor means for causing display of a selected ballot upon which that particular voter is entitled to vote, including vote selection mean connected to said processor means for storing valid selections from said selected ballot, verification means under control of a voter for causing display of the valid selections on said visual display means, said verification means effecting transfer of the valid selections from said vote selection means to said record means whereby the display verification is identical with recorded information.

59. An electronic voting machine as defined in claim 58 including exit control means under control of a voter for committing said displayed verification to said recording means.

60. An electronic voting machine as defined in claim 59 wherein said vote selection means is effective to allow a voter to alter his selections after verification.

61. In an electronic voting machine, in combination:

processor means for processing selections made by a voter and for selectively presenting to a voter a ballot upon which he is entitled to vote; and write-in means connected to said processor means for storing data therein corresponding to a write-in candidate written in by a voter, recording means connected to said processor means for recording valid vote selections including said data corresponding to a write-in candidate, display means connected to said processor means and verification means under control of a voter for causing said display means to display valid selections inclusive of write-in candidates on said display means, said verification means effecting transfer of the valid selections from said processor means to said recording means whereby the displayed verification is identical with recorded information.

62. An electronic voting machine as defined in claim 61 including exit control means under control of a voter for committing said displayed verification to said recording means.

63. An electronic voting machine as defined in claim 62 wherein said vote selection means is effective to allow a voter to alter his selections after verification.

64. In an electronic voting machine, in combination:

processor means for processing selections made by a voter;

storage means for storing a large number of different ballot formats which may be presented to a voter;

voter identification means connected to said processor means for allowing a voter access to the machine and for causing the processor means to call up from said storage means and present to the voter that particular ballot format upon which he is entitled to vote;

said processor means being effective to validate vote selections on each of the ballot formats presented to a voter; and write-in means connected to said processor means for storing data therein corresponding to a write-in candidate written in by a voter, including recording means connected to said storage means for recording the valid selections made by a voter, display means connection to said processor means and verification means under control of a voter for causing display of valid selections on said display means, said verification means effecting transfer of the valid selections from said storage means to said recording means whereby the displayed verification is identical with recorded information.

65. A voting system having a microcomputer section including a read only memory, a random access memory, a central processing unit and an input/output section all interconnected by a first bus, a second bus connected to the input/output section and a voting assembly connected to the second bus and including a CRT for display of a ballot and for voter selection with such ballot and a magnetic tape section for recording the vote selections.

66. A voting system according to claim 65 including provision for voter write-in selection and recordation of such write-in selection on a magnetic tape section.

67. A voting system according to claim 65 wherein said tape section includes first and second tapes one of which remains with the machine and the other of which is removable.

68. A voting system according to claim 65 wherein the CRT section includes provision for display of a voter's selection from the magnetic tape section prior to premanent storage of such selection on the tape.

69. The voting system according to claim 65 wherein the magnetic tape section stores the ballot to be displayed by the CRT and also records the running totals of the voting process.

70. The voting system according to claim 65 wherein the magnetic tape section stores the vote selections and the voters' user numbers on separate sections for separate recovery thereof.

71. The voting system according to claim 65 wherein the magnetic tape section stores a plurality of different ballots applicable to a given region and the voting assembly includes a card reading portion for calling up that ballot upon which a particular voter is entitled to vote.

72. The voting system according to claim 65 wherein the voting assembly includes a printer and control switch for printing out vote selection tallies at the close of an election day.

73. The voting system according to claim 65 in which a plurality of systems feed a central data processor.

74. A voting system according to claim 66 wherein said tape section includes first and second tapes one of which remains with the machine and the other of which is removable.

75. The voting system according to claim 72 wherein the voting assembly also includes an accoustic coupler for relaying the vote selection tallies over phone lines.

76. An electronic voting machine system comprising, in combination:

processing means including a read only memory, a random access memory, an input/output section and a central processing unit;

a series of peripheral units comprising a vote selection system proper, one of said peripheral units comprising means for storing voter selections in said random access memory; and bus means interconnecting said peripheral units with said processing means for forming a complete voting machine entity, one of said peripheral units comprising a bus extender for allowing connection thereto of at least certain redundant peripheral units comprising a second vote selection system proper, one of said peripheral units being a visual display means, said one of said peripheral units being a vote selection means under control of a voter, a further peripheral unit being a recording means for receiving and recording valid vote selections from said random access memory, verification means under control of a voter for causing display of the valid selections on said visual display means, said verification means effecting transfer of said valid selections in the random access memory to said recording means, said verification means effecting display of the valid selections from said recording means whereby the verification display is identical with recorded information.

77. An electronic voting machine system as defined in claim 76 including exit control means under control of a voter for committing said displayed verification to said recording means.

78. An electronic voting machine system as defined in claim 77 wherein said vote selection means is effective to allow a voter to alter his selections after verification.

79. An electronic voting machine system comprising, in combination:

processing means including a read only memory, a random access memory, an input/output section and a central processing unit;

a series of peripheral units comprising a vote selection system proper;

bus means interconnecting said peripheral units with said processing means for forming a complete voting machine entity;

one of said peripheral units being a visual display means; and means for causing said visual display means to display the alphabet in response to write-in request by a voter, and wherein said processor means stores as a write-in vote sequentially those letter selections effected from the alphabet display.

80. An electronic voting machine system comprising, in combination:

processing means including a read only memory, a random access memory, an input/output section and a central processing unit;

a series of peripheral units comprising a vote selection system proper; and bus means interconnecting said peripheral units with said processing means for forming a complete voting machine entity;

one of said peripheral units being a visual display means;

another of said peripheral units being a vote selection means under control of a voter;

a further peripheral unit being a recording means for receiving and recording valid vote selections from said random access memory;

said visual display means being in the form of a cathode ray tube and said vote selection means being in the form of a light pen.

81. An electronic voting machine system as defined in claim 80 wherein each ballot contains discrete target areas corresponding to vote selection points and said visual display means includes circuitry for identifying the coordinates of a point on the display at which the light pen is placed, said processor means being effective to store a valid vote selection when the coordinates identified by said visual display means coincide with a discrete target area.

82. An electronic voting machine system as defined in claim 81 wherein said light pen includes a light-sensitive diode and circuit means for producing an output pulse in time-related reference to the visual display.

83. An electronic voting machine system comprising, in combination:

processing means including a read only memory, a random access memory, an input/output section and a central processing unit;

a series of peripheral units comprising a vote selection system proper, one of said peripheral units comprising means for storing voter selections in said random access memory; and bus means interconnecting said peripheral units with said processing means for forming a complete voting machine entity, a peripheral unit comprising a card reader means for reading a voter identification card to record voter information and to select a ballot format for the voter in accord with said voter information, one of said peripheral units comprising a bus extender for allowing connection thereto of at least certain redundant peripheral units to comprise a second vote selection system proper, one of said peripheral units being a visual display means, said one of said peripheral units being a vote selection means under control of a voter, a further peripheral unit being a recording means for receiving and recording valid vote selections from said random access memory, verification means under control of a voter for causing display of the valid selections on said visual display means, said verification means effecting transfer of said valid selections in the random access memory to said recording means, said verification means effecting display of the valid selections from said recording means whereby the verification display is identical with recorded information.

84. An electronic voting machine system comprising, in combination:

processing means including a read only memory, a random access memory, an input/output section and a central processing unit;

a series of peripheral units comprising a vote selection system proper; and bus means interconnecting said peripheral units with said processing means for forming a complete voting machine entity;

a peripheral unit comprising a card reader means for reading a voter identification card to record voter information and to select a ballot format for the voter in accord with said voter information;

one of said peripheral units comprising a bus extender for allowing connection thereto of at least certain redundant peripheral units to comprise a second vote selection system proper;

one of said peripheral units being a visual display means;

another of said peripheral units being a vote selection means under control of a voter;

a further peripheral unit being a recording means for receiving and recording valid vote selections from said random access memory;

said visual display means being in the form of a cathode ray tube and said vote selection means being in the form of a light pen.

85. An electronic voting machine as defined in claim 84 wherein each ballot contains discrete target areas corresponding to vote selection points and said visual display means includes circuitry for identifying the coordinates of a point on the display at which the light pen is placed, said processor means being effective to store a valid vote selection when the coordinates identified by said visual display means coincide with a discrete target area.

86. An electronic voting machine as defined in claim 85 wherein said light pen includes a light-sensitive diode and circuit means for producing an output pulse in time-related reference to the visual display.

* * * * *